US006818388B2

(12) United States Patent
Makuta et al.

(10) Patent No.: US 6,818,388 B2
(45) Date of Patent: Nov. 16, 2004

(54) SILVER HALIDE COLOR PHOTOGRAPHIC PHOTOSENSITIVE MATERIAL AND PROCESS FOR FORMING COLOR IMAGE

(75) Inventors: Toshiyuki Makuta, Kanagawa (JP); Shin Soejima, Kanagawa (JP); Hiroyuki Yoneyama, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/654,064

(22) Filed: Sep. 4, 2003

(65) Prior Publication Data

US 2004/0072109 A1 Apr. 15, 2004

Related U.S. Application Data

(62) Division of application No. 10/152,338, filed on May 22, 2002, now Pat. No. 6,649,333.

(30) Foreign Application Priority Data

May 23, 2001 (JP) ..... 2001-154666
May 23, 2001 (JP) ..... 2001-154693
May 23, 2001 (JP) ..... 2001-154700

(51) Int. Cl.[7] ..... G03C 1/73; G03C 7/327
(52) U.S. Cl. ..... 430/383; 430/549
(58) Field of Search ..... 430/383, 549

(56) References Cited

U.S. PATENT DOCUMENTS 6,007,975 A * 12/1999 Tomotake et al. ..... 430/549

FOREIGN PATENT DOCUMENTS

| | | |
|---|---|---|
| JP | 5 341470 | 12/1993 |
| JP | 6 202291 | 7/1994 |
| JP | 7 140625 | 6/1995 |

OTHER PUBLICATIONS

Abstract of JP06167769A, Jun. 1994.

Abstract of JP07140597A, Jun. 1995.

Abstract of JP08015832A, Jan. 1996.

* cited by examiner

*Primary Examiner*—Hoa Van Le
(74) *Attorney, Agent, or Firm*—Sughrue Mion, PLLC

(57) ABSTRACT

A silver halide color photographic photosensitive material comprising, on a reflective support, at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer. Reflective density A(λ) at a wavelength λ at an unexposed portion of the material after a color development treatment is 0.08 or less for 450 nm, 0.10 or less for 550 nm, and 0.08 or less for 650 nm. Alternatively, chromaticity at the unexposed portion of the material after the color development treatment satisfies the condition: $91 \leqq L^* \leqq 96$, $0 \leqq a^* \leqq 2.0$, $-9.0 \leqq b^* \leqq -3.0$. Also provided is a process for forming an image using the silver halide color photographic photosensitive material.

14 Claims, No Drawings

SILVER HALIDE COLOR PHOTOGRAPHIC PHOTOSENSITIVE MATERIAL AND PROCESS FOR FORMING COLOR IMAGE

This is a divisional of Application No. 10/152,338 filed May 22, 2002 now U.S. Pat. No. 6,649,333, the disclosure of which is incorporated herein by reference.

BACKGROUND OF THE INVENTION

1. Field of the Invention

The present invention relates to a silver halide color photographic photosensitive material (hereinafter sometimes simply referred to as a "photosensitive material"), and more particularly, it relates to a silver halide color photographic photosensitive material that is excellent in whiteness degree and is excellent in production stability, performance stability with respect to long-term storage in an unexposed state, and performance stability with respect to fluctuation of processing conditions of the photosensitive material. It further relates to a silver halide color photographic photosensitive material that can provide a preferred whiteness degree in highlight portions immediately after developing process and can maintain a preferred whiteness degree in highlight portions after storing under a high humidity condition, and also relates to a silver halide photographic photosensitive material that is improved in white background and color resolving power of a colored cyan dye, has an enhanced color reproduction range, and is excellent in faithful reproduction property. The invention also relates to a process for forming a color image using the silver halide color photographic photosensitive material.

2. Description of the Related Art

Silver halide color photographic photosensitive materials have been widely used as materials for stably providing a high quality image at low cost, but the users' demands for high image quality, qualitative stability and high productivity are being increased. As for the demand for high image quality, improvements in whiteness, color reproducibility and sharpness are required, and as for the demand for qualitative stability, improvements in production stability, stability in long-term storage in an unexposed state and stability in performance on developing process are required for the photosensitive materials. With respect to the improvement in productivity, increase in processing rate is demanded.

White background is important in photographic photosensitive materials for direct viewing, such as color paper. In an image having white background in a large proportion, there are cases where impression of an image is largely changed by changing a light source for viewing the image, and therefore, such white background is demanded that is stable against the light source. As one measure for improving quality of white background, unnecessary coloration is decreased as far as possible, and for example, reduction of fogging of a silver halide emulsion, reduction of remaining coloration of a sensitizing dye and an irradiation preventing dye, and prevention of attachment of contamination of a processing solution to the photosensitive material are exemplified. Another measure for improving the quality of white background is that the color is adjusted with a coloring matter having a complementary color with respect to the unnecessary coloration.

As one measure for reducing the unnecessary coloration, an amount of a binder in a hydrophilic colloid layer constituting the photosensitive material is decreased to reduce adsorption of remaining coloration of a sensitizing dye and an irradiation preventing dye and contamination of a processing solution. When the amount of the binder, such as gelatin, is decreased, such an adverse effect occurs that the strength of the film is reduced. The adverse effect can be avoided by decreasing an amount of a lipophilic photographically useful component (hereinafter referred to as an oil soluble component) in the photographic constitutional layers. As a method for decreasing the oil soluble component, for example, the amount of a high boiling point organic solvent used as a solvent of, for example, a dye-forming coupler is decreased. However, the reduction of the coupler solvent causes such a problem that the coloring property is lowered, and image fastness of the formed dye is deteriorated. Therefore, an alternative technique is being demanded.

As another measure for improving quality of white background, there is such a method that the color is adjusted with a coloring matter having a complementary color with respect to the unnecessary coloration. For example, it has been known that in the case where so-called resin coated paper, which is obtained by coating a paper support with a water resistant resin containing a white pigment, is used, a blueish pigment, such as an ultramarine blue pigment, is added to the water resistant resin layer. However, this method has such disadvantages that the necessary amount for adjusting the color is too large, and the brittleness of the support is deteriorated, and therefore, an alternative technique is being demanded.

Color print photographic materials have been widely used as a method for forming an image that can easily provide a color image at low cost. It is natural that a color print having good image quality is desired, and four items of characteristics, i.e., an image density, gradation, color balance and whiteness in highlight portions, are considered as characteristics that largely influence the quality of the color print material.

As a method for adjusting the whiteness of highlight portions among the characteristics, a method of adjusting whiteness of a support, and the method of adjusting whiteness of a hydrophilic colloid layer constituting a photographic constitutional layer are generally employed. For example, examples of the method for improving the whiteness include a method, in which a white pigment or a fluorescent whitening agent is added to the support or the hydrophilic colloid layer to improve the whiteness, and a method, in which blue tone is applied to antagonize yellow stain to avoid yellow stain, whereby a neutral color is obtained to make whiteness that can be viewed by human eyes.

However, the whiteness of highlight portions is fluctuated by the nature of the other photographic constitutional elements and the method of processing.

In recent years, photographic photosensitive materials of high image quality that can be quickly processed is demanded as a part of improvements of service for users and a measure for improving productivity. In order to deal with the demand, such a quick process is generally practiced that a photographic photosensitive material containing a high silver chloride emulsion (hereinafter sometimes referred to as a "high silver chloride print material") is processed for a coloration development time of 45 seconds, whereby the total process from the start of the developing step to the completion of the drying step is carried out within about 4 minutes (for example, COLOR PROCESS CP-45X produced by Fuji Photo Film Co., Ltd.). The quickness of the quick developing process of the high silver chloride print material cannot be satisfactory in comparison to the quickness of image production of other color image production methods (such as an electrostatic transfer method, a thermal transfer method and an ink jet recording method), and a super quick process is demanded that provides such a level that the total process time from the start of developing step of the high silver chloride color print material to the completion of the drying step is less than one minute.

Various studies and attempts for measures for improving the applicability to the super quick process have been made in this field of art to realize the demand. For example, as measures for improving the applicability to the super quick process, it has been investigated that (1) a high activity coupler and a coupler having a coloring dye having a large molecular extinction coefficient are employed to reduce the coated amount of organic materials, and a coated amount of a hydrophilic binder is reduced, and (2) a silver halide emulsion exhibiting a high developing rate is employed. Furthermore, it has been known that a silver halide emulsion layer having the lowest developing rate (corresponding to a layer containing a yellow coupler in a conventional color print material) is coated at a position that is farthest from the support to improve the quickness of development, which is disclosed, for example, in JP-A No. 7-239538 and No. 7-239539.

In the case where the quick process is to be carried out, quality deterioration in whiteness of highlight portions is liable to occur as described in the foregoing.

It is considered that the reasons therefor are as follows. Fogging is increased by increase of activity caused by increasing the rate of development of the silver halide emulsion and increasing the activity of the developer solution. A part of a sensitizing dye contained in the photosensitive material remains in an image after the developing process caused by shortening the water washing time to cause coloration (referred to as remaining coloration), whereby the minimum density (Dmin) is increased. Coloration on the white background occurs by desilvering failure and remaining matters in the photosensitive material caused by shortening the desilvering time.

Various earnest investigations have been made in this field of art for avoiding the increase in density on the white background due to the super quick developing process. Examples thereof include the methods for improving the whiteness, such as the method of adjusting the whiteness of the support and the method of adjusting the whiteness with the hydrophilic colloid layer constituting the photographic constitutional layers, which are described in the foregoing. In addition to these methods, examples of the method for suppressing the fogging and the remaining coloration and for obtaining a low density Dmin include a method disclosed in JP-A No. 6-202291, and examples of the method for suppressing the remaining coloration include a method disclosed in JP-A No. 6-329936, such as the use of a water soluble diaminostilbene fluorescent whitening agent and the use of a sensitizing dye having high hydrophilicity.

Print materials are demanded to provide high image quality immediately after processing, and furthermore demanded to maintain the high image quality obtained immediately after processing even after storing for a long period of time.

As the image storage property, it is important to maintain whiteness in highlight portions, in addition to the fastness of the color image. In particular, upon carrying out the quick process, colorless substances remain in the photosensitive material in a large amount after processing. There are cases where the print obtained after processing is colored with the remaining matters causing time-lapse coloration during long-term storage, particularly storage under high humidity, and therefore, techniques for decreasing the coloration during long-term storage are demanded.

The quickening of the development process as a measure for improving the applicability to the super quick process as described in the foregoing often accompanies deterioration of the image quality, and in particular, this is considerable constrain upon attempting the super quick process. The particular deterioration upon attempting the super quick process is deterioration of the whiteness of highlight portions. The deterioration of the whiteness is cased by the following reasons. Fogging is increased by increase of the developing activity. A part of a sensitizing dye contained in the photosensitive material remains in an image after the developing process (referred to as remaining coloration), whereby the minimum density (Dmin) is increased. Coloration on the white background occurs by desilvering failure and remaining matters in the photosensitive material. The whiteness also largely depends on a light source for viewing.

Various earnest investigations have been made in this field of art for avoiding the problems associated with the super quick developing process. Examples of a method for suppressing the fogging and the remaining coloration and to obtain a low density Dmin include methods disclosed in JP-A No. 6-39936, No. 6-59421 and No. 6-202291, examples of a method for suppressing time-lapse increase of image staining include methods disclosed in JP-A No. 7-140625 and No. 5-341470, and examples of a method for suppressing the remaining coloration include the use of a water soluble diaminostilbene fluorescent whitening agent and the use of a sensitizing dye having high hydrophilicity, which are disclosed, for example, in JP-A No. 6-329936. However, these are not yet satisfactory.

Furthermore, the high silver chloride print material is inferior in color gamut in bright regions to other color image production methods (such as an electrostatic transfer method, a thermal transfer method and an ink jet recording method). The color gamut is important characteristics in color prints and image forming systems. The color gamut is an index of a color region that can be formed by using combinations of the prescribed coloring agents. It is desired that the color gamut is as large as possible. The color gamut of the image forming system is mainly controlled by the absorption characteristics of a set of coloring agents used for image formation. In the image forming system, three or more kinds of coloring agents are typically used, and typical examples thereof include cyan, magenta and yellow in the conventional subtractive image forming method. It is general that the image forming system further contains an achromatic color, such as black.

The ability for forming an image containing a particular color is restricted by the color gamut of the image forming system and a material used for image formation. Therefore, the color region that can be utilized for image reproduction is restricted by the image forming system and the color gamut that can be formed by the material. It is often considered that the color gamut becomes maximum by using a so-called "block dye". It is suggested in "The Reproduction of Color", 4th edition, by R. W. G. Hunt, p. 13 to 144 that the optimum color gamut is the subtractive trichromatic system using three kinds of theoretical block dyes, and it is obtained by using a method, in which the blocks thereof are separated at about 490 nm and 580 nm. The suggestion is considerable but is not satisfactory from various reasons. In particular, there is no actual coloring agent corresponding to the suggested block dyes.

Various embodiments of the concept of the block dye are advanced by "Brightness and Hue of Present-Day Dyes in Relation to Colour Photography", Photo. J., vol. 88b, p. 22 (1948), by M. E. Clarkson and T. Vickerstaff. Three kinds of example shapes, i.e., a block, a trapezoid and a triangle, have been provided by Clarkson and Vickerstaff. The authors concluded, contrary to the suggestion by Hunt, that a trapezoidal absorption spectrum is preferred in comparison to a vertical side block dye. The dyes having a trapezoidal spectrum herein are also theoretical but cannot be actually available.

Both the commercially available dyes and the theoretical dyes are finally studied by "The Color Gamut Obtainable by the Combination of Subtractive Color Dyes—Optimum Absorption Bands as Defined by Nonlinear Optimization Technique", J. Imaging Science, vol. 30, p. 9 to 12. The author thereof, N. Ohta, covers the existing dyes and indicates in this publication that the existing curve of a typical cyan dye is the optimum absorption curve of a cyan dye from the standpoint of the color gamut.

SUMMARY OF THE INVENTION

The invention has been developed for solving the problems associated with the conventional techniques as described in the fore going to attain the following objects.

A first object of the invention is to provide a silver halide color photographic photosensitive material excellent in white background, and to provide a silver halide color photographic photosensitive material that provides stable white background irrespective of a viewing light source. It is also to provide a silver halide color photographic photosensitive material excellent in performance stability upon long-term storage in an unexposed state and in performance stability against fluctuation in processing conditions, and to provide a silver halide color photographic photosensitive material excellent in applicability to quick process.

A second object of the invention is to provide a silver halide color photographic photosensitive material that can provide a preferred whiteness degree in highlight portions immediately after a developing process and can maintain the preferred whiteness degree of highlight portions after storage under high humidity conditions.

A third object of the invention is to provide a silver halide color photographic photosensitive material that can reduce coloration on white background of a high silver chloride print material containing the super quick process to obtain a color print that is satisfactory from the standpoint of image quality, and to provide a silver halide color photographic photosensitive material that can reproduce the faithful color in a bright region superior to the other color image formation methods.

A fourth object of the invention is to provide a process for forming an image using the silver halide color photographic photosensitive material of the invention.

As a result of earnest investigations made by the inventors, it has been found that the foregoing and other objects of the invention can be accomplished by the following silver halide color photographic photosensitive materials and the following processes for forming an image using the same.

A first aspect of the present invention provides a silver halide color photographic photosensitive material comprising, on a reflective support, at least one yellow-coloring photosensitive silver halide emulsion layer, at least one magenta-coloring photosensitive silver halide emulsion layer, at least one cyan-coloring photosensitive silver halide emulsion layer, and at least one non-photosensitive, non-coloring hydrophilic colloid layer, reflective density A(λ) for wavelength λ at an unexposed portion of the material after a color development treatment being 0.08 or less for 450 nm, 0.10 or less for 550 nm, and 0.08 or less for 650 nm.

A second aspect of the silver halide color photographic photosensitive material according to the first aspect, wherein at least one of the hydrophilic colloid layer and the silver halide emulsion layers comprises at least one of high boiling point organic solvents represented by the following general formulae (A) to (F):

$$RaOOC(CH_2)_mCOORb \qquad \text{General formula (A)}$$

wherein Ra and Rb each independently represents a linear or branched alkyl group having from 4 to 10 carbon atoms, and m represents an integer of from 2 to 10, $$RcOOC(C_nH_{2n-2})COORd \qquad \text{General formula (B)}$$

wherein Rc and Rd each independently represents a linear or branched alkyl group having from 4 to 10 carbon atoms, and n represents an integer of from 2 to 10, $$ReCOO(CH_2)_pOCORf \qquad \text{General formula (C)}$$

wherein Re and Rf each independently represents a linear or branched alkyl group having from 3 to 24 carbon atoms, and p represents an integer of from 2 to 10, $$C(Rg)(Rh)(Ri)(OH) \qquad \text{General formula (D)}$$

wherein Rg represents an alkyl group or an alkenyl group, Rh and Ri each independently represents a hydrogen atom, an alkyl group or an alkenyl group, and the total carbon number of the groups represented by Rg, Rh and Ri is at least 10, $$X—((CH_2)_q—O(CO)Rj)_r \qquad \text{General formula (E)}$$

wherein X represents a 5- to 7-member saturated hydrocarbon group, q represents an integer of from 0 to 2, r represents an integer of from 1 to 3, and Rj represents a linear or branched alkyl group having from 4 to 16 carbon atoms, and $$YO—C(COORk)(CH_2COORl)(CH_2COORm) \qquad \text{General formula (F)}$$

wherein Rk, Rl and Rm each independently represents an alkyl group, an alkenyl group or an aryl group, and Y represents a hydrogen atom or an acyl group.

A third aspect of the present invention provides the silver halide color photographic photosensitive material according to the second aspect, wherein the hydrophilic colloid layer comprises a color mixing prevention layer, and the color mixing prevention layer includes at least one of the at least one of high boiling point organic solvents represented by the general formulae (A) to (F).

A fourth aspect of the present invention provides the silver halide color photographic photosensitive material according to the first aspect, wherein the reflective density A(λ) for wavelength λ at the unexposed portion after the color development treatment is 0.07 or less for 450 nm, 0.09 or less for 550 nm, and 0.07 or less for 650 nm.

A fifth aspect of the present invention provides the silver halide color photographic photosensitive material according to the fourth aspect, wherein, after a red-exposing process and the color development treatment, reflective density C(λ)

for wavelength λ at a cyan-colored portion satisfies the following conditions (1) and (2):

$$0.04 \leqq (C(\mathbf{425}) - C(\min))/(1 - C(\min)) \leqq 0.10 \quad (1)$$

$$0.09 \leqq (C(\mathbf{530}) - C(\min))/(1 - C(\min)) \leqq 0.15 \quad (2)$$

wherein C(min) represents a minimum density in a wavelength range from 400 to 700 nm, given that cyan density for a wavelength that provides a maximum density of cyan coloration is 1.0.

A sixth aspect of the present invention provides the silver halide color photographic photosensitive material according to the fifth aspect, wherein at least one of the at least one cyan-coloring photosensitive silver halide emulsion layer comprises at least one compound selected from compounds represented by the following general formulae (PTA-I) and (PTA-II):

General formula (PTA-I)

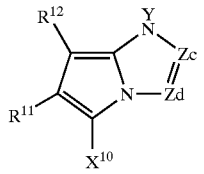

General formula (PTA-II)

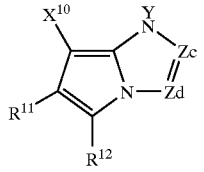

in which: one of Zc and Zd represents —N═ and the other represents —C($R_{13}$)═, and $R_{13}$ represents a hydrogen atom or a substituent; $R_{11}$ and $R_{12}$ each represents an electron attracting group having a Hammett's substituent constant σp of 0.2 or more, and the sum of the σp values of $R_{11}$ and $R_{12}$ is 0.65 or more; $X_{10}$ represents a hydrogen atom or a group that is releasable by a coupling reaction with an oxidized product of an aromatic primary amine color developing agent; Y represents a hydrogen atom or a group that is releasable by the color development treatment; and $R_{11}$, $R_{12}$, $R_{13}$ and $X_{10}$ each may be a divalent group that bonds with a polymer chain or a multimer, which is at least a dimer, to form a homopolymer or a copolymer.

A seventh aspect of the present invention provides the silver halide color photographic photosensitive material according to the fifth aspect, wherein at least one of the at least one cyan-coloring photosensitive silver halide emulsion layer comprises at least one of compounds represented by the following general formula (IA):

General formula (IA)

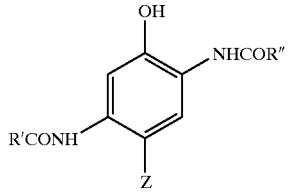

in which R' and R" each independently represents a substituent, and Z represents a hydrogen atom or a group that is releasable by a coupling reaction with an oxidized product of an aromatic primary amine color developing agent.

An eighth aspect of the present invention provides the silver halide color photographic photosensitive material according to the first aspect, wherein the reflective density A(λ) for wavelength λ at the unexposed portion after the color development treatment is 0.06 or less for 450 nm, 0.07 or less for 550 nm, and 0.05 or less for 650 nm.

A ninth aspect of the present invention provides the silver halide color photographic photosensitive material according to the first aspect, wherein density ratios of the reflective density A(λ) for wavelength λ at the unexposed portion after the color development treatment satisfy the following conditions (I) and (II):

$$1.0 \leqq A(\mathbf{550})/A(\mathbf{450}) \leqq 1.4 \quad (I)$$

$$0.6 \leqq A(\mathbf{650})/A(\mathbf{450}) \leqq 1.2 \quad (II)$$

A tenth aspect of the present invention provides the silver halide color photographic photosensitive material according to the first aspect, wherein at least one of layers constituting the photosensitive material includes pigment.

An eleventh aspect of the present invention provides the silver halide color photographic photosensitive material according to the tenth aspect, wherein the pigment comprises at least one pigment selected from the group consisting of indanthrone pigment, indigo pigment, triarylcarbonium pigment, azo pigment, quinacridone pigment, dioxazine pigment and diketopyrrolopyrrole pigment.

A twelfth aspect of the present invention provides the silver halide color photographic photosensitive material according to the first aspect, wherein at least one of layers constituting the photosensitive material comprises at least one of magenta couplers represented by the following general formulae (M-1) and (M-2):

General formula (M-1)

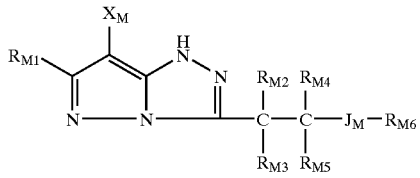

in which: $R_{M1}$ represents a hydrogen atom or a substituent; $R_{M2}$ and $R_{M3}$ each represents an alkyl group; $R_{M4}$ and $R_{M5}$ each represents a hydrogen atom or an alkyl group; JM represents —O—C(═O)—, —N$R_{M7}$CO— or —N$R_{M7}$$SO_2$—, and $R_{M7}$ represents a hydrogen atom or an alkyl group; $R_{M6}$ represents an alkyl group, an aryl group, an alkoxy group, an aryloxy group, an alkylamino group or an arylamino group; and $X_M$ represents a hydrogen atom, a halogen atom or a group that is releasable by a coupling reaction with an oxidized product of a color developing agent, and:

General formula (M-2)

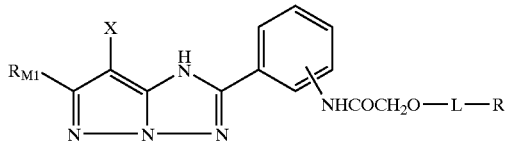

in which: R represents an alkyl group, an alkenyl group, an alkynyl group, an aryl group or a heterocyclic group; $R_{M1}$ represents a hydrogen atom or a substituent; L represents —CO— or —$SO_2$—; and X represents a hydrogen atom or a group that is releasable by a coupling reaction with an oxidized product of a developing agent.

A thirteenth aspect of the present invention provides a silver halide color photographic photosensitive material comprising, on a reflective support, at least one yellow-coloring photosensitive silver halide emulsion layer, at least one magenta-coloring photosensitive silver halide emulsion layer, at least one cyan-coloring photosensitive silver halide emulsion layer, and at least one non-photosensitive, non-coloring hydrophilic colloid layer, chromaticity at an unexposed portion of the material after a color development treatment satisfying the following condition (A):

$$91 \leqq L^* \leqq 96,\ 0 \leqq a^* \leqq 2.0,\ -9.0 \leqq b^* \leqq -3.0 \quad \text{(A).}$$

A fourteenth aspect of the present invention provides the silver halide color photographic photosensitive material according to the thirteenth aspect, wherein at least one of the hydrophilic colloid layer and the silver halide emulsion layers comprises at least one of high boiling point organic solvents represented by the general formulae (A) to (F).

A fifteenth aspect of the present invention provides the silver halide color photographic photosensitive material according to the fourteenth aspect, wherein the hydrophilic colloid layer comprises a color mixing prevention layer, and the color mixing prevention layer includes at least one of the at least one of high boiling point organic solvents represented by the general formulae (A) to (F).

A sixteenth aspect of the present invention provides the silver halide color photographic photosensitive material according to the thirteenth aspect, wherein the chromaticity of the unexposed portion after the color development treatment satisfies the following condition (B):

$$91 \leqq L^* \leqq 96,\ 0.3 \leqq a^* \leqq 1.6,\ -8.0 \leqq b^* \leqq -4.8 \quad \text{(B).}$$

A seventeenth aspect of the present invention provides the silver halide color photographic photosensitive material according to the thirteenth aspect, wherein the chromaticity of the unexposed portion after the color development treatment satisfies the following condition (C):

$$93 \leqq L^* \leqq 96,\ 0.3 \leqq a^* \leqq 1.6,\ -8.0 \leqq b^* \leqq -4.8 \quad \text{(C).}$$

An eighteenth aspect of the present invention provides the silver halide color photographic photosensitive material according to the thirteenth aspect, wherein at least one of layers constituting the photosensitive material includes pigment.

A nineteenth aspect of the present invention provides the silver halide color photographic photosensitive material according to the eighteenth aspect, wherein the pigment comprises at least one pigment selected from the group consisting of indanthrone pigment, indigo pigment, triarylcarbonium pigment, azo pigment, quinacridone pigment, dioxazine pigment and diketopyrrolopyrrole pigment.

A twentieth aspect of the present invention provides the silver halide color photographic photosensitive material according to the thirteenth aspect, wherein at least one of layers constituting the photosensitive material comprises at least one of magenta couplers represented by the general formulae (M-1) and (M-2).

A twenty first aspect of the present invention provides the silver halide color photographic photosensitive material comprising, on a reflective support, at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, a chromaticity of an unexposed portion after a color development treatment satisfying the following condition (B), and a reflective density C(λ) for wavelength λ at a cyan colored portion after a red-exposing process and a color development treatment satisfying the following conditions (1) and (2):

$$91 \leqq L^* \leqq 96,\ 0.3 \leqq a^* \leqq 1.6,\ -8.0 \leqq b^* \leqq -4.8 \quad \text{(B)}$$

$$0.04 \leqq (C(\mathbf{425}) - C(\min))/(1 - C(\min)) \leqq 0.10 \quad (1)$$

$$0.09 \leqq (C(\mathbf{530}) - C(\min))/(1 - C(\min)) \leqq 0.15 \quad (2)$$

wherein C(min) represents a minimum density in a wavelength range from 400 to 700 nm, given that cyan density for a wavelength that provides a maximum density of cyan coloration is 1.0.

A twenty second aspect of the present invention provides the silver halide color photographic photosensitive material according to the twenty first aspect, wherein a chromaticity of an unexposed portion after a color development treatment satisfies the following condition (C):

$$93 \leqq L^* \leqq 96,\ 0.3 \leqq a^* \leqq 1.6,\ -8.0 \leqq b^* \leqq -4.8 \quad \text{(C)}$$

A twenty third aspect of the present invention provides the silver halide color photographic photosensitive material according to the twenty first aspect, wherein at least one of the at least one cyan-coloring photosensitive silver halide emulsion layer comprises at least one compound selected from compounds represented by the general formulae (PTA-I) and (PTA-II).

A twenty fourth aspect of the present invention provides the silver halide color photographic photosensitive material according to the twenty first aspect, wherein at least one of the at least one cyan-coloring photosensitive silver halide emulsion layer comprises at least one of compounds represented by the general formula (IA).

A twenty fifth aspect of the present invention provides the silver halide color photographic photosensitive material according to the twenty first aspect, wherein at least one layer of the layers constituting the photosensitive material includes a pigment.

A twenty sixth aspect of the present invention provides the silver halide color photographic photosensitive material according to the twenty fifth aspect, wherein the pigment comprises at least one pigment selected from the group consisting of indanthrone pigment, indigo pigment, triarylcarbonium pigment, azo pigment, quinacridone pigment, dioxazine pigment and diketopyrrolopyrrole pigment.

A first aspect of the present invention provides a process for forming a color image, the process comprising the steps of: preparing the silver halide color photographic photosensitive material according to any one of the first, thirteenth and twenty first aspects; scan-exposing the photosensitive material with a light beam modulated based on image information; and thereafter, subjecting the photosensitive material to a color development treatment.

A second aspect of the present invention provides a process for forming a color image, the process comprising the steps of: preparing the silver halide color photographic photosensitive material according to any one of the first, thirteenth and twenty first aspects; converting image information to halftone dot information; and scan-exposing the photosensitive material with light source units based on the halftone dot information, the light source units including at least three light source units that emit mutually different wavelengths of light, at least one of the light source units including a light source selected from laser light sources and light emitting diodes.

A third aspect of the present invention provides the process for forming a color image, the process comprising the steps of: imagewise exposing the silver halide color photographic photosensitive material according to any one of the first, thirteenth and twenty first aspects; subjecting the photosensitive material to a color development treatment; thereafter, subjecting the photosensitive material to at least one of desilvering, water washing, and stabilization; and subsequently, drying the photosensitive material to form the color image, wherein the color development treatment includes a duration of from 3 to 25 seconds, and the process for forming a color image includes a duration from commencement of the step of subjecting the photosensitive material to a color development treatment to completion of the step of drying of from 10 to 100 seconds.

DESCRIPTION OF THE PREFERRED EMBODIMENTS

Silver Halide Color Photographic Photosensitive Material

<<First Embodiment and Thirteenth Embodiment>>

The first embodiment and the thirteenth embodiment of the silver halide color photographic photosensitive material of the invention will be described below.

The first embodiment of the silver halide color photographic photosensitive material according to the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, and a reflective density A(λ) at a wavelength λ in an unexposed portion after a color development treatment is 0.08 or less at 450 nm, 0.10 or less at 550 nm and 0.08 or less at 650 nm.

In the first embodiment, the reflective density A(λ) at a wavelength λ in an unexposed portion after a color development treatment is preferably 0.07 or less at 450 nm, 0.09 or less at 550 nm and 0.07 or less at 650 nm, and more preferably 0.06 or less at 450 nm, 0.07 or less at 550 nm and 0.05 or less at 650 nm.

The density ratio of the reflective density A(λ) at a wavelength λ in an unexposed portion after a color development treatment preferably satisfies the following conditions (I) and (II):

$$1.0 \leqq A(\mathbf{550})/A(\mathbf{450}) \leqq 1.4 \quad \text{(I)}$$

$$0.6 \leqq A(\mathbf{650})/A(\mathbf{450}) \leqq 1.2 \quad \text{(II)}$$

The thirteenth embodiment of the silver halide color photographic photosensitive material according to the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, and a chromaticity of an unexposed portion after a color development treatment satisfies the following condition (A):

$$91 \leqq L^* \leqq 96,\ 0 \leqq a^* \leqq 2.0,\ -9.0 \leqq b^* \leqq -3.0 \quad \text{(A)}$$

In the thirteenth embodiment, the chromaticity of an unexposed portion after a color development treatment preferably satisfies the following condition (B), and more preferably satisfies the following condition (C):

$$91 \leqq L^* \leqq 96,\ 0.3 \leqq a^* \leqq 1.6,\ -8.0 \leqq b^* \leqq -4.8 \quad \text{(B)}$$

$$93 \leqq L^* \leqq 96,\ 0.3 \leqq a^* \leqq 1.6,\ -8.0 \leqq b^* \leqq -4.8 \quad \text{(C)}$$

In the first and thirteenth embodiments of the invention, it is preferred that at least one layer of the layers constituting the photosensitive material contains a pigment, and the pigment is preferably selected from the group consisting of an indanthrone pigment, an indigo pigment, a triarylcarbonium pigment, an azo pigment, a quinacridone pigment, a dioxadine pigment and a diketopyrrolopyrrole pigment.

In the first and thirteenth embodiments of the invention, it is preferred that at least one layer of the layers constituting the photosensitive material contains at least one kind of magenta couplers represented by the following general formulae (M-1) and (M-2):

General formula (M-1)

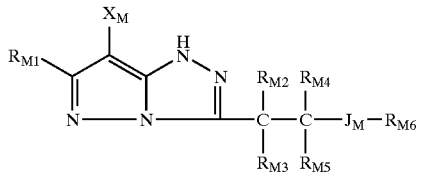

wherein $R_{M1}$ represents a hydrogen atom or a substituent, $R_{M2}$ and $R_{M3}$ each represents an alkyl group, $R_{M4}$ and $R_{M5}$ each represents a hydrogen atom or a substituent, $J_M$ represents —O—C(=O)—, —$NR_{M7}$CO— or —$NR_{M7}SO_2$—, $R_{M7}$ represents a hydrogen atom or an alkyl group, $R_{M6}$ represents an alkyl group, an alkoxy group, an aryloxy group, an alkylamino group or an arylamino group, and $X_M$ represents a hydrogen atom, a halogen atom or a group that is releasable by a coupling reaction with an oxidized product of an aromatic primary amine color developing agent, General formula (M-2)

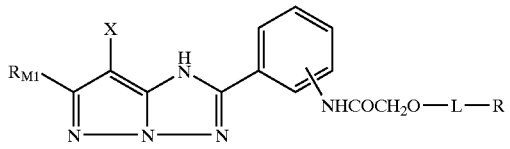

wherein R represents an alkyl group, an alkenyl group, an alkynyl group, an aryl group or a heterocyclic group, $R_{M1}$ represents a hydrogen atom or a substituent, L represents —CO— or —$SO_2$—, and X represents a hydrogen atom or a group that is releasable by a coupling reaction with an oxidized product of an aromatic primary amine color developing agent.

<Reflective Density A(λ)>

In the first embodiment of the invention, the reflective density A(λ) at a wavelength λ in an unexposed portion (white background) after the color development treatment preferably satisfies the following conditions. That is, the reflective density A at 450 nm (hereinafter abbreviated as A(450)) is preferably 0.08 or less, more preferably 0.07 or less, and most preferably 0.06 or less. The reflective density A at 550 nm (hereinafter abbreviated as A(550)) is preferably 0.10 or less, more preferably 0.09 or less, and most preferably 0.07 or less. The reflective density A at 650 nm (hereinafter abbreviated as A(650)) is preferably 0.08 or less, more preferably 0.07 or less, and most preferably 0.05 or less. The value A(λ) is preferably as small as possible, and in the case where a paper support coated with a polyethylene resin containing a white pigment is used, the values A(450), A(550) and A(650) are substantially 0.01 or more. In particular, the value A(650) is preferably from 0.04 to 0.08, more preferably from 0.04 to 0.07, and further preferably from 0.05 to 0.06. Furthermore, there are preferred conditions for the density ratio because the tendency on sensuous "white" taking human preference into account varies depending on color balance. That is, it is preferred that $1.0 \leqq A(550)/A(450) \leqq 1.4$ and $0.6 \leqq A(650)/A(450) \leqq 1.2$, it is more preferred that $1.1 \leqq A(550)/A(450) \leqq 1.3$ and $0.6 \leqq A(650)/A(450) \leqq 1.2$, and it is further preferred that $1.1 \leqq A(550)/A(450) \leqq 1.2$ and $0.8 \leqq A(650)/A(450) \leqq 1.1$. In the case where the density ratio satisfies the conditions, it is preferred since stable white background can be obtained even when the light source for viewing is changed, and in particular, stable white background can be obtained even when various kinds of fluorescent lamps are used.

The reflective density $A(\lambda)$ at a wavelength $\lambda$ nm is defined in detail below. Reflective absorbance is obtained under 25° C. 60% RH conditions at an integrating sphere open area ratio of 2% and a slit width of 5 nm with specular light being removed. Representative examples of a measuring device for reflective absorbance include a spectrophotometer U-3410 produced by Hitachi, Ltd.

<Chromaticity of Unexposed Portion>

In the thirteenth embodiment of the invention, the chromaticity of an unexposed portion (white background) after the color development treatment preferably satisfies the following conditions in the CIE 1976 L*a*b* color space (hereinafter abbreviated as CIELAB color space). That is, L* is preferably from 91 to 96, more preferably from 92 to 96, and most preferably from 93 to 96. a* is preferably from 0 to 2.0, more preferably from 0.3 to 1.6, and further preferably from 0.5 to 1.3. b* is preferably from −9.0 to −3.0, more preferably from −8.0 to −4.8, and further preferably from −8.0 to −4.0.

The CIE 1976 L*a*b* color space is described in detail in "Fine Imaging and Color Hard Copies" edited by Society of Photographic Science and Technology of Japan and The Imaging Society of Japan, p. 354 (1999), published by Corona Publishing Co., Ltd. The tristimulus values upon using the color space are such values obtained according to JIS Z8717 defining the measuring method for the tristimulus values of the X, Y and Z coordinates of a fluorescent reflective body. The chromaticity on the CIE 1976 L*a*b* color space (hereinafter abbreviated as CIELAB color space) is measured by placing the chromaticity of the standard white on CIE D65 (6,504 K) as the international standard of standard daylight. Therefore, the measurement for verifying as to whether the conditions of the conditions (A), (B) and (C) are satisfied can be carried out by using any chromaticity measuring device that can measure chromaticity in the CIE 1976 L*a*b* color space. For example, a color analyzer C-2000 produced by Hitachi, Ltd. can be used with CIE D65 (6,504 K) as the standard light source.

The method for adjusting the white background to the foregoing preferred ranges in the invention can be roughly classified into two methods, i.e., a method of adjusting the whiteness of the support and a method of adjusting with the hydrophilic colloid layer forming the photographic constitutional layers.

<Reflective Support>

A reflective support that can be preferably used in the invention will be described in detail.

The reflective support used in the invention preferably has such a constitution that a water resistant resin coated layer on the side of the reflective support, on which a photosensitive layer is to be formed, contains a white pigment. Examples of the white pigment to be mixed and dispersed in the water resistant resin include an inorganic pigment, such as titanium dioxide, barium sulfate, lithopone, aluminum oxide, calcium carbonate, silicon oxide, antimony trioxide, titanium phosphate, zinc oxide, white lead and zirconium oxide, and an organic pigment, such as polystyrene and a styrene-divinylbenzene copolymer. Among these pigments, the use of titanium dioxide is particularly effective. Titanium oxide may be either the rutile type or the anatase type, and the anatase type is preferred when whiteness is prioritized, whereas the rutile type is preferred when sharpness is prioritized. The anatase type and the rutile type may be used in combination by mixing in order to take both whiteness and sharpness into account. In the case where the water resistant resin layer has a multilayer structure, it is preferred that the anatase type is added to one layer, and the rutile type is added to the other layer. Titanium dioxide used herein may be those produced by either the sulfate process or the chloride process.

The water resistant resin in the reflective support used in the invention is such a resin that has a water absorption (% by weight) of 0.5 or less, and preferably 0.1 or less, and examples thereof include a polyolefin, such as polyethylene, polypropylene and a polyethylene series polymer, a vinyl polymer and a copolymer thereof (such as polystyrene, polyacrylate and a copolymer thereof), and a polyester (such as polyethylene terephthalate and polyethylene isophthalate) and a copolymer thereof. Among these, polyethylene and polyester are particularly preferred. Examples of polyethylene that can be used herein include high density polyethylene, low density polyethylene, linear low density polyethylene and a blend thereof.

The polyester is preferably polyester synthesized through polycondensation of a dicarboxylic acid and a diol. Preferred examples of the dicarboxylic acid include terephthalic acid, isophthalic acid and naphthalenedicarboxylic acid. Preferred examples of the diol include ethylene glycol, butylene glycol, neopentyl glycol, triethylene glycol, butanediol, hexylene glycol, a bisphenol A ethylene oxide adduct (2,2-bis(4-(2-hydroxyethyloxy)phenyl)propane) and 1,4-dihydroxymethylcyclohexane. Various kinds of polyester obtained through polycondensation of the dicarboxylic acid solely or a mixture thereof and the diol solely or a mixture thereof can be used. Among these, it is preferred that at least one kind of the dicarboxylic acid is terephthalic acid.

The mixing ratio of the water resistant resin and the white pigment (water resistant resin/white pigment) is generally from 98/2 to 30/70 by weight, preferably from 95/5 to 50/50 by weight, and particularly preferably from 90/10 to 60/40 by weight. The water resistant resin layer is preferably coated on a substrate to a thickness of from 2 to 200 $\mu$m, and more preferably from 5 to 80 $\mu$m. A resin composition to be coated on the side the substrate, on which the photosensitive layer is not formed, is preferably coated to a thickness of from 5 to 100 $\mu$m, and more preferably from 10 to 50 $\mu$m.

In the reflective support used in the invention, there are some cases where it is preferred from the standpoint of cost and production suitability of the support that the water resistant resin coated layer formed on the side, on which the photosensitive layer is to be formed, contains two or more water resistant resin coated layers having different contents of the white pigment. In this case, among the water resistant resin coated layers having different contents of the white pigment, it is preferred that the content of the white pigment of the water resistant resin coated layer that is the nearest the substrate is lower than the content of the white pigment of at least one water resistant resin coated layer that is formed as an upper layer with respect to the layer that is the nearest the substrate.

The respective layers of the multilayer water resistant resin layer generally has a content of the white pigment of from 0 to 70% by weight, preferably from 0 to 50% by weight, and more preferably from 0 to 40% by weight. Among the multilayer water resistant resin layer, the content of the white pigment of the layer having the largest content is generally from 9 to 70% by weight, preferably from 15 to 50% by weight, and more preferably from 20 to 40% by weight.

It is also possible that a blueing agent is added to the water resistant resin layer, whereby it is adjusted to the range of the white background of the invention. Examples of the blueing agent used herein include an ultramarine blue pigment, cobalt blue, cobalt phosphate oxide, a quinacridone pigment and a mixture thereof. The particle diameter of the blueing agent is not particularly limited, and a commercially available blueing agent generally has a particle diameter of about from 0.3 to 10 $\mu$m, which can be used in the invention without any problem. In the case where the water resistant resin layer of the reflective support used in the invention has a multilayer structure, it is preferred that the content of the blueing agent in the water resistant resin layer as the uppermost layer is equal to or larger than the content thereof in the lower layers. The content of the blueing agent is preferably from 0.2 to 0.5% by weight for the uppermost layer and is preferably from 0 to 0.45% by weight for the lower layers.

The substrate used in the reflective support of the invention may be any of natural pulp paper produced with natural pulp as a main raw material, mixed paper formed with natural pulp and synthetic fibers, synthetic fiber paper formed with synthetic fibers as a main raw material, so-called synthetic paper obtained by forming a synthetic resin film, such as polystyrene and polypropylene, into a paper form, and a plastic film, such as a polyester film, e.g., polyethylene terephthalate and polybutylene terephthalate, a cellulose triacetate film, a polystyrene film, a polyolefin film, such as a polypropylene film. As the substrate for the water resistant resin coating for photographic use, natural pulp paper (hereinafter simply referred to as base paper) is particularly preferably used. The white background thereof can be adjusted to the range of the invention by adding a dye and a fluorescent dye depending on necessity.

The thickness of the base paper of the support used in the invention is not particularly limited. The basis weight thereof is preferably from 50 to 250 g/m$^2$, and the thickness thereof is preferably from 50 to 250 $\mu$m.

Preferred examples of the reflective support used in the invention include those having a polyolefin layer having minute pores formed on the side of the base paper, on which the silver halide emulsion layer is to be formed. The polyolefin layer may have a multilayer structure, and in this case, it is preferred that the polyolefin layer adjacent to the gelatin layer on the side of the silver halide emulsion layer preferably has no minute pore (such as polypropylene and polyethylene), and the layer on the side near the paper substrate is formed with a polyolefin (such as polypropylene and polyethylene) having minute pores. The multilayer or single polyolefin layer positioned between the paper substrate and the photographic constitutional layers preferably has a density of from 0.40 to 1.0 g/ml, and more preferably from 0.50 to 0.70 g/ml. The multilayer or single polyolefin layer positioned between the paper substrate and the photographic constitutional layers preferably has a thickness of from 10 to 100 $\mu$m, and more preferably from 15 to 70 $\mu$m. The thickness ratio of the polyolefin layer and the paper substrate is preferably from 0.05 to 0.2, and more preferably from 0.1 to 0.15.

It is also preferred from the standpoint of improvement of rigidity of the reflective support that a polyolefin layer is formed on the side of the paper substrate opposite to the photographic constitutional layers (i.e., formed on the back surface). In this case, the polyolefin layer formed on the back surface is preferably polyethylene or polypropylene having a matte surface, and polypropylene is more preferred. The polyolefin layer formed on the back surface preferably has a thickness of from 5 to 50 $\mu$m, and more preferably from 10 to 30 $\mu$m, and preferably has a density of from 0.7 to 1.1 g/ml. Examples of preferred embodiments of the reflective support of the invention include those disclosed in JP-A No. 10-333277, No. 10-333278, No. 11-52513, No. 11-65024, EP 0,880,065 and EP 0,880,066.

The water resistant resin layer preferably contains a fluorescent whitening agent. It is also possible that a hydrophilic colloid layer containing the fluorescent whitening agent dispersed therein will be separately formed. Preferred examples of the fluorescent whitening agent include a benzooxazole series, a coumarin series and a pyrazoline series, and more preferably a benzooxiazolylnaphthalene series and benzooxazolylstilbene series. The using amount thereof is not particularly limited and is preferably from 1 to 100 mg/m$^2$. The mixing ratio in the case where it is mixed with the water resistant resin is preferably from 0.0005 to 3% by weight, and more preferably from 0.001 to 0.5% by weight, based on the resin.

The reflective support may be a transmission support or a reflective support having a hydrophilic colloid layer containing a white pigment formed thereon. The reflective support may be a support having a metallic surface having mirror reflection or second-class diffuse reflection.

A method for adjusting the white background to the preferred range with a hydrophilic colloid layer forming the photographic constitutional layers coated on the support will be described in detail below.

As factors of deterioration of the white background ascribed to the photographic constitutional layers, fogging of a silver halide emulsion, remaining color of a sensitizing dye and absorption of contamination of a pressing solution are exemplified. The whiteness can be approximated to the inherent whiteness of the support by reducing the factors of deterioration. The whiteness can also be adjusted to the preferred range in such manners that a dye or a pigment that is not decolored by processing is added to color, and a fluorescent whitening agent is added to the photosensitive material after processing.

<Pigment>

The pigment that is preferably used for coloring the hydrophilic colloid layer of the photographic constitutional layers in the invention will be described. In the silver halide color photographic photosensitive material of the invention, it is preferred that at least one layer of the photosensitive silver halide emulsion layers and the non-photosensitive layers coated on the reflective support contains at least one kind of a pigment (i.e., a dispersed pigment). In the invention, the layer containing a pigment may be either a photosensitive layer containing a silver halide emulsion, an intermediate layer positioned between the silver halide emulsion layers, an ultraviolet absorbing layer positioned as an upper layer of the silver halide emulsion layers, or a non-photosensitive layer, such as an undercoating layer containing gelatin. Because the coating amount of the silver halide emulsion layer is generally changed to adjust the characteristic curve, it is often preferred that the pigment is added to the non-photosensitive layer in order to obtain constant coloration.

In order to avoid yellow stain, blue coloration is generally applied. The pigment is added to such an amount that sufficiently applies coloration to antagonize yellow stain to make a neutral color that is viewed as white by human eyes. A wide range of compensation of yellow stain can be carried out by using two or more kinds of pigments and by changing the using amount ratio of the pigments. A combination use of a blue pigment, which changes the hue to the cyan direction, and a red or violet pigment, which changes the hue to the magenta direction, is generally employed, whereby a wide range of adjustment of color can be carried out.

The pigment used in the invention is not limited as far as it is water insoluble, and such a pigment is preferred that has high affinity with an organic solvent and can be easily dispersed in an organic solvent.

In general, the particle diameter of the pigment is suitably from 0.01 to 5 $\mu$m for effective coloration. It is preferably from 0.01 to 3 $\mu$m.

In the invention, it is most preferred that the pigment is introduced in the following manner. That is, the pigment used in the invention is added to a high boiling point organic solvent in the same manner as in the case where photographic useful substances, such as an ordinary dye-forming coupler (sometimes referred to as a coupler herein), are dispersed and emulsified, whereby a uniform spontaneous dispersion liquid containing pigment fine particles is formed. The liquid is dispersed and emulsified into a fine particle form in a hydrophilic colloid, preferably a gelatin aqueous solution, along with a dispersing agent, such as a surface active agent, by using a known apparatus, such as a colloid mill, a homogenizer, a Manton Gorey and a high-speed dissolver, so as to obtain a dispersion.

The high boiling point organic solvent used in the invention is not particularly limited, and ordinary ones can be used. Examples thereof include those disclosed in U.S. Pat. No. 2,322,027 and JP-A No. 7-152129.

An auxiliary solvent may be used in addition to the high boiling point organic solvent. Examples of the auxiliary solvent include an acetate of a lower alcohol, such as ethyl acetate and butyl acetate, ethyl propionate, secondary butyl acetate, methyl ethyl ketone, methyl isobutyl ketone, β-ethoxyethyl acetate, methylcellosolve acetate, methylcarbitol acetate and cyclohexanone.

It is most preferred that the pigment used in the invention is prepared as an emulsion in such a manner that the pigment is made coexistent in an organic solvent for dissolving the photographic useful substances, such as a coupler, used in the photographic material of the invention through coemulsification.

The invention will be described in more detail with reference to examples below, but the invention is not limited to the examples unless otherwise noted.

In the invention, any kind of pigments may be used without limitation as far as they can used for the desired color adjustment, and they are not changed and remain in the photosensitive material upon developing step. Preferred pigments will be described below with reference to specific examples. The blue pigments used in the invention designate pigments classified into the C.I. Pigment Blue in "Color Index" (The Society of Dyers and Colourists), and similarly, the red pigments used in the invention designate pigments classified into the C.I. Pigment Violet.

Examples of the blue pigments that can be used in the invention include organic pigments, for example, an azo pigment (such as C.I. Pigment Blue 25), a phthalocyanine pigment (such as C.I. Pigment Blue 15:1, ditto 15:3, ditto 15:6, ditto 16 and ditto 75), an indanthrone pigment (such as C.I. Pigment Blue 60, ditto 64 and ditto 21), a triarylcarbonium series basic dye lake pigment (such as C.I. Pigment Blue 1, ditto, 2, ditto 9, ditto 10, ditto 14 and ditto 62), a triarylcarbonium series acidic dye lake pigment (such as C.I. Pigment Blue 18, ditto 19, ditto 24:1, ditto 24:x, ditto 56 and ditto 61), and an indigo pigment (such as C.I. Pigment Blue 63 and ditto 66). Among these, an indanthrone pigment, a triarylcarbonium series basic dye lake pigment, a triarylcarbonium series acidic dye lake pigment and an indigo pigment are preferred from the standpoint of hue, and an indanthrone pigment is most preferred from the standpoint of fastness.

As the blue pigment in the invention, an ultramarine blue pigment and cobalt blue, which are inorganic pigments, are also preferably used.

As the indanthrone pigment used in the invention, those having high affinity with an organic solvent, which can be selected from the commercially available products. Examples thereof include BLUE A3R-KP, a trade name, and BLUE A3R-K, a trade name, produced by Ciba Speciality Chemicals, Inc.

In the invention, it is preferred to use a red or violet pigment in combination for adjustment of hue. Preferred examples of the red pigment include an azo pigment (such as C.I. Pigment Red 2, ditto 3, ditto 5, ditto 12, ditto 23, ditto 48:2, ditto 52:1, ditto 53:1, ditto 57:1, ditto 63:2, ditto 112, ditto 144, ditto 146, ditto 150, ditto 151, ditto 166, ditto 175, ditto 176, ditto 184, ditto 187, ditto 220, ditto 221 and ditto 245, a quinacridone pigment (such as C.I. Pigment Red 122, ditto 192, ditto 202, ditto 206, ditto 207 and ditto 209), a diketopyrrolopyrrole pigment (such as C.I. Pigment Red 254, ditto 255, ditto 264 and ditto 272), a perylene pigment (such as C.I. Pigment Red 123, ditto 149, ditto 178, ditto 179, ditto 190 and ditto 224), a perynone pigment (such as C.I. Pigment Red 194), an anthraquinone pigment (such as C.I. Pigment Red 83:1, ditto 89, ditto 168 and ditto 177), a benzimidazolone pigment (such as C.I. Pigment Red 171, ditto 175, ditto 176, ditto 185 and ditto 208), a triarylcarbonium series basic dye lake pigment (such as C.I. Pigment Red 81:1 and ditto 169), a thioindigo pigment (such as C.I. Pigment Red 88 and ditto 181), a pyranthrone pigment (such as C.I. Pigment Red 216 and ditto 226), a pyrazoloquinazolone pigment (such as C.I. Pigment Red 251 and ditto 252), and an isoindoline pigment (such as C.I. Pigment Red 260). Among these, an azo pigment, a quinacridone pigment, a diketopyrrolopyrrole pigment and a perylene pigment are preferred, and an azo pigment and a diketopyrrolopyrrole pigment are particularly preferred.

Preferred examples of the violet pigment include an azo pigment (such as C.I. Pigment Violet 13, ditto 25, ditto 44 and ditto 50), a dioxazine pigment (such as C.I. Pigment Violet 23 and ditto 37), a quinacridone pigment (such as C.I. Pigment Violet 19 and ditto 42), a triarylcarbonium series basic dye lake pigment (such as C.I. Pigment Violet 1, ditto 2, ditto 3, ditto 27 and ditto 39), an anthraquinone pigment (such as C.I. Pigment Violet 5:1 and ditto 33), a perylene pigment (such as C.I. Pigment Violet 29), an isoviolunthrone pigment (such as C.I. Pigment Violet 31), and a benzimidazolone pigment (such as C.I. Pigment Violet 32). Among these, an azo pigment, a dioxazine pigment and a quinacridone pigment are preferred, and a dioxazine pigment is particularly preferred.

As the dioxazine pigment used in the invention, those having high affinity with an organic solvent are preferred, which can be selected from the commercially available products. Examples thereof include VIOLET B-K, a trade name, and VIOLET B-KP, a trade name, produced by Ciba Speciality Chemicals, Inc.

In the invention, other pigments (such as pigments classified into C.I. Pigment Yellow, C.I. Pigment Orange, C.I. Pigment Brown and C.I. Pigment Green) than those described in the foregoing can be used in combination for color adjustment.

Specific compounds thereof are disclosed in "Color Index" (The Society of Dyers and Colourists) and "Industrial Organic Pigments" by W. Herbst and K. Hunger (VCH Verlagsgesellschsft mbH 1993).

The pigment that can be used in the invention may be either a naked pigment or a pigment having been subjected to a surface treatment. Examples of the method for the surface treatment include a method of coating the surface with a resin or wax, a method of attaching a surface active agent, a method of bonding a reactive substance (such as a silane coupling agent, an epoxy compound and a polyisocyanate) to the surface of the pigment, and a method of using a pigment derivative (synergist), which are disclosed in the following literatures, i.e., "Kinzoku Sekken no Seisitu to Ouyou" (Nature and Application of Metallic Soap) (published by Saiwai Shobo), "Insatsu Ink Gijutu" (Printing Ink Technique) (published by CMC Publishing, 1984) and "Saishin Ganryo Oyo Gijutu" (Newest Pigment Application Technique) (published by CMC Publications, 1986).

A so-called instant pigment, i.e., a easily dispersible pigment that is commercially available in the form having a resin or wax coated on the surface thereof (such as Microns Pigment produced by Ciba Speciality Chemicals, Inc.), is particularly preferred because it is not necessary to be dispersed upon introducing into the photosensitive material and can be well dispersed in a high boiling point organic solvent. In this case, a high boiling point organic solvent having the pigment dispersed therein can be further dispersed in a hydrophilic colloid, such as gelatin.

In the invention, the pigment is dispersed in a high boiling point organic solvent and then further dispersed in a hydrophilic colloid, such as gelatin, and in alternative, the pigment may be directly dispersed in a hydrophilic colloid. Various kinds of dispersing agents can be used thereon, for example, a low molecular weight dispersing agent and a high molecular weight dispersing agent of a surface active agent type, and a high molecular weight dispersing agent is preferably used from the standpoint of dispersion stability. Examples of the dispersing agent include those disclosed in JP-A No. 3-69949 and European Patent No. 549,486.

The particle diameter of the pigment that can be used in the invention is preferably in a range of from 0.01 to 10 $\mu$m, and more preferably in a range of from 0.02 to 1 $\mu$m.

As the method for dispersing the pigment in a binder, known dispersion techniques used upon production of ink and production of toners can be employed. Examples of a disperser include a sand mill, an attritor, a pearl mill, a super mill, a ball mill, an impeller, a disperser, a KD mill, a colloid mill, a dynatron, a three-roll mill and a pressure kneader. Details thereof are disclosed in "Saishin Ganryo Oyo Gijutu" (Newest Pigment Application Technique) (published by CMC Publications, 1986).

The total using amount of the pigment used in the invention is preferably in a range of from 0.1 to 10 mg/m$^2$, and more preferably in a range of from 0.3 to 5 mg/m$^2$. It is preferred that the blue pigment is used in combination with a pigment of other hue. The method of adding the pigment to the hydrophilic colloid layer forming the photographic constitutional layers is preferred in comparison to the method of adding the pigment to the polyolefin coating resin of the support because the amount of the pigment necessary for adjusting the desired color can be greatly decreased.

In the case where the blue pigment is used in combination with the red pigment and/or the violet pigment in the invention, they may be used by dispersing either in the same hydrophilic colloid layer or in different hydrophilic colloid layers without any limitation.

In the invention, it is also preferred that an oil soluble dye is used in the photographic constitutional layers of the photosensitive material to adjust the white background. Specific examples of the oil soluble dye include Compounds Nos. 1 to 27 disclosed in JP-A No. 2-842, p. (8) and (9).

In the invention, it is also possible that a fluorescent whitening agent is added to the photographic constitutional layers of the photosensitive material, whereby the fluorescent whitening agent remain in the photosensitive material after processing, so as to adjust the white background. It is also possible that a polymer, such as polyvinylpyrrolidone, capable of catching a fluorescent whitening agent is added to the photosensitive material.

<Coupler Represented by General Formulae (M-1) and (M-2)>

A coupler used in the invention will be described below.

In the invention, at least one kind of magenta couplers represented by the general formulae (M-1) and (M-2) is preferably used as a coupler.

A magenta coupler represented by the general formula (M-1) will be described.

In the general formula (M-1), examples of the substituent represented by $R_{M1}$ include an alkyl group (such as a methyl group, an ethyl group, a propyl group, an isopropyl group, a t-butyl group, a pentyl group, a cyclopentyl group, a hexyl group, a cyclohexyl group, an octyl group and a dodecyl group), an alkenyl group (such as a vinyl group and an allyl group), an alkynyl group (such as a propagyl group), an aryl group (such as a phenyl group and a naphthyl group), a heterocyclic group (such as pyridyl group, a thoazolyl group, an oxazolyl group, an imidazolyl group, a furyl group, a pyrrolyl group, a pyrazinyl group, a pyrimidinyl group, a selenazolyl group, a sulfolanyl group, a piperidinyl group, a pyrazolinyl group and a tetrazolyl group), a halogen atom (such as a chlorine atom, a bromine atom, an iodine atom and fluorine atom), an alkoxy group (such as a methoxy group, an ethoxy group, a propyloxy group, a pentyloxy group, a cyclopentyloxy group, a hexyloxy group, a cyclohexyloxy group, an octyloxy group and a dodecyloxy group), an aryloxy group (such as a phenoxy group and a naphthyloxy group), an alkoxycarbonyl group (such as a methyloxycarbonyl group, an ethyloxycarbonyl group, a butyloxycarbonyl group, an octyloxycarbonyl group and a dodecyloxycarbonyl group), an aryloxycarbonyl group (such as a phenyloxycarbonyl group and a naphthyloxycarbonyl group), a sulfonamide group (such as a methylsulfonylamino group, an ethylsulfonylamino group, a butylsulfonylamino group, a hexylsulfonylamino group, a cyclohexylsulfonylamino group, an octylsulfonylamino group, a dodecylsulfonylamino group and a phenylsulfonylamino group), a sulfamoyl group (such as an aminosufonyl group, a methylaminosufonyl group, a dimethylaminosufonyl group, a butylaminosufonyl group, a hexylaminosufonyl group, a cyclohexylaminosufonyl group, an octylaminosufonyl group, a dodecylaminosufonyl group, a phenylaminosufonyl group, a naphthylaminosulfonyl group and a 2-pyridylaminosulfonyl group), an ureido group (such as a methylureido group, an ethylureido group, a pentylureido group, a cyclohexylureido group, an octylureido group, a dodecylureido group, a phenylureido group, a naphthylureido group and a 2-pyridylureido group), an acyl group (such as an acetyl group, an ethylcarbonyl group, a propylcarbonyl group, a pentylcarbonyl group, a cyclohexylcarbonyl group, an octylcarbonyl group, a 2-ethylhexylcarbonyl group, a dodecylcarbonyl group, a phenylcarbonyl group, a naphthylcarbonyl group and a pyridylcarbonyl group), an acyloxy group (such as an acetyloxy group, an ethylcarbonyloxy group, a butylcarbonyloxy group, an octylcarbonyloxy group, a dodecylcarbonyloxy group and a phenylcarbonyloxy group), a carbamoyl group (such as an aminocarbonyl group, a methylaminocarbonyl group, a dimethylaminocarbonyl group, a propyaminocarbonyl group, a pentylaminocarbonyl group, a cyclohexylaminocarbonyl group, an octylaminocarbonyl group, a 2-ethylhexylaminocarbonyl group, a dodecylaminocarbonyl group, a phenylaminocarbonyl group, a naphthylaminocarbonyl group and 2-pyridylaminocarbonyl group), an amide group (such as a methylcarbonylamino group, an ethylcarbonylamino group, a dimethylcarbonylamino group, a propylcarbonylamino group, a pentylcarbonylamino group, a cyclohexylcarbonylamino group, a 2-ethylhexylcarbonylamino group, an octylcarbonylamino group, a dodecylcarbonylamino group, a phenylcarbonylamino group and a naphthylcarbonylamino group), a sulfonyl group (such as a methylsulfonyl group, an ethylsulfonyl group, a butylsulfonyl group, a cyclohexylsulfonyl group, a 2-ethylhexylsulfonyl group, a dodecylsulfonyl group, a phenylsulfonyl group, a naphthylsulfonyl group and a 2-pyridylsulfonyl group), an amino group (such as an amino group, an ethylamino group, a dimethylamino group, a butylamino group, a cyclopentylamino group, a 2-ethylhexylamino group, a dodecylamino group, an anilino group, a naphthylamino group and a 2-pyridylamino group), a cyano group, a nitro group, a sulfo group, a carboxyl group and a hydroxyl group, and these groups may be further substituted with these substituents. Among these, for example, such groups as alkyl, cycloalkyl, alkenyl, aryl, acylamino, sulfonamide, alkylthio, arylthio, a halogen atom, heterocyclic, sulfonyl, sulfinyl, acyl, carbamoyl, sulfamoyl, cyano, alkoxy, aryloxy, acyloxy, amino, alkylamino, ureido, alkoxycarbonyl, aryloxycarbonyl and carbonyl are preferred, and an alkyl group is more preferred, with a t-butyl group being particularly preferred.

Examples of the alkyl group represented by $R_{M2}$ to $R_{M5}$ and $R_{M7}$ in the general formula (M-1) include a linear or branched alkyl group, such as a methyl group, an ethyl group, an i-propyl group, a t-butyl group, a 2-ethylhexyl group, a dodecyl group and a 1-hexylnonyl group. These groups may be further substituted with the substituent represented by $R_{M1}$. As the alkyl group represented by $R_{M2}$ and $R_{M3}$, a methyl group is preferred, and $R_{M7}$ is preferably a hydrogen atom.

Examples of the alkyl group, the aryl group, the alkoxy group, the aryloxy group, the alkylamino group and the arylamino group represented by $R_{M6}$ in the general formula (M-1) include those exemplified for the aryl group, the alkoxy group, the aryloxy group, the alkylamino group and the arylamino group represented by $R_{M1}$.

Examples of the halogen atom represented by $X_M$ in the general formula (M-1) include a chlorine atom, a bromine atom and a fluorine atom, and examples of the group that is releasable by a coupling reaction with an oxidized product of a coloration developing agent include such groups as alkoxy, aryloxy, heterocyclic oxy, acyloxy, sulfonyloxy, alkoxycarbonyloxy, aryloxycarbonyloxy, alkyloxalyloxy, alkylthio, arylthio, heterocyclic thio, alkyloxythiocarbonylthio, acylamino, sulfonamide, nitrogen-containing heterocyclic bonded with the N atom, alkyloxycarbonylamino, aryloxycarbonylamino and carboxyl, and a halogen atom is preferred, with a chlorine atom being particularly preferred.

A magenta coupler represented by the general formula (M-2) will be described.

In the general formula (M-2), $R_{M1}$ has the same meaning as in the general formula (M-1), and among these, an alkyl group is preferred, with a branched alkyl group being most preferred.

In the general formula (M-2), R represents an alkyl group, an alkenyl group, an alkynyl group, an aryl group or a heterocyclic group. The alkyl group, the alkenyl group and the alkynyl group may be linear, branched or cyclic. In the case where they are cyclic, they are generally referred to as a cycloalkyl group, a cycloalkenyl group and a cycloalkynyl group, respectively, which are included and used in the invention.

Examples of the unsubstituted alkyl group include such groups as methyl, ethyl, n-butyl, t-butyl, n-hexyl, cyclohexyl, 2-ethylbutyl, 2-methylpentyl, n-heptyl, n-octyl, 2-ethylhexyl, n-decyl, n-tetradecyl and adamantyl. Examples of the unsubstituted alkenyl group include such groups as vinyl, allyl, 1-butenyl, cis-2-butenyl, trans-2-butenyl, oleyl and cyclohexenyl. Examples of the unsubstituted alkynyl group include such groups as propagyl, 1-butynyl, 2-butynyl and 1-pentynyl. The alkyl groups, the alkenyl groups and the alkynyl groups may be further substituted with a substituent, and examples of the substituent include the following:

That is, examples thereof include a halogen atom (such as fluorine and chlorine), an alkoxy group (such as methoxy, ethoxy, isopropoxy, dodecyloxy and 2-methoxyethoxy), an aryl group (such as phenyl, naphthyl and anthranyl), an aryloxy group (such as phenoxy, 2-methoxyphenoxy, 4-t-octylphenoxy and naphthoxy), an alkylthio group (such as methylthio, ethylthio, hexylthio, octylthio, hexadecylthio and 2-ethoxycarbonylpropylthio), an arylthio group (such as phenylthio, 2-pivaloylamidephenylthio, 2-butoxy-5-t-octylphenylthio, naphthylthio and 2-butoxycarbonylphenylthio), an alkylcarbonyl group (such as methylcarbonyl, ethylcarbonyl, propylcarbonyl and t-butylcarbonyl), an arylcarbonyl group (such as phenylcarbonyl, naphthylcarbonyl and p-toluenecarbonyl), an alkylcarbonyloxy group (such as acetyloxy, propyonyloxy, heptanoyloxy, 2-ethylhexanoyloxy, cyclohexanoyloxy and pivaloyloxy), an arylcarbonyloxy group (such as benzoyloxy, 2-butoxybenzoyloxy, 2,5-dichlorobenzoyloxy and 3-octyloxycarbonylbenzoyloxy), an alkoxycarbonyl group (such as methoxycarbonyl, ethoxycarbonyl, propyloxycarbonyl, butoxycarbonyl, octyloxycarbonyl, dodecyloxycarbonyl and 2-ethylhexyloxycarbonyl), a carboxylic amide group (such as acetamide, propaneamide, hexadecaneamide, pivaloylamide, benzamide, 2-ethoxybenzamide, 3-dodecyloxycarbonylpropaneamide and 4-tetradecyloxycarbonylbutaneamide), a sulfoneamide group (such as methanesulfoneamide, butanesulfoneamide, octanesulfoneamide, hexadecanesulfoneamide, benzenesulfoneamide, p-toluenesulfoneamide and 2-octyloxy-5-t-octylbenzenesulfoneamide), an alkylamino group (such as methylamino, N,N-diethylamino, t-butylamino, N,N-di-n-butylamino, methylethylamino and N,N-di-n-octylamino), an arylamino group (such as aminophenyl and aminonaphthyl), a carbamoyl group (such as N-methylcarbamoyl, N-butylcarbamoyl, N-cyclohexylcarbamoyl, N-dodecylcarbamoyl, N-phenylcarbamoyl, N,N-diethylcarbamoyl and N,N-dibutylcarbamoyl), a sulfamoyl group (such as N-ethylsulfamoyl, N-butylsulfamoyl, N-hexadecylsulfamoyl, N-cyclohexylsulfamoyl, N,N-dibutylsulfamoyl, N-phenylsulfamoyl and N-methyl-N-octadecylsulfamoyl), an imide group (such as succinic acid imide, phthalic acid imide, hexadecylsuccinic acid imide and octadecylsuccinic acid imide), a urethane group (such as methylurethane, ethylurethane, t-butylurethane, dodecylurethane and phenylurethane), a ureido group (such as N-methylureido, N-ethylureido, N-dodecylureido, N,N-dibutylureido, N-phenylureido and N-cyclohexylureido), a sulfonyl group (such as methylsulfonyl, ethylsulfonyl, propylsulfonyl, butylsulfonyl, hexylsulfonyl, octylsulfonyl, dodecylsulfonyl, hexadecylsulfonyl and phenylsulfonyl), a heterocyclic group (preferably a 5- to 7-member heterocyclic group having at least one of a nitrogen atom, an oxygen atom and a sulfur atom as a constitutional atom, such as pyridyl, quinolyl, thienyl, morpholyl, piperidyl, thiazolyl and benzimidazolyl), a carboxyl group, a cyano group, a hydroxyl group, a nitro group and an unsubstituted amino group.

Among these substituents, a halogen atom, an alkoxy group, an aryloxy group, an alkylcarbonyloxy group, an arylcarbonyloxy group, an alkyloxycarbonyl group, a carbonamido group, a cyano group and a nitro group are preferred, and a halogen atom, an alkoxy group, a carbonamido group and a cyano group are more preferred. These substituents may be further substituted with these substituents.

Examples of the unsubstituted aryl group include phenyl, naphthyl and anthranyl. Examples of a substituent of the substituted aryl group include an alkyl group (such as methyl, ethyl, propyl, t-butyl, cyclohexyl, 2-ethylhexyl, octadecyl and adamantyl) and those substituents exemplified for the substituents of the alkyl group. Preferred examples of the substituent on the aryl group include a halogen atom, an alkyl group, an alkoxy group, an aryloxy group, an alkylcarbonyloxy group, an arylcarbonyloxy group, an alkyloxycarbonyl group, a sulfonamide group, a carbonamido group, a cyano group and a nitro group, and more preferred examples thereof include a halogen atom, an alkyl group, an alkoxy group, a carbonamido group, a sulfonamide group and a cyano group. These substituents may be further substituted with these substituents.

Preferred examples of the unsubstituted heterocyclic group include a 5- to 7-member heterocyclic group having at least one of a nitrogen atom, an oxygen atom and a sulfur atom as a constitutional atom, and examples thereof include pyridyl, furyl, thienyl, imidazolyl, triazolyl, pyrimidyl, oxazolyl, thiazolyl, piperazyl, morpholyl, tetrahydropyranyl, quinolyl, benzimidazolyl, benzotriazolyl and carbazolyl. Examples of the substituent on the substituted heterocyclic group include those substituents exemplified for the substituted aryl group. Preferred examples of the heterocyclic group include pyridyl, furyl, oxazolyl, thiazolyl, morpholyl and benzimidazolyl.

Preferred examples of the group represented by R in the general formula (M-2) include an unsubstituted alkyl group having from 1 to 50 carbon atoms, an unsubstituted alkenyl group having from 2 to 50 carbon atoms, an unsubstituted alkynyl group having from 2 to 50 carbon atoms, a substituted alkyl group having from 1 to 50 carbon atoms, a substituted alkenyl group having from 2 to 50 carbon atoms, a substituted alkynyl group having from 2 to 50 carbon atoms, an aryl group having from 6 to 36 carbon atoms and a substituted aryl group having from 6 to 36 carbon atoms, and more preferred examples thereof include a branched alkyl group having from 2 to 30 carbon atoms, a branched alkenyl group, a branched alkynyl group, a substituted alkyl group having from 2 to 30 carbon atoms, a substituted alkenyl group having from 2 to 30 carbon atoms, a substituted alkynyl group having from 2 to 30 carbon atoms, an aryl group having from 6 to 20 carbon atoms and a substituted aryl group having from 6 to 25 carbon atoms. Among these, an alkyl group having from 2 to 30 carbon atoms and an aryl group having from 6 to 20 carbon atoms are preferred, and a branched alkyl group having from 10 to 20 carbon atoms is most preferred.

In the general formula (M-2), L represents —CO— or —$SO_2$—, and preferably L represents —CO—.

In the general formula (M-2), the group represented by —$NHCOCH_2O$—L—R may be substituted on any position of the benzene ring. It is preferably the meta position or the para position, and particularly preferably the para position.

In the general formula (M-2), X preferably represents a hydrogen atom, a halogen atom or an aryloxy group. In the coupler of the invention, the group represented by X, which is a halogen atom or an aryloxy group, is released through a coupling reaction with an oxidized product of a developing agent. Examples of the halogen atom include a fluorine, chlorine and bromine. The aryloxy group is an aryloxy group, which may have a substituent, and examples of the substituent of the substituted aryloxy group include those exemplified as the substituents for the substituted aryl group represented by R. The aryloxy group preferably has a carbon number of from 6 to 20. Examples of the aryloxy group include phenoxy, 4-methylphenoxy, 4-tert-butylphenoxy, 4-methoxycarbonylphenoxy, 4-ethoxycarbonylphenoxy and 2,4-dimethylphenoxy. Among these, X preferably represents a halogen atom or an aryloxy group, and more preferably a halogen atom, with a chlorine atom being most preferred.

Specific examples of the couplers represented by the general formulae (M-1) and (M-2) will be described below, but the invention is not limited thereto.

M-1

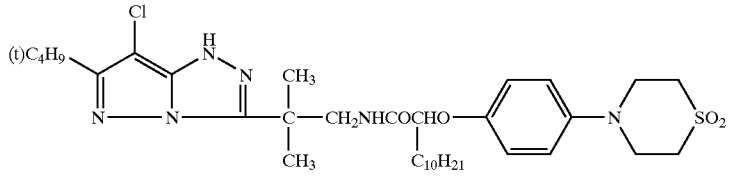

-continued
M-2
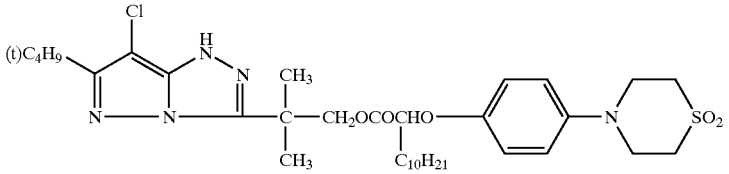
M-3
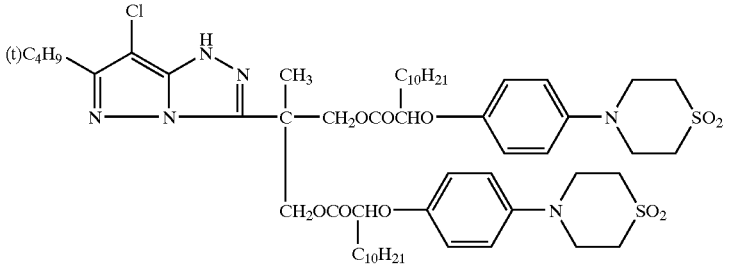
M-4
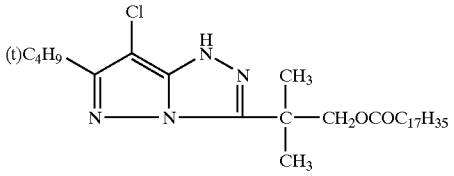
M-5
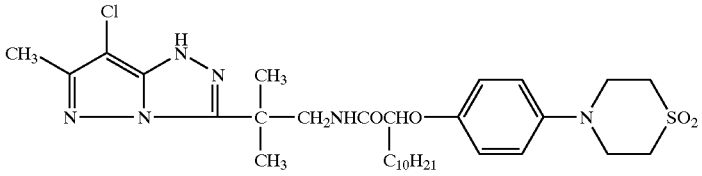
M-6
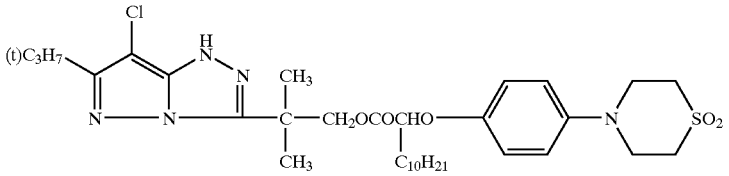
M-7
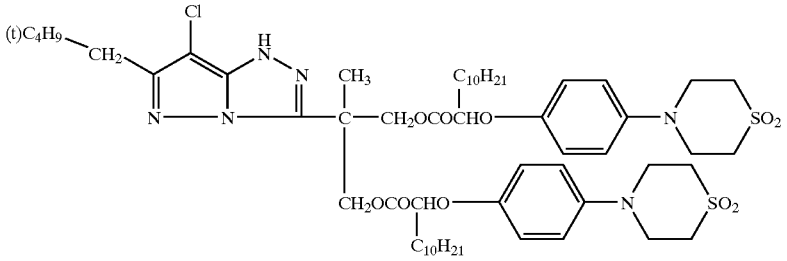
M-8
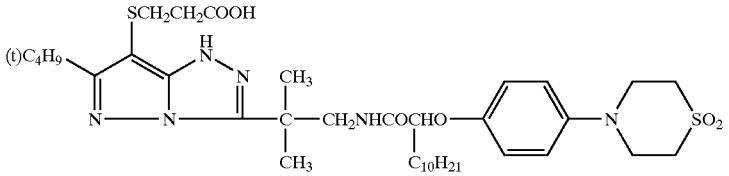

-continued
M-9
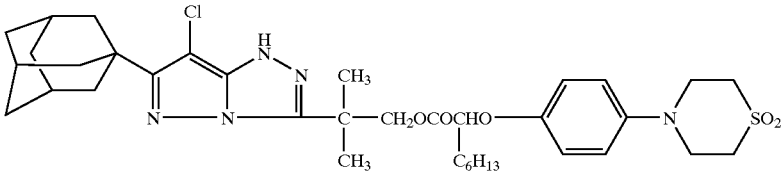
M-10
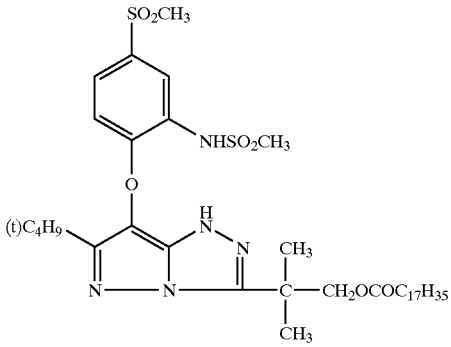
M-11
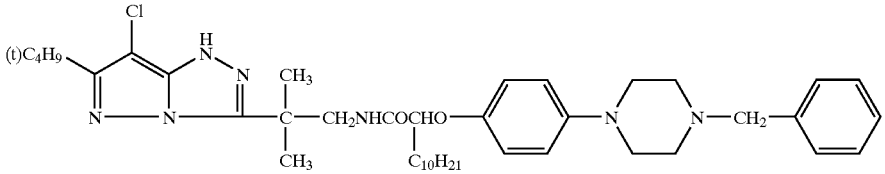
M-12
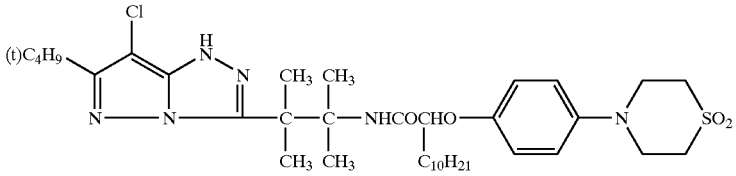
M-13
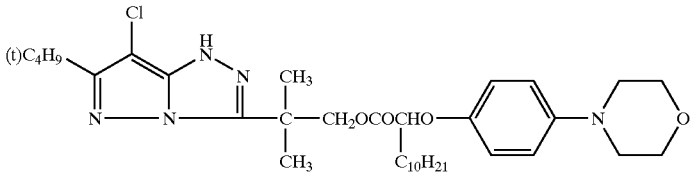
M-14
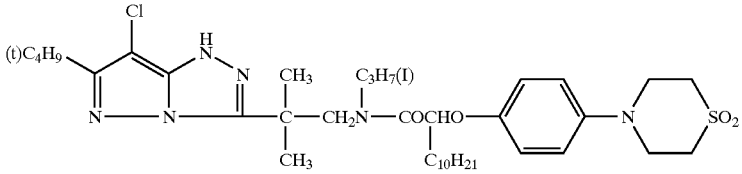
M-15
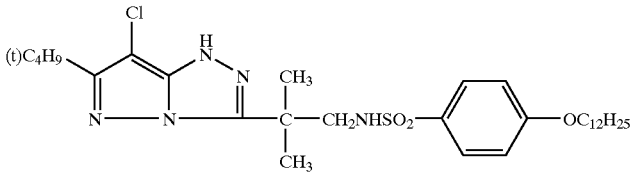

-continued
M-16
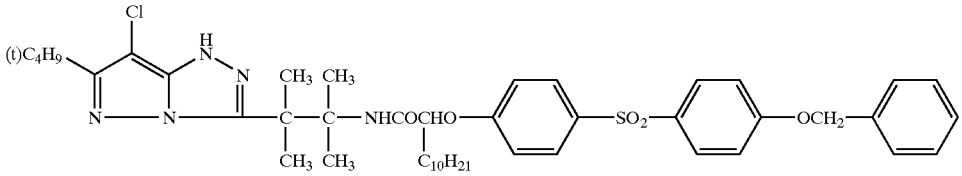
M-17
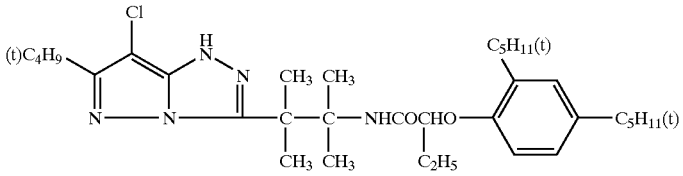
M-18
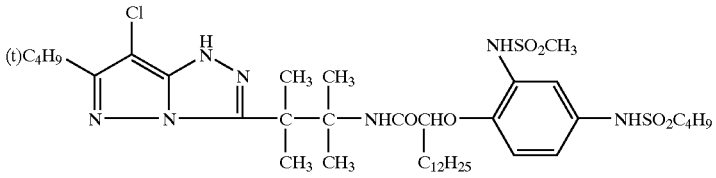
M-19
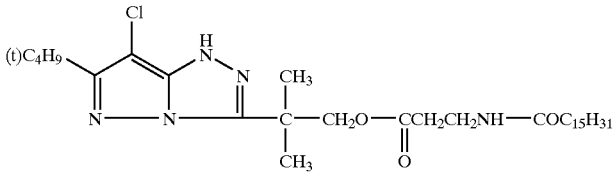
M-20
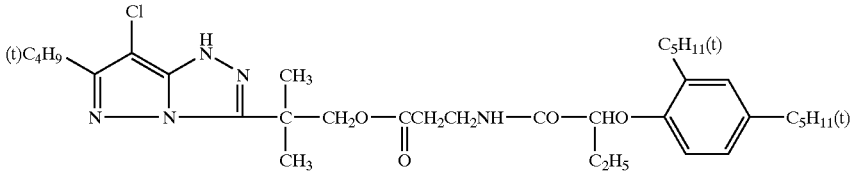
M-21
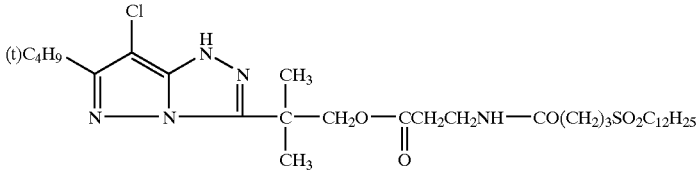
M-22
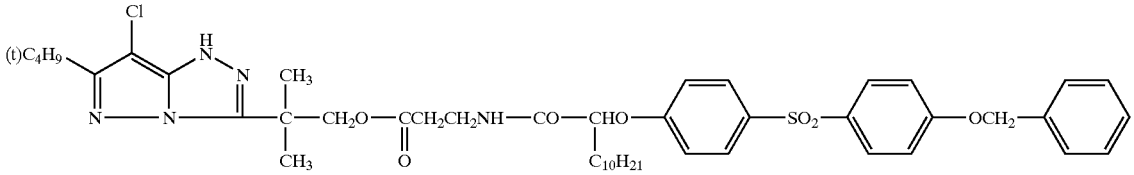
M-23
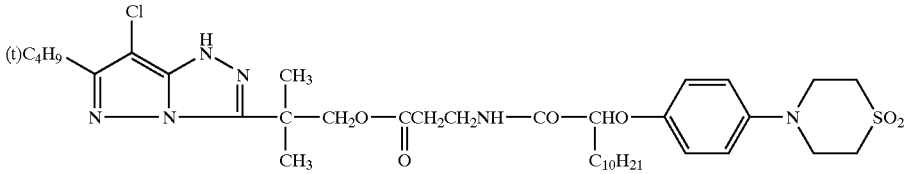

-continued
M-24
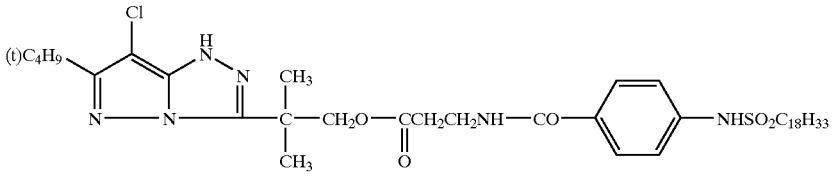
M-25
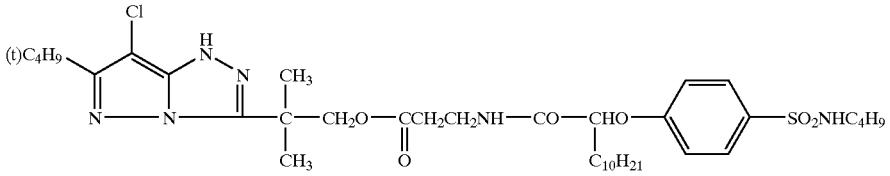
M-26
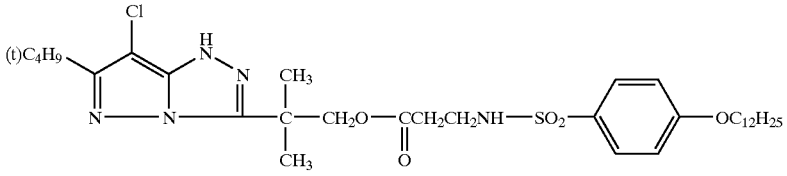
M-27
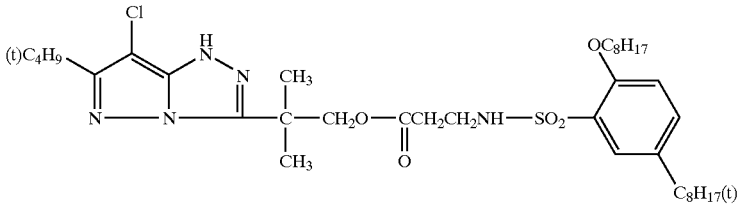
M-28
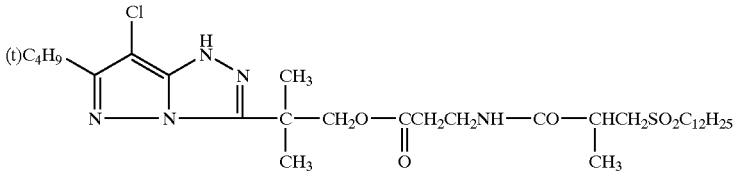
M-29
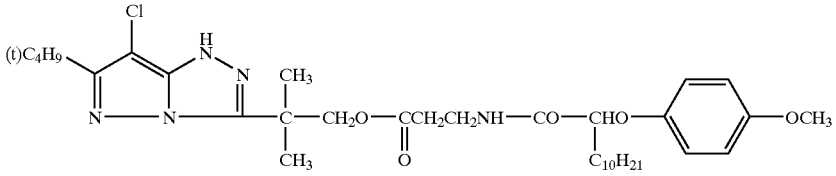
M-30
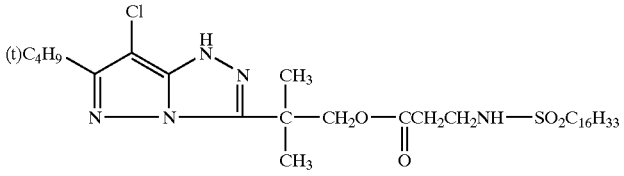
M-31
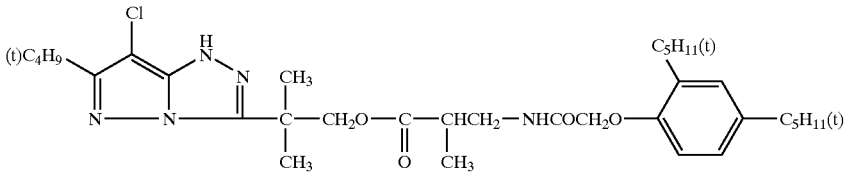

-continued
M-32
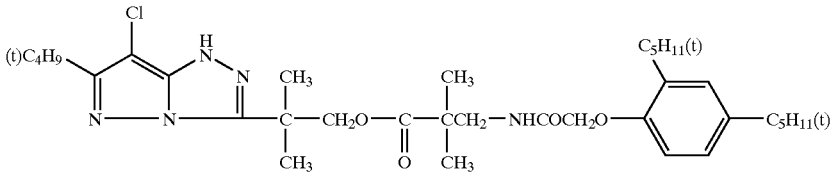
M-33
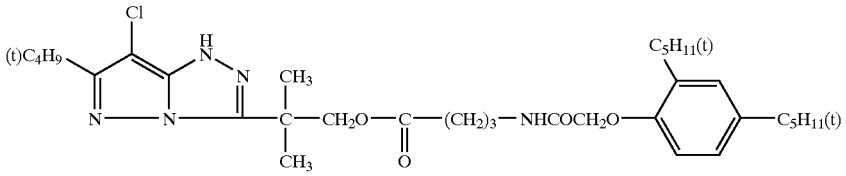
M-34
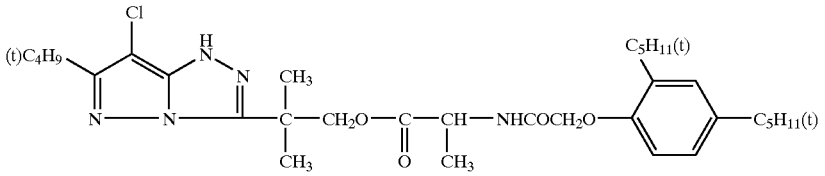
M-35
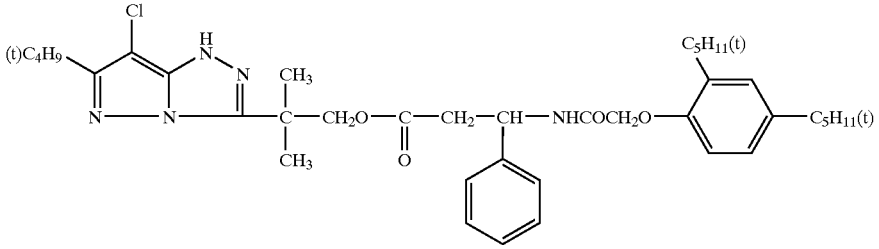
M-36
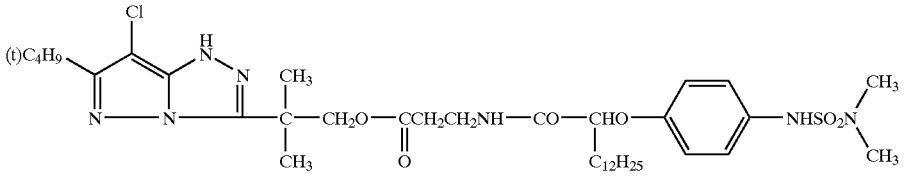
M-37
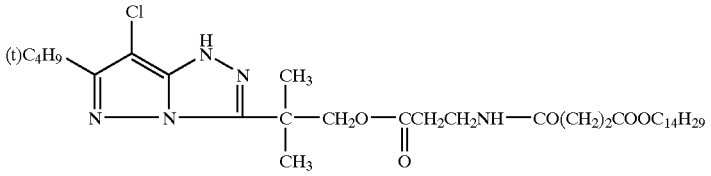
M-38
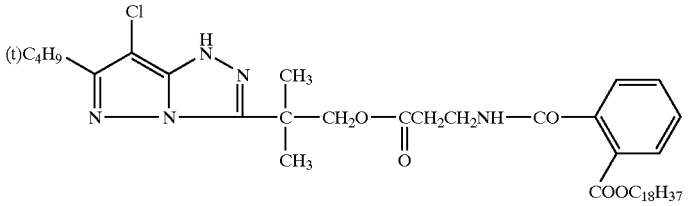
M-39
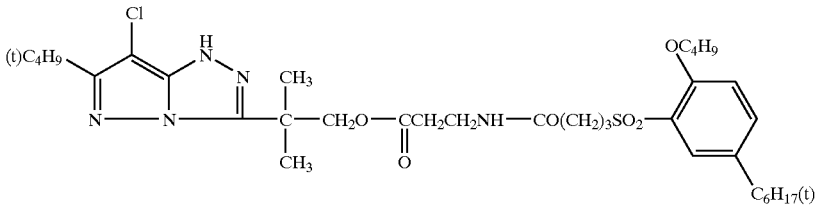

-continued
M-40
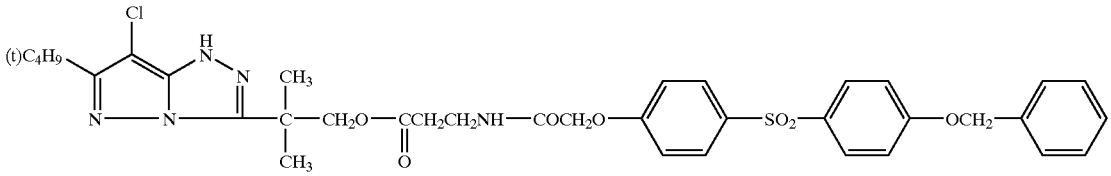
M-41
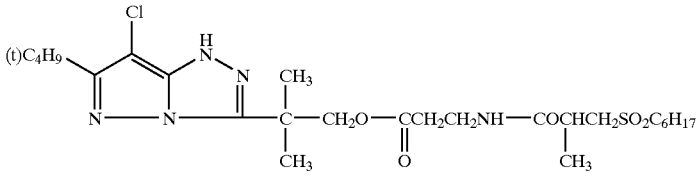
M-42
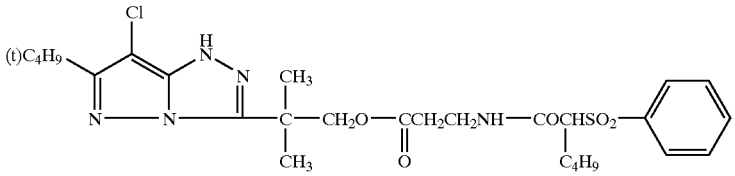
M-43
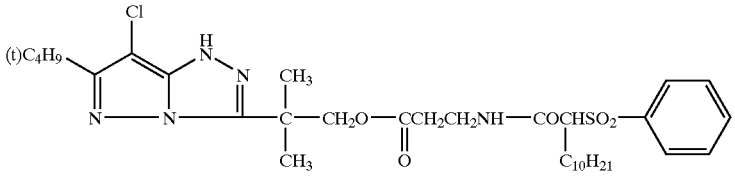
M-44
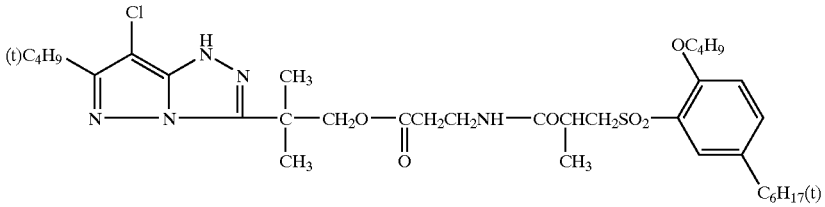
M-45
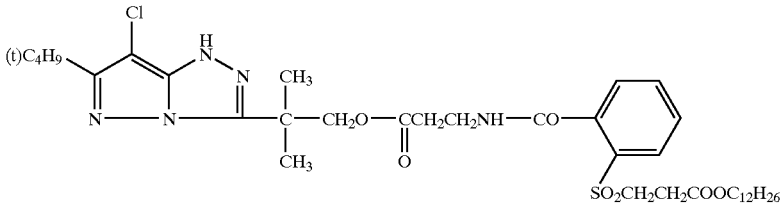
M-46
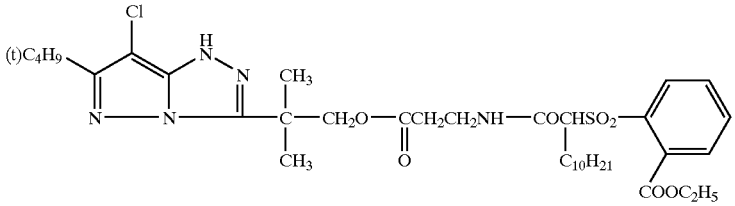
M-47
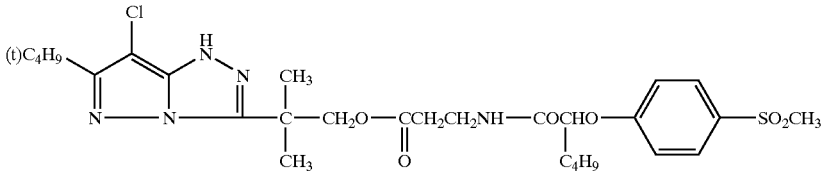

-continued
M-48
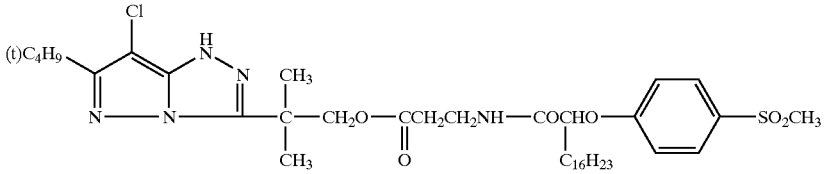
M-49
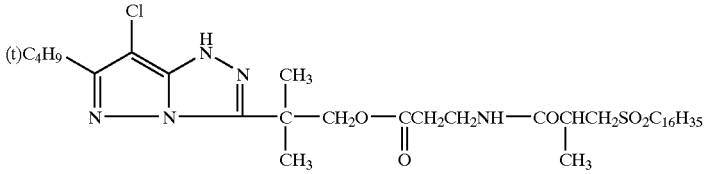
M-50
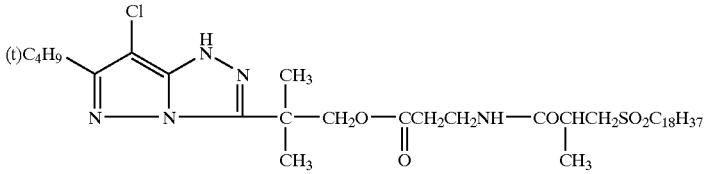
M-51
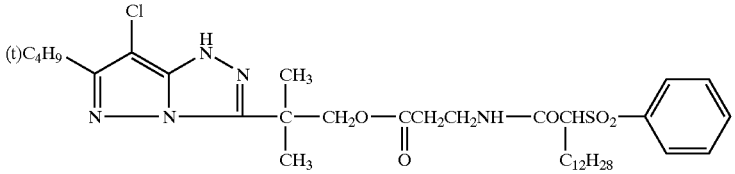
M-52
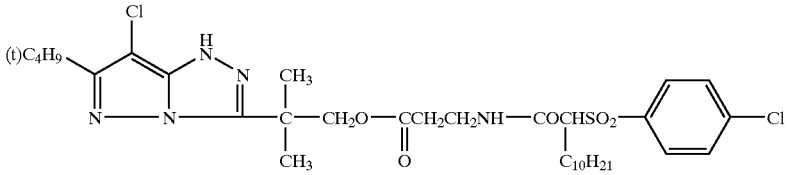
M-53
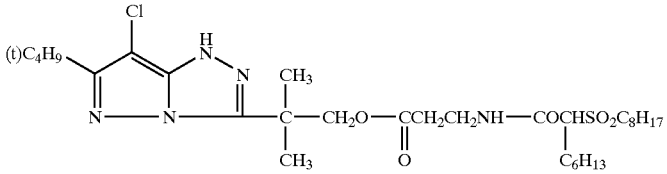
M-54
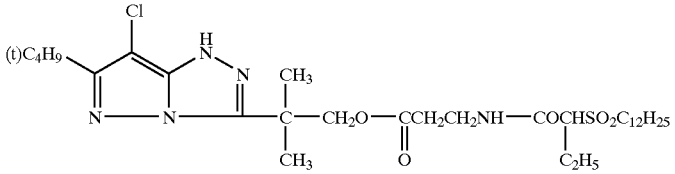
M-55
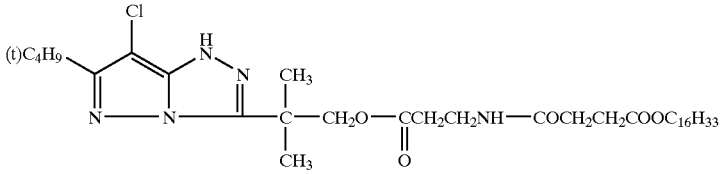

-continued
M-56
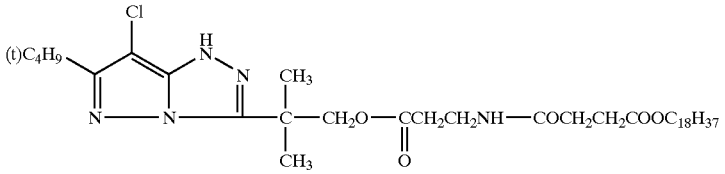
M-57
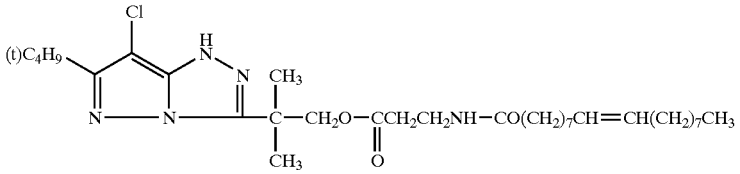
M-58
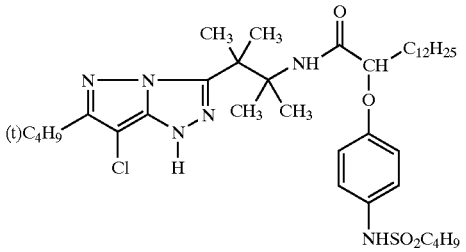
M-59
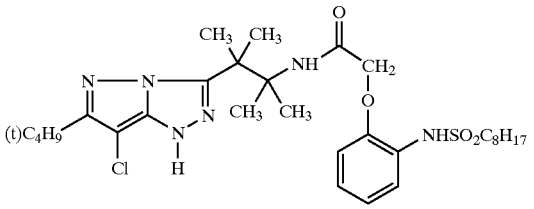
M-60
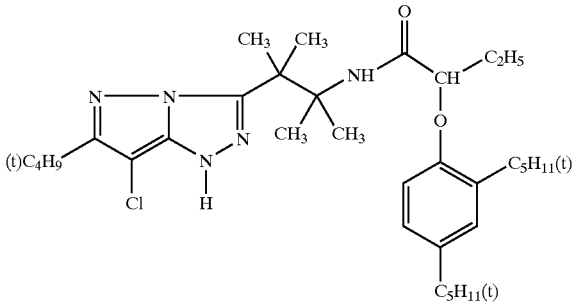
M-61
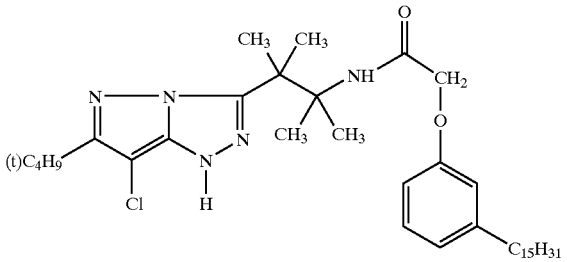
M-62
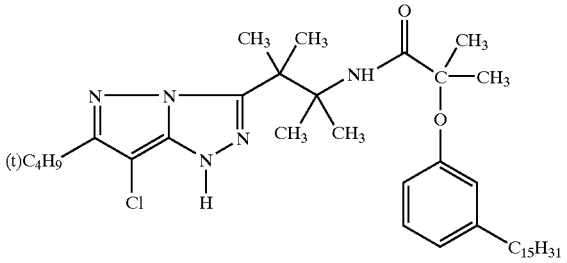

-continued
M-63
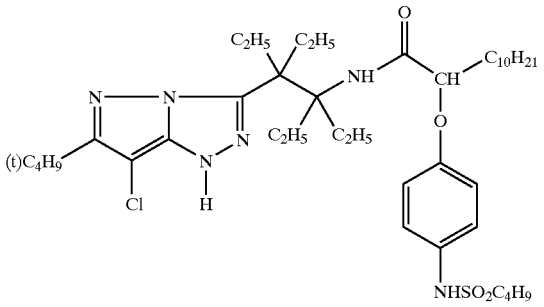
M-64
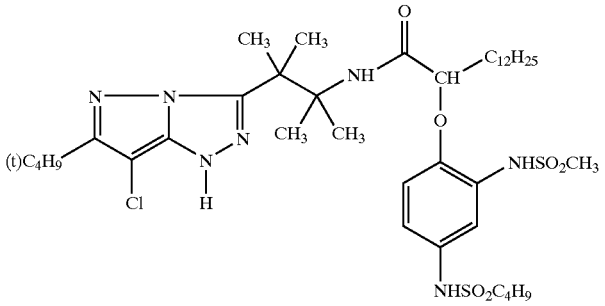
M-65
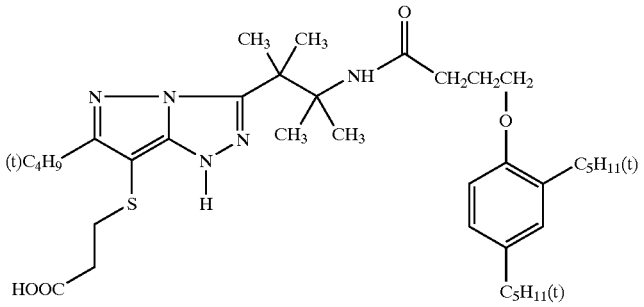
M-66
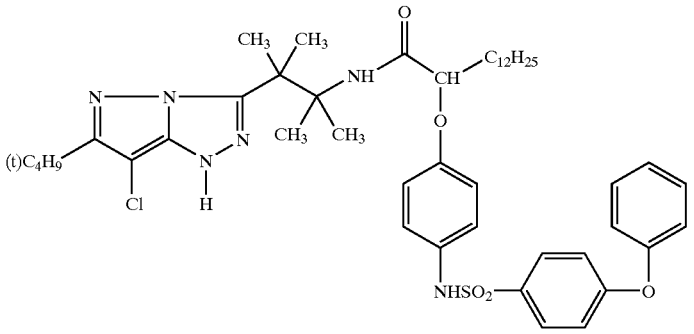
M-67
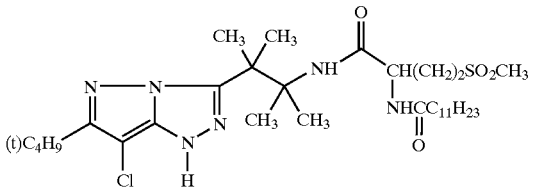
M-68
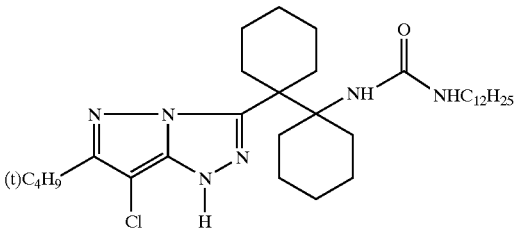

-continued
M-69
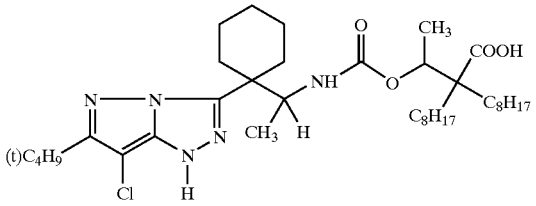
M-70
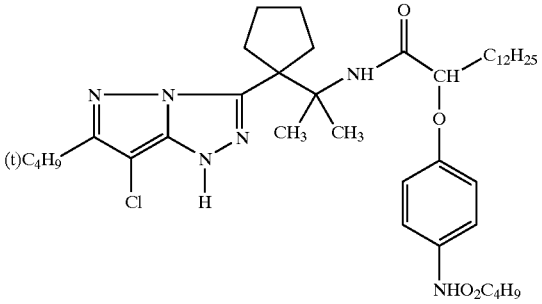
M-71
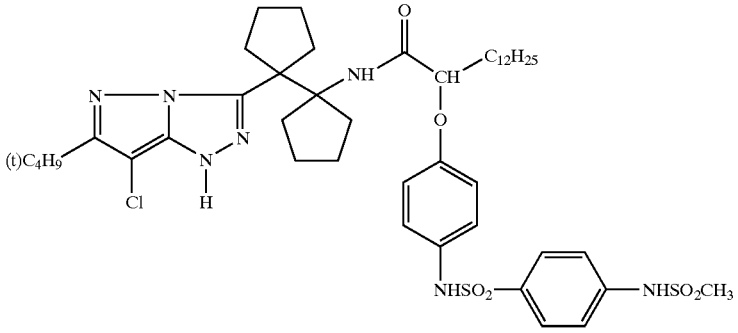
M-72
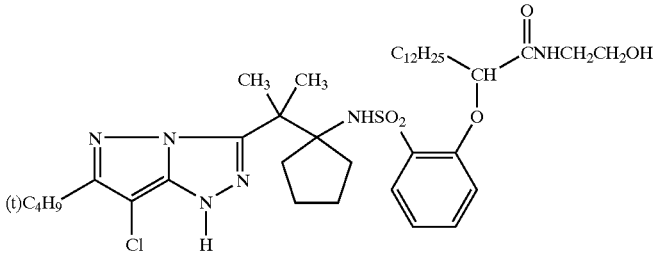
M-73
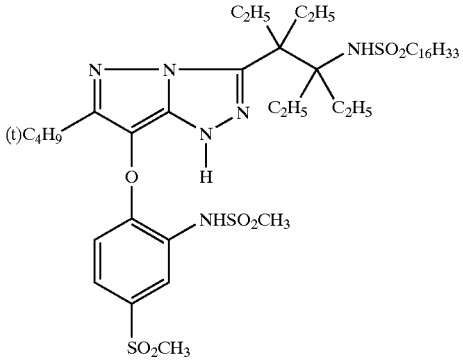
M-74
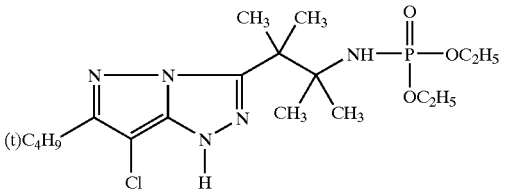
M-75
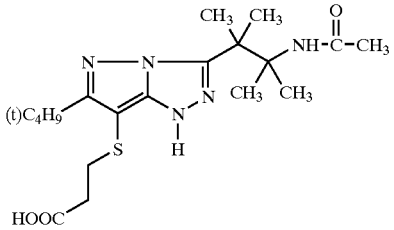
M-76
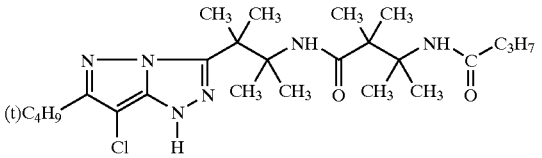

-continued
M-77
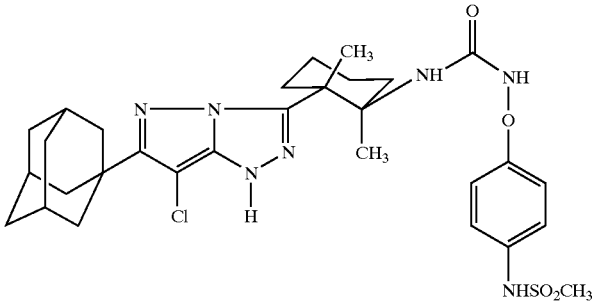
M-78
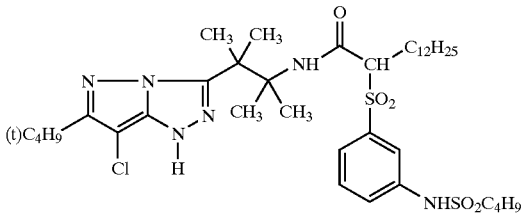
M-79
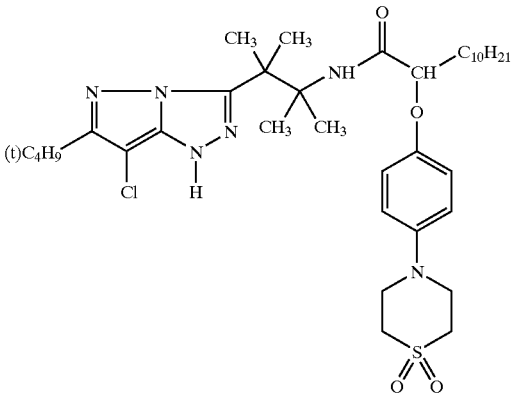
M-80
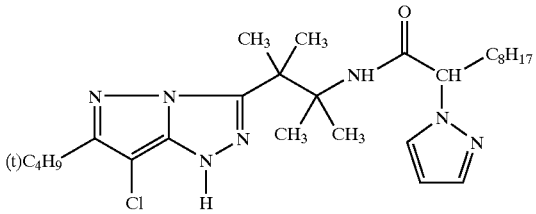
M-81
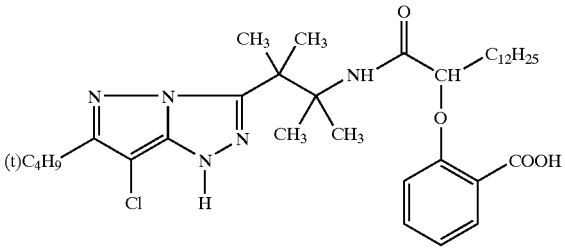
M-82
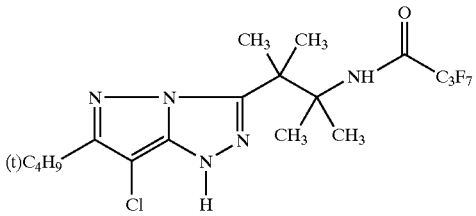
M-83
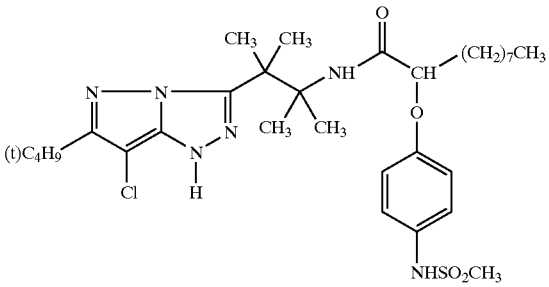
M-84
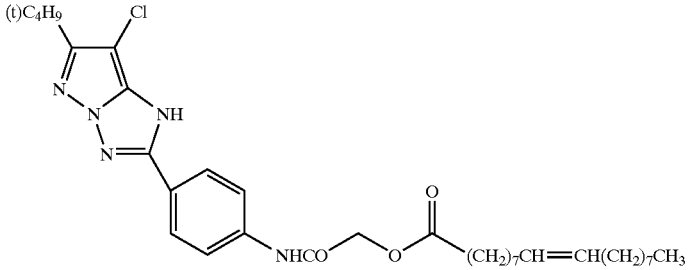

-continued
M-85
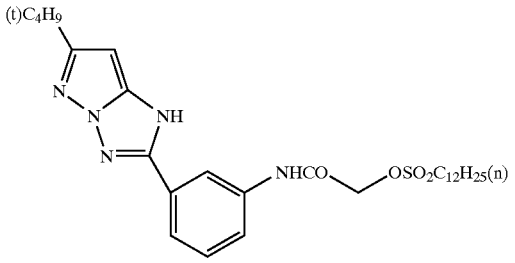
M-86
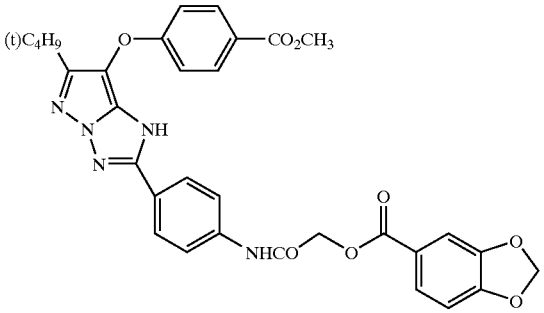
M-87
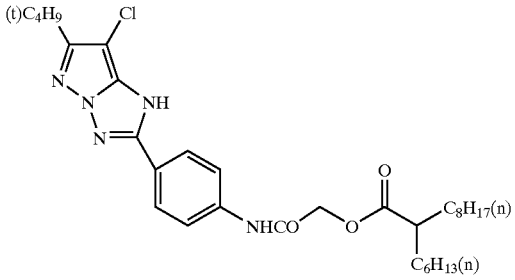
M-88
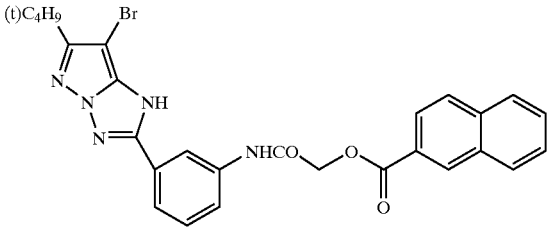
M-89
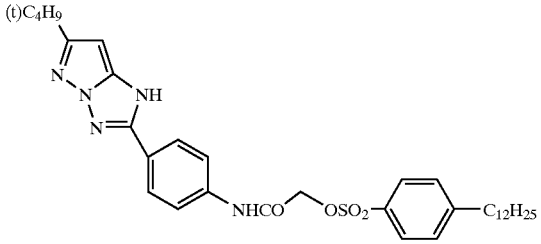
M-90
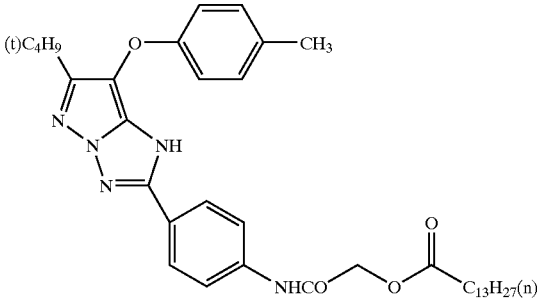
M-91
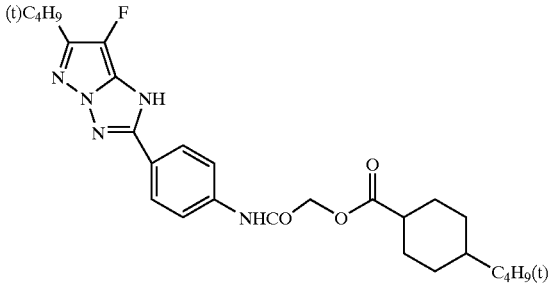
M-92
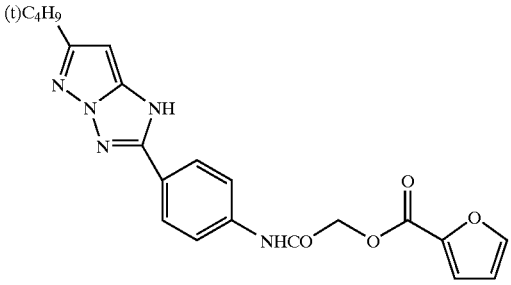
M-93
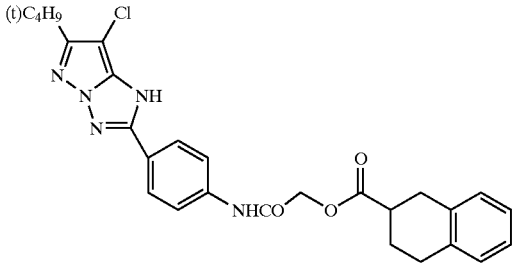
M-94
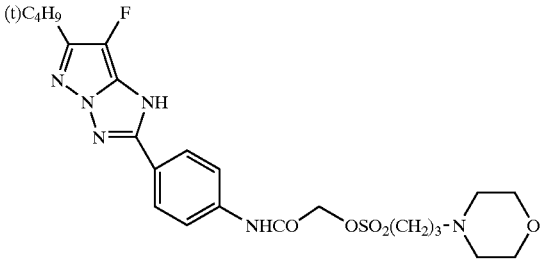

-continued
M-95
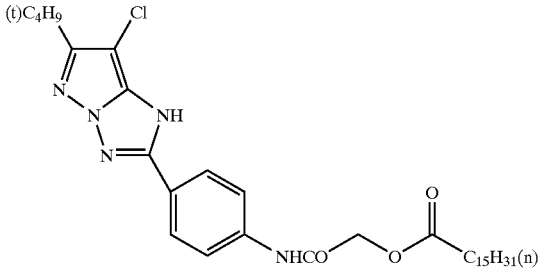
M-96
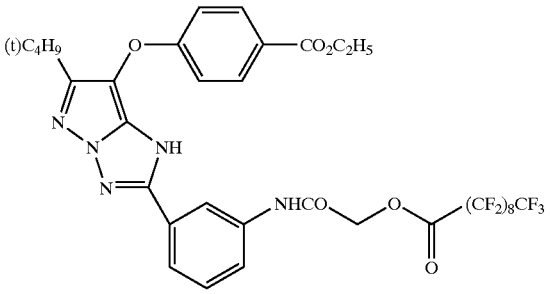
M-97
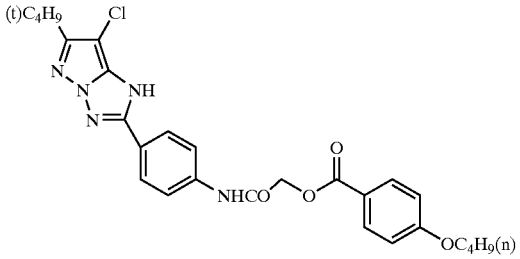
M-98
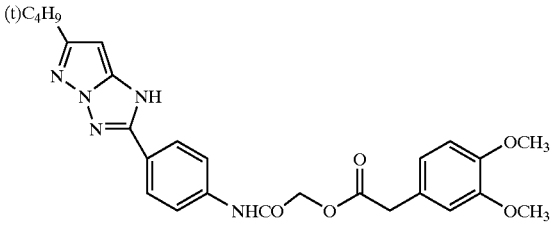
M-99
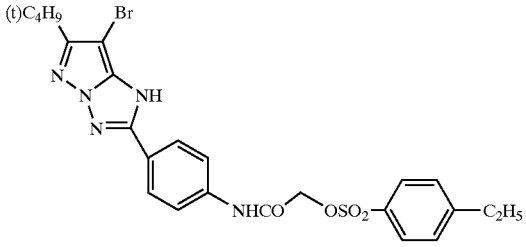
M-100
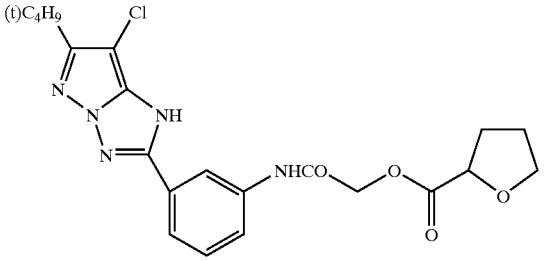
M-101
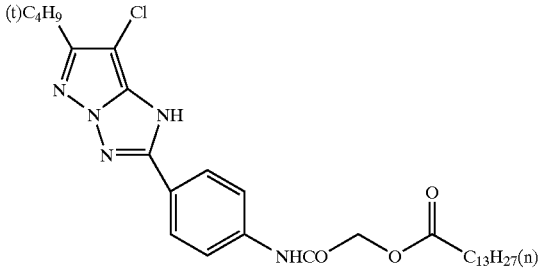
M-102
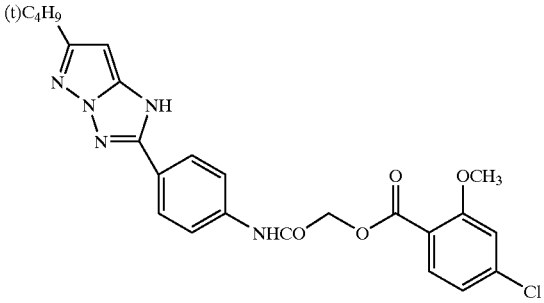
M-103
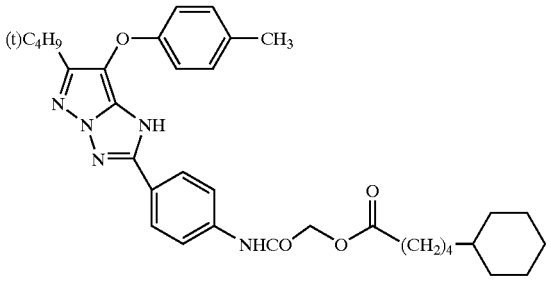
M-104
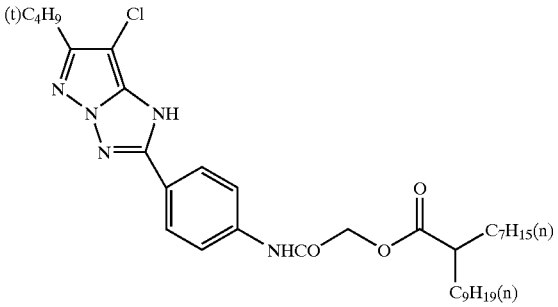

-continued
M-105
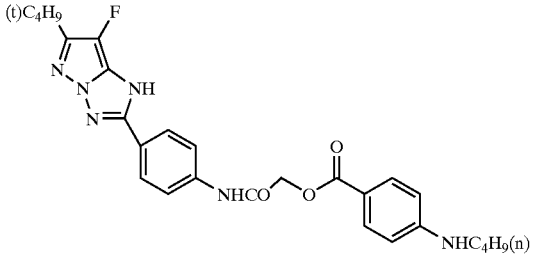
M-106
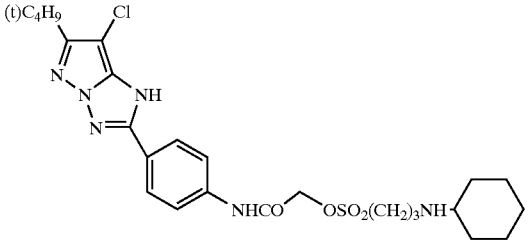
M-107
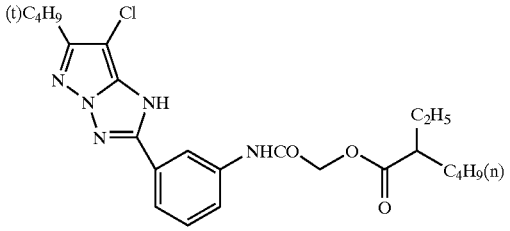
M-108
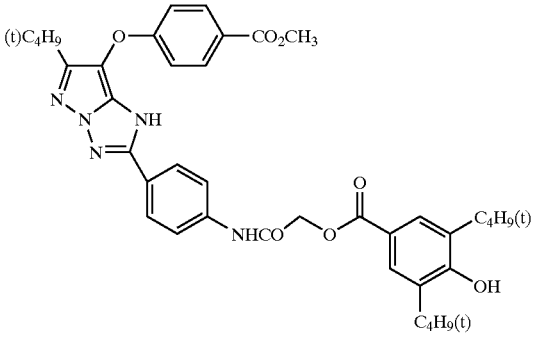
M-109
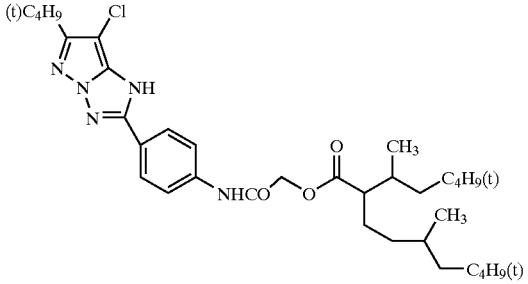
M-110
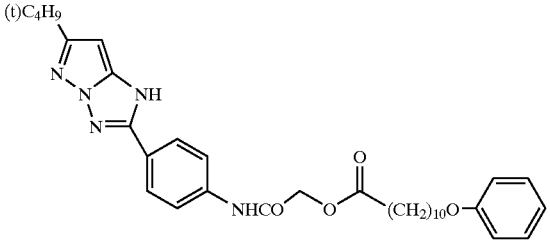
M-111
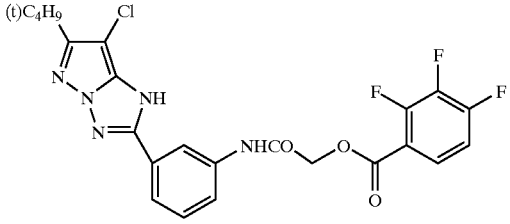
M-112
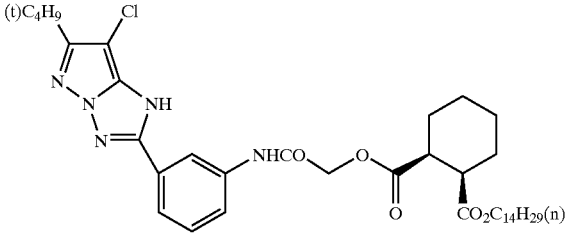
M-113
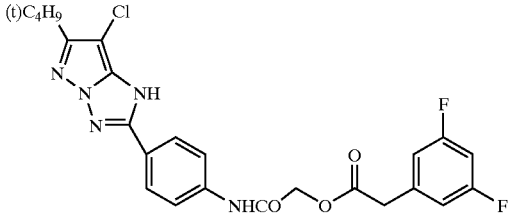
M-114
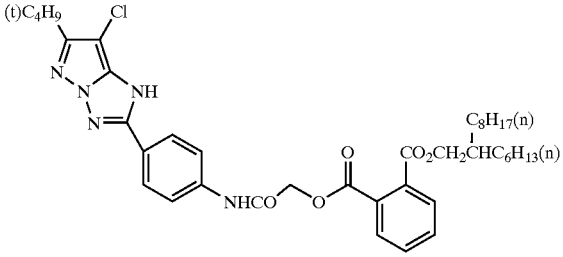

-continued
M-115
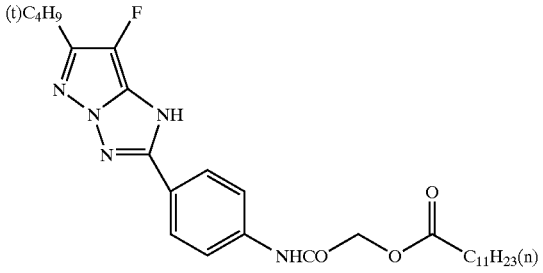
M-116
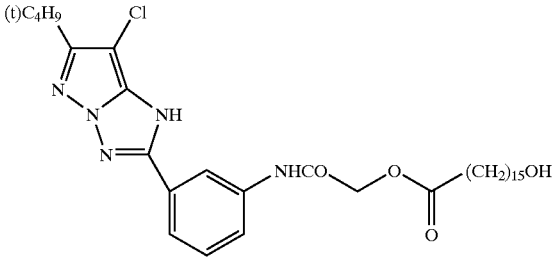
M-117
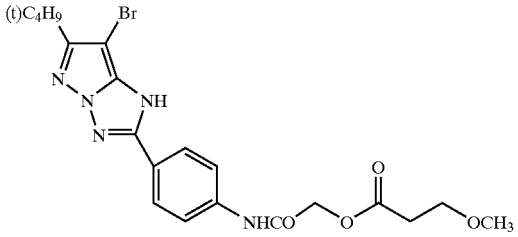
M-118
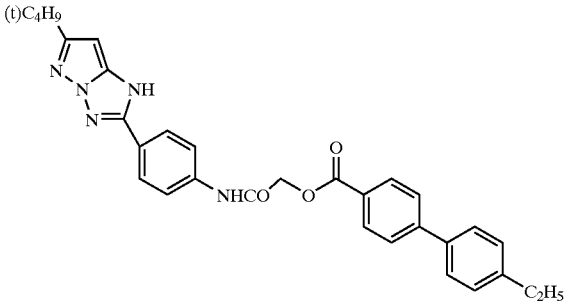
M-119
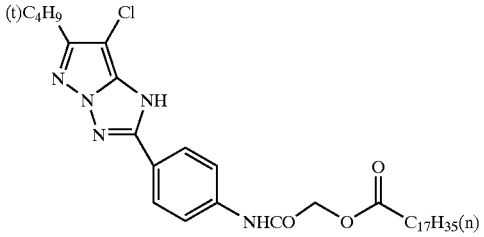
M-120
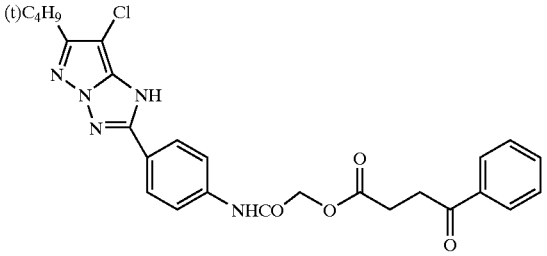
M-121
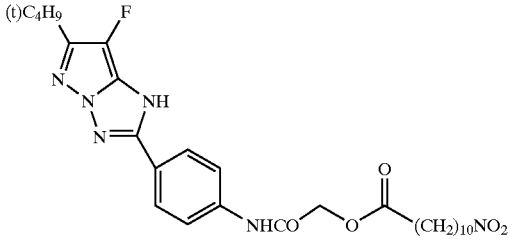
M-122
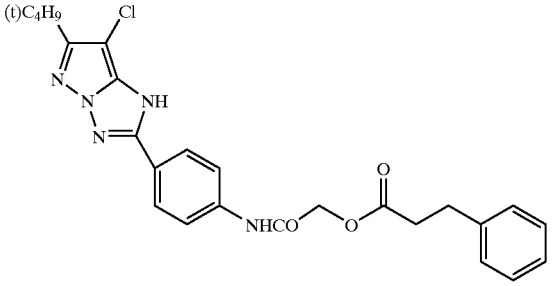
M-123
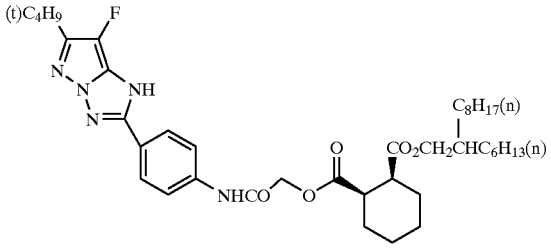
M-124
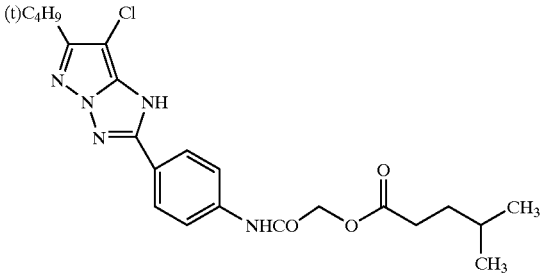

-continued

M-125

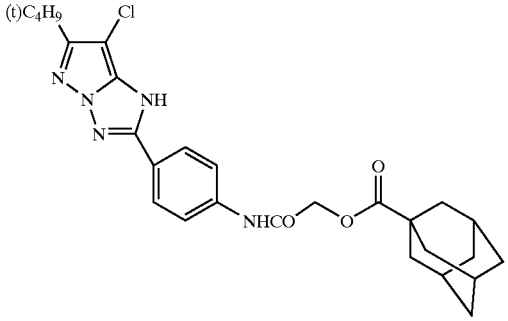

M-126

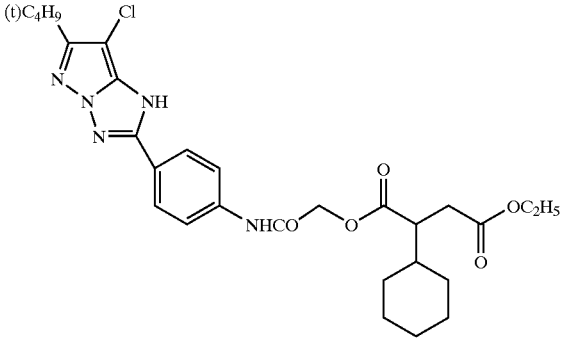

M-127

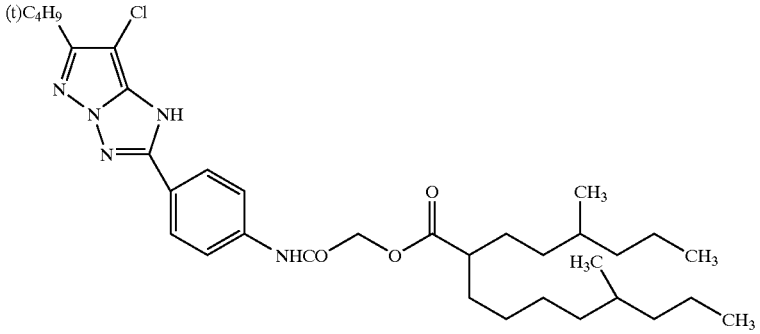

M-128

M-129

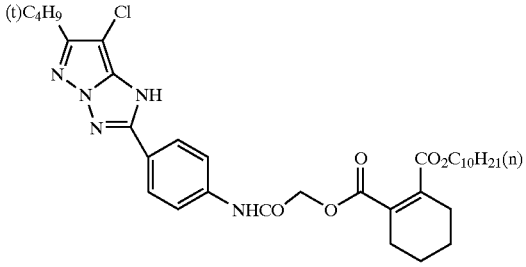

M-130

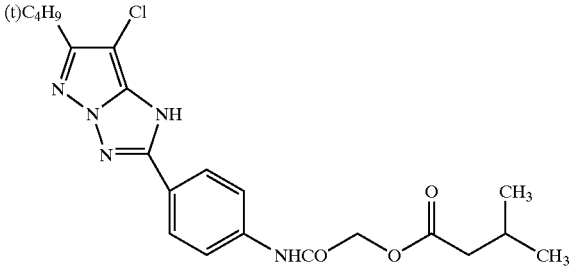

M-131

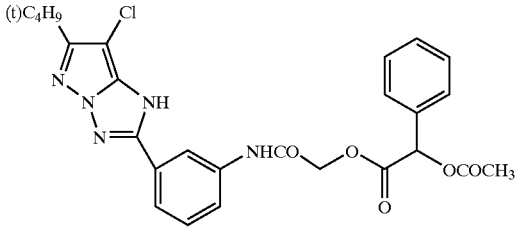

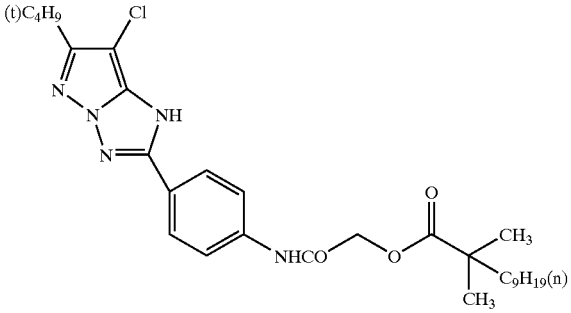

<Method for Dispersing Coupler>

In the invention, known dispersing methods, such as a oil-in-water droplet dispersion method using a high boiling point organic solvent described later and a latex dispersion method, may be employed in order to introduce the coupler and other photographic useful compounds to a silver halide photosensitive material.

In the oil-in-water droplet dispersion method, the coupler and other photographic useful compounds are dissolved in a high boiling point solvent, and is dispersed and emulsified in a hydrophilic colloid, preferably a gelatin aqueous solution, along with a dispersing agent, such as a surface active agent, by using a known apparatus, such as an ultrasonic wave, a colloid mill, a homogenizer, a Manton Gorey and a high-speed dissolver. Examples of the high boiling point solvent used in the oil-in-water droplet dispersion method are disclosed in JP-A No. 5-313327, No. 5-323539, No. 5-323541, No. 6-258803, No. 8-262662 and U.S. Pat. No. 2,322,027.

Specific examples of the process of the latex dispersion method as one of the polymer dispersion methods, the effect and the latex for impregnation thereof are disclosed in U.S. Pat. No. 4,199,363, West German Patent (OLS) No. 2,541, 274, No. 2,541,230, JP-B No. 53-41091 and EP 029,104, and a dispersion method with a organic solvent soluble polymer is disclosed in International Patent Application WO88/00723 and JP-A No. 5-150420. Methacrylate series and acrylamide series polymers are preferred, and an acrylamide series polymer is particularly preferred from the standpoint of fastness of an image.

The oil-in-water droplet dispersion method is preferred in that the coupler of the invention is dissolved in the high boiling point organic solvent (in combination, depending on necessity, with a low boiling point organic solvent), and then dispersed and emulsified in a gelatin aqueous solution, followed by adding to a silver halide emulsion.

The term high boiling point herein means a boiling point of 175° C. or more under ordinary pressure.

Examples of the high boiling point solvent used in the invention include a phthalate (such as dibutyl phthalate, dichlorohexyl phthalate, di-2-ethylhexyl phthalate, decyl phthalate, bis(2,4-di-tert-amylphenyl) phthalate, bis(2,4-di-tert-amylphenyl) isophthalate and bis(1,1-diethylpropyl) phthalate), esters of phosphoric acid and phosphonic acid (such as triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate and di-2-ethylhexylphenyl phosphonate), a benzoate (such as 2-ethylhexyl benzoate, dodecyl benzoate and 2-ethylhexyl p-hydroxybenzoate), an amide (such as N,N-diethyldodecaneamide, N,N-diethyllaurylamide and N-tetradecylpyrrolidone), a sulfonamide (such as N-butylbenzenesulfonamide), an alcohol and a phenol (such as isostearyl alcohol and 2,4-di-tert-amylphenol), an aliphatic carboxylate (such as bis(2-ethylhexyl) sebacate, dioctyl azelate, glycerol tributyrate, isostearyl lactate and trioctyl citrate), an aniline derivative (such as N,N-dibutyl-2-butoxy-5-tert-octylaniline), a hydrocarbon (such as paraffin, dodecylbenzene and diisopropylnaphthalene), and chlorinated parafin. The hydrogen donating compounds disclosed in JP-A No. 6-258803 and No. 8-262662 can be preferably used for adjusting hue. In order to reduce the load on the environments compounds disclosed in EP 969,320A1 and EP 969,321A1 are preferably used instead of phthalates, and other examples include tributyl citrate and pentaglycerin triester.

An auxiliary solvent may be used upon dissolving the coupler and the photographic useful compounds. The auxiliary solvent herein means an organic solvent effective on the emulsification dispersion and is to be substantially removed from the photosensitive material after the drying step on coating. Examples thereof include an acetate of a lower alcohol, such as ethyl acetate and butyl acetate, ethyl propyonate, sec-butyl alcohol, methyl ethyl ketone, methyl isobutyl ketone, β-ethoxyethyl acetate, methylcellosolve acetate, methylcarbitol acetate, methylcarbitol propionate and cyclohexanone.

Furthermore, an organic solvent that is completely miscible with water, such as methyl alcohol, ethyl alcohol, acetone, tetrahydrofuran and dimethylformamide, may be partially used in combination. These organic solvents may be used in combination of two or more kinds thereof.

From the standpoint of improvement of the long-term stability upon storage in the form of an emulsion dispersion product, and from the standpoint of suppression of fluctuation and long-term stability of the photographic performance in the final coating composition after mixing an emulsion, the entire or a part of the auxiliary solvent can be removed from the emulsion dispersion by such a method as distillation under reduced pressure, noodle water washing and ultra filtration.

The oleophilic fine particle dispersion thus obtained preferably has an average particle size of from 0.04 to 0.50 μm, more preferably from 0.05 to 0.30 μm, and most preferably from 0.08 to 0.20 μm. The average particle size can be measured, for example, by using Coulter submicron particle analyzer MODEL N4 (Coulter Electronics, Inc.). When the average particle size of the oleophilic fine particle dispersion is too large, such problems are liable to occur that the coloring efficiency of the coupler is lowered, and the glossiness on the surface of the photosensitive material is deteriorated. When the size is too small, the viscosity of the dispersion is increased, whereby it is difficult to handle upon production thereof.

From the standpoint of quickening of water washing, the using amounts of the high boiling point organic solvent and the other photographic useful compounds are preferably as small as possible, and the total amount thereof in terms of weight ration to the coupler is preferably from 0.05 to 8.0, more preferably from 0.1 to 3.0, and most preferably from 0.1 to 2.5. It is also possible that completely no high boiling point organic solvent is used by using a coupler having high activity.

The dielectric constant of the high boiling point organic solvent is preferably from 2.0 to 7.0, and more preferably from 3.0 to 6.0, while it depends on purpose.

In the invention, the using amount of the oleophilic fine particle dispersion containing the coupler with respect to the dispersion medium is preferably from 2 to 0.1, and more preferably from 1.0 to 0.2, by weight ratio per 1 of the dispersion medium. The dispersion medium is typically gelatin, and a hydrophilic polymer, such as polyvinyl alcohol, can also be exemplified. The oleophilic fine particle dispersion may contain various kinds of compounds depending on purpose in addition to the coupler of the invention.

<Silver Halide Color Photographic Photosensitive Material>

As the silver halide color photographic photosensitive material of the invention, such a silver halide color photographic photosensitive material is preferably used that comprises a support having thereon at least one silver halide emulsion layer containing a yellow dye-forming coupler, at least one silver halide emulsion layer containing a magenta dye-forming coupler, and at least one silver halide emulsion layer containing a cyan dye-forming coupler.

In the invention, the silver halide emulsion layer containing a yellow dye-forming coupler functions as a yellow-coloring layer, the silver halide emulsion layer containing a magenta dye-forming coupler functions as a magenta-coloring layer, and the silver halide emulsion layer containing a cyan dye-forming coupler functions as a cyan-coloring layer. The silver halide emulsions contained in the yellow-coloring layer, the magenta-coloring layer and the cyan-coloring layer preferably have photosensitivity to light of wavelength bands that are different from each other (for example, the blue band, the green band and the red band).

The photosensitive material of the invention may further have, depending on necessity, a hydrophilic colloid layer, an antihalation layer, an intermediate layer and a coloring layer described later, in addition to the yellow-coloring layer, the magenta-coloring layer and the cyan-coloring layer.

An example of a silver halide photosensitive material that can be preferably used in the invention will be described in detail below.

Silver Halide Emulsion

Silver halide particles in the silver halide emulsion used in the invention are preferably cubic particles, tetradecahedral crystalline particles (which may have roundness on the apexes of the particles to have higher order planes) or octahedral crystalline particles, which substantially have the {100} plane, or tabular particles having an aspect ratio of 2 or more, in which 50% or more of the projected area thereof is formed with the {100} plane or the {111} plane. The aspect ratio is a value obtained by dividing a diameter of a circle corresponding to the projected area by the thickness of the particles. In the invention, tabular particles having the {100} plane as the primary plane or tabular particles having the {111} plane as the primary plane are preferably used.

In the silver halide emulsions used in the invention, for example, silver chloride, silver bromide, silver iodidebromide and silver chloride(iodide)bromide emulsions are used. Silver chloride, silver chloridebromide, silver chlorideiodide and silver chloridebromideiodide emulsions having a silver chloride content of 90% by mole or more are preferred, and silver chloride, silver chloridebromide, silver chlorideiodide and silver chloridebromideiodide emulsions having a silver chloride content of 98% by mole or more are more preferred. Among the silver halide emulsions, such emulsions are preferred that from 0.01 to 0.50% by mole, more preferably from 0.05 to 0.40% by mole, of a silver iodidechloride phase based on the total silver is contained in the shell part of the silver halide particles, because high sensitivity can be obtained, and excellent exposure applicability to high illuminance can be obtained. Such emulsions are also preferred that from 0.2 to 5% by mole, more preferably from 0.5 to 3% by mole, of a silver bromide localized phase is contained in the surface of the silver halide particles, because high sensitivity is obtained, and the photographic performance is stabilized.

The emulsions used in the invention preferably contain silver iodide. In order to introduce an iodide ion, a solution of an iodide salt is solely added, or in alternative, an iodide salt solution is added along with the addition of a silver salt solution and a high chloride salt solution. In the later case, the iodide salt solution and the high chloride salt solution may be separately added, or in alternative, a mixed solution of an iodide salt and a high chloride salt may be added. The iodide salt is added in the form of a soluble salt, such as an alkali or alkaline earth iodide salt. In alternative, the iodide can be introduced through cleavage of an iodide ion from an organic molecule as disclosed in U.S. Pat. No. 5,389,508. Furthermore, minute silver iodide particles can be used as another iodide ion source.

The addition of the iodide salt solution may be carried out as concentrated within a short period upon particle formation or may also be carried out over a certain period. The introduced position of the iodide ion into the high chloride emulsion is restricted from the standpoint that an emulsion having high sensitivity and low fogging is to be obtained. When the iodide ion is introduced into the inner part of the emulsion particles, increase of the sensitivity is smaller. Therefore, the addition of the iodide salt solution is preferably effected to the 50% or outer part by volume of the particles, more preferably the 70% or outer part by volume of the particles, and most preferably the 80% or outer part by volume of the particles. The addition of the iodide salt solution is preferably completed until the 98% or inner part by volume of the particles, and more preferably completed until the 96% or inner part by volume of the particles. When the addition of the iodide salt solution is completed until the position slight inner from the surface, an emulsion having higher sensitivity and lower fogging can be obtained.

The distribution of the iodide ion concentration in the depth direction of the particles can be measured according to the etching/TOF-SIMS (time of flight-secondary ion mass spectrometry) by using, for example, TOF-SIMS Model TRIFT II, produced by PHI Evans, Inc. The TOF-SIMS method is specifically described in "Hyomen Gjutu Sensho—Niji Ion Shituryo Bunsekiho" (Surface Technology Sampler—Secondary Ion Mass Spectrometry), edited by The Surface Science Society of Japan (published by Maruzen Co., Ltd. 1999). Upon analyzing the emulsion particles by the etching/TOF-SIMS method, it is found that iodide ions ooze toward the surface of the particles even when the addition of the iodide salt solution is completed until the interior of the particles. In the case where the emulsions used in the invention contain silver iodide, it is preferred that the concentration of iodide ions exhibits maximum at the surface of the particles and is decreased toward the interior of the particles.

The emulsions in the photosensitive material of the invention preferably have a silver bromide localized phase.

In the case where the emulsions of the invention have a silver bromide localized phase, it is preferred that a silver bromide localized phase having a silver bromide content of at least 10% by mole is epitaxially grown on the surface of the particles. It is also preferred that an outermost shell part having a silver bromide content of 1% by mole or more is present in the vicinity of the surface.

The silver bromide content of the silver bromide localized phase is preferably in a range of from 1 to 80% by mole, and most preferably in a range of from 5 to 70% by mole. The silver bromide localized phase is preferably constituted with from 0.1 to 30% by mole, and more preferably from 0.3 to 20% by mole, of silver based on the total silver content constituting the silver halide particles in the invention. It is preferred that a VIII group metallic complex ion, such as an iridium ion, is contained in the silver bromide localized phase. The addition amount of the compounds vary over wide ranges and is preferably from $10^{-9}$ to $10–25^{-2}$ mole per 1 mole of the silver halide.

In the invention, on the course of forming and/or growing the silver halide particles, it is preferred that a metallic ion is embedded in the interior and/or the surface of the silver halide particles. Preferred examples of the metallic ion to be embedded include a transition metallic ion, and among these, iron, ruthenium, iridium, osmium, lead, cadmium and zinc are preferred. It is more preferred that the metallic ion forms a six-coordination octahedral complex with ligands. In the case where an inorganic compound is used as the ligand, a cyanide ion, a halogenide ion, thiocyan, a hydroxyl ion, a peroxide ion, an azide ion, a nitrite ion, water, ammonia, a nitrosyl ion or a thionitrosyl ion are preferably used, and they are preferably coordinated to the metallic ion of iron, ruthenium, iridium, osmium, lead, cadmium or zinc. It is also preferred that plural kinds of ligands are used in one complex molecule.

It is particularly preferred that the silver halide emulsions of the invention have an iridium ion having at least one organic ligand for the purpose of improvement of reciprocity failure on high illuminance. In the case where an organic compound is used as the ligand, preferred examples of the organic compound include a linear compound having a carbon number of the main chain of 5 or less and/or a 5-member or 6-member heterocyclic compound, which are also common to the other transition metals. More preferred examples of the organic compound include compounds having a nitrogen atom, a phosphorous atom, an oxygen atom or a sulfur atom as a coordinating atom to the metal, and most preferred examples thereof include furan, thiophene, oxazole, isoxazole, thiazole, isothiazole, imidazole, pyrazole, triazole, furazane, pyran, pyridine, pyridazine, pyrimidine and pyrazine. Compounds formed with the basic skeletons of these compounds having a substituent introduced thereto are also preferred.

Among these, as the ligand on an iridium ion, 5-methylthiazole among thiazole ligands is particularly preferably used.

Preferred examples of the combination of a metallic ion and a ligand include a combination of an iron ion or a ruthenium ion and a cyanide ion. In the compound, it is preferred that the cyanide ion occupies the majority of the coordination number on iron or ruthenium, and the balance of the coordination sites are occupied by thiocyan, ammonia, water, a nitrosyl ion, dimethylsulfoxide, pyridine, pyradine or 4,4-piperidine. It is most preferred that all the six coordination sites are occupied by cyanide ions to form a hexacyano iron complex or a hexacyano ruthenium complex. The complex having a cyanide ion as a ligand is preferably added during the formation of the particles in an amount of from $1\times10^{-8}$ to $1\times10^{-2}$ mole, and more preferably from $1\times10^{-6}$ to $5\times10^{-4}$ mole, per 1 mole of silver.

It is also preferred that, in addition to the organic ligand, a fluoride ion, a chloride ion, a bromide ion and an iodide ion, particularly a chloride ion and a bromide ion, are used for an iridium ion. Other examples of the iridium complex include, in addition to those having the organic ligand, $(IrCl_6)^{3-}$, $(IrCl_6)^{2-}$, $(IrCl_5(H_2O))^{2-}$, $(IrCl_5(H_2O))^{-}$, $(IrCl_4(H_2O)_2)^{-}$, $(IrCl_4(H_2O)_2)^{0}$, $(IrCl_3(H_2O)_3)^{0}$, $(IrCl_3(H_2O)_3)^{+}$, $(IrBr_6)^{3-}$, $(IrBr_6)^{2-}$, $(IrBr_5(H_2O))^{2}$—, $(IrBr_5(H_2O))^{-}$, $(IrBr_4(H_2O)_2)^{-}$, $(IrBr_4(H_2O)_2)^{0}$, $(IrBr_3(H_2O)_3)^{0}$ and $(IrBr_3(H_2O)_3)^{+}$. These iridium complexes are preferably added during the formation of particles in an amount of from $1\times10^{-10}$ to $1\times10^{-3}$ mole, and most preferably from $1\times10^{-8}$ to $1\times10^{-5}$ mole, per 1 mole of silver. In the case where ruthenium or osmium is used as the central metal, it is also preferred that a nitrosyl ion, a thionitrosyl ion or water and a chloride ion are used in combination as ligands. It is more preferred that a pentachloronitrosyl complex, a pentachlorothionitrosyl complex or a pentachloroaqua complex is formed, and it is also preferred that a hexachloro complex is formed. The complex is preferably added during the formation of particles in an amount of from $1\times10^{-10}$ to $1\times10^{-6}$ mole, and more preferably from $1\times10^{-9}$ to $1\times10^{-6}$ mole, per 1 mole of silver.

It is preferred that the complexes in the invention are embedded in the silver halide particles in such a method that they are directly added to the reaction solution upon formation of silver halide particles, or in such a method that they are added to a halogenize aqueous solution or other solutions for forming the silver halide particles, which are added to the particle formation reaction solution. It is also preferred that these methods are used in combination to add the complexes to the silver halide particles.

In the case where the complexes are embedded in the silver halide particles, it is preferred that they are uniformly present in the interior of the particles. It is also preferred that they are present only in a surface layer of the particles as disclosed in JP-A No.4-208936, No.2-125245 and No. 3-188437, and it is still preferred that the complexes are present only in the interior of the particles, and a layer containing no complex is added to the surface of the particles. As disclosed in U.S. Pat. Nos. 5,252,451 and 5,256,530, it is also preferred that physical aging is carried out with fine particles having the complex embedded in the interior thereof to modify the surface phase of the particles. Furthermore, these methods may be used in combination, and plural kinds of complexes are embedded in one silver halide particle. The halogen composition of the position where the complex is contained is not particularly limited, and it is preferred that the complex is contained in any of a silver chloride layer, a silver chloridebromide layer, a silver bromide layer, a silver iodidechloride layer and a silver iodidebromide layer.

The average particle size (i.e., a number average value of a particle sizes obtained as diameters of circles equivalent to the projected areas of the particles) of the silver halide particles contained in the silver halide emulsion used in the invention is preferably from 0.01 to 2 $\mu$m.

The variation coefficient of the particle size distribution (i.e., a value obtained by dividing the standard deviation of the particle size distribution by the average particle size) is generally 20% or less, preferably 15% or less, and more preferably 10% or less, i.e., so-called monodisperse particles are preferred. At this time, in order to provide a wide latitude, it is preferred that the monodisperse emulsions are mixed in one layer or are subjected to multilayer coating.

In the silver halide emulsions used in the invention, various kinds of compounds and precursors thereof may be added for such purposes that fogging during production process, storage or photographic process of the photosensitive material is prevented, and the photographic performance is stabilized. As specific examples of the compounds, those disclosed in JP-A No. 62-215272, p. 39 to 72, are preferably used. Furthermore, a 5-arylamino-1,2,3,4-thiatriazole compound (at least one electron attracting group is present in the aryl residual group) disclosed in EP 0,447,647 is also preferably used.

In order to improve storage property of the silver halide emulsions in the invention, the following compounds are also preferably used in the invention, i.e., a hydroxamic acid derivative disclosed in JP-A No. 11-109576, a cyclic ketone having a double bond adjacent to a carbonyl group, with both ends of the double bond being substituted with an amino group or a hydroxyl group disclosed in JP-A No. 11-327094 (particularly, the compound represented by (S1), and the paragraphs 0036 to 0071 thereof is incorporated herein by reference), a sulfo-substituted catechol or hydroquinone (such as 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid and 3,4,5-trihydroxybenzenesulfonic acid) disclosed in JP-A No. 11-143011, and water soluble reducing agents represented by the general formulae (I) to (III) disclosed in JP-A No. 11-102045.

Spectral Sensitization

Spectral sensitization is carried out to impart spectral sensitivity in a desired light wavelength band to an emulsion for the respective layers in the photosensitive material of the invention.

In the photosensitive material of the invention, examples of spectral sensitizing dyes used for spectral sensitization in blue, green and red bands include those disclosed in "Heterocyclic Compounds—Cyanine Dyes and Related Compounds" by F. M. Harmer (John Wiley & Sons (New York and London) 1964). As specific examples and the spectral sensitizing methods, those disclosed in JP-A No. 62-215272, right upper column of page 22 to page 38 are preferably used. As a red sensitive spectral sensitizing dye for silver halide emulsion particles having a high silver chloride content, spectral sensitizing dyes disclosed in JP-A No. 3-123340 are considerably preferred from the standpoints of stability, strength of adsorption and temperature dependency of exposure.

The addition amount of the spectral sensitizing dye varies in a wide range depending on cases. It is preferably from $0.5\times10^{-6}$ to $1.0\times10^{-2}$ mole, and more preferably from $1.0\times10^{-6}$ to $5.0\times10^{-3}$ mole, per 1 mole of silver halide.

Chemical Sensitization

The silver halide emulsions used in the invention are generally subjected to chemical sensitization. As the method for chemical sensitization, sulfur sensitization represented by the addition of an unstable sulfur compound, noble metal sensitization represented by gold sensitization, and reduction sensitization can be used solely or in combination thereof. Preferred examples of the compounds used for chemical sensitization include those disclosed in JP-A No. 62-215272, right lower column of page 18 to right upper column of page 22. Among these, those subjected to gold sensitization are preferred. By subjecting to gold sensitization, fluctuation in photographic performance upon scan-exposure with laser light can be further decreased.

In order to subject the silver halide emulsions used in the invention to gold sensitization, various kinds of in organic gold compounds, a gold(I) complex having an inorganic ligand and a gold(I) complex having an organic ligand can be utilized. Preferred examples of the inorganic gold compound include aurichloric acid and a salt thereof, preferred examples of the gold(I) complex having an inorganic ligand include a gold dithiocyanic acid compound, such as gold (I) potassium dithiocyanate, and a gold dithiosulfuric acid compound, such as gold(I) trisodium dithiosulfate.

Examples of the gold(1) complex having an organic ligand include a bis gold(I) mesoionic heterocyclic compound disclosed in JP-A No. 4-267249, such as gold(I) tetrafluoroborate bis(1,4,5-trimethyl-1,2,4-trizaorium-3-thiolate), an organic gold(I) mercapto complex disclosed in JP-A No. 11-218870, such as potassium bis(1-(3-(2-sulfonatebenzamide) phenyl)-5-mercaptotetrazole potassium salt) aurate(I) pentahydride, and a gold(I) compound having a nitrogen compound anion coordinated disclosed in JP-A No. 4-268550, such as bis(1-methylhydantoinate) gold (I) sodium salt tetrahydrate.

A gold(I) thiolate compound disclosed in U.S. Pat. No. 3,503,749, gold compounds disclosed in JP-A No. 8-69074, No. 8-69075 and No. 9-269554, and compounds disclosed in U.S. Pat. Nos. 5,620,841, 5,912,112, 5,620,841, 5,939,245 and 5,912,111 can also be used.

The addition amount of the compounds varies depending on cases and is generally from $5\times10^{-7}$ to $5\times10^{-3}$ mole, and preferably from $5\times10^{-6}$ to $5\times10^{-4}$ mole, per 1 mole of silver halide.

Colloidal gold sulfide may also be used, and the production process thereof is disclosed in "Research Disclosure" 37154, "Solid State Ionics", vol. 79, p. 60 to 66 (1995), and "Compt. Rend. Hebt. Seances Acad. Sci. Sect. B, vol. 263, p. 1328 (1966). The colloidal gold sulfide may have various sizes, and one having a particle diameter of 50 nm or less can also be used. The addition amount thereof varies depending on cases, and is generally from $5\times10^{-7}$ to $5\times10^{-3}$ mole, and preferably from $5\times10^{-6}$ to $5\times10^{-4}$ mole, in terms of gold atoms per 1 mole of silver halide.

In the invention, other sensitization methods than the gold sensitization, such as sulfur sensitization, selenium sensitization, tellurium sensitization, reduction sensitization and noble metal sensitization using other elements than gold can be used in combination.

Decolorizable Dye

In the photosensitive material of the invention, a decolorizable dye that can be decolorized by a treatment disclosed in EP 0,337,490A2, p. 27 to 76 (particularly an oxonol dye and a cyanine dye) is preferably contained in the hydrophilic colloid layers in order to prevent irradiation and halation and to improve safelight safety. Furthermore, dyes disclosed in EP 0,819,977 are also preferably added in the invention. There are some compounds among these water soluble dyes that deteriorate color separation or safelight safety when the using amount thereof is too large. As a dye that can be used without deterioration of color separation, water soluble dyes disclosed in JP-A No. 5-127324, No. 5-127325 and No. 5-216185 are preferred.

Decolorizable Colored Layer

In the invention, a decolorizable colored layer that can be decolorized by a treatment is used instead of the water soluble dye or in combination with the water soluble dye. The decolorizable colored layer that can be decolorized by a treatment may be directly in contact with the emulsion layer or may be arranged to be made in contact therewith through an intermediate layer containing a treatment color mixing prevention agent, such as gelatin and hydroquinone. The colored layer is preferably arranged as a lower layer (on the side of the support) of the emulsion layer that is colored to the same primary color as the color of the colored layer. The colored layer may be separately provided for each of the primary colors or may be provided for a part of the primary colors that are arbitrarily selected. A colored layer that is colored corresponding to plural primary color bands may be provided. The optical reflective density of the colored layer is preferably from 0.2 to 3.0 in terms of an optical density value at such a wavelength that provides the maximum optical density within the wavelength band used for exposure (e.g., a visible light band of from 400 to 700 nm in exposure in an ordinary printer, and in the case of scanning exposure, the wavelength of the light source used for the scanning exposure). It is more preferably from 0.5 to 2.5, and particularly preferably from 0.8 to 2.0.

In order to form the colored layer, known methods can be applied. Examples thereof include a method of adding a dye in a solid fine particle dispersion state to the hydrophilic colloid layer, for example dyes disclosed in JP-A No. 2-282244, right upper column of page 3 to page 8 and dyes disclosed in JP-A No. 3-7931, right upper column of page 3 to left lower column of page 11, a method of mordanting a cationic polymer with an anionic dye, a method of fixing a dye to a layer through adsorption on fine particles, such as silver halide, and a method of using colloidal silver disclosed in JP-A No. 1-239544. As a method for dispersing fine particles of a dye in a solid state, such a method is disclosed in JP-A No. 2-308244, p. 4 to 13 that a fine powder dye, which is substantially water insoluble at pH 6 or lower but is substantially water soluble at pH 8 or higher, is contained. Furthermore, for example, a method of mordanting a cationic polymer with an anionic dye is disclosed in JP-A No. 2-84637, p. 18 to 26. A preparation method of colloidal silver as a light absorbing agent is disclosed in U.S. Pat. Nos. 2,688,601 and 3,459,563. Among these methods, the method of containing a fine powder dye and the method of using colloidal silver are preferred.

Layer Structure

Color photographic printing paper as the photosensitive material of the invention preferably has at least one yellow-coloring silver halide emulsion layer, at least one magenta-coloring silver halide emulsion layer and at least one cyan-coloring silver halide emulsion layer, and in general, these silver halide emulsion layers are arranged in the order from the side near the support, the yellow-coloring silver halide emulsion layer, the magenta-coloring silver halide emulsion layer and the cyan-coloring silver halide emulsion layer.

However, layer structures other than the foregoing may be employed.

The silver halide emulsion layer containing a yellow coupler may be arranged in any position on the support, and in the case where the yellow coupler-containing layer contains silver halide tabular particles, it is preferably arranged at a position that is farther from the support than at least one layer of the magenta coupler-containing silver halide emulsion layer and the cyan coupler-containing silver halide emulsion layer. From the standpoints of acceleration of coloration development, acceleration of desilvering and reduction of remaining color due to a sensitizing dye, it is preferred that the yellow coupler-containing silver halide emulsion layer is arranged at the farthest position from the support among the other silver halide emulsion layers. Furthermore, from the standpoint of blix discoloration, the cyan coupler-containing silver halide emulsion layer is positioned as a center layer of the other silver halide emulsion layers, and from the standpoint of color degradation due to light, the cyan coupler-containing silver halide emulsion layer is preferably the lowermost layer. The coloring layers of yellow, magenta and cyan each may be formed from two or three layers. For example, as disclosed in JP-A No. 4-75055, No. 9-114035, No. 10-246940 and U.S. Pat. No. 5,576,159, it is preferred that a coupler layer containing no silver halide is provided adjacent to the silver halide emulsion layer to make a coloring layer.

Processing Method and Additives for Processing

As the silver halide emulsions and other materials (such as additives), the photographic constitutional layers (such as layer arrangement), and the processing methods and the additives for processing applied to process the photosensitive material, those disclosed in JP-A No. 62-215272, No. 2-33144 and EP 0,355,660A2 are preferably used, and those disclosed in EP 0,355,660A2 are particularly preferably used. Furthermore, silver halide color photographic photosensitive materials and processing methods therefor disclosed in JP-A No. 5-34889, No. 4-359249, No. 4-313753, No. 4-270344, No. 5-66527, No. 4-34548, No. 4-145433, No. 2-854, No. 1-158431, No. 2-90145, No. 3-194539, No. 2-93641 and EP 0.520,457A2 are also preferred.

In the invention, with respect to the reflective support, the silver halide emulsion, the heterogeneous metallic ion species doped in the silver halide particles, the storage stabilizer of the silver halide emulsion, the fog preventing agent, the chemical sensitizing method (sensitizer), the spectral sensitizing method (spectral sensitizer), the cyan, magenta and yellow couplers and the emulsion dispersion method therefor, the color image storage property improving agent (such as a stain preventing agent and a discoloration preventing agent), the dye (colored layer), the gelatin species, the layer structure of the photosensitive material, and the pH of the films of the photosensitive material, those disclosed in the parts shown in Table 1 below are particularly preferred.

TABLE 1

| Item | JP-A No. 7-104448 | JP-A No. 7-77775 | JP-A No. 7-301859 |
|---|---|---|---|
| Reflective support | col. 7, 1, 12 to col. 12, 1.19 | col. 35, 1.43 to col. 44, 1.1 | col. 5, 1.40 to col. 9, 1.26 |
| Silver halide emulsion | col. 72, 1.29 to col. 74, 1.18 | col. 44, 1.36 to col. 46, 1.29 | col. 77, 1.48 to col. 80, 1.28 |
| Heterogeneous metallic ion | col. 74, 1.19 to ditto, 1.44 | col. 46, 1.30 to col. 47, 1.5 | col. 80, 1.29 to col. 81, 1.6 |
| Storage property improving agent and fog preventing agent | col. 75, 1.9 to ditto, 1.18 | col. 47, 1.20 to ditto, 1.29 | col. 18, 1.11 to col. 31, 1.37 (particularly, mercaptoheterocyclic compound) |
| Chemical sensitizing method (chemical sensitizer) | col. 74, 1.45 to col. 75, 1.6 | col. 47, 1.7 to ditto, 1.17 | col. 81, 1.9 to ditto, 1.17 |
| Spectral sensitizing method (spectral sensitizer) | col. 75, 1.19 to col. 76, 1.45 | col. 47, 1.30 to col. 49, 1.6 | col. 81, 1.21 to col. 82, 1.48 |
| Cyan coupler | col. 12, 1.20 to col. 39, 1.49 | col. 62, 1.50 to col. 63, 1.16 | col. 88, 1.49 to col. 89, 1.16 |
| Yellow coupler | col. 87, 1.40 to col. 88, 1.3 | col. 63, 1.17 to ditto, 1.30 | col. 89, 1.17 to ditto, 1.30 |
| Magenta coupler | col. 88, 1, 4 to ditto, 1.18 | col. 63, 1.3 to col. 64, 1.11 | col., 31, 1.34 to col. 77, 1.44 and col. 88, 1.32 to ditto, 1.46 |
| Emulsion dispersion method of coupler | col. 71, 1.3 to col. 72, 1.11 | col. 61, 1.36 to ditto, 1.49 | col. 87, 1.35 to ditto, 1.48 |
| Color image storage property improving agent (stain preventing agent) | col. 39, 1.50 to col. 70, 1.9 | col. 61, 1.50 to col. 62, 1.49 | col. 87, 1.49 to col. 88, 1.48 |
| Discoloration preventing agent | col. 70, 1.10 to col. 71, 1.2 | | |
| Dye (coloring agent) | col. 77, 1.42 to col. 78, 1.41 | col. 7, 1.14 to col. 19, 1.42 and col. 50, 1.3 to col. 51, 1.14 | col. 9, 1.27 to col. 18, 1.10 |
| Gelatin species | col. 78, 1.42 to ditto, 1.48 | col. 51, 1.15 to ditto, 1.20 | col. 83, 1.13 to ditto, 1.19 |
| Layer structure of photosensitive material | col. 39, 1.11 to ditto, 1.26 | col. 44, 1.2 to ditto, 1.35 | col. 31, 1.38 to col. 32, 1.33 |
| pH of films of photosensitive material | col. 72, 1.12 to ditto, 1.28 | | |

TABLE 1-continued

| Item | JP-A No. 7-104448 | JP-A No. 7-77775 | JP-A No. 7-301859 |
|---|---|---|---|
| Scanning exposure | col. 76, 1.6 to col. 77, 1.41 | col. 49, 1.7 to col. 50, 1.2 | col. 82, 1, 49 to col. 83, 1.12 |
| Preservative in developer solution | col. 88, 1.19 to col. 89, 1.22 | | |

Coupler

In addition to the foregoing, couplers disclosed in JP-A No. 62-215272, line 4 of right upper column of page 91 to line 6 of left upper column of page 121, No. 2-33144, line 14 of right upper column of page 3 to the last line of left upper column of page 18 and line 6 of right upper column of page 30 to line 11 of right lower column of page 35, and EP 0,355,660A2, p. 4,1. 15 to 27, p. 5,1.30 to p. 28, last line, p. 45,1.29 to 31, and p. 47, 1. 23 to p. 63, 1. 50 are also useful as the cyan, magenta and yellow couplers used in the invention.

Furthermore, compounds represented by the general formulae (II) and (III) in WO 98/33760 and the general formula (D) in JP-A No. 10-221825 may be preferably added in the invention.

As the cyan dye-forming coupler (sometimes simply referred to as a "cyan coupler") that can be used in the invention, a pyrrolotriazole series coupler is preferably used, and couplers represented by the general formulae (I) and (II) in JP-A No. 5-313324, couplers represented by the general formula (I) in JP-A No. 6-347960 and example couplers disclosed in these literatures are particularly preferred. Phenol series and naphthol series cyan couplers are also preferred, and for example, a cyan coupler represented by the general formula (ADF) in JP-A No. 10-333297 is preferred. Other examples of the cyan coupler include a pyrroloazole type cyan coupler disclosed in EP 0,488,248 and EP 0,491,197A1, a 2,5-diacylaminophenol coupler disclosed in U.S. Pat. No. 5,888,716, and a pyrazoloazole type cyan coupler having an electron attracting group or a hydrogen bond group at the 6-position disclosed in U.S. Pat. Nos. 4,873,183 and 4,916,051, and in particular, a pyrazoloazole type cyan coupler having a carbamoyl group at the 6-position disclosed in JP-A No. 8-171185, No. 8-311360 and No. 8-339060 is also preferred.

In addition to a diphenylimidazole series cyan coupler disclosed in JP-A No. 2-33144, a 3-hydroxypyridine series cyan coupler disclosed in EP 0,333,185A2 (particularly, a coupler obtained by attaching a chlorine releasing group to a tetravalent coupler of Coupler (42) as enumerated as specific examples to make a divalent coupler, and Couplers (6) and (9) are preferred), a cyclic active methylene series cyan coupler disclosed in JP-A 64-32260 (particularly, example couplers 3, 8 and 34 enumerated as specific examples are preferred), a pyrrolopyrazole type cyan coupler disclosed in EP 0,456,226A1, and a pyrroloimidazole type cyan coupler disclosed in EP 0,484,909 can also be used.

Among these couplers, a pyrroloazole series cyan coupler represented by the general formula (1) in JP-A No. 11-282138 is particularly preferred, and example cyan couplers (1) to (47) disclosed in paragraphs 0012 to 0059 of the literature can be applied to the invention as they are, which are incorporated herein by reference.

As the magenta dye-forming coupler (sometimes simply referred to as a "magenta coupler") used in the invention, the 5-pyrazolone series magenta couplers and the pyrazoloazole series magenta couplers as disclosed in the known literatures shown in Table 1 can be used, and among these, from the standpoint of hue, image stability and coloring property, a pyrazoloazole coupler having a secondary or tertiary alkyl group directly bonded to the 2-, 3- or 6-position of the pyrazolotriazole ring disclosed in JP-A No. 61-65245, a pyrazoloazole coupler containing a sulfonamide group in the molecule disclosed in JP-A No. 61-65246, a pyrazoloazole coupler having an alkoxyphenylsulfoneamide ballast group disclosed in JP-A No. 61-147254, and a pyrazoloazole coupler having an alkoxy group or an aryloxy group at the 6-position disclosed in EP 226,849A and EP 294,785A are preferably used. In particular, a pyrazoloazole coupler represented by the general formula (M-1) disclosed in JP-A No. 8-122984 is preferred as the magenta coupler, and paragraphs 0009 to 0026 of that literature is incorporated herein by reference. In addition to the foregoing, a pyrazoloazole coupler having steric hindrance groups at both the 3- and 6-positions disclosed in EP 854,384 and EP 884,640 is also preferably used. In particular, magenta couplers represented by the general formulae (M-1) and (M-2) are preferably used.

As the yellow dye-forming coupler (sometimes simply referred to as a "yellow coupler"), in addition to the compounds disclosed in Table 1, an acylacetamide type yellow coupler having a 3- to 5-member cyclic structure on the acyl group disclosed in EP 0,447,969A1, a malondianilide type yellow coupler having a cyclic structure disclosed in EP 0,482,552A1, a pyrrol-2 or 3-yl or indol-2 or 3-yl carbonyl acetic acid anilide series coupler disclosed in EP 953,870A1, EP 953,871A1, EP 953,872A1, EP 953,863A1, EP 953,874A1 and EP 953,875A1, and an acylacetamide type yellow coupler having a dioxane structure disclosed in U.S. Pat. No. 5,118,599 are preferably used. Among these, an acylacetamide type yellow coupler, in which the acyl group is a 1-alkylcyclopropane-1-carbonyl group, and a malondianilide type yellow coupler, in which one of anilide forms an indoline ring, are particularly preferably used. These couplers may be used singly or in combination thereof.

It is preferred that the couplers used in the invention are impregnated in a loadable latex polymer (disclosed, for example, in U.S. Pat. No. 4,203,716) in the presence (or absence) of a high boiling point organic solvent disclosed in Table 1, and dissolved along with a water insoluble and organic solvent soluble polymer, followed by dispersing and emulsifying in the hydrophilic colloid aqueous solution. Preferred examples of the water insoluble and organic solvent soluble polymer include homopolymers and copolymers disclosed in U.S. Pat. No. 4,857,449, columns 7 to 15 and WO 88/00723, p. 12 to 30. Methacrylate series or acrylamide series polymers are preferably used, and particularly an acrylamide polymer is further preferably used, from the standpoint of color image stability.

Other Components

In the invention, known color mixing prevention agents can be used, and among these, those disclosed in the following literatures are preferred.

For example, a high molecular weight redox compound disclosed in JP-A No. 5-333501, a phenidone or hydrazine series compound disclosed in WO 98/33760 and U.S. Pat. No. 4,923,787, and a white coupler disclosed in JP-A No. 5-249637, No. 10-282615 and German Patent No. 19,629,142A1 can be used. In the case where the pH of the developer solution is increased to quicken the development, redox compounds disclosed in German Patent No. 19,618,786A1, EP 839,623A1, EP 842,975A1, German Patent No. 19,806,846 and French Patent No. 2,760,460A1 are also preferably used.

In the invention, a compound having a triazine skeleton having a high molar extinction coefficient is preferably used as an ultraviolet ray absobent, and for example, those compounds disclosed in the following literatures can be used. The compounds are preferably added to the photosensitive layer and/or the non-photosensitive layer. For example, compounds disclosed in JP-A No. 46-3335, No. 55-152776, No. 5-197074, No. 5-232630, No. 5-307232, No. 6-211813, No. 8-53427, No. 8-234364, No. 8-239368, No. 9-31067, No. 10-115898, No. 10-147577, No. 10-182621, German Patent No. 19,739,797A1, EP 711,804A and JP-W No. 501291 can be used.

As the binder and the protective colloid that can be used in the photosensitive material of the invention, gelatin is advantageously used, and other hydrophilic colloids may be used singly or in combination with gelatin. Gelatin used herein preferably has a content of heavy metals, such as iron, copper, zinc and manganese, as impurities is 5 ppm or less, and more preferably 3 ppm or less. The amount of calcium contained in the photosensitive material is preferably 20 $mg/m^2$ or less, more preferably 10 $mg/m^2$ or less, and most preferably 5 $mg/m^2$ or less.

In the invention, in order to prevent fungus and bacteria that breed in the hydrophilic colloid layers to deteriorate an image, it is preferred to add an antibacterium and antifungus agent disclosed in JP-A No. 63-271247. Furthermore, the pH of the film of the photosensitive material is preferably from 4.0 to 7.0, and more preferably from 4.0 to 6.5.

In the invention, a surface active agent may be added to the photosensitive material from the standpoints of improvement of coating stability, prevention of generation of electrostatic charge and adjustment of charging amount of the photosensitive material. The surface active agent includes an anionic surface active agent, a cationic surface active agent, a betain surface active agent and nonionic surface active agent, and examples thereof include those disclosed in JP-A No. 5-333492. As the surface active agent used in the invention, a surface active agent containing a fluorine atom is preferred. In particular, a fluorine atom-containing surface active agent can be preferably used. The fluorine atom-containing surface active agent may be used singly or in combination with other conventional surface active agents, with the combination use of with the conventional surface active agent being preferred. The addition amount of the surface active agent is not particularly limited and is generally from $1\times10^{-5}$ to 1 $g/m^2$, preferably from $1\times10^{-4}$ to $1\times10^{-1}$ $g/m^2$, and more preferably from $1\times10^{-3}$ to $1\times10^{-2}$ $g/m^2$.

<<Second Embodiment and Fourteenth Embodiment>>

The second embodiment and the fourteenth embodiment of the silver halide photosensitive material of the invention will be described.

The second embodiment of the silver halide color photographic photosensitive material according to the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, and a reflective density A(λ) at a wavelength λ in an unexposed portion after a color development treatment is 0.08 or less at 450 nm, 0.10 or less at 550 nm and 0.08 or less at 650 nm, wherein at least one layer of the photosensitive silver halide emulsion layers and/or the non-photosensitive, non-coloring hydrophilic colloid layer contains at least one kind of high boiling point organic solvents represented by the following general formulae (A) to (F) (hereinafter sometimes referred to as a "particular high boiling point organic solvent"):

$$RaOOC(CH_2)_mCOORb \quad (A)$$

wherein Ra and Rb each independently represents a linear or branched alkyl group having from 4 to 10 carbon atoms, and m represents an integer of from 2 to 10, $$ReOOC(C_nH_{2n-2})COORd \quad (B)$$

wherein Rc and Rd each independently represents a linear or branched alkyl group having from 4 to 10 carbon atoms, and n represents an integer of from 2 to 10, $$ReCOO(CH_2)_pOCORf \quad (C)$$

wherein Re and Rf each independently represents a linear or branched alkyl group having from 3 to 24 carbon atoms, and p represents an integer of from 2 to 10, $$C(Rg)(Rh)(Ri)(OH) \quad (D)$$

wherein Rg represents an alkyl group or an alkenyl group, and Rh and Ri each independently represents a hydrogen atom or the groups represented by Rg, provided that a total carbon number of the groups represented by Rg, Rh and Ri is 10 or more, $$X—((CH_2)_q—O(CO)Rj)_r \quad (E)$$

wherein X represents a 5- to 7-member saturated hydrocarbon group, q represents an integer of from 0 to 2, r represents an integer of from 1 to 3, and Rj represents a linear or branched alkyl group having from 4 to 16 carbon atoms, and $$YO—C(COORk)(CH_2COORl)(CH_2COORm) \quad (F)$$

wherein Rk, Rl and Rm each independently represents an alkyl group, an alkenyl group or an aryl group, and Y represents a hydrogen atom or an acyl group.

In the second embodiment, the reflective density A(λ) at a wavelength λ in an unexposed portion after a color development treatment is preferably 0.07 or less at 450 nm, 0.09 or less at 550 nm and 0.07 or less at 650 nm, and more preferably 0.06 or less at 450 nm, 0.07 or less at 550 nm and 0.05 or less at 650 nm.

In the second embodiment, the density ratio of the reflective density A(λ) at a wavelength λ in an unexposed portion after a color development treatment preferably satisfies the following conditions (I) and (II):

$$1.0 \leq A(\mathbf{550})/A(\mathbf{450}) \leq 1.4 \quad (I)$$

$$0.6 \leq A(\mathbf{650})/A(\mathbf{450}) \leq 1.2 \quad (II)$$

The fourteenth embodiment of the silver halide color photographic photosensitive material according to the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, and a chromaticity of an unexposed portion after a color development treatment satisfies the following condition (A):

$$91 \leqq L^* \leqq 96,\ 0 \leqq a^* \leqq 2.0,\ -9.0 \leqq b^* \leqq -3.0 \quad (A)$$

wherein at least one layer of the photosensitive silver halide emulsion layers and/or the non-photosensitive, non-coloring hydrophilic colloid layer contains at least one kind of high boiling point organic solvents represented by the general formulae (A) to (F).

In the fourteenth embodiment, the chromaticity of the unexposed portion after a color development treatment preferably satisfies the following condition (B), and more preferably satisfies the following condition (C):

$$91 \leqq L^* \leqq 96,\ 0.3 \leqq a^* \leqq 1.6,\ -8.0 \leqq b^* \leqq -4.8 \quad (B)$$

$$93 \leqq L^* \leqq 96,\ 0.3 \leqq a^* \leqq 1.6,\ -8.0 \leqq b^* \leqq -4.8 \quad (C)$$

In the second and fourteenth embodiments, it is preferred that at least one layer constituting the photosensitive material contains a pigment, and it is more preferred that the pigment is at least one kind selected from the group consisting of an indanthrone pigment, an indigo pigment, a triarylcarbonium pigment, an azo pigment, a quinacridone pigment, a dioxadine pigment and a diketopyrrolopyrrole pigment.

In the second and fourteenth embodiments, it is preferred that the photosensitive material has a color mixing prevention layer as the hydrophilic colloid layer, and the layer contains at least one kind of the high boiling point organic solvents represented by the general formulae (A) to (F).

<Chromaticity of Unexposed Portion>

In the fourteenth embodiment of the invention, the chromaticity of an unexposed portion (white background) after the color development treatment preferably satisfies the following conditions in the CIE 1976 L*a*b* color space (hereinafter sometimes abbreviated as CIELAB color space).

That is, L* is preferably from 91 to 96, more preferably from 92 to 96, and most preferably from 93 to 96. a* is preferably from 0 to 2.0, more preferably from 0.3 to 1.6, and further preferably from 0.5 to 1.3. b* is preferably from −9.0 to −3.0, more preferably from −8.0 to −4.8, and further preferably from −8.0 to −4.0.

Therefore, in the silver halide color photographic photosensitive material of the invention, the chromaticity of the unexposed portion (white background) after the color development treatment preferably satisfies the condition (A), more preferably satisfies the condition (B), and further preferably satisfies the condition (C).

$$91 \leqq L^* \leqq 96,\ 0 \leqq a^* \leqq 2.0,\ -9.0 \leqq b^* \leqq 3.0 \quad (A)$$

$$91 \leqq L^* \leqq 96,\ 0.3 \leqq a^* \leqq 1.6,\ -8.0 \leqq b^* \leqq -4.8 \quad (B)$$

$$93 \leqq L^* \leqq 96,\ 0.3 \leqq a^* \leqq 1.6,\ -8.0 \leqq b^* \leqq -4.8 \quad (C)$$

The details of the CIE 1976 L*a*b* color space are the same as the description for the first and thirteenth embodiments.

<Reflective Density A(λ)>

In the second embodiment of the invention, the reflective density A(λ) at a wavelength λ in an unexposed portion after the color development treatment preferably satisfies the following conditions. That is, the reflective density A at 450 nm (hereinafter abbreviated as A(450)) is preferably 0.08 or less, more preferably 0.07 or less, and most preferably 0.06 or less. The reflective density A at 550 nm (hereinafter abbreviated as A(550)) is preferably 0. 10 or less, more preferably 0.09 or less, and most preferably 0.07 or less. The reflective density A at 650 nm (hereinafter abbreviated as A(650)) is preferably 0.08 or less, more preferably 0.07 or less, and most preferably 0.05 or less. The value A(λ) is preferably as small as possible, and in the case where a paper support coated with a polyethylene resin containing a white pigment is used, the values A(450), A(550) and A(650) are substantially 0.01 or more.

Furthermore, there are preferred conditions for the density ratio because the tendency on sensuous "white" taking human preference into account varies depending on color balance. That is, it is preferred that 1.0≦A(550)/A(450)≦1.4 and 0.6≦A(650)/A(450)≦1.2, it is more preferred that 1.1≦A(550)/A(450)≦1.3 and 0.6≦A(650)/A(450)≦1.2, and it is further preferred that 1.1≦A(550)/A(450)≦1.2 and 0.8≦A(650)/A(450)≦1.1.

The definition of the reflective density A(λ) at a wavelength λ and the method for adjusting the white background to the preferred ranges are the same as those in the first and thirteenth embodiments.

<Reflective Support>

A reflective support that can be preferably used in the second and fourteenth embodiments is the same as the reflective support that can be preferably used in the first and thirteenth embodiments.

<Pigment>

A pigment that can be preferably used for coloring the hydrophilic colloid layers of the photographic constitutional layers in the second and fourteenth embodiments is the same as the pigment that can be preferably used in the first and thirteenth embodiments.

In the second and fourteenth embodiments of the invention, it is also preferred that an oil soluble dye is used in the photographic constitutional layers of the photosensitive material to adjust the white background. Specific examples of the oil soluble dye include Compounds Nos. 1 to 27 disclosed in JP-A No. 2-842, p. (8) and (9).

In the second and fourteenth embodiments of the invention, it is also possible that a fluorescent whitening agent is added to the photographic constitutional layers of the photosensitive material, whereby the fluorescent whitening agent remain in the photosensitive material after processing, so as to adjust the white background. It is also possible that a polymer, such as polyvinylpyrrolidone, capable of catching a fluorescent whitening agent is added to the photosensitive material.

<High Boiling Point Organic Solvent>

The particular high boiling point organic solvent used in the second and fourteenth embodiments of the invention will be described in detail below.

In the second and fourteenth embodiments of the invention, at least one kind of the high boiling point organic solvents represented by the following general formulae (A) to (F), whereby increase in reflective density on the unexposed portion can be suppressed even upon storage under moist and high temperature conditions.

The high boiling point organic solvents represented by the general formulae (A) to (F) of the invention will be described.

$$RaOOC(CH_2)_mCOORb \quad (A)$$

In the general formula (A), Ra and Rb each independently represents a linear or branched alkyl group having from 4 to 10 carbon atoms. Examples of the alkyl group include a butyl group, an iso-butyl group, a 2-ethylhexyl group, an octyl group, a tert-octyl group, a sec-octyl group, a nonyl group, an iso-nonyl group, a decyl group and an iso-decyl group.

In the general formula (A), m represents an integer of from 2 to 10, and more preferably an integer of from 4 to 8.

$$ReOOC(C_nH_{2n-2})COORd \quad (B)$$

In the general formula (B), Rc and Rd each independently represents a linear or branched alkyl group having from 4 to 10 carbon atoms. Examples of the alkyl group include a butyl group, an iso-butyl group, a 2-ethylhexyl group, an octyl group, a tert-octyl group, a sec-octyl group, a nonyl group, an iso-nonyl group, a decyl group and an iso-decyl group.

In the general formula (B), n represents an integer of from 2 to 10, and more preferably an integer of from 4 to 8.

In the general formula (B), examples of the dibasic acid residual group represented by $—OOC(C_nH_{2n-2})COO—$ include such residual groups as malonic acid, fumaric acid, itaconic acid, citraconic acid, mesaconic acid, 2-pentenic acid, 2-hexenic acid and 3-hexenic diacid.

$$ReCOO(CH_2)_pOCORf \quad (C)$$

In the general formula (C), Re and Rf each independently represents a linear or branched alkyl group having from 3 to 24 carbon atoms (preferably from 4 to 10 carbon atoms), and p represents an integer of from 2 to 10.

Examples of the linear or branched alkyl group having from 3 to 24 carbon atoms represented by Re and Rf include a propyl group, a butyl group, an iso-butyl group, a pentyl group, a heptyl group, a 2-ethylhexyl group, an octyl group, a decyl group, a nonyl group an iso-nonyl group, a pentadecyl group and a tetradecyl group.

$$C(Rg)(Rh)(Ri)(OH) \quad (D)$$

In the general formula (D), Rg represents an alkyl group or an alkenyl group, and Rh and Ri each independently represents a hydrogen atom or the groups represented by Rg, provided that a total carbon number of the groups represented by Rg, Rh and Ri is 10 or more.

Examples of the alkyl group represented by Rg include a methyl group, an ethyl group, a propyl group, a butyl group, a pentyl group, an iso-pentyl group, a 2-ethylhexyl group, an octyl group and a decyl group.

Examples of the alkenyl group represented by Rg include a 2-propenyl group, a 3-butenyl group, a 1-methyl-3-propenyl group, a 3-pentenyl group, a 1-methyl-3-butenyl group and a 4-hexenyl group.

The alkyl group or the alkenyl group represented by Rg may further have a substituent.

While Rh and Ri each independently represents a hydrogen atom or the groups represented by Rg, it is preferred that at least one of them represents a hydrogen atom, and it is more preferred that both of them represent hydrogen atoms.

$$X—((CH_2)_q—O(CO)Rj)_r \quad (E)$$

In the general formula (E), X represents a 5- to 7-member saturated hydrocarbon. Examples of the 5- to 7-member saturated hydrocarbon include cyclopentane, cyclohexane and cycloheptane, and cyclohexane is more preferred.

In the general formula (E), q represents an integer of from 0 to 2, and preferably from 0 to 1. r represents an integer of from 1 to 3, and preferably from 1 to 2.

Rj represents a linear or branched alkyl group having from 4 to 16 carbon atoms, and preferably having from 4 to 12 carbon atoms.

Examples of the linear or branched alkyl group represented by Rj include a butyl group, an iso-butyl group, a pentyl group, a hexyl group, a heptyl group, a 1-ethylpentyl group, an octyl group, a nonyl group, an iso-nonyl group, a decyl group, an iso-decyl group, an undecyl group, a dodecyl group and a hexadecyl group.

$$YO—C(COORk)(CH_2COORl)(CH_2COORm) \quad (F)$$

In the general formula (F), Rk, Rl and Rm each independently represents an alkyl group, an alkenyl group or an aryl group.

Examples of the alkyl group represented by Rk, Rl and Rm include a butyl group, an iso-butyl group, a tert-butyl group, a 2-ethylhexyl group, an octyl group, a tert-octyl group, a sec-octyl group, a nonyl group, an iso-nonyl group, a decyl group and an iso-decyl group.

Examples of the alkenyl group represented by Rk, Rl and Rm include a 2-propenyl group, a 3-butenyl group, a 1-methyl-3-propenyl group, a 3-pentenyl group, a 1-methyl-3-butenyl group and a 4-hexenyl group. Examples of the aryl group include a phenyl group and a naphthyl group. In particular, an iso-butyl group and a tert-butyl group are preferred. It is preferred that Rk, Rl and Rm represent the same groups.

Y represents a hydrogen atom or an acyl group, and preferably a hydrogen atom.

In the invention, among the high boiling point organic solvents represented by the general formulae (A) to (F), the high boiling point organic solvents represented by the general formulae (B) to (F) are preferred, and the high boiling point solvent represented by the general formula (F) is particularly preferred.

The high boiling point organic solvent in the invention may be contained in any constitutional layer in the photosensitive material, and may be contained in plural layers. In order to exert the effect of the invention in the most effective manner, it is preferably contained in a color mixing prevention layer positioned between emulsion layers that have different sensitivities.

When a hydroquinone compound is contained in the color mixing prevention layer in the invention, the effect of the invention is exerted in a more effective manner, but even when the hydroquinone compound is not contained, the effect of the invention is exerted.

The particular high boiling point organic solvent in the invention may be used in combination with other high boiling point organic solvents.

The using amount of the particular high boiling point organic solvent in the invention is preferably from 0.01 to 10 $g/m^2$, more preferably from 0.05 to 5 $g/m^2$, and further preferably from 0.1 to 1 $g/m^2$. When it exceeds the foregoing range, blur occurs in an image when it is placed under high humidity conditions, and when it is less than the range, the effect of the invention cannot be exerted.

In the case where the particular high boiling point organic solvent is used in the same constitutional layer in the invention, the high boiling point organic solvent may be used singly or as a mixture of two or more kinds of the high boiling point organic solvents. In the case where two or more kinds of the high boiling point organic solvents are used as a mixture, a high boiling point organic solvent outside the scope of the invention may also be used by mixing. It is a preferred embodiment that the another high boiling organic solvent is used by mixing to satisfy other performance.

Examples of the organic solvent that can be used by mixing include a phosphate ester, an benzoate ester, an amide compound, an epoxy compound, an aniline compound and a phenolic compound. In the case where the particular high boiling point organic solvent in the invention has a melting point of 80° C. or more, it is preferred that two or more kinds of the high boiling point organic solvents are used as a mixture.

In the invention, it is preferred that a phthalate ester, particularly dibutyl phthalate, is not used because it impairs the effect of the invention.

Typical specific examples of the high boiling point organic solvents represented by the general formulae (A) to (F) will be shown below, but the invention is not limited thereto.

| | |
|---|---|
| A-1 | dibutyl adipate |
| A-2 | di-iso-butyl adipate |
| A-3 | di(2-ethylhexyl) adipate |
| A-4 | dioctyl adipate |
| A-5 | (octyl)decyl adipate |
| A-6 | (2-ethylhexyl)decyl adipate |
| A-7 | di-isononyl adipate |
| A-8 | di(2-ethylhexyl) azelate |
| A-9 | dinonyl azelate |
| A-10 | dibutyl sebacate |
| A-11 | di(2-ethylhexyl) sebacate |
| A-12 | dioctyl sebacate |
| B-1 | dibutyl maleate |
| B-2 | di(2-ethylhexyl) maleate |
| B-3 | di-iso-nonyl maleate |
| B-4 | dibutyl fumarate |
| B-5 | di(2-ethylhexyl) fumarate |
| B-6 | dibutyl itaconate |
| B-7 | di(2-ethylhexyl) itaconate |

C-1

$H_{19}C_9COO(CH_2)_4OCOC_9H_{19}$

C-2

$C_4H_9-HC(C_2H_5)COO(CH_2)_4OCOCH(C_2H_5)-C_4H_9$

C-3

$H_{11}C_5COO(CH_2)_6OCOC_5H_{11}$

C-4

$H_{19}C_9COO(CH_2)_6OCOC_9H_{19}$

C-5

$H_9C_4COO(CH_2)_8OCOC_4H_9$

C-6

$H_7C_3COO(CH_2)_{10}OCOC_3H_7$

D-1

$C_{11}H_{23}OH$

D-2

$C_{12}H_{25}OH$

D-3

$C_{16}H_{33}OH$

D-4

$CH_3CH(OH)(CH_2)_9CH_3$

D-5

$CH_3(CH_2)_7CH{=}CH(CH_2)_8OH$

D-6

$CH_3C(CH_3){=}CHCH_2CH_2C(CH_3){=}CHCH_2CH_2C(OH)(CH_3)CH{=}CH_2$

D-7

$C_8H_{17}CH(C_8H_{13})CH_2OH$

-continued

D-8

$C_{10}H_{21}CH(C_8H_{17})CH_2OH$

D-9

$(CH_3)_2CHCH_2CH(OH)CH_2CH_2CH(C_2H_6)(CH_2)_3CH_3$

D-10

$C_7H_{15}CH{=}CH(CH_2)_6OH$

E-1

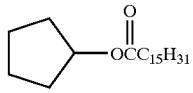

E-2

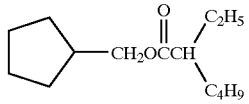

E-3

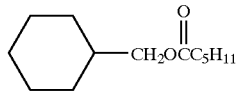

E-4

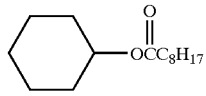

E-5

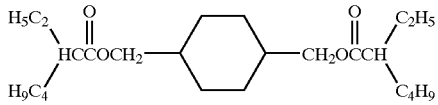

E-6

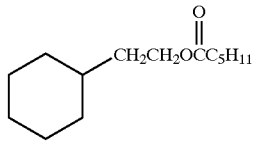

E-7

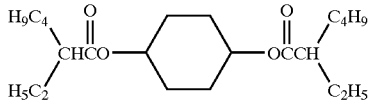

E-8

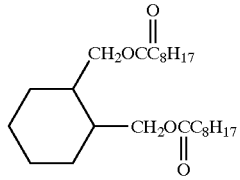

E-9

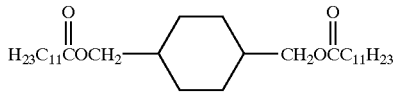

E-10

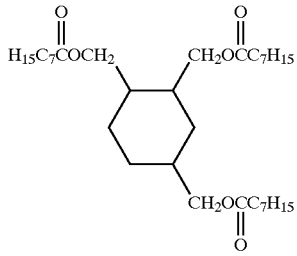

-continued

E-11

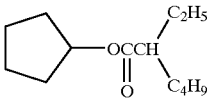

F-1

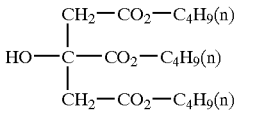

F-2

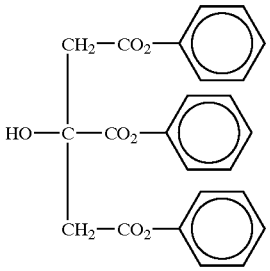

F-3

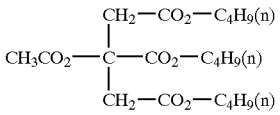

F-4

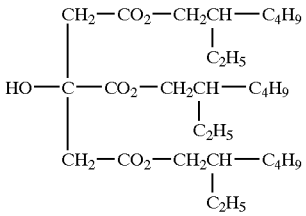

F-5

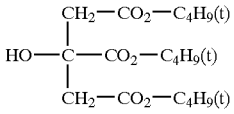

F-6

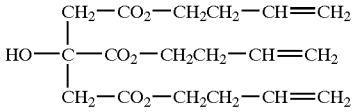

<Silver Halide Color Photographic Photosensitive Material>

In the second and fourteenth embodiments of the invention, the details of the silver halide color photographic photosensitive material, i.e., the silver halide emulsions, the spectral sensitization, the chemical sensitization, the decolorizable dye and colored layer, the layer structure, the processing method for the photosensitive material and the additives for processing, the cyan, magenta and yellow couplers, and other components, are the same as those described for the first and thirteenth embodiments.

<<Fifth Embodiment and Twenty First Embodiment>>

The fifth embodiment of the silver halide color photographic photosensitive material according to the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, and a reflective density A(λ) at a wavelength λ in an unexposed portion after a color development treatment is 0.08 or less at 450 nm, 0.10 or less at 550 nm and 0.08 or less at 650 nm, wherein a reflective density C(λ) at a wavelength λ in a cyan-colored portion after a red exposing step and a color development treatment satisfies the following conditions (1) and (2):

$$0.04 \leqq (C(\mathbf{425}) - C(\text{min}))/(1 - C(\text{min})) \leqq 0.10 \quad (1)$$

$$0.09 \leqq (C(\mathbf{530}) - C(\text{min}))/(1 - C(\text{min})) \leqq 0.15 \quad (2)$$

In the conditions (1) and (2), C(min) represents a minimum density at a wavelength of from 400 to 700 nm when a cyan density at a wavelength that provides the maximum density of cyan coloration is 1.0.

In the fifth embodiment, it is preferred that the reflective density A(λ) is 0.06 or less at 450 nm, 0.07 or less at 550 nm, and 0.05 or less at 650 nm.

In the fifth embodiment, it is preferred that the reflective density A(λ) at a wavelength λ in an unexposed portion after the color development treatment satisfies the following conditions (I) and (II):

$$1.0 \leqq A(\mathbf{550})/A(\mathbf{450}) \leqq 1.4 \quad (\text{I})$$

$$0.6 \leqq A(\mathbf{650})/A(\mathbf{450}) \leqq 1.2 \quad (\text{II})$$

The twenty first embodiment of the silver halide color photographic photosensitive material according to the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, in which a chromaticity of an unexposed portion after a color development treatment satisfies the following condition (B), and a reflective density C(λ) at a wavelength λ in a cyan-colored portion after a red exposing step and a color development treatment satisfies the following conditions (1) and (2):

$$91 \leqq L^* \leqq 96,\ 0.3 \leqq a^* \leqq 1.6,\ -8.0 \leqq b^* \leqq -4.8 \quad (\text{B})$$

$$0.04 \leqq (C(\mathbf{425}) - C(\text{min}))/(1 - C(\text{min})) \leqq 0.10 \quad (1)$$

$$0.09 \leqq (C(\mathbf{530}) - C(\text{min}))/(1 - C(\text{min})) \leqq 0.15 \quad (2)$$

In the conditions (1) and (2), C(min) represents a minimum density at a wavelength of from 400 to 700 nm when a cyan density at a wavelength that provides the maximum density of cyan coloration is 1.0.

In the twenty first embodiment, it is preferred that the chromaticity of an unexposed portion after the color development treatment satisfies the following condition (C):

$$93 \leqq L^* \leqq 96,\ 0.3 \leqq a^* \leqq 1.6,\ -8.0 \leqq b^* \leqq -4.8 \quad (\text{C})$$

In the fifth and twenty first embodiments, it is preferred that at, least one layer of the cyan-coloring photosensitive silver halide emulsion layer contains at least one kind selected from compounds represented by the following general formulae (PTA-I) and (PTA-II):

General formula (PTA-I)

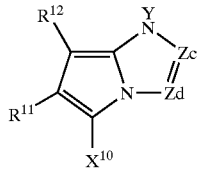

General formula (PTA-II)

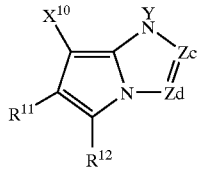

wherein Zc and Zd each represents —C($R_{13}$)= or —N=, $R_{13}$ represents a hydrogen atom or a substituent, provided that one of Zc and Zd represents —C($R_{13}$)= and the other thereof represents —N=, $R_{11}$, and $R_{12}$ each represents an electron attracting group having a Hammett's substituent constant $\pi p$ of 0.2 or more with a sum of $\sigma p$ of $R_{11}$ and $R_{12}$ being 0.65 or more, $X_{10}$ represents a hydrogen atom or a group that is releasable by a coupling reaction with an oxidized product of an aromatic primary amine color developing agent, and Y represents a hydrogen atom or a group that is releasable by the color development treatment, provided that $R_{11}$, $R_{12}$, $R_{13}$ and $X_{10}$ each may be a divalent group to form a multimer of a dimer or more, or to form a homopolymer or a copolymer by combining a polymer chain.

In the fifth and twenty first embodiments, it is preferred that at least one layer of the cyan-coloring photosensitive silver halide emulsion layer contains at least one kind of a compound represented by the following general formula (IA):

General formula (IA)

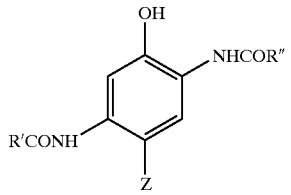

wherein R' and R" each independently represents a substituent, and Z represents a hydrogen atom or a group that is releasable by a coupling reaction with an oxidized product of an aromatic primary amine color developing agent.

In the fifth and twenty first embodiments, it is preferred that at least one layer of the layers constituting the photosensitive material contains a pigment, and the pigment is preferably selected from the group consisting of an indanthrone pigment, an indigo pigment, a triarylcarbonium pigment, an azo pigment, a quinacridone pigment, a dioxadine pigment and a diketopyrrolopyrrole pigment.

<Reflective Density A(λ)>

In the fifth embodiment of the invention, the reflective density A(λ) at a wavelength λ in an unexposed portion after a color development treatment (hereinafter sometimes referred to as a "reflective density A(λ)") is 0.07 or less at 450 nm, 0.09 or less at 550 nm and 0.07 or less at 650 nm, and is more preferably the following conditions.

That is, the reflective density A at 450 nm (hereinafter sometimes referred to as "A(450)") is preferably 0.06 or less, the reflective density A at 550 nm (hereinafter sometimes referred to as "A(550)") is preferably 0.07 or less, and the reflective density A at 650 nm (hereinafter sometimes referred to as "A(650)") is preferably 0.05 or less.

The value A is preferably as small as possible, and in the case where a paper support coated with a polyethylene resin containing a white pigment is used, the values A(450), A(550) and A(650) are substantially 0.01 or more.

<Reflective Density C(λ)>

In the fifth embodiment, the reflective density C(λ) at a wavelength λ nm in a cyan-colored portion after a red exposing step and a color development treatment can be obtained by measuring in the following manner. A red exposing step is carried out to exert coupling coloration of a cyan-coloring dye-forming coupler present in a red photosensitive emulsion layer and a 4-amino-3-methyl-N-ethyl-N-(β-methanesulfoneamide)aniline coloration developing agent, and then a color development treatment is carried out. After desilvering and water washing, the extinction coefficient of the cyan-coloring dye is measured under 25° C. 60% RH conditions at an integrating sphere open area ratio of 2% and a slit width of 5 nm with specular light being removed to obtain a reflective density.

The reflective density C(λ) is measured in the following manner. Scanning is carried out from 400 to 700 nm to produce a sample to make the density at such a wavelength that provides the maximum density is 1.0. The minimum density upon scanning from 400 to 700 nm is designated as C(min), the reflective density at a wavelength of 425 nm is designated as C(425), and the reflective density at 530 nm is designated as C(530).

Representative examples of a measuring device for reflective absorbance include a spectrophotometer U-3410 produced by Hitachi, Ltd., as similar to those described in the foregoing.

In the fifth embodiment, the reflective density C(λ) preferably satisfies the following conditions.

That is, (C(425)−C(min))/(1−C(min)) is preferably from 0.04 to 0.08, and (C(530)−C(min))/(1−C(min)) is preferably from 0.10 to 0.12.

When the white background and the density of the cyan-coloring dye in the invention are selected in the preferred regions, color resolving power in a bright region is improved, whereby the reproducible color reproduction range can be increased in a hyper-additive manner.

In the fifth embodiment of the silver halide color photographic photosensitive material of the invention, there are preferred conditions for the density ratio of the reflective density A(λ) because the tendency on sensuous "white" taking human preference into account varies depending on color balance. That is, it is preferred that 1.0≦A(550)/A(450)≦1.4 and 0.6≦A(650)/A(450)≦1.2, it is more preferred that 1.1≦A(550)/A(450)≦1.3 and 0.6≦A(650)/A(450)≦1.2, and it is further preferred that 1.1≦A(550)/A(450)≦1.2 and 0.8≦A(650)/A(450)≦1.1.

The definition of the reflective density A(λ) at a wavelength λ nm in an unexposed portion after the color development treatment is the same as those in the first and thirteenth embodiments.

The twenty first embodiment of the silver halide color photographic photosensitive material of the invention comprises a reflective support having thereon at least one yellow-coloring photosensitive silver halide emulsion layer, at least one magenta-coloring photosensitive silver halide emulsion layer, at least one cyan-coloring photosensitive silver halide emulsion layer and at least one non-photosensitive, non-coloring hydrophilic colloid layer, in which a chromaticity of an unexposed portion after a color development treatment satisfies the following condition (B), and a reflective density C(λ) at a wavelength λ in a cyan-colored portion after a red exposing step and a color development treatment satisfies the following conditions (1) and (2):

$$91 \leqq L^* \leqq 96,\ 0.3 \leqq a^* \leqq 1.6,\ -8.0 \leqq b^* \leqq -4.8 \quad (B)$$

$$0.04 \leqq (C(\mathbf{425}) - C(\min))/(1 - C(\min)) \leqq 0.10 \quad (1)$$

$$0.09 \leqq (C(\mathbf{530}) - C(\min))/(1 - C(\min)) \leqq 0.15 \quad (2)$$

In the conditions (1) and (2), C(min) represents a minimum density at a wavelength of from 400 to 700 nm when a cyan density at a wavelength that provides the maximum density of cyan coloration is 1.0.

<Chromaticity of Unexposed Portion>

In the twenty first embodiment, the chromaticity of an unexposed portion (white background) after the color development treatment preferably satisfies the following conditions in the CIE 1976 L*a*b* color space (hereinafter sometimes referred to as "CIELAB color space"). That is, L* is preferably from 92 to 96, and more preferably from 93 to 96. a* is preferably from 0.5 to 1.3. b* is preferably from −8.0 to −4.0.

The details of the CIE 1976 L*a*b* color space are the same as those described for the first and thirteenth embodiments.

The measurement for determining as to whether the conditions (B) and (C) are satisfied can be carried out by using any chromaticity measuring apparatus that can measure chromaticity in the CIELAB color space. For example, a color analyzer C-2000 produced by Hitachi, Ltd. can be used with CIE D65 (6,504 K) as the standard light source.

In the twenty first embodiment, the definition of the reflective density C(λ) at a wavelength λ nm in a cyan-colored portion after a red exposing step and a color development treatment is the same as that in the fifth embodiment.

In the fifth and twenty first embodiment, the method for adjusting the white background to the foregoing preferred ranges in the invention can be roughly classified into two methods, i.e., a method of adjusting the whiteness of the support and a method of adjusting with the hydrophilic colloid layer forming the photographic constitutional layers.

In the fifth and twenty first embodiments, details of the reflective support that can be preferably used are the same as those described for the first and thirteenth embodiments.

A method for adjusting the white background to the preferred range with a hydrophilic colloid layer forming the photographic constitutional layers coated on the support will be described in detail below.

As factors of deterioration of the white background ascribed to the photographic constitutional layers, fogging of a silver halide emulsion, remaining color of a sensitizing dye and absorption of contamination of a pressing solution are exemplified. The whiteness can be approximated to the inherent whiteness of the support by reducing the factors of deterioration. The whiteness can also be adjusted to the preferred range of the invention in such manners that a dye or a pigment that is not decolored by processing is added to color, and a fluorescent whitening agent is added to the photosensitive material after processing.

<Pigment>

The pigments used for coloring the hydrophilic colloid layers of the photographic constitutional layers in the fifth and twenty first embodiments of the invention are the same as those that can be preferably used in the first and thirteenth embodiments.

In the fifth and twenty first embodiment of the invention, it is also preferred that an oil soluble dye is used in the photographic constitutional layers of the photosensitive material to adjust the white background. Specific examples of the oil soluble dye include Compounds Nos. 1 to 27 disclosed in JP-A No. 2-842, p. (8) and (9).

In the fifth and twenty first embodiment of the invention, it is also possible that a fluorescent whitening agent is added to the photographic constitutional layers of the photosensitive material, whereby the fluorescent whitening agent remain in the photosensitive material after processing, so as to adjust the white background. It is also possible that a polymer, such as polyvinylpyrrolidone, capable of catching a fluorescent whitening agent is added to the photosensitive material.

<Silver Halide Color Photographic Photosensitive Material>

In the fifth and twenty first embodiment of the invention, among the details of the silver halide color photographic photosensitive material, the silver halide emulsions, the spectral sensitization, the chemical sensitization, the decolorizable dye and colored layer, the layer structure, the processing method of the photosensitive material and the additives for processing are the same as those described for the first and thirteenth embodiments.

Coupler

In addition to the foregoing, couplers disclosed in JP-A No. 62-215272, line 4 of right upper column of page 91 to line 6 of left upper column of page 121, No. 2-33144, line 14 of right upper column of page 3 to the last line of left upper column of page 18 and line 6 of right upper column of page 30 to line 11 of right lower column of page 35, and EP 0,355,660A2, p. 4,1. 15 to 27, p. 5,1.30 to p. 28, last line, p. 45,1.29 to 31, and p. 47,1. 23 to p. 63, 1. 50 are also useful as the cyan, magenta and yellow couplers used in the invention.

Furthermore, compounds represented by the general formulae (II) and (III) in WO 98/33760 and the general formula (D) in JP-A No. 10-221825 may be preferably added in the invention.

As the cyan dye-forming coupler (hereinafter, sometimes simply referred to as a "cyan coupler") that can be used in the invention, a pyrrolotriazole series coupler is preferably used, and couplers represented by the general formulae (I) and (II) in JP-A No. 5-313324, couplers represented by the general formula (I) in JP-A No. 6-347960 and example couplers disclosed in these literatures are particularly preferred.

Phenol series and naphthol series cyan couplers are also preferred, and for example, a cyan coupler represented by the general formula (ADF) in JP-A No. 10-333297 is preferred.

Other examples of the cyan coupler include a pyrroloazole type cyan coupler disclosed in EP 0,488,248 and EP 0,491,197A1, a 2,5-diacylaminophenol coupler disclosed in U.S. Pat. No. 5,888,716, and a pyrazoloazole type cyan coupler having an electron attracting group or a hydrogen bond group at the 6-position disclosed in U.S. Pat. Nos. 4,873,183 and 4,916,051, and in particular, a pyrazoloazole type cyan coupler having a carbamoyl group at the 6-position disclosed in JP-A No. 8-171185, No. 8-311360 and No. 8-339060 is also preferred.

In addition to a diphenylimidazole series cyan coupler disclosed in JP-A No. 2-33144, a 3-hydroxypyridine series cyan coupler disclosed in EP 0,333,185A2 (particularly, a coupler obtained by attaching a chlorine releasing group to a tetravalent coupler of Coupler (42) as enumerated as specific examples to make a divalent coupler, and Couplers (6) and (9) are preferred), a cyclic active methylene series cyan coupler disclosed in JP-A 64-32260 (particularly, example couplers 3, 8 and 34 enumerated as specific examples are preferred), a pyrrolopyrazole type cyan coupler disclosed in EP 0,456,226A1, and a pyrroloimidazole type cyan coupler disclosed in EP 0,484,909 can also be used.

In the invention, a cyan coupler that can be preferably used in the invention may be any cyan coupler that can form a cyan dye, and for example, a phenol cyan coupler, a naphthol cyan coupler and a heterocyclic cyan coupler. Among these, a pyrroloazole coupler is preferred, which is a cyan coupler represented by the following general formulae (PTA-I) and (PTA-II):

General formula (PTA-I)

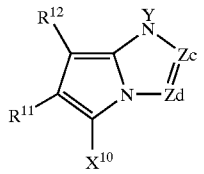

General formula (PTA-II)

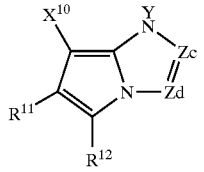

wherein Zc and Zd each represents —C($R_{13}$)= or —N=, $R_{13}$ represents a hydrogen atom or a substituent, provided that one of Zc and Zd represents —C($R_{13}$)= and the other thereof represents —N=, $R_{11}$ and $R_{12}$ each represents an electron attracting group having a Hammett's substituent constant σp of 0.2 or more with a sum of σp of $R_{11}$ and $R_{12}$ being 0.65 or more, $X_{10}$ represents a hydrogen atom or a group that is releasable by a coupling reaction with an oxidized product of an aromatic primary amine color developing agent, and Y represents a hydrogen atom or a group that is releasable by the color development treatment, provided that $R_{11}$, $R_{12}$, $R_{13}$ and $X_{10}$ each may be a divalent group to form a multimer of a dimer or more, or to form a homopolymer or a copolymer by combining a polymer chain.

Among these, a cyan coupler represented by the following general formula (PTA-III) is more preferably used from the standpoints of quickness of processing, color reproducibility and storage stability of the photosensitive material in an unexposed state:

General formula (PTA-III)

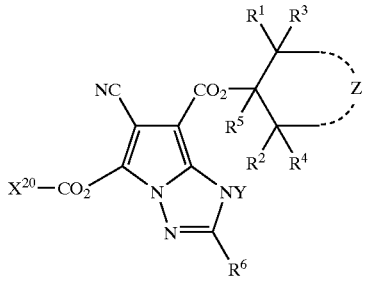

wherein $R^1$ and $R^2$ each independently represents an alkyl group or an aryl group, $R^3$, $R^4$ and $R^5$ each independently represents a hydrogen atom, an alkyl group or an aryl group, Z represents a non-metallic atomic group necessary for forming a saturated ring, $R^6$ represents a substituent, $X_{20}$ represents a heterocyclic group, a substituted amino group or an aryl group, and Y represents a hydrogen atom or a group that is releasable by a color development treatment.

In the general formula (PTA-III), the alkyl group represented by $R^1$ to $R^5$ is generally a linear, branched or cyclic alkyl group having from 1 to 36 carbon atoms, preferably a linear, branched or cyclic alkyl group having from 1 to 22 carbon atoms, and particularly preferably a linear or branched group having from 1 to 8 carbon atoms. Examples thereof include methyl, ethyl, n-propyl, isopropyl, t-butyl, t-amyl, t-octyl, decyl, dodecyl, cetyl, stearyl, cyclohexyl and 2-ethylhexyl.

In the general formula (PTA-III), the aryl group represented by $R^1$ to $R^5$ is generally an aryl group having from 6 to 20 carbon atoms, preferably an aryl group having from 6 to 14 carbon atoms, and particularly preferably an aryl group having from 6 to 10 carbon atoms. Examples thereof include phenyl, 1-naphthyl, 2-naphthyl and 2-phenanthryl.

In the general formula (PTA-III), the non-metallic atomic group necessary for forming a saturated ring represented by Z is a non-metallic atomic group necessary for forming a 5- to 8-member ring, and the ring may be substituted and may be a saturated ring or an unsaturated ring. Examples of the atoms for forming the ring include a carbon atom, an oxygen atom, a nitrogen atom and a sulfur atom. It is preferably a 6-member saturated carbon ring, and particularly preferably a cyclohexane ring having an alkyl group having from 1 to 24 carbon atoms substituted at the 4-position.

In the general formula (PTA-III), examples of the substituent represented by $R^6$ include a halogen atom (such as a fluorine atom, a chlorine atom and a bromine atom), an aliphatic group (such as a linear or branched alkyl group having from 1 to 36 carbon atoms, an aralkyl group, an alkenyl group, an alkynyl group, a cycloalkyl group and a cycloalkenyl group, specific examples of which include methyl, ethyl, propyl, isorpropyl, t-butyl, tridecyl, t-amyl, t-octyl, 2-methanesulfonylethyl, 3-(3-pentadecylphenoxy) propyl, 3-(4-(2-(4-(4-hydroxyphenylsulfonyl)phenoxy) dodecaneamide)-phenyl)propyl, 2-ethoxytridecyl, trifluoromethyl, cyclopentyl and 3-(2,4-di-t-amylphenoxypropyl), an aryl group (which includes an aryl group having from 3 to 36 carbon atoms, for example, phenyl, 4-t-butylphenyl, 2,4-di-t-amylphenyl, 4-tetradecaneamidephenyl and 2-methoxyphenyl), a heterocyclic group (which includes a heterocyclic group having from 1 to 36 carbon atoms, for example, 2-furyl, 2-thienyl, 2-pyrimidinyl and 2-benzothiazolyl), a cyano group, a hydroxyl group, a nitro group, an alkoxy group (which includes a linear, branched or cyclic alkoxy group having from 1 to 36 carbon atoms, for example, methoxy, ethoxy, butoxy, 2-methoxyethoxy, 2-dodecyloxyethoxy, 2-methanesulfonylethoxy), an aryloxy group (which is an aryloxy group having from 6 to 36 carbon atoms, for example phenoxy, 2-methylphenoxy, 4-t-butylphenoxy, 3-nitrophenoxy, 3-t-butyloxycarbamoylphenoxy and 3-methoxycarbamoyl), an acylamino group (which includes an acylamino group having from 2 to 36 carbon atoms, for example, acetamide, benzamide, tetradecaneamide, 2(2,4-di-t-amylphenoxy) butaneamide, 4-(3-t-butyl-4-hydroxyphenoxy) butaneamide and 2-(4-(4-hydroxyphenylsulfonyl) phenoxy)decaneamide), an alkylamino group (which includes an alkylamino group having from 1 to 36 carbon atoms, for example, methylamino, butylamino, dodecylamino, diethylamino and methylbutylamino), an anilino group (which includes an anilino group having from 6 to 36 carbon atoms, for example, phenylamino, 2-chloroanilino, 2-chloro-5-tetradecaneaminoanilino, 2-chloro-5-dodecyloxycarbonylanilino, N-acetylanilino and 2-chloro-5-(2-(3-t-butyl-4-hydroxyphenoxy) decaneamide)anilino), an ureido group (which includes an ureido group having from 2 to 36 carbon atoms, for example, phenylureido, methylureido and N,N-dibutyiureido), a sulfamoylamino group (which includes a sulfamoylamino group having from 1 to 36 carbon atoms, for example, N,N-dipropylsulfamoylamino and N-methyl-N-decylsulfamoylamino), an alkylthio group (which includes an alkylthio group having from 1 to 36 carbon atoms, for example, methylthio, octylthio, tetradecylthio, 2-phenoxyethylthio, 3-phenoxypropylthio and 3-(4-t-butylphenoxy) propylthio), an arylthio group (which includes an arylthio group having from 6 to 36 carbon atoms, for example, phenylthio, 2-butoxy-5-t-octylphenylthio, 3-pentadecylphenylthio, 2-carboxyphenylthio and 4-tetradecaneamidephenylthio), an alkoxycabonylamino group (which includes an alkoxycarbonylamino group having from 2 to 36 carbon atoms, for example, methoxycarbonylamino and tetradecyloxycarbonylamino), a sulfonamide group (which includes an alkyl- and arylsulfonamide group having from 1 to 36 carbon atoms, for example, methanesulfonamide, butanesulfonamide, octanesulfonamide, hexadecanesulfonamide, benzenesulfonamide, p-toluenesulfonamide, octadecanesulfonamide, and 2-methoxy-5-t-butylbenzenesulfonamide), a carbamoyl group (which includes a carbamoyl group having from 1 to 36 carbon atoms, for example, N-ethylcarbamoyl, N,N-dibutylcarbamoyl, N-(2-dodecyloxyethyl) carbamoyl, N-methyl-N-dodecylcarbamoyl and N-(3-(2,4-di-t-amylphenoxy)propyl)carbamoyl), a sulfamoyl group (which includes a sulfamoyl group having from 1 to 36 carbon atoms, for example, N-ethylsulfamoyl, N,N-dipropylsulfamoyl, N-(2-dodecyloxyethyl) sulfamoyl, N-ethyl-N-dodecylsulfamoyl and N,N-diethylsulfamoyl), a sulfonyl group (which includes an alkyl- and arylsulfonyl group having from 1 to 36 carbon atoms, for example, methanesulfonyl, octanesulfonyl, benzenesulfonyl and toluenesulfonyl), an alkoxycarbonyl group (which includes an alkoxycarbonyl group having from 2 to 36 carbon atoms, for example, methoxycarbonyl, butoxycarbonyl, dodecyloxycabonyl and octadecyloxycarbonyl), a heterocyclic oxy group (which includes a heterocyclic oxy group having from 1 to 36 carbon atoms, for example, 1-phenyltetrazole-5-oxy and 2-tetrahydropyranyloxy), an azo group (for example, phenylazo, 4-methoxyphenylazo, 4-pyvaloylaminophenylazo and 2-hydroxy-4-propanoylphenylazo), an acyloxy group (which includes an acyloxy group having from 2 to 36 carbon atoms, for example acetoxy), a carbamoyloxy group (which includes a carbamoyloxy group having from 1 to 36 carbon atoms, for example N-methylcarbamoyloxy and N-phenylcarbamoyloxy), a silyloxy group (which includes a silyloxy group having from 3 to 36 carbon atoms, for example, trimethylsilyloxy and dibutylmethylsilyloxy), an aryloxycarbonylamino group (which includes an aryloxycarbonylamino group having from 7 to 36 carbon atoms, for example, phenoxycarbonylamino), an imide group (which includes an imide group having from 4 to 36 carbon atoms, for example, N-succinimide, N-phthalamide and 3-octadecenylsuccinamide), a heterocyclic thio group (which include a heterocyclic thio group having from 1 to 36 carbon atoms, for example, 2-benzothiazolylthio, 2,4-diphenoxy-1,3,5-triazole-6-thio and 2-pyridylthio), a sulfinyl group (which includes a sulfinyl group having from 1 to 36 carbon atoms, for example, dodecanesulfinyl, 3-pentadecylphenylsulfinyl and 3-phenoxypropylsulfinyl), an alkyl-, aryl- or heterocyclic oxycarbonyl group (for example, methoxycarbonyl, butoxycarbonyl, dodecyloxycarbonyl, octadecyloxycarbonyl, phenyloxycabonyl and 2-pentadecyloxycarbonyl), an alkyl-, aryl- or heterocyclic oxycarbonylamino group (for example, methoxycarbonylamino, tetradecyloxycarbonylamino, phenoxycarbonylamino and 2,4-di-tert-butylphenoxycarbonylamino), a sulfonamide group (for example, methanesulfonamide, hexadecanesulfonamide, benzenesulfonamide, p-toluenesulfonamide, octadecanesulfonamide and 2-methoxy-5-tert-butylbenzenesulfonamide), a carbamoyl group (for example, N-ethylcarbamoyl, N,N-dibutylcarbamoyl, N-(2-dodecyloxyethyl)carbamoyl, N-methyl-N-dodecylcarbamoyl and N-(3-(2,4-di-tert-amylphenoxy)propyl)carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl and N,N-diethylsulfamoyl), a phosphonyl group (for example, phenoxyphosphonyl, octyloxyphosphonyl and phenylphosphonyl), a sulfamide group (for example, dipropylsulfamoylamino), an imide group (for example, N-succinimide, hydantoinyl, N-phthalamide and 3-octadecenylsuccinimide), an azolyl group (for example, imidazolyl, pyrazolyl, 3-chloropyrazole-1-yl and triazolyl), a hydroxyl group, a cyano group, a carboxyl group, a nitro group, a sulfo group and an unsubstituted amino group.

Preferred examples of the group represented by $R^6$ include an alkyl group, an aryl group, a heterocyclic group, a cyano group, a nitro group, an acylamino group, an arylamino group, an ureido group, a sulfamoylamino group, an alkylthio group, an arylthio group, an alkoxycarbonylamino group, a sulfonamide group, a carbamoyl group, a sulfamoyl group, a sulfonyl group, an alkoxycarbonyl group, an aryloxycarbonyl group, a heterocyclic oxy group, an acyloxy group, a carbamoyloxy group, an aryloxycarbonylamino group, an imide group, a heterocyclic thio group, a sulfinyl group, a phosphonyl group, an acyl group and an azolyl group.

It is more preferably an alkyl group or an aryl group, and further preferably an aryl group having at least an alkyl group substituted at the p-position.

$X_{20}$ represents a heterocyclic group, a substituted amino group or an aryl group. Preferred examples of the heterocyclic ring include a 5- to 8-member ring having a nitrogen atom, an oxygen atom or a sulfur atom and having from 1 to 36 carbon atoms. It is more preferably a 5- or 6-member ring bonded with a nitrogen atom, and the 6-member ring is particularly preferred.

Specific examples thereof include imidazole, pyrazole, triazole, a lactam compound, piperidine, pyrrolidine, pyrrole, morpholine, pyrazolidine, thiazolidine and pyrazoline, and morpholine and pyperidine are preferred.

Examples of the substituent of the substituted amino group include an aliphatic group, an aryl group and a heterocyclic group. Examples of the aliphatic group include the substituents exemplified for $R^6$, which may be further substituted by a cyano group, an alkoxy group (such as methoxy), an alkoxycarbonyl group (such as ethoxycarbonyl), a chlorine atom, a hydroxyl group or a carboxyl group. The substituted amino group preferably a disubsituted one rather than a monosubstituted one. The aryl group is preferably those having from 6 to 36 carbon atoms, and a monocyclic one is more preferred. Specific examples thereof include phenyl, 4-t-butylphenyl, 2-methylphenyl, 2,4,6-trimethylphenyl, 2-methoxyphenyl, 4-methoxyphenyl, 2,6-dichlorophenyl, 2-chlorophenyl and 2,4-dichlorophenyl.

Preferred specific examples thereof in the case where X20 is a substituted amino group are shown below.

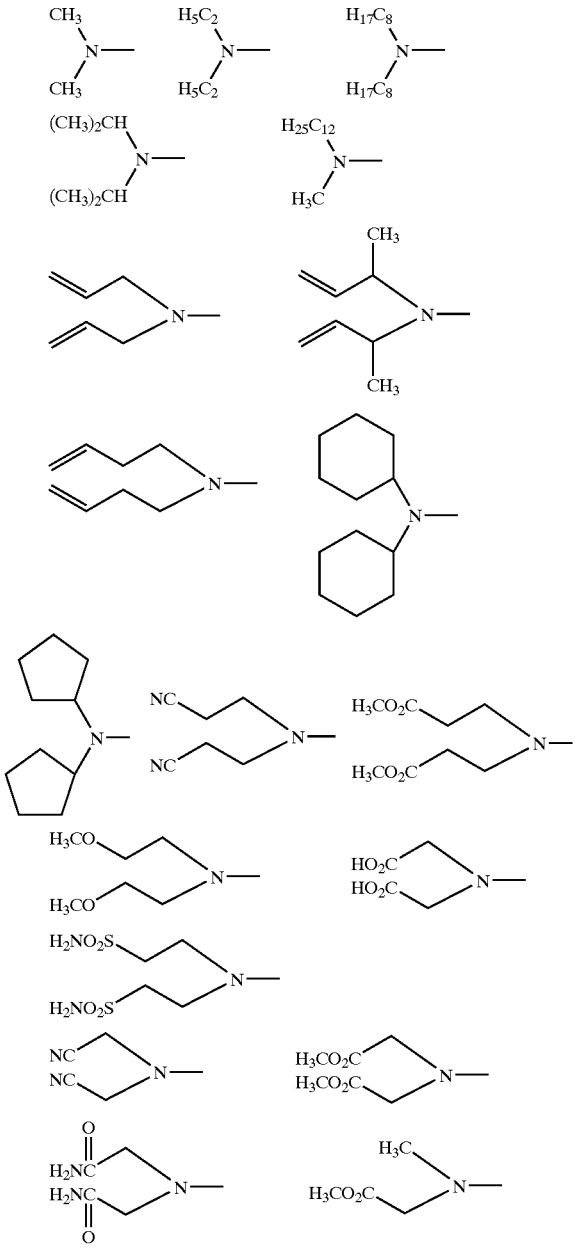

-continued

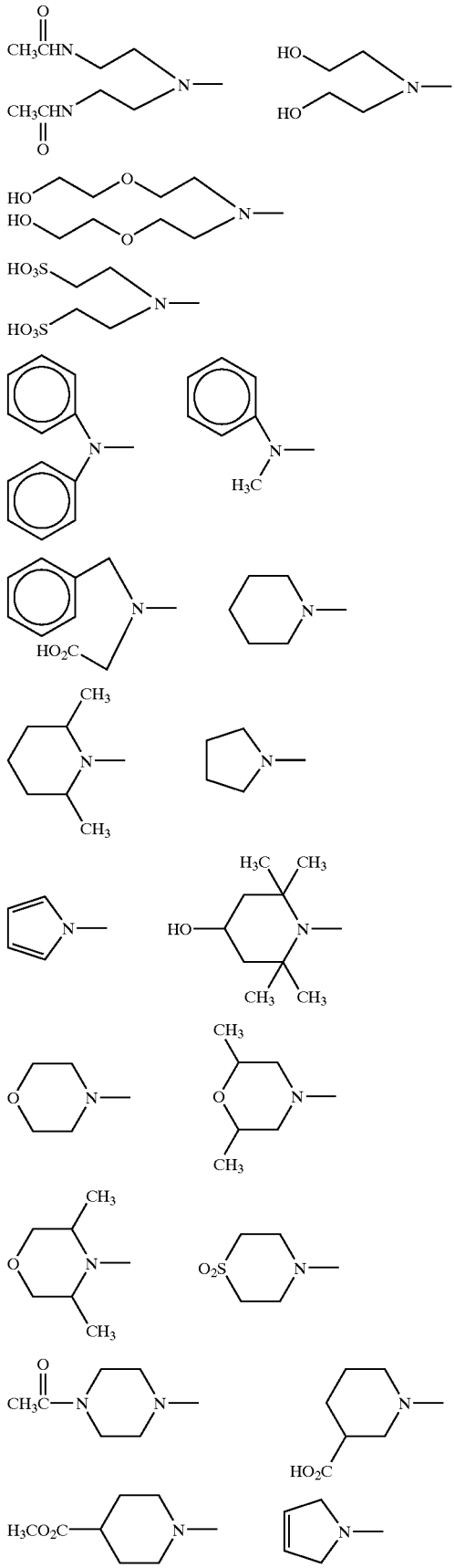

-continued

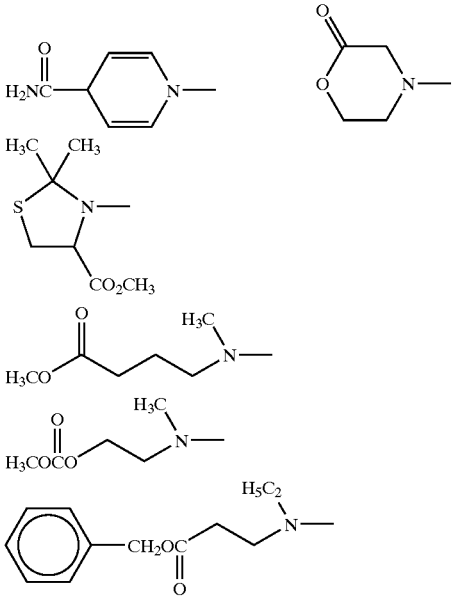

Y represents a hydrogen atom or a group that is releasable by a color development treatment. Examples of the substituent represented by Y include a group capable of being released under alkaline conditions disclosed in JP-A No. 61-228444 and a substituent exerting coupling off through a reaction with a developing agent disclosed in JP-A No. 56-133734, and it is preferably a hydrogen atom.

It is possible that the coupler represented by the general formula (PTA-III) contains a coupler residual group having $R^6$ represented by the general formula (PTA-III) to form a multimer of a dimer or more, or to form a homopolymer or a copolymer by containing a polymer chain in the group represented by $R^6$. Typical examples the homopolymer or the copolymer containing a polymer chain include a homopolymer or copolymer of an addition polymerizable ethylenic unsaturated compound having a coupler residual group represented by the general formula (PTA-III). In this case, one or more kinds of the cyan-coloring repeating unit having the coupler residual group represented by the general formula (PTA-II) may be contained the polymer, and it may be a copolymer containing one or more non-coloring ethylenic monomer as a copolymerization component that is not coupled with an oxidation product of an aromatic primary amine developing agent, such as an acrylate ester, a methacrylate ester and a maleate ester. The using amount of the compound represented by the general formula (PTA-III) is preferably from 0.01 to 1.0 mole, more preferably from 0.12 to 1.0 mole, and particularly preferably from 0.25 to 0.5 mole, per 1 mole of photosensitive silver halide contained in the same layer.

Specific examples of the cyan coupler used in the invention are shown below, but the invention is not limited thereto.

(1)

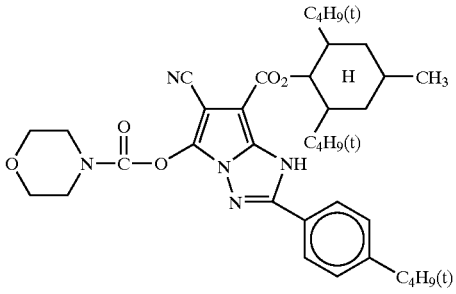

(2)

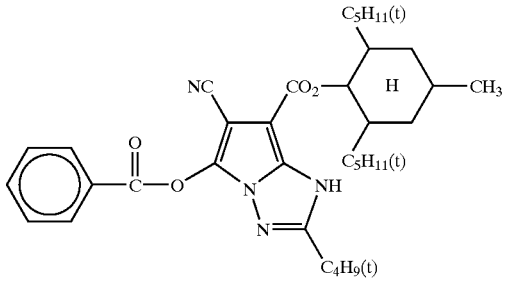

(3)

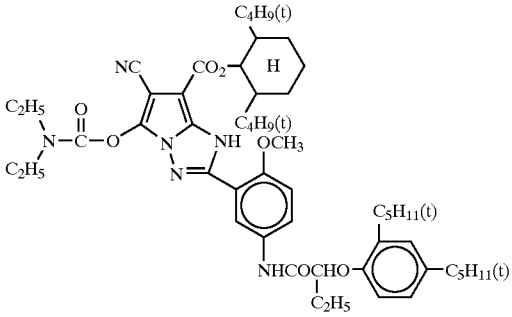

(4)

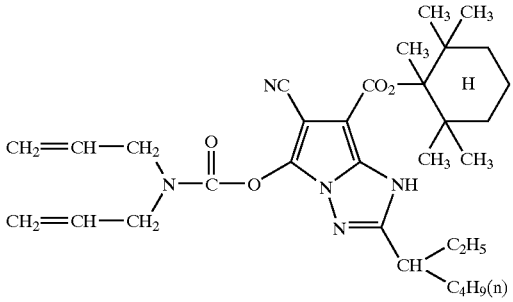

-continued
(5)
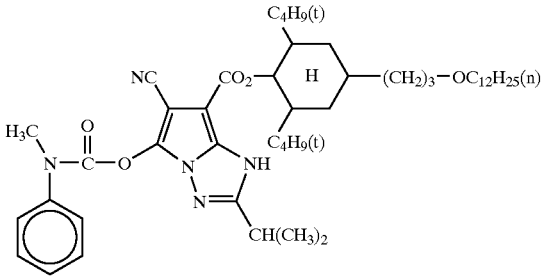
(6)
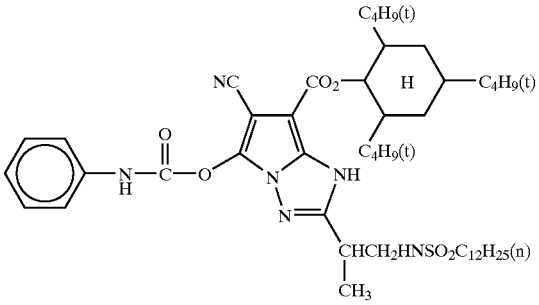
(7)
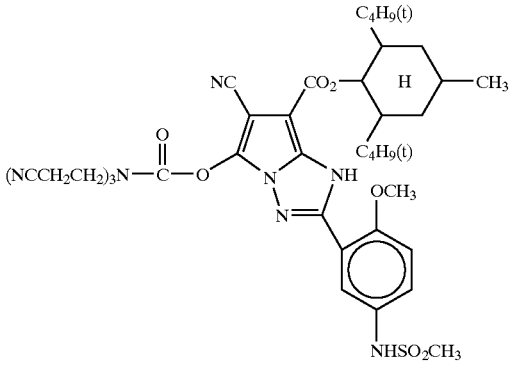
(8)
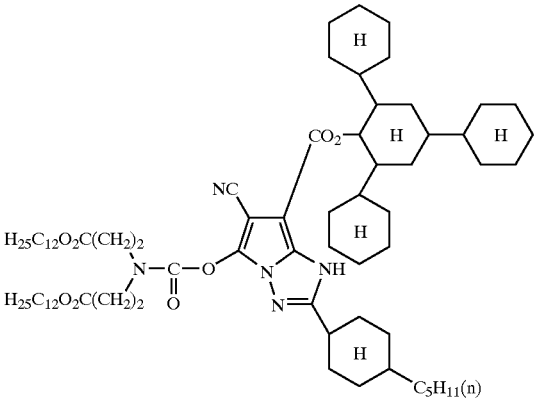
(9)
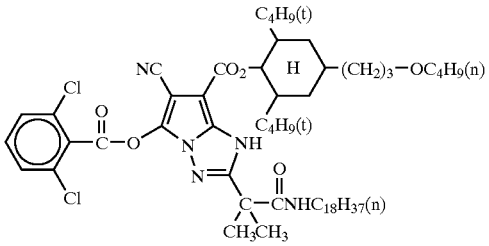
(10)
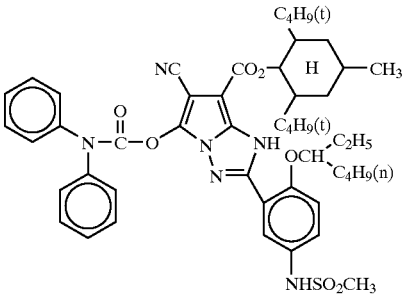
(11)
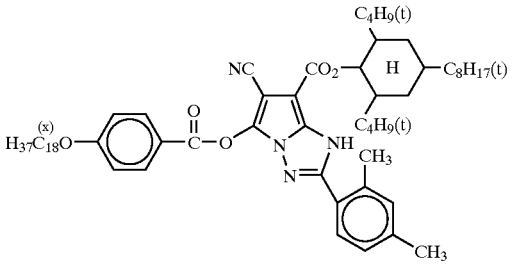
(12)
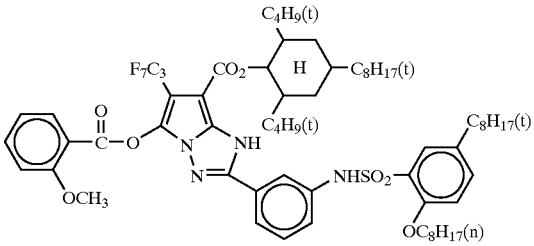
(13)
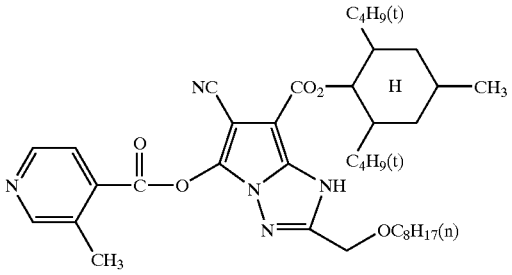

-continued
(14)
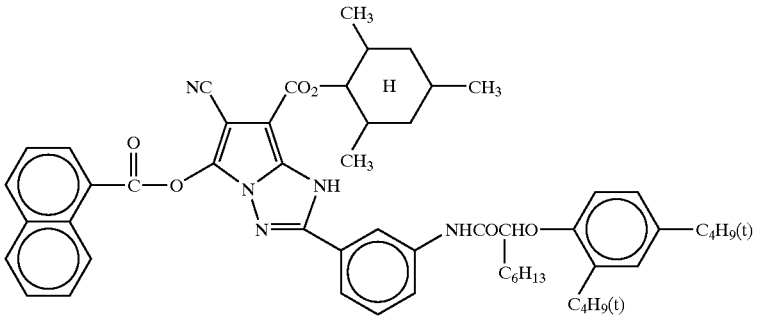
(15)
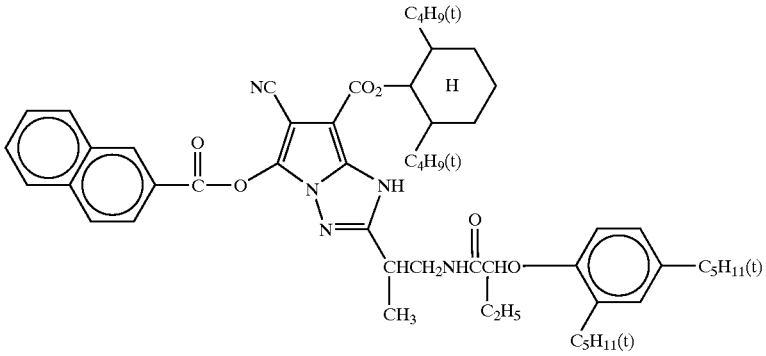
(16)
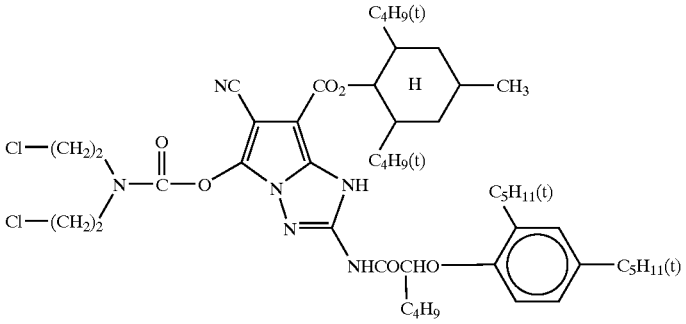
(17)
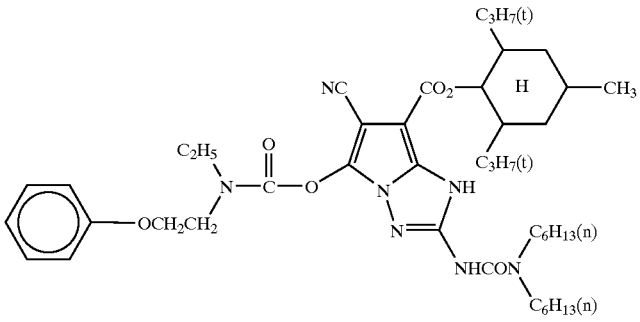

-continued
(18)
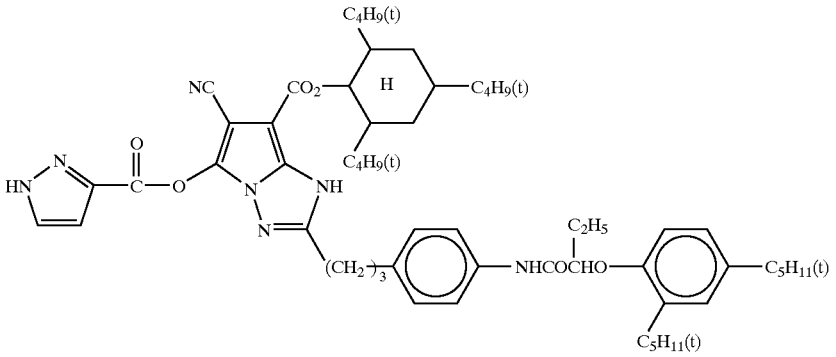
(19)
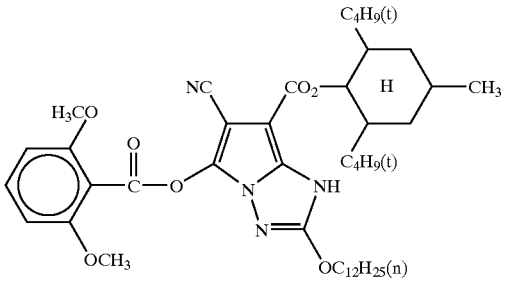
(20)
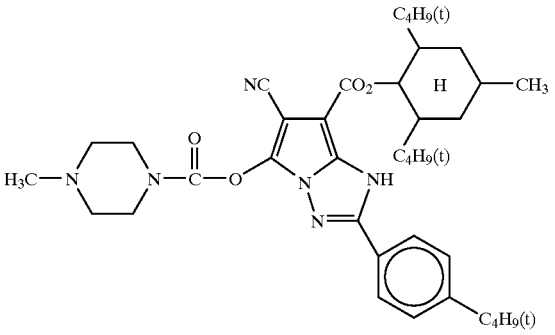
(21)
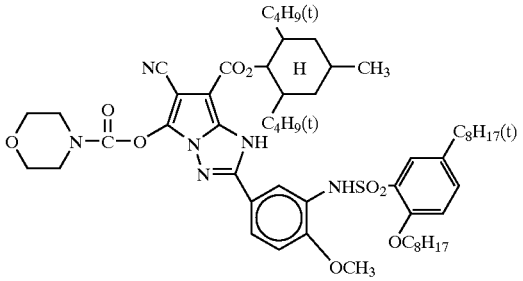
(22)
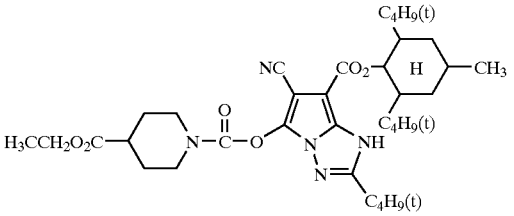
(23)
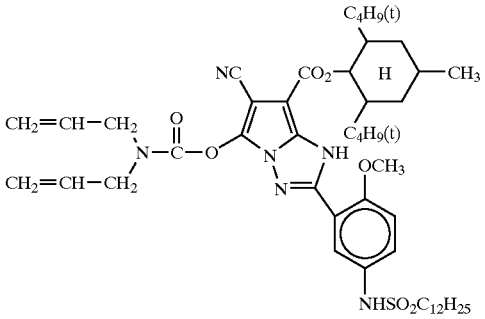
(24)
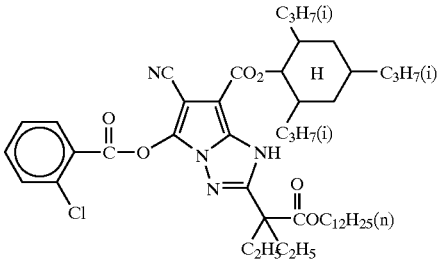

-continued
(25)
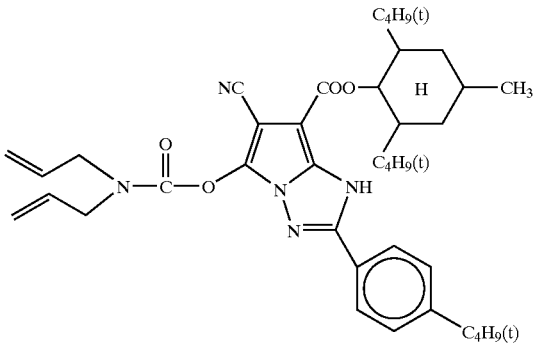
(26)
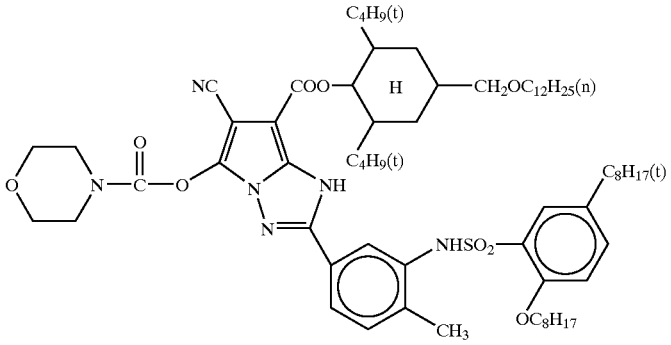
(27)
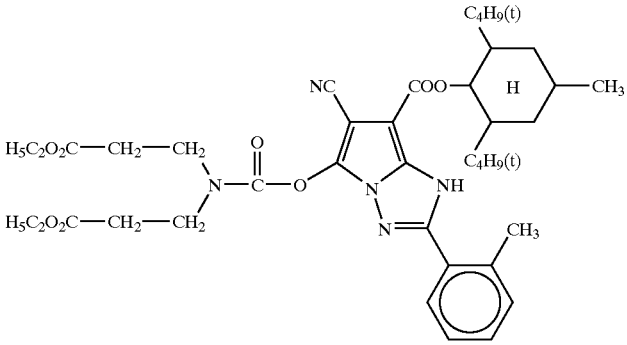
(28)
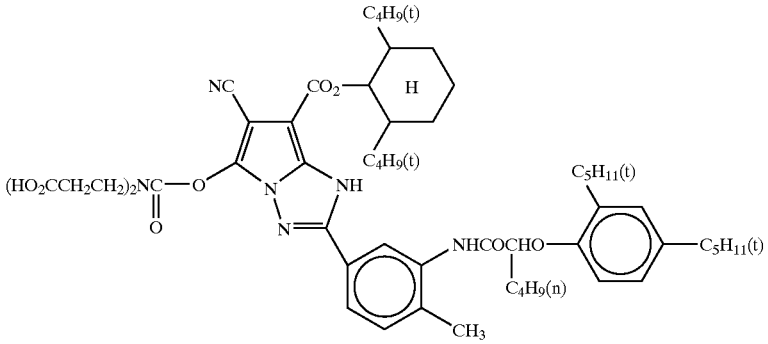

-continued (29)

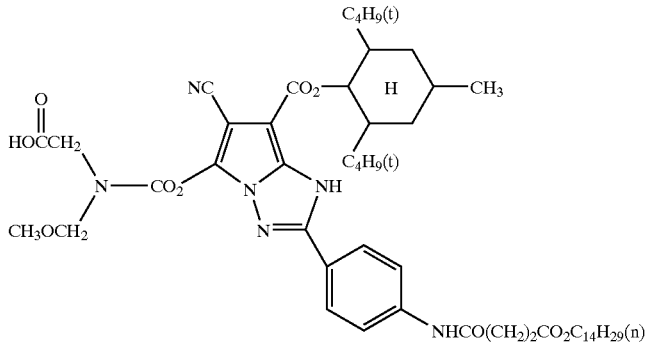

(30)

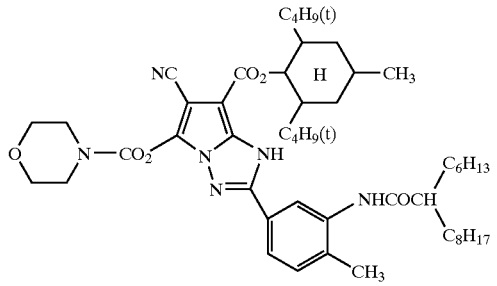

(31)

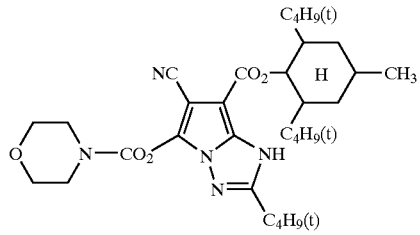

(32)

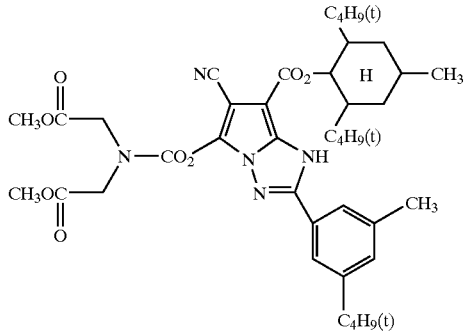

The compound represented by the general formula (PTA-III) used in the invention can be synthesized by known methods, such as those disclosed in JP-A No. 5-255333, No. 5-202004, 7-48376 and No. 8-110632.

A compound represented by the following general formula (IA) is also preferably used as the cyan coupler.

General formula (IA)

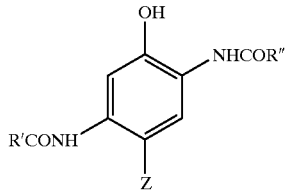

wherein R' and R" each independently represents a substituent, and Z represents a hydrogen atom or a group that is releasable by a coupling reaction with an oxidized product of an aromatic primary amine color developing agent.

The groups represented by R' and R" are preferably selected in such a manner that the coupler has such hue that is defined the invention.

The term "alkyl" referred herein means, unless otherwise noted, an unsaturated or saturated and linear or branched alkyl group (including alkenyl and aralkyl), and contains a cyclic alkyl group (including cycloalkenyl) having from 3 to 8 carbon atoms, and the term "aryl" referred herein includes a condensed aryl group.

It is preferred that R' and R" in the general formula (IA) each is independently selected from an unsubstituted or substituted alkyl group, an aryl group, an amino group, an alkoxy group and a 5- to 10-member heterocyclic group (which may be unsubstituted or substituted) containing one or more heteroatom selected from nitrogen, oxygen and sulfur.

In the case where R' and/or R" represent alkoxy group, they may be substituted by a halogen atom, an aryloxy group or an alkyl- or arylsulfonyl group. However, it is preferred that R' and R" each is independently selected from an unsubstituted or substituted alkyl or aryl group and a 5- to 10-member heterocyclic group, such as pyridyl, morpholino, imidazolyl and pyridazolyl.

Preferred examples of R' include an alkyl group substituted by a halogen atom, an alkyl group, an aryloxy group or an alkyl- or arylsulfonyl group (which may be further substituted). In the case where R" represents an alkyl group, it may be similarly further substituted.

However, R" preferably represents an unsubstituted aryl group or a heterocyclic group substituted, for example, by cyano, chloro, fluoro, bromo, iodo, alkyl- or arylcarbonyl, alkyl- or aryloxycarbony, acyloxy, carbonamido, alkyl- or arylcarbonamido, alkyl- or aryloxycarbonamido, alkyl- or arylsulfonyl, alkyl- or arylsulfonyloxy, alkyl- or aryloxysulfonyl, alkyl- or arylsulfoxide, alkyl- or arylsulfamoyl, alkyl- or arylsulfamoylamino, alkyl- or arylsulfonamide, aryl, alkyl, alkoxy, aryloxy, nitro, alkyl- or arylureido or alkyl- or arylcarbamoyl (all of which may be further substituted). Preferred examples of the group include halogen, cyano, alkoxycarbonyl, alkylsulfamoyl, alkylsulfonamide, alkylsulfonyl, carbamoyl, alkylcarbamoyl and alkylcarbonamido. In the case where R' represents an aryl group or a heterocyclic group, it may be similarly further substituted.

Preferred examples of the group represented by R" include 4-chlorophenyl, 3,4-dichlorophenyl, 3,4-difluorophenyl, 4-cyanophenyl, 3-chloro-4-cyanophenyl, pentafluorophenyl and 3- or 4-sulfonamidephenyl.

In the general formula (IA), Z represents a hydrogen atom or a group that is releasable by a coupling reaction with an oxidized product of an aromatic primary amine color developing agent. Preferred examples of Z include hydrogen, chlorine, fluorine, substituted aryloxy and mercaptotetrazolyl, and more preferably it may be hydrogen or chlorine.

The chemical equivalence of the coupler, i.e., whether it is a divalent coupler or a tetravalent coupler, is determined by Z, and the reactivity of the coupler can be changed by the kind of Z. Examples of such a group include those exerting, after released from the coupler, such functions as dye formation, adjustment of dye hue, acceleration or suppression of development, acceleration or suppression of bleaching, facilitation of electron migration, and color compensation, so as to apply favorable effects on the layer containing the coupler and the other layers in the photographic recording material.

Representative examples of the coupling releasing group include halogen, alkoxy, aryloxy, heterocyclic oxy, sulfonyloxy, acyloxy, acyl, heterocyclic, sulfonamide, heterocyclic thio, benzothiazolyl, phosphonyloxy, alkylthio, arylthio and arylazo. The coupling releasing group is disclosed, for example, in U.S. Pat. Nos. 2,455,169, 3,227,551, 3,432,521, 3,467,563, 3,617,291, 3,880,661, 4,052,212, 4,134,766, British Patent No. 1,466,728, No. 1,531,927, No. 1,533,039, British Patent Application No. 2,066,755A and No. 2,017,704A (which are incorporated herein by reference). Among these, a halogen atom, an alkoxy group and an aryloxy group are most preferred.

Preferred examples of the coupling releasing group include —Cl, —F, —Br, —SCN, —$OCH_3$, —$OC_6H_5$, —$OCH_2C(=O)NHCH_2CH_2OH$, —$OCH_2C(O)NHCH_2CH_2OCH_3$, —$OCH_2C(O)NHCH_2CH_2$° C. (=O)$OCH_3$, —$P(=O)(OC_2H_5)_2$, —$SCH_2CH_2COOH$ and groups represented by the following structural formulae:

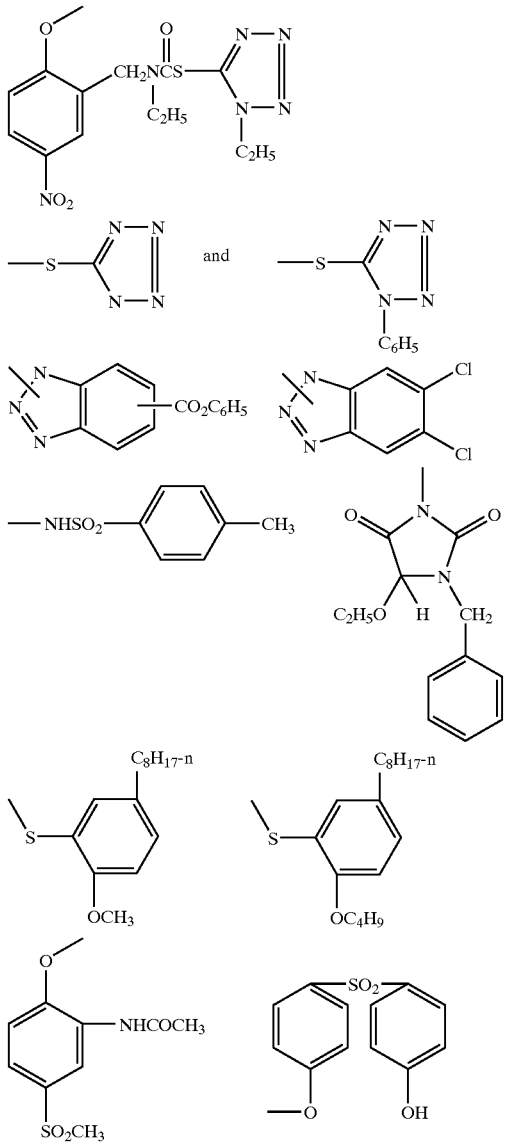

The coupling releasing group is generally a chlorine atom, a hydrogen atom or a p-methoxyphenoxy group.

Specific examples of the compound represented by the general formula (IA) will be shown below, but the invention is not limited thereto.

IC-1

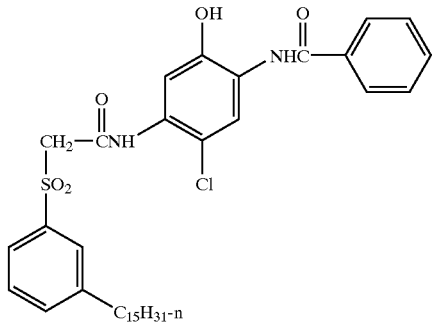

-continued
IC-2
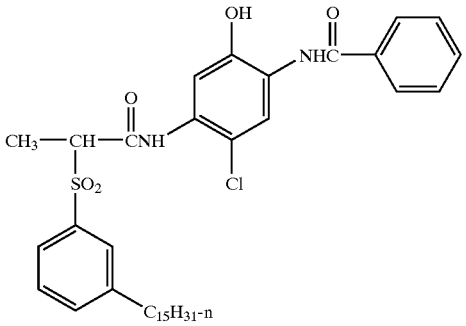
IC-3
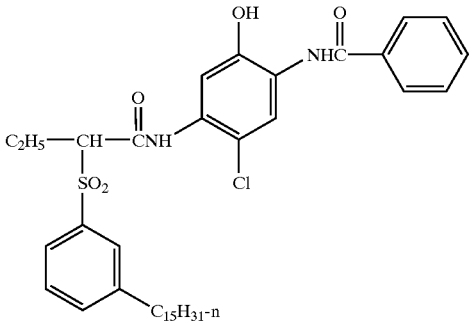
IC-4
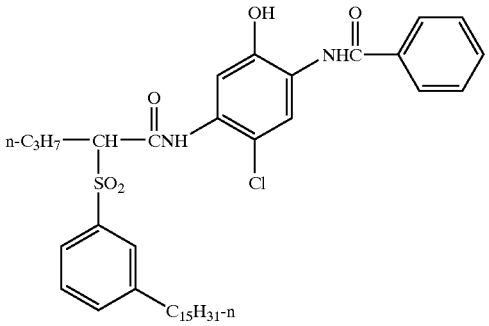
IC-5
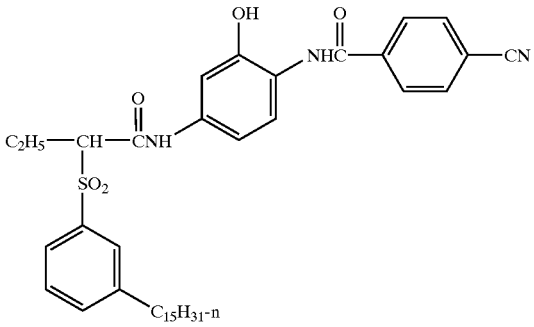
-continued
IC-6
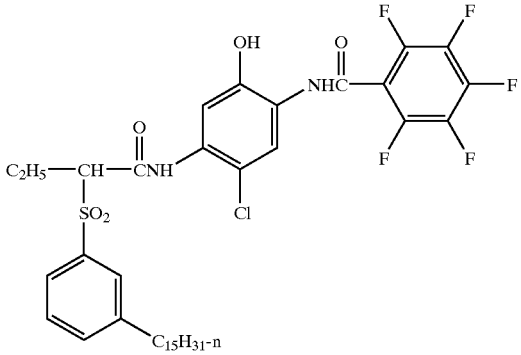
IC-7
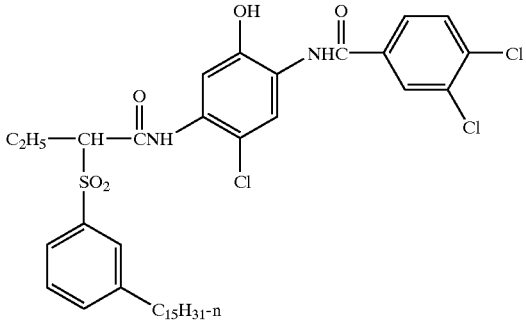
IC-8
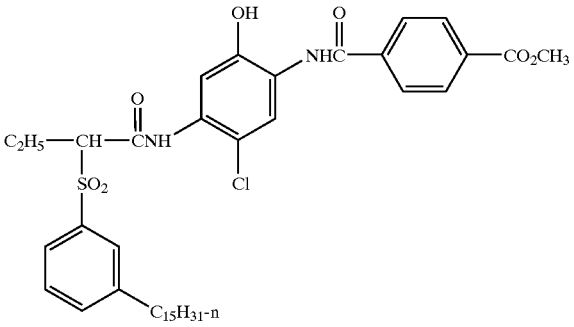
IC-9
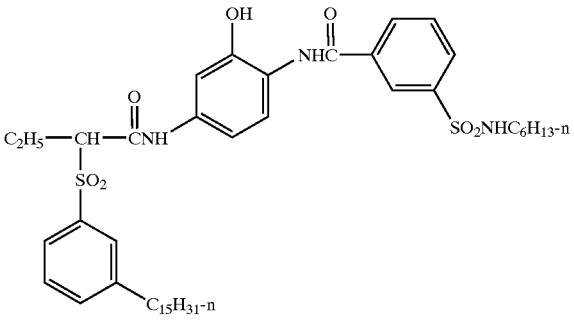

-continued
IC-10
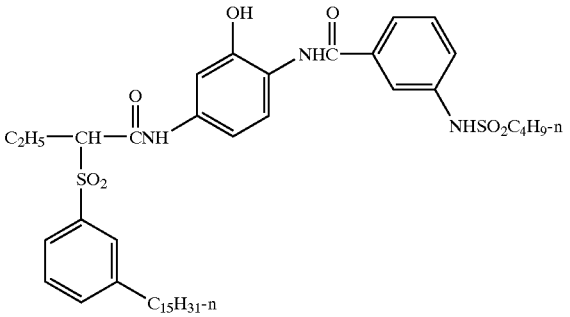
IC-11
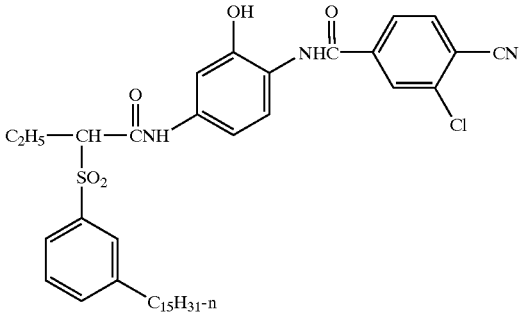
IC-12
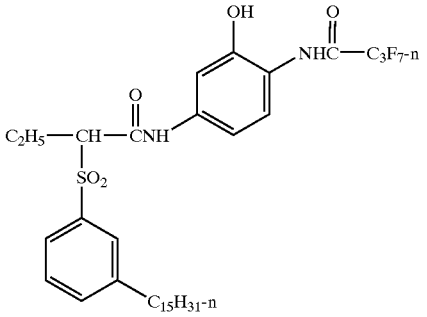
IC-13
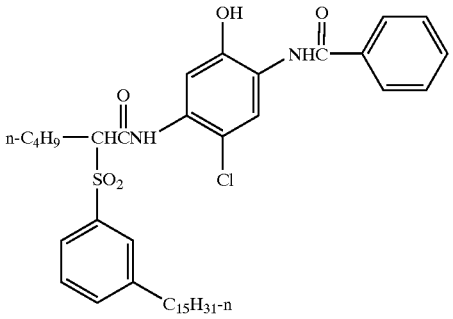
IC-14
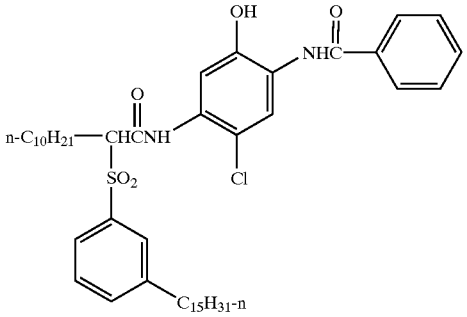
-continued
IC-15
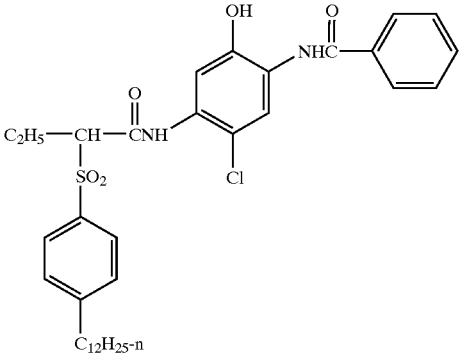
IC-16
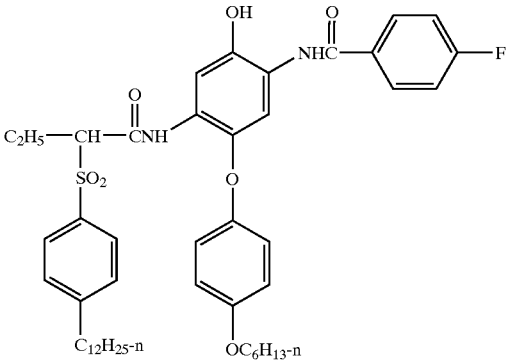
IC-17
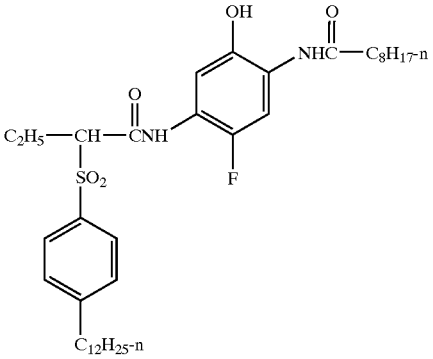
IC-18
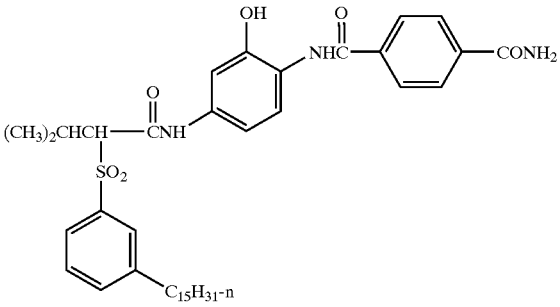

-continued
IC-19
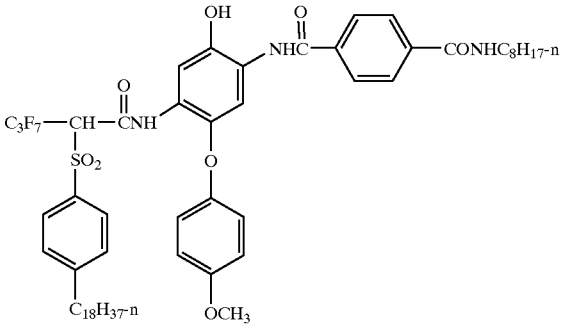
IC-20
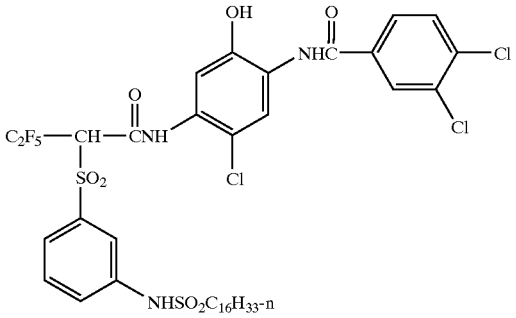
IC-21
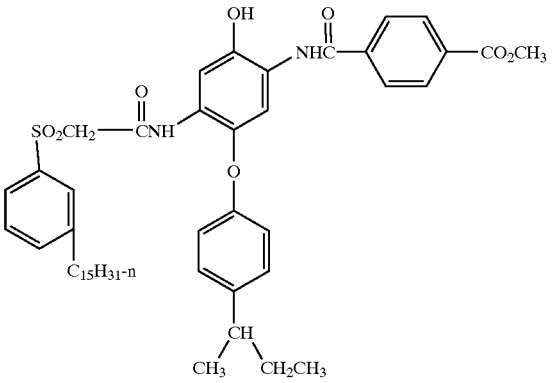
IC-22
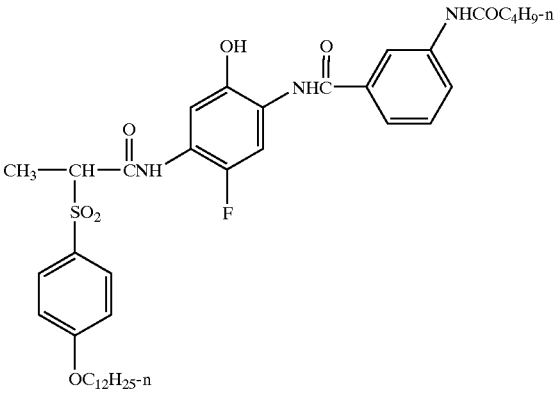
-continued
IC-23
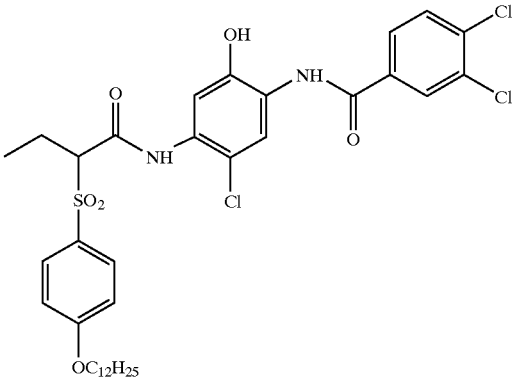
IC-24
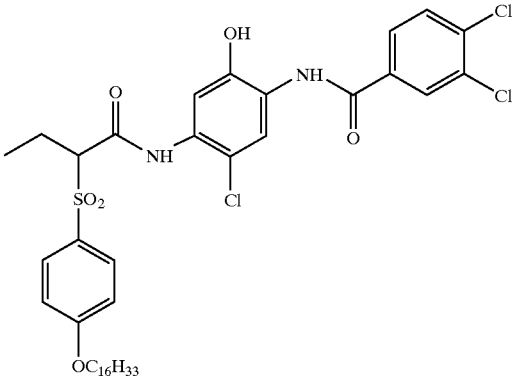
IC-25
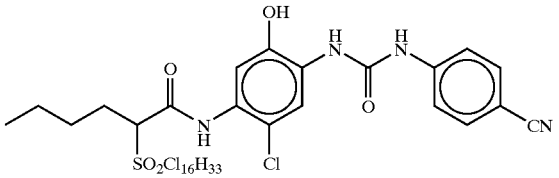
IC-26
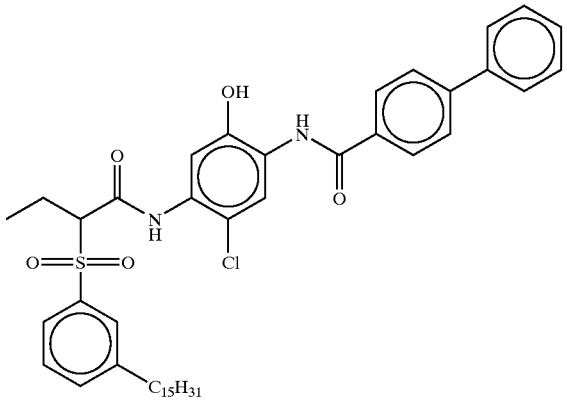

-continued

IC-27

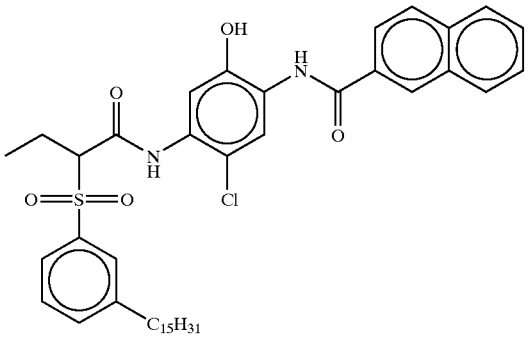

IC-28

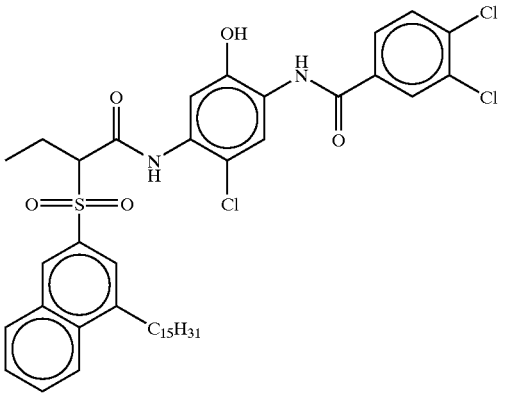

As the magenta dye-forming coupler (hereinafter sometimes simply referred to as a "magenta coupler") used in the invention, a 5-pyrazolone magenta coupler and a pyrazoloazole magenta coupler are generally used as shown in the known literatures noted in the foregoing table, and among these, from the standpoint of hue, image stability and coloring property, a pyrazoloazole coupler having a secondary or tertiary alkyl group directly bonded to the 2-, 3- or 6-position of the pyrazolotriazole ring disclosed in JP-A No. 61-65245, a pyrazoloazole coupler containing a sulfonamide group in the molecule disclosed in JP-A No. 61-65246, a pyrazoloazole coupler having an alkoxyphenylsulfoneamide ballast group disclosed in JP-A No. 61-147254, and a pyrazoloazole coupler having an alkoxy group or an aryloxy group at the 6-position disclosed in EP 226,849A and EP 294,785A are preferably used. In particular, a pyrazoloazole coupler represented by the general formula (M-1) disclosed in JP-A No. 8-122984 is preferred as the magenta coupler, and paragraphs 0009 to 0026 of that literature is incorporated herein by reference. In addition to the foregoing, a pyrazoloazole coupler having steric hindrance groups at both the 3- and 6-positions disclosed in EP 854,384 and EP 884,640 is also preferably used.

Examples of the yellow dye-forming coupler (hereinafter sometimes simply referred to as a "yellow coupler") used in the fifth and twenty first embodiment of the invention include those described for the first and thirteenth embodiments, and preferred examples thereof are also the same.

It is preferred that the couplers used in the invention are impregnated in a loadable latex polymer (disclosed, for example, in U.S. Pat. No. 4,203,716) in the presence (or absence) of a high boiling point organic solvent, and dissolved along with a water insoluble and organic solvent soluble polymer, followed by dispersing and emulsifying in the hydrophilic colloid aqueous solution. Preferred examples of the water insoluble and organic solvent soluble polymer include homopolymers and copolymers disclosed in U.S. Pat. No. 4,857,449, columns 7 to 15 and WO 88/00723, p. 12 to 30. Methacrylate series or acrylamide series polymers are preferably used, and particularly an acrylamide polymer is further preferably used, from the standpoint of color image stability.

In the fifth and twenty first embodiments of the invention, other components to be added (such as a color mixing prevention agent, an ultraviolet absorbent, a binder, a protective colloid, an antibacterium and antifungus agent and a surface active agent) are the same as those described for the first and thirteenth embodiments.

Process for Forming Image

The silver halide color photographic photosensitive material of the invention can be preferably applied to the following processes for forming a color image.

That is the photosensitive material can be applied to a process for forming a color image comprising steps of: scan-exposing the silver halide color photographic photosensitive material with a light beam modulated based on image information, and subjecting the photosensitive material to coloration development; a process for forming a color image comprising steps of: scan-exposing the silver halide color photographic photosensitive material with at least three light source units having wavelengths different from each other based on image information having been converted to halftone dots, in which at least one of the light source units is selected from a laser light source and a light emitting diode; and a process for forming a color image comprising steps of: imagewise exposing the silver halide color photographic photosensitive material, subjecting the photosensitive material to coloration development, subjecting the photosensitive material to at least one of desilvering, water washing and stabilization, and drying the photosensitive material, so as to form a color image, in which a period of time for the color development treatment is from 3 to 25 seconds, and a total period of time from start of the color development treatment to completion of the drying step is from 10 to 100 seconds.

In the photosensitive material of the invention, an image can be formed through an exposing step of irradiating with light corresponding to image information, and a developing step of developing the photosensitive material thus irradiated with light.

The photosensitive material of the invention is suitable for a scanning exposure system using a cathode ray tube (CRT), as well as an ordinary printing system using a negative printer. A cathode ray tube exposing apparatus is convenient and compact and of low cost, in comparison to an apparatus using a laser. Furthermore, adjustments of the light axis and color are also easy. In the cathode ray tube used for imagewise exposure, various kinds of luminous materials emitting light in necessary spectral bands. For example, one kind of or a mixture of two or more kinds of a red luminous material, a green luminous material and a blue luminous material is used. The spectral bands are not limited to red, green and blue as in the foregoing, but fluorescent materials emitting light in yellow, orange violet colors or in an infrared band. In particular, such a cathode ray tube is often used that emits white light by mixing the luminous materials.

In the case where the photosensitive material has plural photosensitive layers having different spectral sensitivity distributions, and the cathode ray tube also has a fluorescent material emitting light in plural spectral bands, exposure may be carried out with plural kinds of colors at a time, i.e., image signals of plural colors are input in the cathode ray tube to emit light. It is possible to employ such a system that image signals of respective colors are sequentially input to emit light of respective colors in a sequential manner, and exposure is carried out by using a film that cuts other colors than the color to be used for the exposure (surface sequential exposure). In general, the surface sequential exposure is preferred from the standpoint of high image quality because a cathode ray tube having high resolution can be used.

The photosensitive material of the invention can be preferably applied to a digital scanning exposure system using monochrome high density light, such as a gas laser, a light emitting diode, a semiconductor laser, and a secondary harmonic wave generator (SHG) light source constituted with a combination of a semiconductor laser or a solid laser using a semiconductor laser as an exciting light source with a nonlinear optical crystal. In order to construct a compact and low cost system, it is preferred to use a semiconductor laser or a secondary harmonic wave generator (SHG) light source constituted with a combination of a semiconductor laser or a solid laser with a nonlinear optical crystal. Particularly, in order to design an apparatus of low cost, long service life and high stability, the use of a semiconductor laser is preferred, and it is also preferred that a semiconductor laser is used as at least one of the exposure light sources.

In the case where the scanning exposure light source is used, the spectral sensitivity maximum wavelength of the photosensitive material of the invention can be arbitrarily set depending on the wavelength of the scanning exposure light source used. In the case of the SHG light source constituted with a combination of a solid laser using a semiconductor laser as an exciting light source or a semiconductor laser with a nonlinear optical crystal, the oscillation wavelength of the laser can be reduced into half, and thus blue light and green light can be obtained. Therefore, the spectral sensitivity maximum of the photosensitive material can generally be positioned in three wavelength bands of blue, green and red. The exposure time in the scanning exposure is preferably $10^{-4}$ second or less, and more preferably $10^{-6}$ second or less, as it is defined as a period of exposing a pixel having a size corresponding to a pixel density of 400 dpi.

Exposure may be carried out on the same photosensitive layer plural times, and in this case, it is preferred to carry out at least three times. Particularly preferably the exposure time is from $10^{-4}$ to $10^{-8}$ second, and in the case where the exposure time is from $10^{-5}$ to $10^{-8}$ second, the exposure is preferably carried out at least eight times. The light source is not limited, and examples thereof include a gas laser, a solid laser (LD), an LED (inorganic and organic) and a Xe light source with a narrowed spot, with a solid laser and an LED being preferred. The light source is necessarily spectralized to the sensitive wavelengths of the respective dye forming layers, and in order therefor, a suitable color filter (such as inclusion and vapor-deposition of a dye) may be used, or the oscillation wavelength of an LD and an LED is properly selected. Furthermore, both of them may be used in combination. The spot diameter of the light source is not particularly limited and is preferably from 5 to 250 $\mu$m, and particularly preferably from 10 to 100 $\mu$m, in terms of a half value width of light intensity. The shape of the spot may be any of a circular shape, an elliptical shape and a rectangular shape. The distribution of the amount of light in one spot may exhibit Gaussian distribution or may be trapezoid with relatively uniform intensity. The light source may be a single light source or may be an array containing plural light sources.

In the invention, the exposure is generally carried out by scanning exposure, and the light source may be scanned, or in alternative, the photosensitive material may be scanned. The exposure time for one time is defined by the following equation.

$$\text{exposure time} = \text{spot diameter}/\text{moving speed of light source (or moving speed of photosensitive material)}$$

The spot diameter herein means the diameter of the spot (half value width, unit: $\mu$m) in the direction that the light source used for the scanning exposure is moved upon exposure. The moving speed of the light source herein means the speed of movement per unit period of time (unit: $\mu$m/sec) of the light source used for the scanning exposure. In general, the spot diameter may not be the same as the diameter of the pixel and may be larger or smaller than it. The number of times of exposure herein means the number of times of irradiation of light that is caught by the layer of the same color sensitivity on one point (pixel) of the photosensitive material, and in the case where the exposure is carried out plural times, it means the number of times of exposure of an intensity of ⅕ or more of the maximum exposure intensity within the plural times of exposure. Therefore, exposure of an intensity of less than ⅕, stray light and overlap of the spots are not counted.

The silver halide color photographic photosensitive material of the invention can be preferably used in combination with exposure and development systems disclosed in the following known literatures. Examples of the development system include an automatic printing and development system disclosed in JP-A No. 10-333253, a photosensitive material transporting apparatus disclosed in JP-A No. 2000-10206, a recording system containing an image reading apparatus disclosed in JP-A No. 11-215312, an exposure system of a color image recording system disclosed in JP-A No. 11-88619 and No. 10-202950, a digital photographic printing system containing a remote diagnosis system disclosed in JP-A No. 10-210206, and a photographic printing system containing an image recording apparatus disclosed in JP-A No. 10-159187.

Examples of the scanning exposure system that can be preferably applied in the invention are disclosed in the literatures shown in the foregoing table.

In the case where the photosensitive material of the invention is subjected to exposure in a printer, it is preferred to use a band stop filter disclosed in U.S. Pat. No. 4,880,726. Light color mixing can be removed by using the same, and thus the color reproducibility is considerably improved.

It is possible in the invention that a yellow micro-dot pattern is preliminarily exposed before applying image information to apply duplicate restriction.

Upon processing the photosensitive material of the invention, processing materials and processing methods disclosed in JP-A No. 2-207250, line 1 of right lower column of page 26 to line 9 of right upper column of page 34 and JP-A No. 4-97335, line 17 of left upper column of page 5 to line 20 of right lower column of page 18 can be preferably applied. As a preservative used in a developer solution, compounds disclosed in the literatures shown in the foregoing table can be preferably used.

Known or commercially available diaminostilbene fluorescent whitening agent may be used in a coloration developer solution. As the known bistriazinylaminostilbene disulfonate compound, compounds disclosed in JP-A No. 6-329936, No. 7-140625 and No. 10-104809 are preferred.

The known compounds are disclosed, for example, in "Senshoku Note" (Dyeing Note), 19th edition, p. 165 to 168 (Shikisensha Co., Ltd.), and among the products disclosed therein, Blankophor UWliq, Blankophor REU and Hakkol BRK are preferred. The following compounds FL-1 to FL-3 are preferably used. It is preferred to use the following compound SR-1 as a remaining coloration suppressing agent.

FL-1

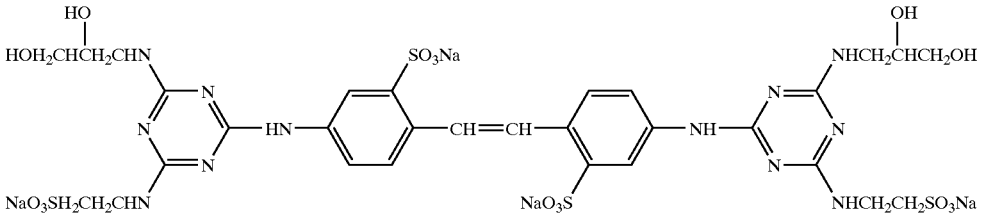

FL-2

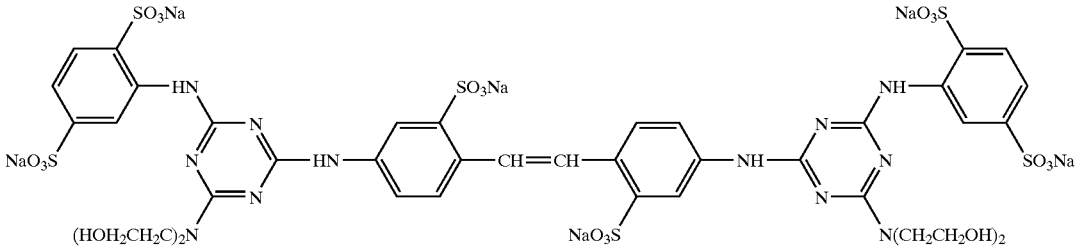

FL-3

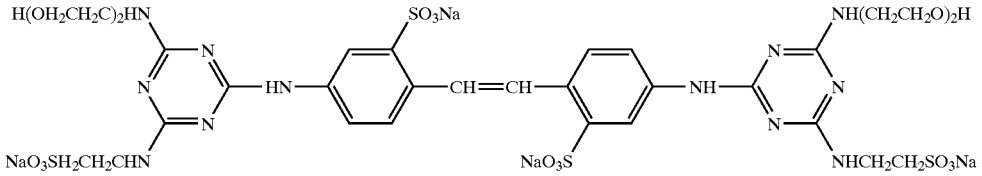

SR-1

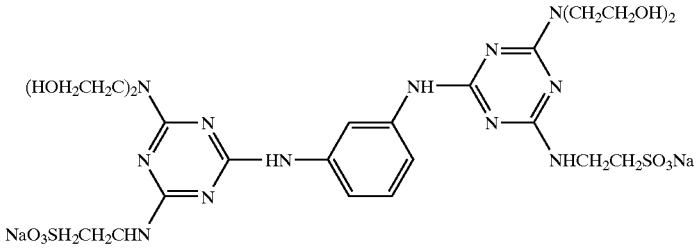

Representative examples of the coloration developing process upon defining the hue and the white background in the invention include MINILAB PP350 produced by Fuji Photo Film Co., Ltd., in which while CP48S chemicals are used as a processing agent, imagewise exposure is carried out on a sample of the photosensitive material from a negative film having the average density, and the sample is processed with such a processing solution that has been subjected to continuous processing until the volume of a replenisher of the coloration developer solution becomes twice the capacity of the coloration development tank.

As the chemicals for the processing agent, for example, CP45X and CP47L produced by Fuji Photo Film Co., Ltd. and RA-100 and RA-4 may also be used.

The invention can be preferably applied to a photosensitive material having applicability to a quick process. Upon carrying out the quick process, the coloration developing time is preferably 60 seconds or less, more preferably from 3 to 50 seconds, and further preferably from 3 to 25 seconds. Similarly, the blix time is preferably 60 seconds or less, more preferably from 3 to 45 seconds, and further preferably from 3 to 25 seconds. The water washing or stabilizing time is preferably 90 seconds or less, and more preferably from 3 to 40 seconds. The drying time is preferably 90 seconds or less, more preferably 20 seconds or less, and most preferably 10 seconds or less. While the bleaching (desilvering), the water washing and the stabilization may be arbitrarily carried out, the total process time from the start of the coloration development to the completion of the drying is the sum of the foregoing periods of time and is preferably from 10 to 100 seconds.

The coloration developing time herein means the period from the time when the photosensitive material enters the coloration developing solution to the time when the photosensitive material enters the blix solution as the next process step. For example, in the case where the processing is carried out with an automatic developing machine, the coloration developing time means the sum of the period of time while the photosensitive material is immersed in the coloration developing solution (i.e., so-called submerged time) and the period of time while the photosensitive material is transported in the air toward the blix bath as the next process step (i.e., so-called aloft time). Similarly, the blix time means the period from the time when the photosensitive material enters the blix solution to the time when the photosensitive material enters the water washing or stabilizing bath as the next process step. The water washing or stabilizing time means the period from the time when the photosensitive material enters the water washing or stabilizing bath to the time when the photosensitive material exits from the bath toward the next drying step (i.e., so-called submerged time).

Usable examples of the method for developing the photosensitive material of the invention after exposure include wet processes, such as a method of developing with a conventional developer solution containing an alkali agent and a developing agent, and a method of developing with an activator solution, such as an alkaline solution containing no developing agent, while a developing agent is contained in the photosensitive material, as well as a heat developing method using no processing solution. In particular, the activator method is preferred because the developing agent is not contained in the processing solution, whereby control and handling of the processing solution are convenient, and the load upon treating the processing solution is light, which is also preferred from the standpoint of environmental protection.

In the activator method, the developing agent or a precursor thereof contained in the photosensitive material is preferably hydrazine compounds disclosed in JP-A No. 8-234388, No. 9-152686, No. 9-152693, No. 9-211814 and No. 9-160193.

Such a developing method is also preferably employed that the coated silver amount of the photosensitive material is decreased, and an image amplification process (power-assisted process) is carried out by using hydrogen peroxide. In particular, this method is preferably applied to the activator method. Specifically, an image formation process using an activator solution containing hydrogen peroxide disclosed in JP-A No. 8-297354 and No. 9-152695 is preferably employed. In the activator method, while the photosensitive material is generally subjected to a desilvering process after processing with an activator solution, such a convenient method can be used in the image amplification process using a photosensitive material having a low silver content that the desilvering process is omitted but a water washing or stabilizing process is carried out. In the method where image information is read out from the photosensitive material with a scanner, it is possible to use such a processing mode that does not require desilvering process even in the case where a photosensitive material having a high silver content, such as a photosensitive material for picturing, is used.

As the processing materials and the processing methods for the activator solution, a desilvering solution (bleaching/fixing solution) and the water washing and stabilizing solution, those known in the art can be used. Preferably, those disclosed in Research Disclosure, item 36544 (September of 1994), p. 536 to 541 and JP-A No. 8-234388 can be used.

The effect of the invention can be preferably applied to a color photosensitive material for digital direct color proof using a silver halide color photosensitive material (hereinafter referred to as a proof photosensitive material), a digital direct color proof system and an image formation method therefor.

A proof photosensitive material is generally such a silver halide color photosensitive material comprising a support having thereon silver halide photosensitive layers forming a yellow dye, a magenta dye and a cyan dye, which has such hue that is approximated to printing ink. It is exposed with three or more light source units having different wavelengths based on image information having been converted to halftone dots, so as to form an image of area modulation. A fourth photosensitive layer may be provided for such purposes that both solid black (chromaticity and Dmax) and solid color (chromaticity and Dmax) are well realized (i.e., improvement of color reproducibility), and a black print is discriminated. In this case, plural (for example, three or four) light sources having different wavelengths are used as the exposure light source. The exposure light source often has plural units for per one of the light sources of the respective colors (for example, 8 or more units are preferably contained for the same wavelength). While an LED, an LD and other devices can be used, it is preferably selected from a semiconductor laser and a light emitting diode. As the exposure light source, light sources of any wavelength, such as visible region, e.g., blue, green, red, and infrared region, and these may be arbitrarily combined.

Specifically, the following direct digital color proof system, for example, is preferred. That is, the photosensitive material is automatically drawn from a magazine and cut into a sheet form. It is wound on an outer drum for exposure and rotated, to which scanning exposure is carried out based on image information having been converted to halftone dots by using an exposure array light source having three light source units having different wavelengths, each of which comprises 8 units combined, whereby a halftone dot image of area modulation is recorded at a resolution of 2,000 dpi or more. Thereafter, the color photosensitive material is automatically subjected to a developing process with an automatic developing machine to output a halftone dot color proof image having an A3 size (a system providing a B1 size can be provided depending on necessity). However, when the invention is applied to color proof, it is not limited to the proof photosensitive material, the system and the image formation method described in the foregoing.

The effect of the invention can be applied to direct digital color proof systems, image formation processes and proof photosensitive materials that have one or more of the following features. That is, the resolution is 2,400 dpi, and the diameter of the exposure beam for one dot is from 0.5 to 50 $\mu$m in terms of a half value width of light intensity; the exposure time for exposing one dot with at least one exposure light source is from 10-8 to $10^{-2}$ second; the rotation number of the outer drum is from 100 to 4,000 rpm; at least one exposure light sources has a wavelength of 700 nm or more; the exposure amount of at least one exposure light sources is of two or more steps; the exposure energy of the exposure light source having the largest wavelength is 1.1 times or more the other exposure energy; the photosensitive material after exposure is released from the outer drum and transported in such a manner that the exposed surface is directed downward; the photosensitive material is transported in the color developer solution, the blix solution and the water washing bath of the automatic developing machine in such a manner that the photosensitive material is directed downward; the period from the time when the exposure of the photosensitive material is completed to the time when a tip end of the photosensitive material enters the coloration developer solution is from 20 seconds to 3 minutes; the difference between the period from the time when the exposure is completed to the time when a front tip end in the transporting direction of the exposed photosensitive material enters the color coloration developing solution and the period from the time when the exposure is completed to the time when the back tip end in the transporting direction of the photosensitive material enters the color coloration developer solution is from 1 to 10 minutes; the processing time of the color coloration developer solution and the blix solution is from 10 to 100 seconds, and the difference in processing time is 30 seconds or less; the processing tanks of the color coloration developer solution and the blix solution are from 8 to 20 L; the water washing tank contains from 2 to 5 baths; the color coloration developer solution and the blix solution are supplied to a united kit, the replenishing amount of the color coloration developer solution is from 50 to 300 ml per 1 $m^2$ of the photosensitive material, the replenishing amount of the blix solution is from 30 to 250 ml per 1 $m^2$ of the photosensitive material, the replenishing amount of the washing water is from 50 to 1,000 ml in total of the washing water, and they are supplied upon automatically sensing the area of the photosensitive material to be processed; at least one aerial tern transporting rollers of the automatic developing machine has a mechanism of automatic water washing; at least guide plates in contact with the emulsion surface of the photosensitive material used a Teflon material; such a calibration mechanism is provided that a particular image is recorded upon proof printing or other output printing, and the image density or the chromaticity thereof is measured, or the image is compared with the objective image with naked eyes, whereby the change in sensitivity due to the difference among lots and the time-lapse change of the photosensitive material, the change in temperature and humidity upon exposure, and the change in conditions of the processing solutions is compensated; such a calibration mechanism is provided that is carried out with a continuous tone image having a density lower than Dmax of the photosensitive material; calibration can be carried out by judgement with naked eyes, density measurement or measurement of color difference of a flat tint image of from 20 to 80%; photosensitive materials having the same size are supplied from two or more magazines, and when the photosensitive material in one magazine runs out, the photosensitive material in the other magazine is automatically supplied; photosensitive materials having different sizes are simultaneously supplied from different magazines to carry out automatic size switching; the wound length of one photosensitive material is from 30 to 100 m; the period from the time when the photosensitive material is withdrawn from the magazine to the time when the exposure is started after completing the withdrawal is from 10 to 100 seconds; a black print image is constituted with yellow, magenta and cyan; the difference in dot gain among the respective colors constituting the black print is 5% or less; the total thickness of the support used in the photosensitive material is from 50 to 150 $\mu$m; the thickness of the front surface lamination of the support used in the photosensitive material is from 10 to 50 $\mu$m; the thickness of the back surface lamination of the support used in the photosensitive material is from 10 to 50 $\mu$m; a back layer having a thickness of from 0.1 to 30 $\mu$m is provided on the surface of the photosensitive material opposite to the side, on which the photosensitive layers are provided; the total thickness of the surface having photosensitive silver halide of the photosensitive material is from 3 to 30 $\mu$m; the difference between the total thickness of the surface having photosensitive silver halide and the total thickens of the back surface of the photosensitive material is 10 $\mu$m or less; the silver chloride content of the photosensitive silver halide used in the photosensitive material is 90% or more; such a photosensitive material is used that is worked to be rolled with the emulsion surface directed outward; at least one layer has a maximum spectral sensitivity at a wavelength of 700 nm or more; and the photosensitive material having been cut into a sheet form is wound on a drum with a squeeze roller.

The shape of the spot may be any of a circular shape, an elliptical shape and a rectangular shape. The distribution of the amount of light in one spot may exhibit Gaussian distribution or may be trapezoid with relatively uniform intensity. The light source may be a single light source or may be an array containing plural light sources.

The exposure method and the image formation method using a laser, an LED or an array thereof as the light source are disclosed in detail in JP-A No. 10-142752, No. 11-242315, No. 2000-147723, No. 2000-246958, No. 2000-354174, No. 2000-206654 and EP 1,048,976A, which are preferably used in the invention.

Specific details are as follows.

Preferred embodiments of the exposure light source are disclosed in JP-A No. 2000-147723, paragraph 0022, and No. 2000-206654, paragraphs 0053, 0059 to 0061 and 0064 to 0067, which are preferably applied to the invention.

Preferred embodiments of the shape of the beam of the exposure light source and the array of the exposure light source are disclosed in JP-A No. 2000-147732, paragraphs 0022 to 0023, and No. 2000-206654, paragraphs 0025 to 0030, which are preferably applied to the invention.

In order to improve the productivity upon exposure, such a method is excellent that the photosensitive material is wound on a drum and subjected to scanning exposure. Preferred embodiments of the light source therefor include an LED array disclosed in JP-A No. 2000-246958, and an image recording apparatus disclosed in JP-A No. 2000-246958 having the LED array is more preferably applied to the invention. The method for winding on the drum is disclosed in JP-A No. 2000-206654, paragraphs 0057 to 0058 and 0062 to 0063, which are preferably applied to the invention.

It is also preferred that calibration is carried out in a method disclosed in EP 1,048976A to form an image in a stable manner, which can be applied to the invention.

As the method for converting digital image data to image data for exposure and the method for exposure treatment that are preferably employed upon producing a color proof in the invention, those disclosed in JP-A No. 2000-354174 and No. 2000-147723 can be used as they are. More specifically, a color proof producing apparatus disclosed in FIG. 1 of JP-A No. 2000-354174 can be used, and descriptions in FIGS. 1 to 4 including FIG. 1, paragraphs 0011 to 0021, the first sentence of paragraph 0022 and paragraphs 0034 to 0057 are incorporated herein by reference.

EXAMPLES

The invention will be specifically described with reference to the following examples, but the invention is not construed as being limited thereto.

Example 1

<Preparation of Emulsions for Blue Sensitive Layer A-1 and A-2 of Invention>

46.3 ml of a 10% NaCl aqueous solution was added to 1.06 L of deionized distilled water containing 5.7% by weight of deionized gelatin, and 46.4 ml of $H_2SO_4$ (1 N) was further added thereto. After adding 0.012 g of the compound (X) thereto, the temperature of the solution was adjusted t 60° C., and immediately, at that time, 0.1 mole of silver nitrate and 10.1 mole of NaCl were added to the reaction vessel over 10 minutes under high speed stirring. Subsequently, 1.5 mole of silver nitrate and an NaCl solution were added over 60 minutes in a flow rate accelerating method, in which the final addition rate became four times the initial addition rate. 0.2% by mole of silver nitrate and an NaCl solution were added at a constant addition rate over 6 minutes. At this time, $K_3IrCl_5(H_2O)$ was added to the NaCl solution in an amount of $5\times10_{-7}$ mole per total silver content to dope aquotized iridium to particles. 0.2 mole of silver nitrate, 0.18 mole of NaCl and 0.02 mole of a KBr solution were added thereto over 6 minutes. At this time, $K_4Ru(CN)_6$ and $K_4Fe(CN)_6$ were dissolved in the halogen aqueous solution in an amount of 0.5×10-5 mole per total silver content to add to the silver halide particles.

During the final step of particle growth, a KI aqueous solution was added to the reaction vessel over 1 minute in an amount corresponding to 0.001 mole per total silver content. The timing of the start of the addition was the point when 93% of the total particle formation was completed.

Thereafter, a sedimentation agent, i.e., the compound (Y), was added at 40° C., and the pH was adjusted to about 3.5, to carry out desalting and water washing.

Compound X

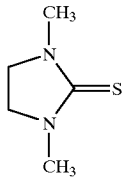

Compound Y

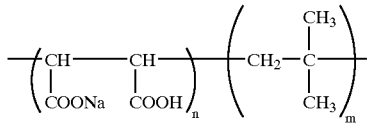

n and m each represents an integer.

The emulsion particles were maintained at 60° C., and $2.5\times10^{-4}$ mole/Ag and $2.0\times10^{-4}$ mole/Ag of the spectral sensitizing dye 1 and the spectral sensitizing dye 2, respectively, were added. $1\times10^{-5}$ mole/Ag of the thiosulfonic acid compound 1 was added, and a fine particle emulsion of particles containing 90% by mole of silver bromide and 10% by mole of silver chloride having an average particle diameter of 0.05 μm doped with iridium hexachloride was added, followed by aging for 10 minutes. Fine particles containing 40% by mole of silver bromide and 60% by mole of silver chloride having an average particle diameter of 0.05 μm was further added, followed by aging for 10 minutes. The fine particles were dissolved, and thus the silver bromide content of the cubic particles as a host was increased to 1.3 mole. Iridium hexachloride was thus doped at $1\times10^{-7}$ mole/Ag.

Subsequently, $1\times10^{-5}$ mole/Ag of sodium thiosulfate and $2\times10^{-5}$ mole of the gold sensitizer 1 were added. Immediately thereafter, the temperature of the mixture was increased to 60° C., followed by aging for 40 minutes, and the temperature is decreased to 50° C. Immediately after decreasing the temperature, $6\times10^{-4}$ mole/Ag each of the mercapto compounds 1 and 2 were added. After subsequent aging for 10 minutes, 0.008 mole per silver of a KBr aqueous solution was added. After aging for 10 minutes, the temperature was decreased, and the resulting emulsion was housed.

Consequently, a high sensitive emulsion for blue sensitive layer A-1 was produced.

Cubic particles having an average edge length of 0.55 μm and a variation coefficient of edge length of 9% were produced in the same manner as in the foregoing preparation process of the emulsion except for the temperature during the particle growth. The temperature during the particle growth was 55° C.

The spectral sensitization and the chemical sensitization were carried out at such amount that were compensated for the specific surface area (edge length ratio 0.7/0.55=1.27 times), so as to produce a low sensitive emulsion for blue sensitive layer A-2.

Spectral sensitizing dye 1

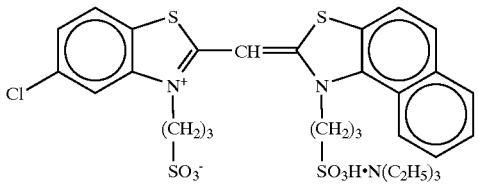

Spectral sensitizing dye 2

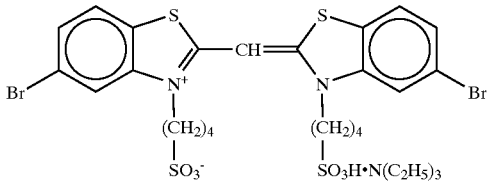

Thiosulfonic acid compound 1

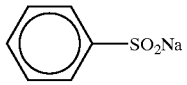

Mercapto compound 1

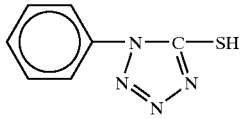

Mercapto compound 2

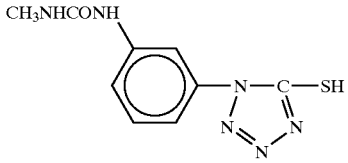

Gold sensitizing agent 1

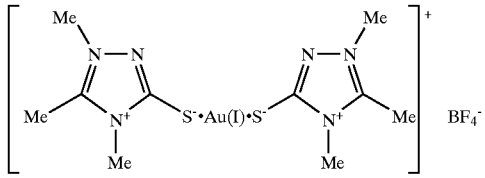

<Preparation of Emulsions for Green Sensitive Layer C-1 and C-2 of Invention>

A high sensitive emulsion for green sensitive layer C-1 and a low sensitive emulsion for green sensitive layer C-2 were produced in the same manner as in the preparation conditions for the emulsions A-1 and A-2 except that the temperature during the particle growth in the emulsion A-1 was decreased, and the kinds of the sensitizing dyes were changed as follows.

The particle size in the high sensitive emulsion C-1 was an average edge length of 0.40 μm, and that of the low sensitive emulsion C-2 was an average edge length of 0.30 μm. The variation coefficients thereof were 8%.

Sensitizing dye D

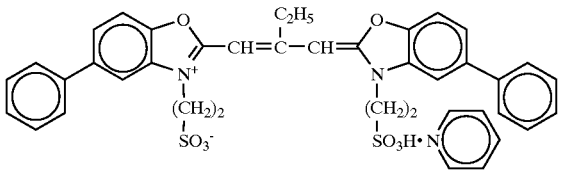

Sensitizing dye E

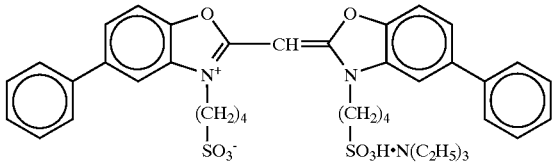

The sensitizing dye D was added in an amount of $3.0\times10^{-4}$ mole for the large size emulsion (high sensitive emulsion C-1) and in an amount of $3.6\times10^{-4}$ mole for the small size emulsion (low sensitive emulsion C-2) per 1 mole of silver halide, and the sensitizing dye E was added in an amount of $4.0\times10^{-5}$ mole for the large size emulsion and in an amount of $7.0\times10^{-5}$ mole for the small size emulsion per 1 mole of silver halide.

<Preparation of Emulsions for Red Sensitive Layer E-1 and E-2 of Invention>

A high sensitive emulsion for red sensitive layer E-1 and a low sensitive emulsion for red sensitive layer E-2 were produced in the same manner as in the preparation conditions for the emulsions A-1 and A-2 except that the temperature during the particle growth in the emulsion A-1 was decreased, and the kinds of the sensitizing dyes were changed as follows.

The particle size in the high sensitive emulsion E-1 was an average edge length of 0.38 μm, and that of the low sensitive emulsion E-2 was an average edge length of 0.32 μm. The variation coefficients thereof were 9% and 10%, respectively.

Sensitizing dye G

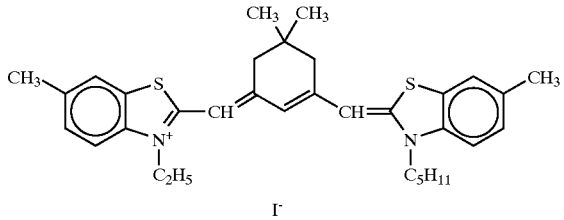

Sensitizing dye H

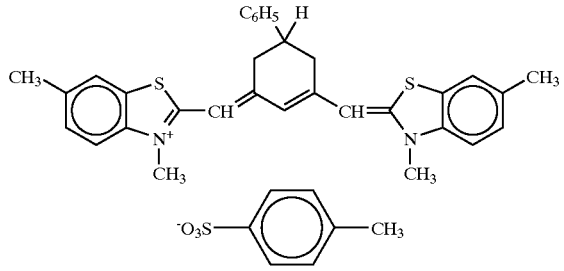

The sensitizing dyes G and H were added in an amount of $8.0\times10^{-5}$ mole, respectively, for the large size emulsion (high sensitive emulsion E-1) and in an amount of $10.7\times10^{-5}$ mole, respectively, for the small size emulsion (low sensitive emulsion E-2) per 1 mole of silver halide. Furthermore, the following compound I was added to the red sensitive layers in an amount of $3.0\times10^{-3}$ mole per 1 mole of silver halide.

Compound I

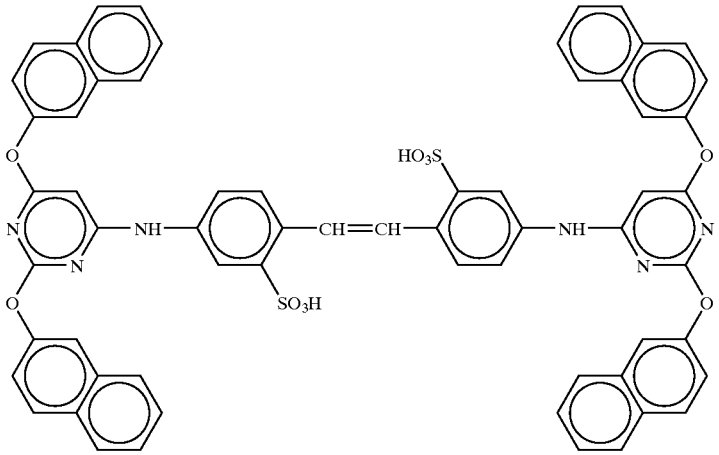

Preparation of Sample a-101

<Preparation of First Layer Coating Composition>

57 g of a yellow coupler (ExY), 7 g of a color image stabilizer (Cpd-1), 4 g of a color image stabilizer (Cpd-2), 7 g of a color image stabilizer (Cpd-3) and 2 g of a color image stabilizer (Cpd-8) were dissolved in 21 g of a solvent (Solv-1) and 80 ml of ethyl acetate. The resulting solution was dispersed and emulsified in 220 g of a 23.5% by weight gelatin aqueous solution containing 4 g of sodium dodecylbenzenesulfonate with a high speed agitation emulsifier (dissolver), and water was added thereto to produce 900 g of an emulsion dispersion A.

The emulsion dispersion A and the emulsions A-1 and A-2 were mixed and dissolved to prepare a first layer coating composition having the composition described later. The coating amounts of the emulsion are based on the coating amounts in terms of silver converted coated amounts.

<Preparation of Second to Seventh Layers Coating Composition>

Coating compositions for the second to seventh layers were prepared in the same manner as in the preparation of the first layer coating composition. As a gelatin hardener for the respective layers, a 1-oxy-3,5-dichloro-s-triazine sodium salts (H-1), (H-2) and (H-3) were used. Furthermore, Ab-1, Ab-2, Ab-3 and Ab-4 were added to the respective layers in total amounts of 15.0 mg/m$^2$, 60.0 mg/m$^2$, 5.0 mg/m$^2$ and 10.0 mg/m$^2$, respectively.

(H-1) Hardener

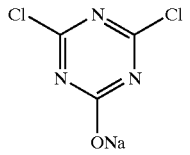

(used in 1.4 % by weight based on gelatin)

(H-2) Hardener

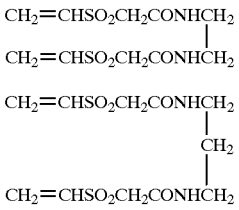

(H-3) Hardener

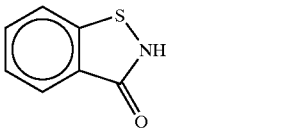

(Ab-1) Antiseptic (Ab-2) Antiseptic

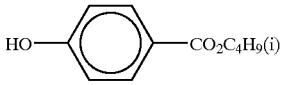

(Ab-3) Antiseptic

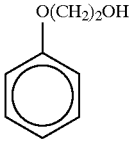

-continued (Ab-4) Antiseptic

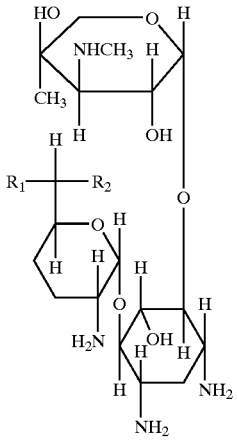

| | $R_1$ | $R_2$ |
|---|---|---|
| a | —$CH_3$ | —$NHCH_3$ |
| b | —$CH_3$ | —$NH_2$ |
| c | —H | —$NH_2$ |
| d | —H | —$NHCH_3$ |

mixing ratio of a/b/c/d = 1/1/1/1 ( by mole)

1-(3-Methylureidophenyl)-5-mercaptotetrazole was added to the second layer, the fourth layer, the sixth layer and the seventh layer in amounts of 0.2 mg/m$^2$, 0.2 mg/m$^2$, 0.6 mg/m$^2$ and 0.1 mg/m$^2$, respectively.

4-Hydroxy-6-methyl-1,3,3a,7-tetrazaindene was added to the blue sensitive emulsion layer and the green sensitive emulsion layer in amounts of $1\times10^{-4}$ mole and $2\times10^{-4}$ mole, respectively, per 1 mole of silver halide.

0.05 g/m$^2$ of a copolymer latex of methacrylic acid and butyl acrylate (weight ratio: 1/1, average molecular weight: 200,000 to 400,000) was added to the red sensitive emulsion layer.

Disodium catechol-3,5-disulfonate was added to the second layer, the fourth layer and the sixth layer in amounts of 6 mg/m$^2$, 6 mg/m$^2$ and 18 mg/m$^2$, respectively.

In order to prevent irradiation, the following dyes were added (the values in parentheses were the coated amounts).

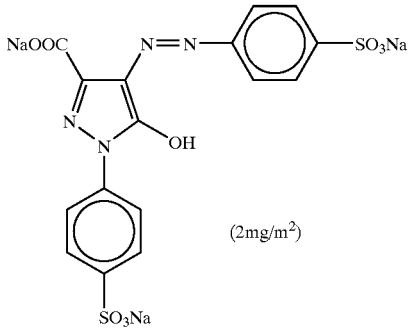

(2mg/m$^2$)

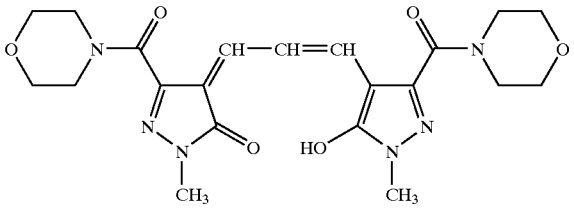

(2mg/m$^2$)

-continued

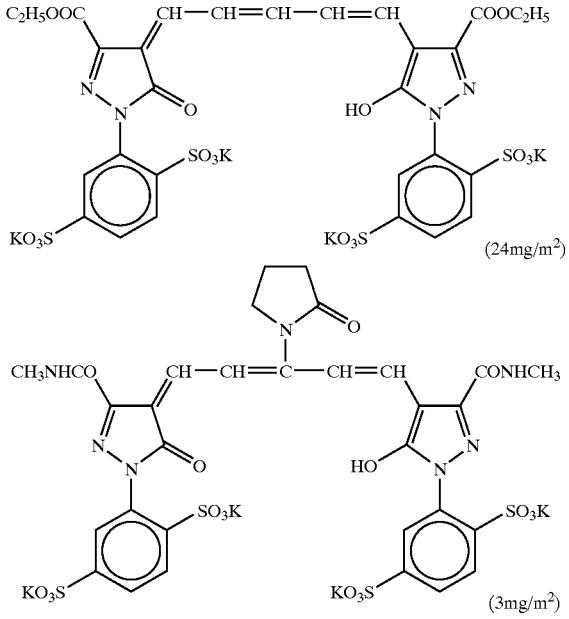

Layer Constitution

The constitutions of the respective layers are shown below. The numerals indicate coated amounts (g/m$^2$). The coating amounts of the silver halide emulsions are in terms of silver converted coated amounts.

<Support>

Polyethylene Resin Coated Laminated Paper (A white pigment ($TiO_2$; content: 16% by weight, ZnO; content: 4% by weight), a fluorescent whitening agent (4,4'-bis(5-methylnenzoxazolyl)stilbene; content: 0.03% by weight) and a blueish pigment (ultramarine blue pigment; content: 0.33% by weight) were contained in the polyethylene resin on the side of the first layer. The amount of the polyethylene resin was 29.2 g/m$^2$.)

<First Layer (Blue Sensitive Emulsion Layer)>

| | |
|---|---|
| Silver chloride emulsion A (cubic particles subjected to gold-sulfur sensitization, 3/7 (silver molar ratio) mixture of large size emulsion A-1 and small size emulsion A-2) | 0.24 |
| Gelatin | 1.25 |
| Yellow coupler (ExY) | 0.57 |
| Color image stabilizer (Cpd-1) | 0.07 |
| Color image stabilizer (Cpd-2) | 0.04 |
| Color image stabilizer (Cpd-3) | 0.07 |
| Color image stabilizer (Cpd-8) | 0.02 |
| Solvent (Solv-1) | 0.21 |

<Second Layer (Color Mixing Prevention Layer)>

| | |
|---|---|
| Gelatin | 1.15 |
| Color image stabilizer (Cpd-4) | 0.10 |
| Color image stabilizer (Cpd-5) | 0.018 |
| Color image stabilizer (Cpd-6) | 0.13 |
| Color image stabilizer (Cpd-7) | 0.07 |
| Solvent (Solv-1) | 0.04 |
| Solvent (Solv-2) | 0.12 |
| Solvent (Solv-5) | 0.11 |

<Third Layer (Green Sensitive Emulsion Layer)>

| | |
|---|---|
| Silver chloride emulsion C (cubic particles subjected to gold-sulfur sensitization, 1/3 (silver molar ratio) mixture of large size emulsion C-1 and small size emulsion C-2) | 0.14 |
| Gelatin | 1.21 |
| Magenta coupler (ExM) | 0.15 |
| Ultraviolet ray absorbent (UV-A) | 0.14 |
| Color image stabilizer (Cpd-2) | 0.003 |
| Color image stabilizer (Cpd-4) | 0.002 |
| Color image stabilizer (Cpd-6) | 0.09 |
| Color image stabilizer (Cpd-8) | 0.02 |
| Color image stabilizer (Cpd-9) | 0.01 |
| Color image stabilizer (Cpd-10) | 0.01 |
| Color image stabilizer (Cpd-11) | 0.0001 |
| Solvent (Solv-3) | 0.09 |
| Solvent (Solv-4) | 0.18 |
| Solvent (Solv-5) | 0.17 |

<Fourth Layer (Color Mixing Prevention Layer)>

| | |
|---|---|
| Gelatin | 0.68 |
| Color image stabilizer (Cpd-4) | 0.06 |
| Color image stabilizer (Cpd-5) | 0.011 |
| Color image stabilizer (Cpd-6) | 0.08 |
| Color image stabilizer (Cpd-7) | 0.04 |
| Solvent (Solv-1) | 0.02 |
| Solvent (Solv-2) | 0.07 |
| Solvent (Solv-5) | 0.065 |

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.16 |
| Gelatin | 0.95 |
| Cyan coupler (ExC-1) | 0.023 |
| Cyan coupler (ExC-2) | 0.05 |
| Cyan coupler (ExC-3) | 0.17 |
| Ultraviolet ray absorbent (UV-A) | 0.055 |
| Color image stabilizer (Cpd-1) | 0.22 |
| Color image stabilizer (Cpd-7) | 0.003 |
| Color image stabilizer (Cpd-9) | 0.01 |
| Color image stabilizer (Cpd-12) | 0.01 |
| Solvent (Solv-8) | 0.05 |

<Sixth Layer (Ultraviolet Ray Absorbing Layer)>

| | |
|---|---|
| Gelatin | 0.46 |
| Ultraviolet ray absorbent (UV-A) | 0.35 |
| Compound (S1-4) | 0.0015 |
| Solvent (Solv-7) | 0.18 |

<Seventh Layer (Protective Layer)>

| | |
|---|---|
| Gelatin | 1.00 |
| Acrylic modified polyvinyl alcohol copolymer (modification degree: 17%) | 0.4 |
| Liquid paraffin | 0.02 |
| Surface active agent (Cpd-13) | 0.02 |

(ExY) Yellow Coupler
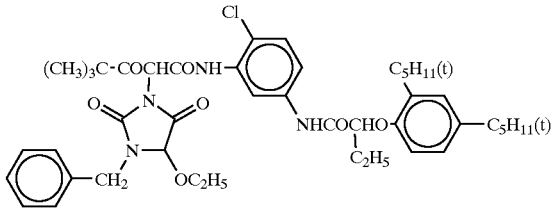
(ExM) Magenta Coupler
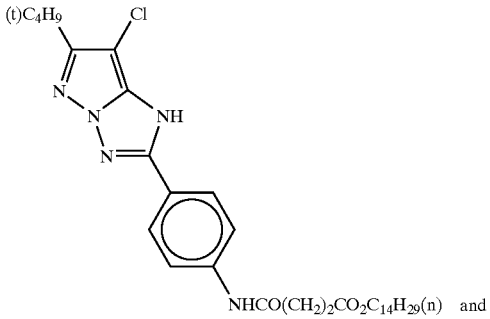
and
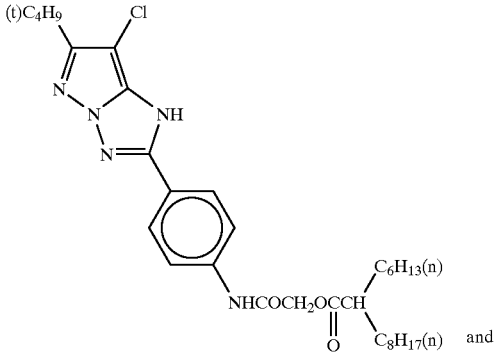
and
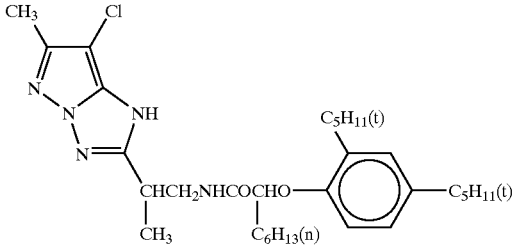
mixture of the above compounds at molar ratio of 40/40/20
(ExC-1) Cyan coupler
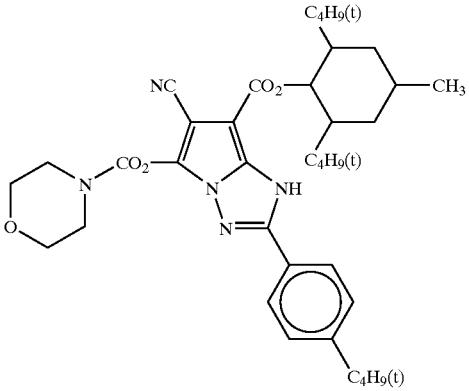
(ExC-2) Cyan coupler
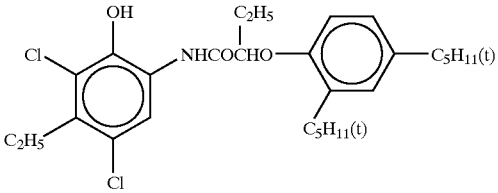
(ExC-3) Cyan coupler
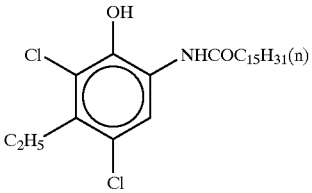
(Cpd-1) Color image stabilizer
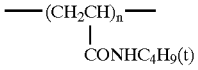
number average molecular weight: 60,000
(Cpd-2) Color image stabilizer
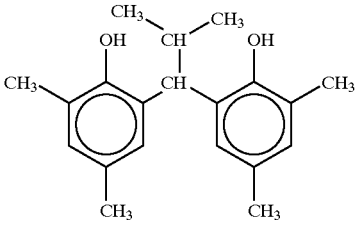
(Cpd-3) Color image stabilizer
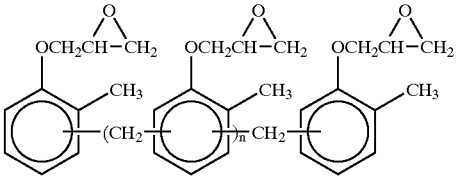
n = 7–8 (average value)

-continued (Cpd-4) Color mixing prevention agent

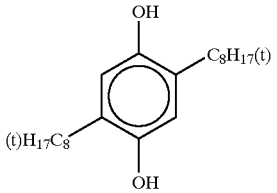

(Cpd-5) Color image stabilizer

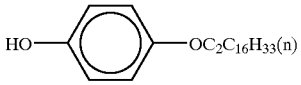

(Cpd-6) Color image stabilizer

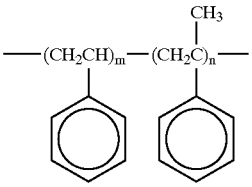

number average molecular weight: 600
m/n = 10/90

(Cpd-7) Color image stabilizer

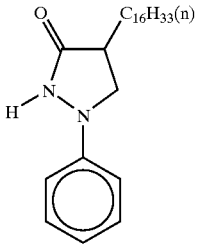

(Cpd-8) Color image stabilizer

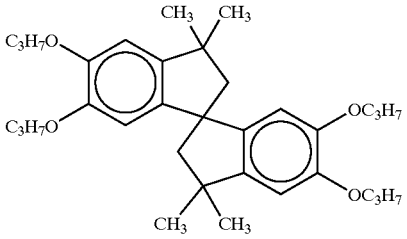

(Cpd-9) Color image stabilizer

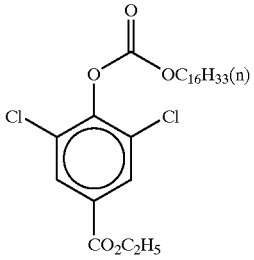

(Cpd-10) Color image stabilizer

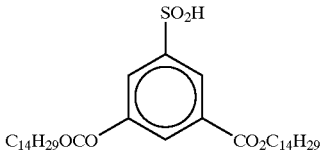

-continued (Cpd-11)

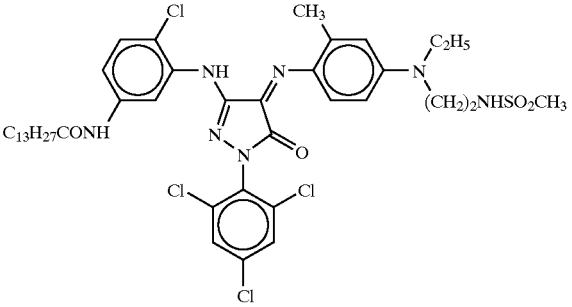

(Cpd-12)

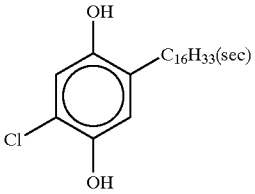

(Cpd-13) Surface active agent

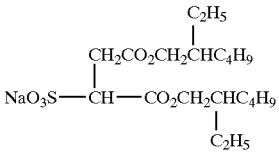

and

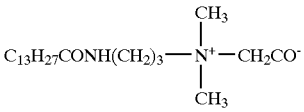

mixture of the above compound at molar ratio of 7/3

(Cpd-14)

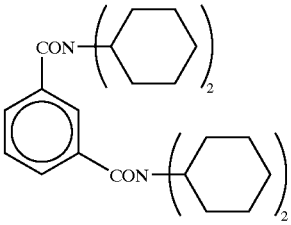

(Cpd-15)

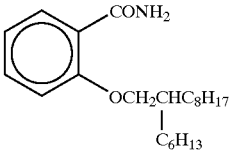

(Cpd-16)

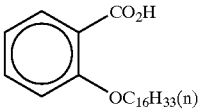

(Cpd-17)

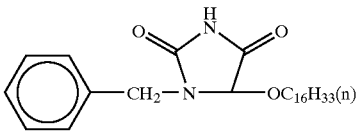

-continued
(Cpd-18)
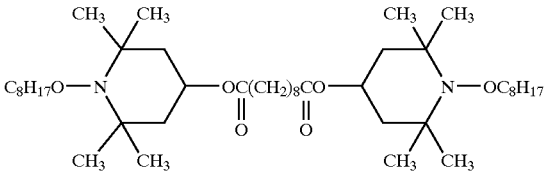
(Cpd-19)
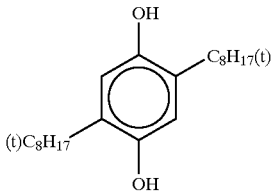
Color mixing preventing agent
(Cpd-20)
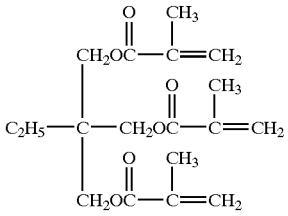
(Solv-1)
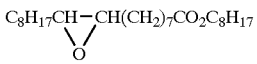
(Solv-2)
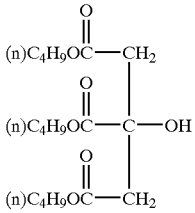
(Solv-3)
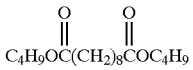
(Solv-4)
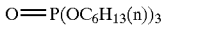
(Solv-5)
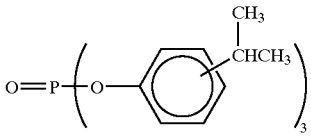
(Solv-7)
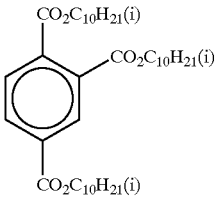
(Solv-8)
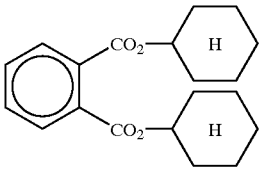
-continued
(S1–4)
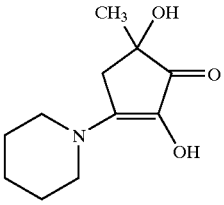
(UV-1) Ultraviolet ray absorbent
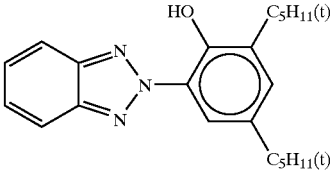
(UV-2) Ultraviolet ray absorbent
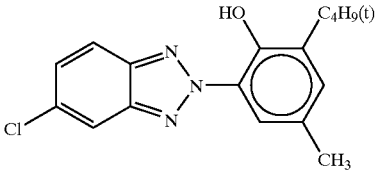
(UV-3) Ultraviolet ray absorbent
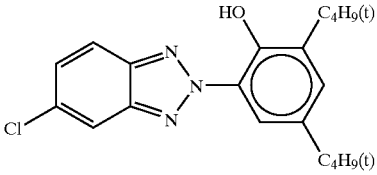
(UV-5) Ultraviolet ray absorbent
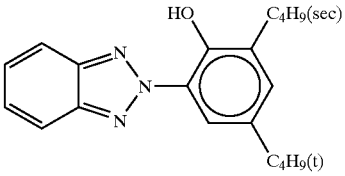
(UV-6) Ultraviolet ray absorbent
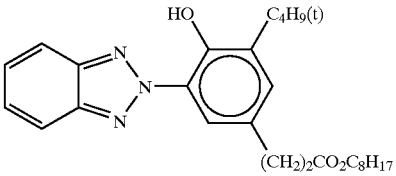
(UV-7) Ultraviolet ray absorbent
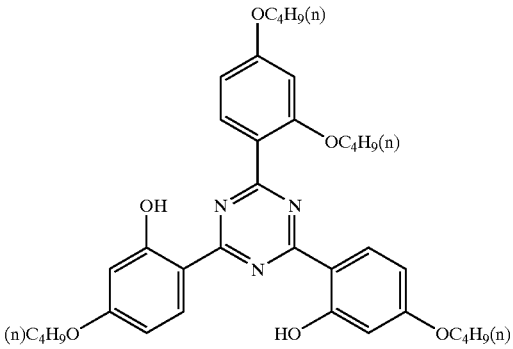

UV-A: mixture of UV-1/UV-2/UV-3=7/2/2 (weight ratio)
UV-B: mixture of UV-1/UV-2/UV-3/UV-5/UV-6=13/3/3/5/3 (weight ratio)
UV-C: mixture of UV-1/UV-3=9/1 (weight ratio)

Samples a-102 to a-110 were produced by making the following modifications to the sample a-101 produced in the foregoing manner.

Production of Sample a-102

A sample a-102 was produced in the same manner as in the sample a-101 except that the silver halide emulsions in the first layer, the third layer and the fifth layer were changed as follows.

<First Layer Silver Halide Emulsion>

Silver halide emulsion B (cubic particles subjected to sulfur sensitization, 3/7 (silver molar ratio) mixture of large size emulsion B-1 and small size emulsion B-2)

<Third Layer Silver Halide Emulsion>

Silver halide emulsion D (cubic particles subjected to gold-sulfur sensitization, 1/3 (silver molar ratio) mixture of large size emulsion D-1 and small size emulsion D-2)

<Fifth Layer Silver Halide Emulsion>

Silver halide emulsion F (cubic particles subjected to gold-sulfur sensitization, 5/5 (silver molar ratio) mixture of large size emulsion F-1 and small size emulsion F-2)

<Preparation of Comparative Emulsions for Blue Sensitive Layer B-1 and B-2>

A comparative high sensitive emulsion for blue sensitive layer B-1 and a comparative low sensitive emulsion for blue sensitive layer B-2 were produced in the same manner as in the preparation conditions for the emulsions B-1 and B-2 except that the preparation conditions in the emulsion A-1 were changed as follows.

Among the preparation conditions of the emulsion A-1, the temperature during the particle growth was changed to 68° C. to make the particle size to an average edge length of 0.85 μm. The variation coefficient of the edge length was 12%. The introduction of an iodide ion in the final step of particle growth was aborted but replaced by a chloride ion. Therefore, the halogen composition after the completion of particle growth was 99% by mole of silver chloride and 1% by mole of silver bromide.

The addition amounts of the spectral sensitizing dye 1 and the spectral sensitizing dye 2 were changed to values 1.25 times those on preparation of the emulsion A-1. The same amount of the thiosulfonic acid compound 1 was used.

The chemical sensitization was changed as follows. A fine particle emulsion of particles containing 90% by mole of silver bromide and 10% by mole of silver chloride having an average particle diameter of 0.05 μm doped with iridium hexachloride was added, followed by aging for 10 minutes. Fine particles containing 40% by mole of silver bromide and 60% by mole of silver chloride having an average particle diameter of 0.05 μm was further added, followed by aging for 10 minutes. The fine particles were dissolved, and thus the silver bromide content of the cubic particles as a host was increased to 2.0 mole. Iridium hexachloride was thus doped at $2\times10^{-7}$ mole/Ag.

Subsequently, $1\times10^{-5}$ mole/Ag of sodium thiosulfate was added. Immediately thereafter, the temperature of the mixture was increased to 55° C., followed by aging for 70 minutes, and the temperature is decreased to 50° C. No gold sensitizer was added. Immediately after decreasing the temperature, $4\times10^{-4}$ mole/Ag each of the mercapto compounds 1 and 2 were added. After subsequent aging for 10 minutes, 0.010 mole per silver of a KBr aqueous solution was added. After aging for 10 minutes, the temperature was decreased, and the resulting emulsion was housed.

Consequently, a comparative high sensitive emulsion for blue sensitive layer B-1 was produced.

A comparative low sensitive emulsion for blue sensitive layer B-2 was produced in the same manner as in the emulsion B-1 except that the temperature during the particle growth was decreased to form particles having an average edge length of 0.68 μm with a variation coefficient of 12%. The spectral sensitization and the chemical sensitization were carried out at an amount 1.25 times those of the comparative high sensitive emulsion for blue sensitive layer B-1 taking the ratio of specific surface area into consideration.

<Preparation of Comparative Emulsions for Green Sensitive Layers D-1 and D-2>

A comparative high sensitive emulsion for green sensitive layer D-1 and a comparative low sensitive emulsion for green sensitive layer D-2 were produced in the same manner as in the preparation conditions for the emulsions B-1 and B-2 except that the temperature during the particle growth in the emulsion B-1 was decreased, and the kinds of the sensitizing dyes were changed as follows.

The particle size in the high sensitive emulsion D-1 was an average edge length of 0.50 μm, and that of the low sensitive emulsion D-2 was an average edge length of 0.40 μm. The variation coefficients thereof were 10%.

The sensitizing dye D was added in an amount of $4.0\times10^{-4}$ mole for the large size emulsion (high sensitive emulsion D-1) and in an amount of $4.5\times10^{-4}$ mole for the small size emulsion (low sensitive emulsion D-2) per 1 mole of silver halide, and the sensitizing dye E was added in an amount of $5.0\times10^{-5}$ mole for the large size emulsion and in an amount of $8.8\times10^{-5}$ mole for the small size emulsion per 1 mole of silver halide.

<Preparation of Comparative Emulsions for Red Sensitive Layer F-1 and F-2>

A comparative high sensitive emulsion for red sensitive layer F-1 and a-comparative low sensitive emulsion for red sensitive layer F-2 were produced in the same manner as in the preparation conditions for the emulsions B-1 and B-2 except that the temperature during the particle growth in the emulsion B-1 was decreased, and the kinds of the sensitizing dyes were changed as follows.

The particle size in the high sensitive emulsion F-1 was an average edge length of 0.57 μm, and that of the low sensitive emulsion F-2 was an average edge length of 0.43 μm. The variation coefficients thereof were 9% and 10%, respectively.

The sensitizing dyes G and H were added in an amount of $1.0\times10^{-4}$ mole, respectively, for the large size emulsion (high sensitive emulsion F-1) and in an amount of $1.0\times10^{-4}$ mole, respectively, for the small size emulsion (low sensitive emulsion F-2) per 1 mole of silver halide. Furthermore, the compound I was added to the red sensitive layers in an amount of $3.0\times10^{-3}$ mole per 1 mole of silver halide.

Production of Sample a-103

A sample a-103 was prepared in the same manner as in the sample a-101 except that the amount of the ultramarine blue pigment in the polyethylene resin on the emulsion layers was decreased to 70% with respect to the sample a-101.

Production of Sample a-104

A sample a-104 was prepared in the same manner as in the sample a-101 except that the amount of the ultramarine blue pigment in the polyethylene resin on the emulsion layers was decreased to 50% with respect to the sample a-101.

Production of Sample a-105

A sample a-105 was prepared in the same manner as in the sample a-101 except that the coating amount of the sixth layer was decreased to 70% with respect to the sample a-101.

Production of Sample a-106

A support was produced in the same manner as in the sample a-101 except that the ultramarine blue pigment in the polyethylene resin on the emulsion layers was removed. A composition was produced in the same manner as in the sample a-101 except that a pigment (BLUE A3R-K and VIOLET B-K, produced by Ciba Speciality Chemicals, Inc.) was mixed in the first layer coating composition along with the yellow coupler, the color image stabilizer, the solvent and the auxiliary solvent, and the dispersion B thus dispersed and emulsified was used after uniformizing. The composition was coated on the support, from which the ultramarine blue pigment had been removed, to produce a sample a-106. The coating amount of BLUE A3R-K was 0.0018 g/m$^2$, and the coating amount of VIOLET B-K was 0.0012 g/m$^2$.

Production of Sample a-107

A sample a-107 was prepared in the same manner as in the sample a-102 except that the amount of the ultramarine blue pigment in the polyethylene resin on the emulsion layers was increased to 150% with respect to the sample a-102.

Production of Sample a-108

A sample a-108 was prepared in such a manner that a cyanish dye (C-Dye-1) was added to the oleophilic fine particles containing the couplers of the third layer of the sample a-101 to adjust the whiteness degree to the value shown in Table 2.

Production of Sample a-109

A sample a-109 was prepared in such a manner that a magentaish dye (Cpd-11) was added to the oleophilic fine particles containing the couplers of the third layer of the sample a-101 to adjust the whiteness degree to the value shown in Table 2.

Production of Sample a-110

A sample a-110 was prepared in the same manner as in the sample a-101 except that the amount of the ultramarine blue pigment in the polyethylene resin on the emulsion layers was increased to 165% with respect to the sample a-101.

Production of Sample a-111

A sample a-111 was prepared in such a manner that a yellowish dye (Y-Dye-1) was added to the oleophilic fine particles containing the couplers of the third layer of the sample a-101 to adjust the whiteness degree to the value shown in Table 2.

C-Dye-1

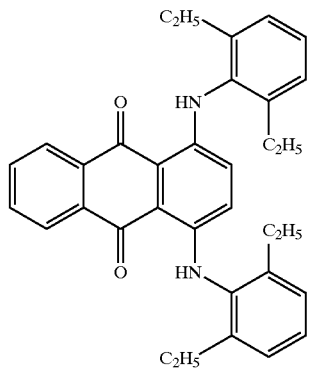

Y-Dye-1

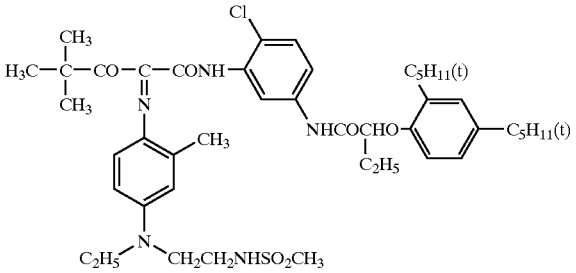

The samples a-101 to a-111 were stored after coating for 10 days under the conditions of 25° C. and 55% RH, and then the samples in an unexposed state were subjected to a coloration developing process according the process A to produce white background. The white background was evaluated by using rectangular white background samples having a dimension of 8.9 cm×12.7 cm. The evaluation results of the samples a-101 to a-111 are shown in Table 2.

Measurement of Reflective Density A(λ) at Wavelength λ nm

The measurement of the reflective density A(λ) at a wavelength λ nm was carried out by using a spectrophotometer U-3410 produced by Hitachi, Ltd.

Measurement of L*a*b* Values

The L*a*b* values were measured with a color analyzer C-2000 produced by Hitachi, Ltd. and a xenon common light source, and the measurement values in the L*a*b* color space were obtained with D65 as the white point.

Functional Evaluation of Preferred White Background

The respective samples in an unexposed state were subjected to a coloration developing process according the process A to produce white background. Functional evaluation for four grades was carried out by 20 test subjects using white background samples having a dimension of 8.9 cm×12.7 cm. The scores for the respective samples were designated as average values of the 20 test subjects.

| | |
|---|---|
| Most preferred as white background | 6 points |
| Preferred as white background | 4 points |
| Allowable as white background | 2 points |
| Not preferred as white background | 0 point |

TABLE 2

| Sample | L* | a* | b* | A(450) | A(550) | A(650) | A(550)/ A(450) | A(650)/ A(450) | Result of functional evaluation | Note |
|---|---|---|---|---|---|---|---|---|---|---|
| a-101 | 91.5 | 1.1 | −6.0 | 0.063 | 0.078 | 0.063 | 1.24 | 1.00 | 4.0 | invention |
| a-102 | 91.0 | 0.9 | −4.0 | 0.075 | 0.081 | 0.067 | 1.08 | 0.89 | 2.0 | invention |
| a-103 | 92.3 | 1.0 | −5.2 | 0.059 | 0.065 | 0.050 | 1.10 | 0.85 | 5.6 | invention |
| a-104 | 92.6 | 0.9 | −3.2 | 0.053 | 0.053 | 0.040 | 1.00 | 0.75 | 4.9 | invention |
| a-105 | 92.3 | 1.1 | −6.9 | 0.063 | 0.078 | 0.063 | 1.24 | 1.00 | 5.0 | invention |
| a-106 | 92.3 | 1.1 | −6.0 | 0.061 | 0.067 | 0.053 | 1.10 | 0.87 | 5.6 | invention |
| a-107 | 89.5 | 1.0 | −6.0 | 0.086 | 0.105 | 0.085 | 1.22 | 0.99 | 1.2 | comparison |
| a-108 | 91.0 | −0.1 | −7.8 | 0.065 | 0.088 | 0.082 | 1.35 | 1.26 | 0.9 | comparison |
| a-109 | 91.0 | 2.2 | −6.5 | 0.070 | 0.102 | 0.065 | 1.46 | 0.93 | 0.9 | comparison |
| a-110 | 90.3 | 1.3 | −9.3 | 0.072 | 0.110 | 0.093 | 1.53 | 1.29 | 1.0 | comparison |
| a-111 | 91.2 | 1.3 | 0.7 | 0.087 | 0.081 | 0.063 | 0.93 | 0.72 | 1.0 | comparison |

It was understood from Table 2 that white backgrounds satisfying the reflective density or the L*a*b* according to the invention exhibited preferred results in the functional evaluation. In particular, the samples a-103 and a-106 exhibited good results in the functional evaluation even when the observation light source was changed to a white fluorescent lamp.

Example 2

Samples a-201 to a-211 were produced by changing the coupler in the third layer of the samples a-101 and a-106 in Example 1 as shown in Table 3. Evaluation of white background was carried out by changing the process from Example 1 for the process B and the process C where 0.5 ml/l of the blix solution was mixed in the color developer solution of the process B. The results obtained are shown in Table 3.

Comparative coupler 1

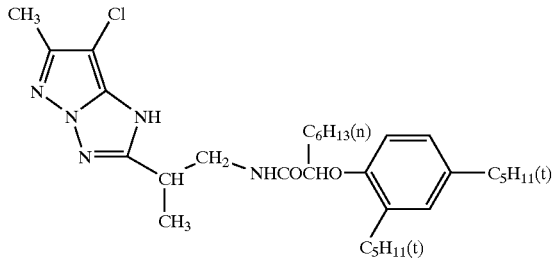

TABLE 3

| Sample | Coupler in 3rd layer | Constitution other than 3rd layer | Process B L* | Process B a* | Process B b* | Process B Result of functional evaluation | Process C L* | Process C a* | Process C b* | Process C Result of functional evaluation | Related embodiment |
|---|---|---|---|---|---|---|---|---|---|---|---|
| a-201 | comparative coupler 1 | 101 | 91.5 | 1.2 | −5.9 | 4.0 | 91.2 | 2.4 | −6.2 | 0.8 | |
| a-202 | comparative coupler 1 | 101 | 91.5 | 1.2 | −5.9 | 4.0 | 91.2 | 2.1 | −6.0 | 0.9 | |
| a-203 | M-87 | 101 | 91.6 | 1.1 | −5.9 | 4.1 | 91.6 | 1.2 | −5.9 | 4.1 | 20 |
| a-204 | comparative coupler 1 | 101 | 91.4 | 1.2 | −5.9 | 4.0 | 91.2 | 2.1 | −5.9 | 0.9 | |
| a-205 | M-2 | 101 | 91.5 | 1.1 | −5.9 | 4.0 | 91.5 | 1.3 | −5.9 | 4.0 | 20 |
| a-206 | M-54 | 101 | 91.5 | 1.1 | −5.9 | 4.0 | 91.5 | 1.3 | −5.9 | 4.0 | 20 |
| a-207 | M-59 | 101 | 91.5 | 1.1 | −5.9 | 4.0 | 91.5 | 1.2 | −5.9 | 4.0 | 20 |
| a-208 | M-87 | 106 | 92.5 | 1.1 | −6.0 | 5.7 | 92.5 | 1.2 | −6.0 | 5.7 | 19, 20 |
| a-209 | M-2 | 106 | 92.3 | 1.1 | −6.0 | 5.7 | 92.3 | 1.3 | −6.0 | 5.7 | 19, 20 |
| a-210 | M-54 | 106 | 92.3 | 1.1 | −6.0 | 5.7 | 92.3 | 1.3 | −6.0 | 5.7 | 19, 20 |
| a-211 | M-59 | 106 | 92.4 | 1.1 | −6.0 | 5.7 | 92.4 | 1.2 | −6.0 | 5.7 | 19, 20 |

-continued

Comparative coupler 2

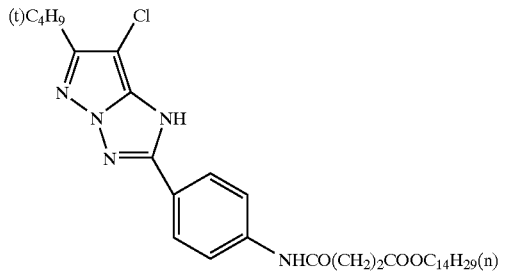

Comparative coupler 3

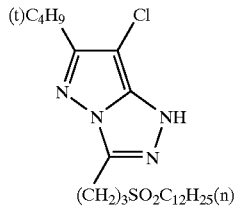

It was understood from Table 3 that preferred white background could be obtained irrespective to fluctuation of the composition of the color developer solution. It is also understood that preferred white background could be obtained by adding a pigment to the hydrophilic colloid layer.

Example 3

Samples a-301 to a-307 were produced by changing the coupler in the third layer of the sample a-101 in Example 1 as shown in Table 4. Evaluation of white background was carried out in the case where the coating composition for the third layer after preparation was stored at 40° C. for one 1 and then coated (production condition A) and the case where the coating composition for the third layer after preparation was stored at 40° C. for one 10 and then coated (production condition B). The change of coupler was effected to cause no change in molar amount thereof. Evaluation of white background was carried out according to Example 1. The results obtained are shown in Table 4.

It was understood from Table 4 that preferred white background could be obtained irrespective to fluctuation in factors upon production of the photosensitive materials.

Example 4

Samples a-401 to a-412 were produced by changing the coupler and the amount of the solvent in the third layer of the sample a-103 in Example 1 as shown in Table 5. The change of coupler was effected to cause no change in molar amount thereof. Upon decreasing the amount of the solvent, the amount of gelatin was also decreased corresponding to the amount ratio of the oil soluble components to the gelatin in the third layer. The following evaluation was carried out by using the samples. The results obtained are shown in Table 5.

Evaluation of White Background

Evaluation of white background was carried out by using a sample that had been subjected to the same process as the process B except that the periods of time of the respective process steps were decreased to 80%.

Fastness of Image

The respective samples were exposed through an optical wedge for trichromatic separation and then processed by the process A. The processed sample was irradiated with Xe light of 20,000 lux for 30 days, and the fastness against light before and after the irradiation was evaluated. The density remaining ratio (%) after the light irradiation providing a density of 1.5 before the light irradiation was evaluated.

TABLE 4

| | | Production condition A | | | | Production condition B | | | | |
|---|---|---|---|---|---|---|---|---|---|---|
| Sample | Coupler in 3rd layer | A(450) | A(550) | A(650) | Result of functional evaluation | A(450) | A(550) | A(650) | Result of functional evaluation | Related embodiment |
| a-301 | comparative coupler 1 | 0.063 | 0.079 | 0.063 | 4.0 | 0.063 | 0.089 | 0.063 | 0.8 | |
| a-302 | comparative coupler 1 | 0.063 | 0.078 | 0.063 | 4.0 | 0.063 | 0.089 | 0.063 | 0.9 | |
| a-303 | comparative coupler 1 | 0.063 | 0.078 | 0.063 | 4.0 | 0.063 | 0.089 | 0.063 | 4.1 | |
| a-304 | M-2 | 0.063 | 0.078 | 0.063 | 4.0 | 0.063 | 0.078 | 0.063 | 0.9 | 12 |
| a-305 | M-54 | 0.063 | 0.078 | 0.063 | 4.0 | 0.063 | 0.078 | 0.063 | 4.0 | 12 |
| a-306 | M-59 | 0.063 | 0.078 | 0.063 | 4.0 | 0.063 | 0.078 | 0.063 | 4.0 | 12 |
| a-307 | M-87 | 0.063 | 0.078 | 0.063 | 4.0 | 0.063 | 0.078 | 0.063 | 4.0 | 12 |

TABLE 5

| Sample | Coupler in 3rd layer | Solvent amount in 3rd layer ($g/m^2$) | Gelatin amount in 3rd layer ($g/m^2$) | L* | a* | b* | Result of functional evaluation | fastness of image (remaining ratio %) | Related embodiment |
|---|---|---|---|---|---|---|---|---|---|
| a-401 | comparative coupler 1 | 0.44 | 1.20 | 91.5 | 1.3 | −3.0 | 1.9 | 84 | |
| a-402 | comparative coupler 1 | 0.26 | 0.96 | 92.3 | 1.0 | −5.1 | 5.4 | 77 | |
| a-403 | M-87 | 0.44 | 1.20 | 91.5 | 1.3 | −3.0 | 1.9 | 94 | 20 |
| a-404 | M-87 | 0.26 | 0.96 | 92.3 | 1.0 | −5.1 | 5.4 | 90 | 20 |
| a-405 | comparative coupler 3 | 0.44 | 1.20 | 91.5 | 1.3 | −3.0 | 1.9 | 78 | |
| a-406 | comparative coupler 3 | 0.26 | 0.96 | 92.3 | 1.0 | −5.1 | 5.4 | 60 | |
| a-407 | M-2 | 0.44 | 1.20 | 91.5 | 1.3 | −3.0 | 1.9 | 83 | 20 |
| a-408 | M-2 | 0.26 | 0.96 | 92.3 | 1.0 | −5.1 | 5.4 | 74 | 20 |
| a-409 | M-54 | 0.44 | 1.20 | 91.5 | 1.3 | −3.0 | 1.9 | 83 | 20 |
| a-410 | M-54 | 0.26 | 0.96 | 92.3 | 1.0 | −5.1 | 5.4 | 74 | 20 |
| a-411 | M-59 | 0.44 | 1.20 | 91.5 | 1.3 | −3.0 | 1.9 | 85 | 20 |
| a-412 | M-59 | 0.26 | 0.96 | 92.3 | 1.0 | −5.1 | 5.4 | 78 | 20 |

It was understood from Table 5 that photosensitive materials that were excellent in white background and fastness of image could be obtained.

Example 6

The same samples as the samples in Examples 1 to 5 were produced except that the composition of the fifth layer was changed as follows. The resulting samples were evaluated in the manner according to Examples 1 to 5, and as a result, photosensitive materials having preferred white background that were excellent in processing stability, resistance against fluctuation upon production and quick processing property were similarly obtained.

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color image stabilizer (Cpd-1) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.01 |
| Color image stabilizer (Cpd-17) | 0.01 |
| Color image stabilizer (Cpd-18) | 0.07 |
| Color image stabilizer (Cpd-20) | 0.01 |
| Ultraviolet ray absorbent (UV-7) | 0.01 |
| Solvent (Solv-5) | 0.15 |

(ExC-4) Cyan coupler

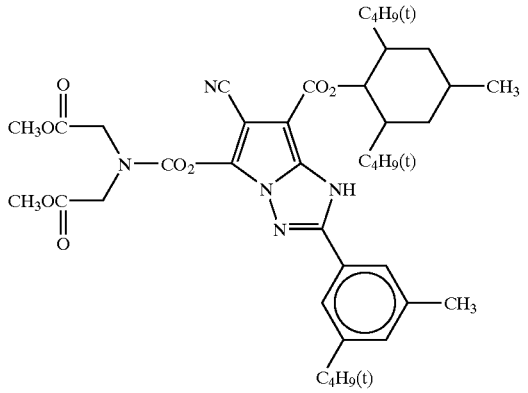

(ExC-5) Cyan coupler

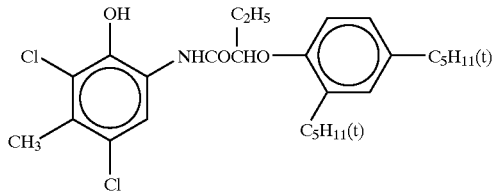

Example 7

The photosensitive materials in Examples 1 to 6 were used. The samples where developed, and the images were totally evaluated in the same manner as in Examples 1 to 6 except that scanning exposure was carried out in the following manner based on digital information obtained by reading negative image with a scanner. As a result, photosensitive materials excellent in white background could be obtained according to the invention, and the images received totally preferred evaluations from the test subjects.

The scanning exposure was carried out by using a scanning exposure apparatus shown in FIG. 6 of JP-A No,. 11-88619. As the light sources, a light source of 688 nm (R light) was obtained by using a semiconductor laser, and a light source of 532 nm (G light) and a light source of 473 nm (B light) were obtained by combining a semiconductor laser with an SHG. The amounts of light were modulated with an external modulator, and the light was reflected by a rotating polyhedron to effect scanning exposure of the sample moving in the direction perpendicular to the scanning direction. The scanning exposure was carried out at 400 dpi, and the average exposure time per one pixel was $8\times10^{-8}$ second. In order to suppress fluctuation of the amount of light of the semiconductor laser, the temperature was maintained at constant by using a peltier element.

Example 8

The samples in Examples 1 to 6 were subjected to the following exposure and processing according to the method disclosed in the example of JP-A No. 2000-354174 to form a halftone dot image containing text information and graphical information. Evaluation of white background, sharpness and color reproducibility was carried out by using the samples after subjecting to the color developing process, and as a result, the effect of the invention was conformed.

Method of Exposure and Processing

The photosensitive materials each was cut into a B-1 size and wound on a rotating dram having a diameter of 30 cm through suction adhesion. It was rotated at 270 rotation per minute and exposed by using light from an LED array of R (699 nm), G (525 nm) and B (465 nm) (64 LEDs for respective colors). The exposure with the light sources was carried out by using a spot having a width of 30 $\mu$m and a trapezoidal intensity distribution, and the exposure time for one point was 30 microsecond. The exposure beam was scooched by 10 $\mu$m on the surface of the photosensitive material to carry out multiplied exposure to expose a halftone dot image of 2,400 dpi. After the exposure, such a process was carried out that was the same as the process A in Example 1 except that the processing periods of time for the respective baths were increased by 1.5 times. The linear velocity upon processing was 7 mm per second.

The process A and the process B used in the foregoing Examples were as follows.

<Process A>

The photosensitive material sample a-101 was worked into a roll form having a width of 127 nm. The photosensitive material was subjected to imagewise exposure from a negative film of an average density by using a MINILAB printer processor PP350 produced by Fuji Photo Film Co., Ltd., and then subjected to continuous processing (running test) until the volume of a replenisher of the coloration developer solution becomes twice the capacity of the coloration development tank. The photosensitive materials were evaluated by carrying out by the following two processes that were different in composition of the processing solution and processing time.

The following process using running processing solutions was designated as the process A.

| Process step | Temperature | Time | Replenishing amount |
|---|---|---|---|
| Color development | 38.5° C. | 45 sec | 45 mL |
| Blix | 38.0° C. | 45 sec | 35 mL |
| Rinse 1 | 38.0° C. | 20 sec | — |
| Rinse 2 | 38.0° C. | 20 sec | — |
| Rinse 3 | 38.0° C. | 20 sec | — |
| Rinse 4 | 38.0° C. | 20 sec | 121 mL |
| Drying | 80° C. | | |

The replenishing amount was shown in terms of an amount per 1 $m^2$ of the photosensitive material.

A rinse cleaning system RC50D produced by Fuji Photo Film Co., Ltd. was attached to the rinse 3 tank, and the rinsing solution was taken out from the rinse 3 tank and transported to a reverse osmosis module (RC50D) by a pump. The transmitted water from the bath was supplied to the rinse 4 tank, whereas the concentrated solution was brought back to the rinse 3 tank. The pump pressure was adjusted to maintain a transmitted water amount to the reverse osmosis module of from 50 to 300 mL/min, and circulation was carried out under controlled temperature for 10 hours per one day. The rinse steps were carried out by a 4-tank counter current system from the tank 1 to the tank 4.

The compositions of the processing solutions were as follows.

| | [Tank solution] | [Replenisher] |
|---|---|---|
| [Color Developer Solution] | | |
| Water | 800 mL | 800 mL |
| Fluorescent whitening agent (FL-1) | 2.2 g | 5.1 g |
| Fluorescent whitening agent (FL-2) | 0.35 g | 1.75 g |
| Triisopropanolamine | 8.8 g | 8.8 g |
| Polyethylene glycol (average molecular weigh: 300) | 10.0 g | 10.0 g |
| Ethylenediamine tetraacetic acid | 4.0 g | 4.0 g |
| Sodium sulfite | 0.10 g | 0.20 g |
| Potassium chloride | 10.0 g | — |
| Sodium 4,5-dihydroxybenzene-1,3-disulfonate | 0.50 g | 0.50 g |
| Disodium N,N-bis(sulfonatethyl)-hydroxylamine | 8.5 g | 14.0 g |
| 4-Amino-3-methyl-N-ethyl-N-(β-methanephosphonamide)-aniline 3/2 sulfate monohydrate | 4.8 g | 14.0 g |
| Potassium carbonate | 26.3 g | 26.3 g |
| Water to make in total | 1,000 L | 1,000 L |
| pH (25° C., adjusted with sulfuric acid and KOH) | 10.15 | |
| [Blix Solution] | | |
| Water | 800 mL | 800 mL |
| Ammonium thiosulfate (750 g/L) | 107 mL | 214 mL |
| m-Carboxybenzene sulfinic acid | 8.3 g | 16.5 g |
| Iron(III) ammonium ethylenediamine tetraacetate | 47.0 g | 94.0 g |
| Ethylenediamine tetraacetic acid | 1.4 g | 2.8 g |

-continued

| | [Tank solution] | [Replenisher] |
|---|---|---|
| Nitric acid (67%) | 16.5 g | 33.0 g |
| Imidazole | 14.6 g | 29.2 g |
| Ammonium sulfite | 16.0 g | 32.0 g |
| Potassium metabisulfite | 23.1 g | 46.2 g |
| Water to make in total | 1,000 L | 1,000 L |
| pH (25° C., adjusted with nitric acid and aqueous ammonia) | 6.5 | 6.5 |
| [Rinse Solution] | | |
| Chlorinated sodium isocyanurate | 0.02 g | 0.02 g |
| Deionized water | 1,000 mL | 1,000 mL |
| (electroconductivity: 5 μS/cm or less) | 6.5 | 6.5 |
| pH (25° C.) | | |

<Process B>

The photosensitive material sample a-101 was worked into a roll form having a width of 127 nm. The photosensitive material was subjected to imagewise exposure from a negative film of an average density by using an experimental processing apparatus produced by modifying a MINILAB printer processor PP350 produced by Fuji Photo Film Co., Ltd. to make the processing time and the processing temperature capable of being changed, and then subjected to continuous processing (running test) until the volume of a replenisher of the coloration developer solution becomes twice the capacity of the coloration development tank. The photosensitive materials were evaluated by carrying out by the following two processes that were different in composition of the processing solution and processing time. The following process using running processing solutions was designated as the process B.

| Process step | Temperature | Time | Replenishing amount |
|---|---|---|---|
| Color development | 45.0° C. | 20 sec | 45 mL |
| Blix | 40.0° C. | 20 sec | 35 mL |
| Rinse 1 | 40.0° C. | 8 sec | — |
| Rinse 2 | 40.0° C. | 8 sec | — |

-continued

| Process step | Temperature | Time | Replenishing amount |
|---|---|---|---|
| Rinse 3 | 40.0° C. | 8 sec | — |
| Rinse 4 | 38.0° C. | 8 sec | 121 mL |
| Drying | 80° C. | 15 sec | |

The replenishing amount was shown in terms of an amount per 1 $m^2$ of the photosensitive material.

A rinse cleaning system RC50D produced by Fuji Photo Film Co., Ltd. was attached to the rinse 3 tank, and the rinsing solution was taken out from the rinse 3 tank and transported to a reverse osmosis module (RC50D) by a pump. The transmitted water from the bath was supplied to the rinse 4 tank, whereas the concentrated solution was brought back to the rinse 3 tank. The pump pressure was adjusted to maintain a transmitted water amount to the reverse osmosis module of from 50 to 300 mL/min, and circulation was carried out under controlled temperature for 10 hours per one day. The rinse steps were carried out by a 4-tank counter current system from the tank 1 to the tank 4.

The compositions of the processing solutions were as follows.

| | [Tank solution] | [Replenisher] |
|---|---|---|
| [Color Developer Solution] | | |
| Water | 800 mL | 800 mL |
| Fluorescent whitening agent (FL-3) | 4.0 g | 8.0 g |
| Remaining color suppressing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.0 g | 4.0 g |
| Sodium sulfite | 0.10 g | 0.10 g |
| Potassium chloride | 10.0 g | — |
| Sodium 4,5-dihydroxybenzene-1,3-disulfonate | 0.50 g | 0.50 g |
| Disodium N,N-bis(sulfonatethyl)-hydroxylamine | 8.5 g | 14.0 g |
| 4-Amino-3-methyl-N-ethyl-N-(β-methanephosphonamide)-aniline 3/2 sulfate monohydrate | 7.0 g | 19.0 g |
| Potassium carbonate | 26.3 g | 26.3 g |
| Water to make in total | 1,000 L | 1,000 L |
| pH (25° C., adjusted with sulfuric acid and KOH) | 10.25 | 12.6 |
| [Blix Solution] | | |
| Water | 800 mL | 800 mL |
| Ammonium thiosulfate (750 g/L) | 107 mL | 214 mL |
| Succinic acid | 29.5 g | 59.0 g |
| Iron(III) ammonium ethylenediamine tetraacetate | 47.0 g | 94.0 g |

-continued

| | [Tank solution] | [Replenisher] |
|---|---|---|
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make in total | 1,000 L | 1,000 L |
| pH (25° C., adjusted with nitric acid and aqueous ammonia) | 6.00 | 6.00 |
| [Rinse Solution] | | |
| Chlorinated sodium isocyanurate | 0.02 g | 0.02 g |
| Deionized water | 1,000 mL | 1,000 mL |
| (electroconductivity: 5 μS/cm or less) | 6.5 | 6.5 |
| pH (25° C.) | | |

FL-1

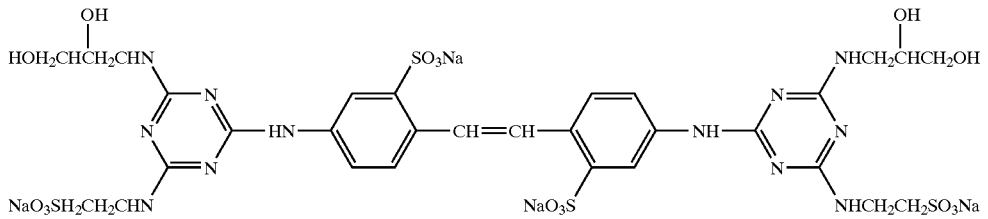

FL-2

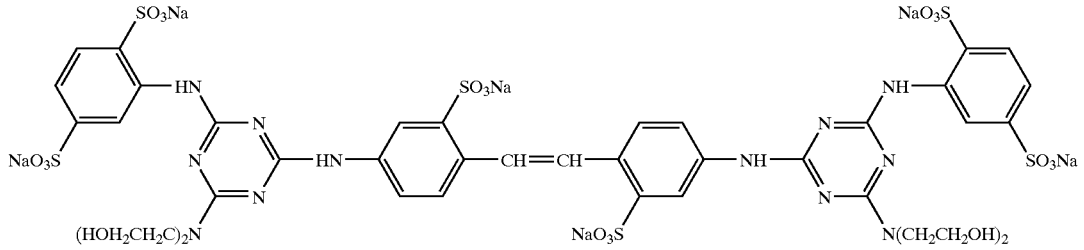

FL-3

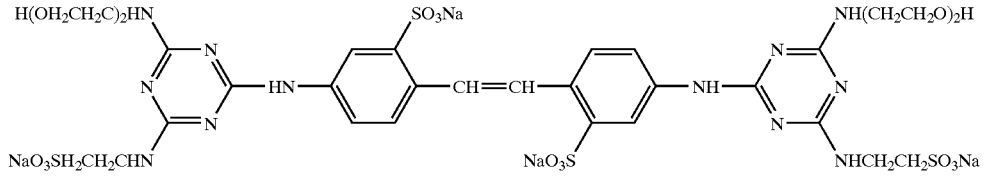

SR-1

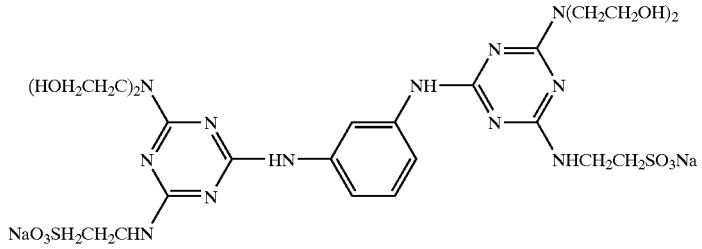

Example 9

<Preparation of Emulsions for Blue Sensitive Layer A-1 and A-2 of Invention>

The emulsions for blue sensitive layer A-1 and A-2 of the invention were prepared in the same compositions and the same method as in Example 1.

<Preparation of Comparative Emulsions for Blue Sensitive Layer B-1 and B-2>

The comparative emulsions for blue sensitive layer B-1 and B-2 were prepared in the same compositions and the same method as in Example 1.

<Preparation of Emulsions for Green Sensitive Layer C-1 and C-2 of Invention>

The emulsions for green sensitive layer C-1 and C-2 of the invention were prepared in the same compositions and the same method as in Example 1.

<Preparation of Comparative Emulsions for Green Sensitive Layer D-1 and D-2>

The comparative emulsions for green sensitive layer D-1 and D-2 were prepared in the same compositions and the same method as in Example 1.

<Preparation of Emulsions for Red Sensitive Layer E-1 and E-2 of Invention>

The emulsions for red sensitive layer E-1 and E-2 of the invention were prepared in the same compositions and the same method as in Example 1. Furthermore, as similar t Example 1, the compound I was added to the red sensitive emulsion layer in an amount of $3.0\times10^{-3}$ mole per 1 mole of silver halide.

<Preparation of Comparative Emulsions for Red Sensitive Layer F-1 and F-2>

The comparative emulsions for red sensitive layer F-1 and F-2 were prepared in the same compositions and the same method as in Example 1.

Production of Sample b-001

<Preparation of Second and Fourth Layer Coating Compositions>

100 g of the color mixing prevention agent (Cpd-4), 18 g of the color image stabilizer (Cpd-5), 130 g of the color image stabilizer (Cpd-6) and 70 g of the color image stabilizer (Cpd-7) were dissolved in 40 g of the solvent (Solv-1), 120 g of the solvent (Solv-2'), 110 g of the solvent (Solv-5) and 160 ml of ethyl acetate. The resulting solution was dispersed and emulsified in 220 g of a 23.5% by weight gelatin aqueous solution containing 19 g of sodium dodecylbenzenesulfonate with a high speed agitation emulsifier (dissolver), and water was added thereto to produce 900 g of an emulsion dispersion G.

The emulsion dispersion A and the emulsions A-1 and A-2 were mixed and dissolved to prepare a first layer coating composition having the composition described later. The coating amounts of the emulsion are based on the coating amounts in terms of silver converted coated amounts.

<Preparation of First, Third and Fifth to Seventh Layers Coating Compositions>

Coating compositions for the first, third and fifth to seventh layers were prepared in the same manner as in the preparation of the second layer coating composition. As a gelatin hardener for the respective layers, the 1-oxy-3,5-dichloro-s-triazine sodium salts (H-1), (H-2) and (H-3) were used. Furthermore, Ab-1, Ab-2, Ab-3 and Ab-4 described in the foregoing were added to the respective layers in total amounts of 15.0 mg/m$^2$, 60.0 mg/m$^2$, 5.0 mg/m$^2$ and 10.0 mg/m$^2$, respectively.

1-(3-Methylureidophenyl)-5-mercaptotetrazole was added to the second, fourth, sixth and seventh layer in amounts of 0.2 g/m$^2$, 0.2 g/m$^2$, 0.6 g/m$^2$ and 0.1 g/m$^2$, respectively.

4-Hydroxy-6-methyl-1,3,3a,7-tetrazaindene was added to the blue sensitive emulsion layer and the green sensitive emulsion layer in amounts of $1\times10^{-4}$ mole and $2\times10^{-4}$ mole, respectively.

Disodium catechol-3,5-disulfonate was added to the second, fourth and sixth layer in amounts of 6 mg/m$^2$, 6 mg/m$^2$ and 18 mg/m$^2$, respectively.

In order to prevent irradiation, the following dyes were added (the values in parentheses were the coated amounts).

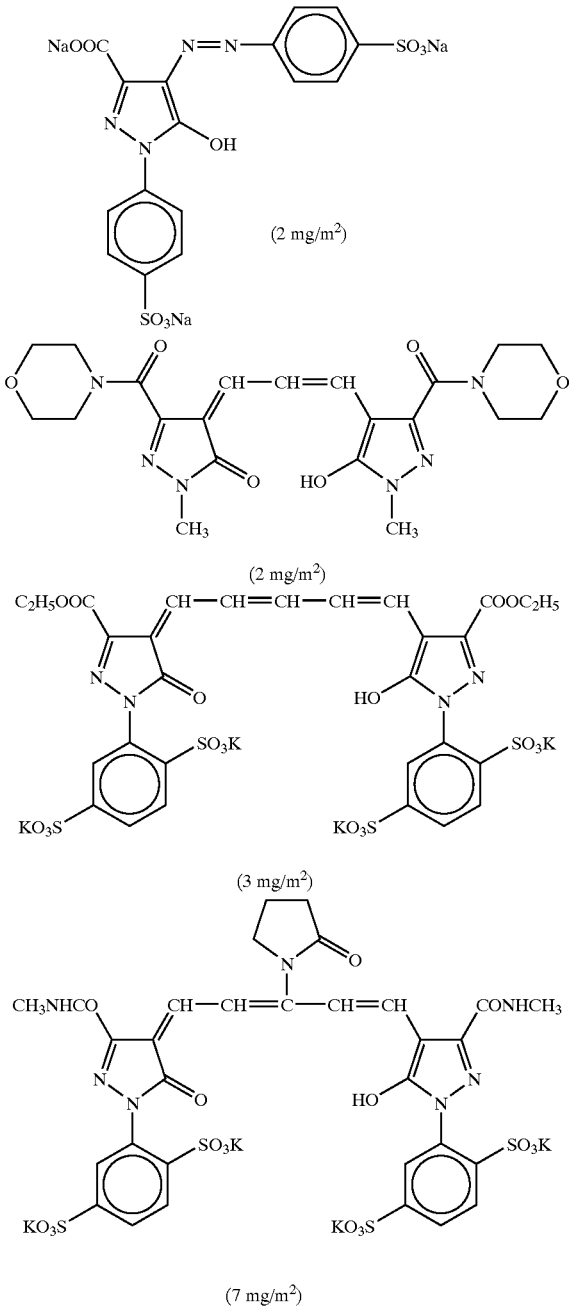

Layer Constitution

The constitutions of the respective layers are shown below. The numerals indicate coated amounts (g/m$^2$). The coating amounts of the silver halide emulsions are in terms of silver converted coated amounts.

<Support>

The same polyethylene resin laminated paper as in Example 1 was used.

<First Layer (Blue Sensitive Emulsion Layer)>

The first layer had the same composition as the first layer (blue sensitive emulsion layer) of Example 1.

<Second Layer (Color mixing prevention Layer)>

The second layer had the same composition as the second layer (color mixing prevention layer) of Example 1, except that the solvent (Solv-2') was used instead of the solvent (Solv-2).

<Third Layer (Green Sensitive Emulsion Layer)>

The third layer had the same composition as the third layer (green sensitive emulsion layer) of Example 1, except that 0.19 g/m$^2$ of the solvent (Solv-3') was used instead of the solvent (Solv-3) and the amount of the solvent (Solv-4) was changed from 0.18 g/m$^2$ to 0.08 g/m$^2$.

<Fourth Layer (Color Mixing Prevention Layer)>

The fourth layer had the same composition as the fourth layer (color mixing prevention layer) of Example 1, except that the solvent (Solv-2') was used instead of the solvent (Solv-2).

<Fifth Layer (Red Sensitive Emulsion Layer)>

The fifth layer had the same composition as the fifth layer (red sensitive emulsion layer) of Example 1.

<Sixth Layer (Ultraviolet Ray Absorbing Layer)>

The sixth layer had the same composition as the sixth layer (ultraviolet ray absorbing layer) of Example 1.

<Seventh Layer (Protective Layer)>

The seventh layer had the same composition as the seventh layer (protective layer) of Example 1.

(UV-1) Ultraviolet ray absorbent

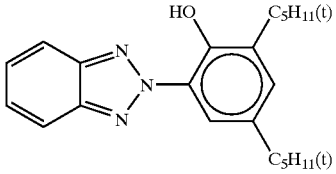

(UV-2) Ultraviolet ray absorbent

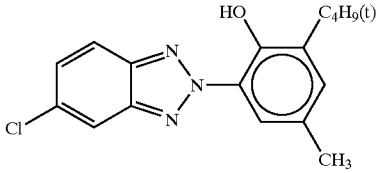

(UV-3) Ultraviolet ray absorbent

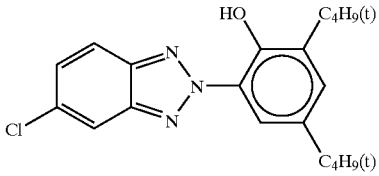

(UV-5) Ultraviolet ray absorbent

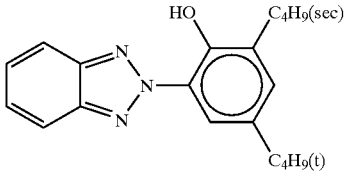

(UV-6) Ultraviolet ray absorbent

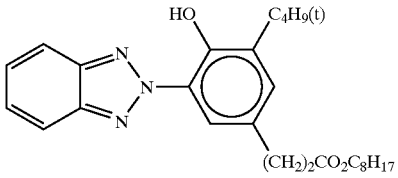

-continued (UV-7) Ultraviolet ray absorbent

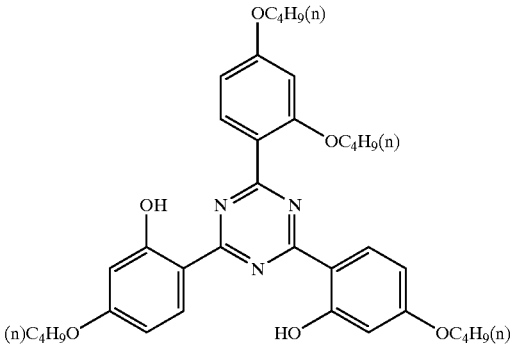

UV-A: mixture of UV-1/UV-2/UV-3=7/2/2 (weight ratio)

UV-B: mixture of UV-1/UV-2/UV-3 UV-5/UV-6=13/3/3/5/3 (weight ratio)

UV-C: mixture of UV-1/UV-3=9/1 (weight ratio)

UV-D: mixture of UV-1/UV-2/UV-3/UV-5/UV-7=13/1/1/5/4 (weight ratio)

(Solv-1)

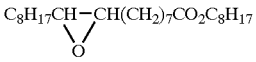

(Solv-2)

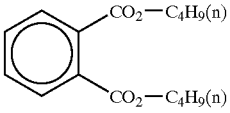

(Solv-3)

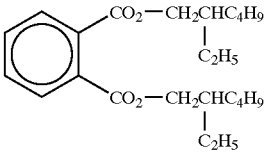

(Solv-4)

(Solv-5)

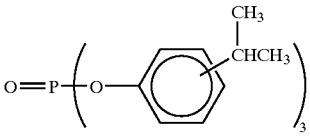

(Solv-7)

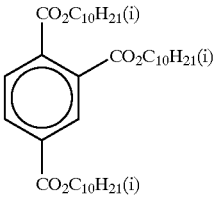

(Solv-8)

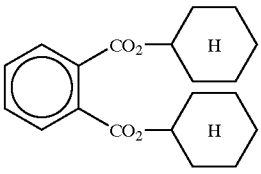

-continued (S1-4)

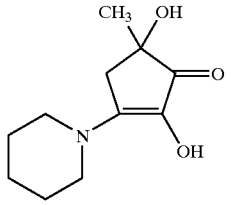

Samples were produced by making the following modifications to the sample b-001 produced in the foregoing manner.

Production of Sample b-002

A sample b-002 was produced in the same manner as in the sample b-001 except that the silver halide emulsions in the first layer, the third layer and the fifth layer were changed as follows.

<First Layer Silver Halide Emulsion>

Silver halide emulsion B (cubic particles subjected to sulfur sensitization, 3/7 (silver molar ratio) mixture of large size emulsion B-1 and small size emulsion B-2)

<Third Layer Silver Halide Emulsion>

Silver halide emulsion D (cubic particles subjected to gold-sulfur sensitization, 1/3 (silver molar ratio) mixture of large size emulsion D-1 and small size emulsion D-2)

<Fifth Layer Silver Halide Emulsion>

Silver halide emulsion F (cubic particles subjected to gold-sulfur sensitization, 5/5 (silver molar ratio) mixture of large size emulsion F-1 and small size emulsion F-2)

Production of Sample b-003

A sample b-003 was prepared in the same manner as in the sample b-001 except that the amount of the ultramarine blue pigment in the polyethylene resin on the emulsion layers was decreased to 70% with respect to the sample b-001.

Production of Samples b-101 to b-106

Samples b-101 to b-106 were prepared in the same manner as in the sample b-001 except that the high boiling point organic solvent (Solv-2') in the second and fourth layers of the sample b-001 was changed to the same amount of the high boiling point organic solvents shown in Table 6.

Production of Samples b-201 to b-206

Samples b-201 to b-206 were prepared in the same manner as in the sample b-003 except that the high boiling point organic solvent (Solv-2') in the second and fourth layers of the sample b-003 was changed to the same amount of the high boiling point organic solvents shown in Table 6.

All the samples thus produced were subjected to the development process in the same manner as in the exposure process A in Examples 1 to 8.

The reflective densities A(450), A(550) and A(650) at wavelengths of 450 nm, 550 nm and 650 nm of the unexposed portion of the respective photosensitive materials after processing were measured by using a spectrophotometer U-3410 produced by Hitachi, Ltd.

The respective samples after processing were stored under high humidity and high temperature conditions of a temperature of 60° C. and a humidity of 70% for 2 months, and the reflective densities were measured in the same manner. The results are shown in Table 6.

The samples before and after the storage were observed by 50 test subjects to functionally evaluate the preference of the whiteness degree of the unexposed portion. The evaluation was scored in the following viewpoints.

5: Very favorable

4: Favorable

3: Somewhat favorable

2: Unfavorable

1: Very unfavorable

TABLE 6

| Sample | High boiling point organic solvent | A(450) | A(550) | A(650) | A(550)/A(450) | A(650)/A(450) | Functional evaluation | Note |
|---|---|---|---|---|---|---|---|---|
| | | | Immediately after processing | | | | | |
| b-001 | Solv-2' | 0.063 | 0.078 | 0.063 | 1.24 | 1.00 | 4.6 | comparison |
| b-002 | Solv-2' | 0.075 | 0.081 | 0.067 | 1.08 | 0.89 | 3.6 | comparison |
| b-003 | Solv-2' | 0.059 | 0.065 | 0.05 | 1.10 | 0.85 | 4.6 | comparison |
| b-101 | A-10 | 0.063 | 0.078 | 0.063 | 1.24 | 1.00 | 4.6 | invention |
| b-102 | B-2 | 0.063 | 0.078 | 0.063 | 1.24 | 1.00 | 4.6 | invention |
| b-103 | C-2 | 0.063 | 0.078 | 0.063 | 1.24 | 1.00 | 4.6 | invention |
| b-104 | D-2 | 0.063 | 0.078 | 0.063 | 1.24 | 1.00 | 4.6 | invention |
| b-105 | E-5 | 0.063 | 0.078 | 0.063 | 1.24 | 1.00 | 4.6 | invention |
| b-106 | F-1 | 0.063 | 0.078 | 0.063 | 1.24 | 1.00 | 4.6 | invention |
| b-201 | A-10 | 0.059 | 0.065 | 0.05 | 1.10 | 0.85 | 4.6 | invention |
| b-202 | B-2 | 0.059 | 0.065 | 0.05 | 1.10 | 0.85 | 4.6 | invention |
| b-203 | C-2 | 0.059 | 0.065 | 0.05 | 1.10 | 0.85 | 4.6 | invention |
| b-204 | D-2 | 0.059 | 0.065 | 0.05 | 1.10 | 0.85 | 4.6 | invention |
| b-205 | E-5 | 0.059 | 0.065 | 0.05 | 1.10 | 0.85 | 4.6 | invention |
| b-206 | F-1 | 0.059 | 0.065 | 0.05 | 1.10 | 0.85 | 4.6 | invention |
| | | | After storage (60° C./70% for 2 months) | | | | | |
| b-001 | Solv-2' | 0.085 | 0.087 | 0.069 | 1.02 | 0.81 | 1.6 | comparison |
| b-002 | Solv-2' | 0.092 | 0.095 | 0.072 | 1.03 | 0.78 | 1.2 | comparison |
| b-003 | Solv-2' | 0.082 | 0.075 | 0.055 | 0.91 | 0.67 | 2 | comparison |
| b-101 | A-10 | 0.069 | 0.082 | 0.065 | 1.19 | 0.94 | 4 | invention |
| b-102 | B-2 | 0.067 | 0.081 | 0.064 | 1.21 | 0.96 | 4.2 | invention |
| b-103 | C-2 | 0.067 | 0.081 | 0.064 | 1.21 | 0.96 | 4.2 | invention |
| b-104 | D-2 | 0.067 | 0.081 | 0.064 | 1.21 | 0.96 | 4.2 | invention |
| b-105 | E-5 | 0.067 | 0.081 | 0.064 | 1.21 | 0.96 | 4.2 | invention |

TABLE 6-continued

| Sample | High boiling point organic solvent | A(450) | A(550) | A(650) | A(550)/A(450) | A(650)/A(450) | Functional evaluation | Note |
|---|---|---|---|---|---|---|---|---|
| b-106 | F-1 | 0.065 | 0.08 | 0.063 | 1.23 | 0.97 | 4.4 | invention |
| b-201 | A-10 | 0.065 | 0.069 | 0.051 | 1.06 | 0.78 | 4.2 | invention |
| b-202 | B-2 | 0.063 | 0.068 | 0.05 | 1.08 | 0.79 | 4.4 | invention |
| b-203 | C-2 | 0.063 | 0.068 | 0.05 | 1.08 | 0.79 | 4.4 | invention |
| b-204 | D-2 | 0.063 | 0.068 | 0.05 | 1.08 | 0.79 | 4.4 | invention |
| b-205 | E-5 | 0.063 | 0.068 | 0.05 | 1.08 | 0.79 | 4.4 | invention |
| b-206 | F-1 | 0.061 | 0.067 | 0.05 | 1.10 | 0.82 | 4.5 | invention |

It was understood from Table 6 that the highlight portions having a whiteness degree within the scope of the invention provided favorable impression. It was also understood, on the other hand, that the samples that did not use the high boiling point organic solvent of the invention suffered coloration on the highlight portions upon placing in the high humidity and high temperature conditions to decrease the whiteness degree, whereby unfavorable impression was provided. It was also understood, however, that when the high boiling point organic solvent of the invention was used, coloration was suppressed, and favorable impression could be maintained even after the storage in the high humidity and high temperature conditions.

Example 10

Production of Samples b-301 to b-303

Samples b-301 to b-303 were prepared in the same manner as in the sample b-001 except that the high boiling point organic solvent (Solv-3') in the third layer of the sample b-001 was changed to the same amount of the high boiling point organic solvents shown in Table 7.

The samples thus produced were subjected to exposure, processing and storage under high humidity and high temperature conditions in the same manner as in Example 9. The results are shown in Table 7.

It was understood that coloration on white background could be prevented to exhibit the effect of the invention even when the high boiling point organic solvent of the invention was used in the emulsion layers. It is also understood, however, that the effect was inferior to the cases where it was added to the color mixing prevention layers.

Example 11

Production of Sample b-004

A sample b-003 was prepared in the same manner as in the sample b-001 except that the coating amount of the sixth layer was decreased to 70% with respect to the sample b-001, and the ultraviolet ray absorbent UV-B in the sixth layer was changed to an ultraviolet ray absorbent UV-C.

Production of Samples b-401 to b-406

Samples b-401 to b-406 were prepared in the same manner as in the sample b-004 except that the high boiling point organic solvent (Solv-2') in the second and fourth layers of the sample b-004 was changed to the same amount of the high boiling point organic solvents shown in Table 8.

The samples were subjected to exposure, processing and storage under high humidity and high temperature conditions in the same manner as in Example 9.

The samples before and after the storage under high humidity and high temperature conditions were measured with a color analyzer C-2000 produced by Hitachi, Ltd. and a xenon common light source, and the measurement values in the L*a*b color space were obtained with D65 as the white point.

TABLE 7

| Sample | High boiling point organic solvent | A(450) | A(550) | A(650) | A(550)/A(450) | A(650)/A(450) | Functional evaluation |
|---|---|---|---|---|---|---|---|
| | | Immediately after processing | | | | | |
| b-001 | Solv-2' | 0.063 | 0.078 | 0.063 | 1.24 | 1.00 | 4.6 |
| b-301 | A-10 | 0.063 | 0.078 | 0.063 | 1.24 | 1.00 | 4.6 |
| b-302 | E-5 | 0.063 | 0.078 | 0.063 | 1.24 | 1.00 | 4.6 |
| b-303 | F-1 | 0.063 | 0.078 | 0.063 | 1.24 | 1.00 | 4.6 |
| | | After storage (60° C./70% for 2 months) | | | | | |
| b-001 | Solv-2' | 0.085 | 0.087 | 0.069 | 1.02 | 0.81 | 1.6 |
| b-301 | A-10 | 0.079 | 0.085 | 0.065 | 1.08 | 0.82 | 3.4 |
| b-302 | E-5 | 0.072 | 0.083 | 0.064 | 1.15 | 0.89 | 3.7 |
| b-303 | F-1 | 0.066 | 0.081 | 0.063 | 1.23 | 0.95 | 3.9 |

The functional evaluation was carried out in the same manner as in Example 9. The results are shown in Table 8.

TABLE 8

| Sample | High boiling point organic solvent | L* | a* | b* | Functional evaluation |
|---|---|---|---|---|---|
| | Immediately after processing | | | | |
| b-004 | Solv-2' | 93.1 | 1.1 | −6.9 | 4.6 |
| b-401 | A-5 | 93.1 | 1.1 | −6.9 | 4.6 |
| b-402 | B-4 | 93.1 | 1.1 | −6.9 | 4.6 |
| b-403 | C-2 | 93.1 | 1.1 | −6.9 | 4.6 |
| b-404 | D-3 | 93.1 | 1.1 | −6.9 | 4.6 |
| b-405 | E-6 | 93.1 | 1.1 | −6.9 | 4.6 |
| b-406 | F-1 | 93.1 | 1.1 | −6.9 | 4.6 |
| | After storage (60° C./70% for 2 months) | | | | |
| b-004 | Solv-2' | 89 | 1.6 | −2.6 | 1.7 |
| b-401 | A-5 | 91.2 | 1.4 | −3.5 | 4.1 |
| b-402 | B-4 | 91.7 | 1.3 | −5.3 | 4.3 |
| b-403 | C-2 | 91.7 | 1.3 | −5.3 | 4.3 |
| b-404 | D-3 | 91.7 | 1.3 | −5.3 | 4.3 |
| b-405 | E-6 | 91.7 | 1.3 | −5.3 | 4.3 |
| b-406 | F-1 | 92.5 | 1.1 | −6.5 | 4.5 |

It was understood from Table 8 that the highlight portions having a whiteness degree within the scope of the invention provided favorable impression. It was also understood, on the other hand, that the samples that did not use the high boiling point organic solvent of the invention suffered coloration on the highlight portions upon placing in the high humidity and high temperature conditions to decrease the whiteness degree, whereby unfavorable impression was provided. It was also understood, however, that when the high boiling point organic solvent of the invention was used, coloration was suppressed, and favorable impression could be maintained even after the storage in the high humidity and high temperature conditions.

Example 12

The fifth layers of the samples b-001, b-002, b-003, b-101 to b-106 and b-201 to b-206 in Example 9 were changed to layers having the following composition, and they were evaluated in the same manner as in the Examples.

In this example, as similar to Example 9, the highlight portions having a whiteness degree within the scope of the invention provided favorable impression. It was also understood, on the other hand, that the samples that did not use the high boiling point organic solvent of the invention suffered coloration on the highlight portions upon placing in the high humidity and high temperature conditions to decrease the whiteness degree, whereby unfavorable impression was provided. It was also understood, however, that such results were obtained that when the high boiling point organic solvent of the invention was used, coloration was suppressed, and favorable impression could be maintained even after the storage in the high humidity and high temperature conditions.

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.10 |
| Gelatin | 1.11 |
| Cyan coupler (ExC-1) | 0.02 |

-continued

| | |
|---|---|
| Cyan coupler (ExC-3) | 0.01 |
| Cyan coupler (ExC-4) | 0.11 |
| Cyan coupler (ExC-5) | 0.01 |
| Color image stabilizer (Cpd-1) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.01 |
| Color image stabilizer (Cpd-17) | 0.01 |
| Color image stabilizer (Cpd-18) | 0.07 |
| Color image stabilizer (Cpd-20) | 0.01 |
| Ultraviolet ray absorbent (UV-7) | 0.01 |
| Solvent (Solv-5) | 0.15 |

Example 13

The samples b-001, b-002, b-003, b-101 to b-106 and b-201 to b-206 in Example 9 were subjected to exposure, processing, storage under high humidity and high temperature conditions, and evaluation in the same manner except that the process was replaced by the exposure process B in Examples 1 to 8.

In this example, as similar to Example 9, the highlight portions having a whiteness degree within the scope of the invention provided favorable impression. It was also understood, on the other hand, that the samples that did not use the high boiling point organic solvent of the invention suffered coloration on the highlight portions upon placing in the high humidity and high temperature conditions to decrease the whiteness degree, whereby unfavorable impression was provided. It was also understood, however, that such results were obtained that when the high boiling point organic solvent of the invention was used, coloration was suppressed, and favorable impression could be maintained even after the storage in the high humidity and high temperature conditions.

Example 14

<Preparation of Emulsions for Blue Sensitive Layer A-1 and A-2 of Invention>

The emulsions for blue sensitive layer A-1 and A-2 of the invention were prepared in the same compositions and the same method as in Example 1.

<Preparation of Comparative Emulsions for Blue Sensitive Layer B-1 and B-2>

The comparative emulsions for blue sensitive layer B-1 and B-2 were prepared in the same compositions and the same method as in Example 1.

<Preparation of Emulsions for Green Sensitive Layer C-1 and C-2 of Invention>

The emulsions for green sensitive layer C-1 and C-2 of the invention were prepared in the same compositions and the same method as in Example 1.

<Preparation of Comparative Emulsions for Green Sensitive Layer D-1 and D-2>

The comparative emulsions for green sensitive layer D-1 and D-2 were prepared in the same compositions and the same method as in Example 1.

<Preparation of Emulsions for Red Sensitive Layer E-1 and E-2 of Invention>

The emulsions for red sensitive layer E-1 and E-2 of the invention were prepared in the same compositions and the same method as in Example 1. Furthermore, as similar t Example 1, the compound I was added to the red sensitive emulsion layer in an Amount of $3.0\times10^{-3}$ mole per 1 mole of silver halide.

<Preparation of Comparative Emulsions for Red Sensitive Layer F-1 and F-2>

The comparative emulsions for red sensitive layer F-1 and F-2 were prepared in the same compositions and the same method as in Example 1.

Production of Sample c-101

<Preparation of First Layer Coating Composition>

57 g of the yellow coupler (ExY), 7 g of the color image stabilizer (Cpd-1), 4 g of the color image stabilizer (Cpd-2), 7 g of the color image stabilizer (Cpd-3) and 2 g of the color image stabilizer (Cpd-8) were dissolved in 21 g of the solvent (Solv-1) and 80 ml of ethyl acetate. The resulting solution was dispersed and emulsified in 220 g of a 23.5% by weight gelatin aqueous solution containing 4 g of sodium dodecylbenzenesulfonate with a high speed agitation emulsifier (dissolver), and water was added thereto to produce 900 g of an emulsion dispersion A.

The emulsion dispersion A and the emulsions A-1 and A-2 were mixed and dissolved to prepare a first layer coating composition having the composition described later. The coating amounts of the emulsion are based on the coating amounts in terms of silver converted coated amounts.

<Preparation of Second to Seventh Layers Coating Composition>

Coating compositions for the second to seventh layers were prepared in the same manner as in the preparation of the first layer coating composition. As a gelatin hardener for the respective layers, the 1-oxy-3,5-dichloro-s-triazine sodium salts (H-1), (H-2) and (H-3) were used. Furthermore, Ab-1, Ab-2, Ab-3 and Ab-4 described in the foregoing were added to the respective layers in total amounts of 15.0 mg/m$^2$, 60.0 mg/m$^2$, 5.0 mg/m$^2$ and 10.0 mg/m$^2$, respectively. 1-(3-Methylureidophenyl)-5-mercaptotetrazole was added to the second layer, the fourth layer, the sixth layer and the seventh layer in amounts of 0.2 mg/m$^2$, 0.2 mg/m$^2$, 0.6 mg/m$^2$ and 0.1 mg/m$^2$, respectively.

4-Hydroxy-6-methyl-1,3,3a,7-tetrazaindene was added to the blue sensitive emulsion layer and the green sensitive emulsion layer in amounts of $1\times10^{-4}$ mole and $2\times10^{-4}$ mole, respectively, per 1 mole of silver halide.

0.05 g/m$^2$ of a copolymer latex of methacrylic acid and butyl acrylate (weight ratio: 1/1, average molecular weight: 200,000 to 400,000) was added to the red sensitive emulsion layer.

Disodium catechol-3,5-disulfonate was added to the second layer, the fourth layer and the sixth layer in amounts of 6 mg/m$^2$, 6 mg/m$^2$ and 18 mg/m$^2$, respectively.

In order to prevent irradiation, the following dyes were added (the values in parentheses were the coated amounts).

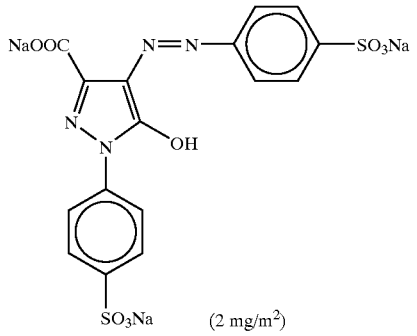

(2 mg/m$^2$)

-continued

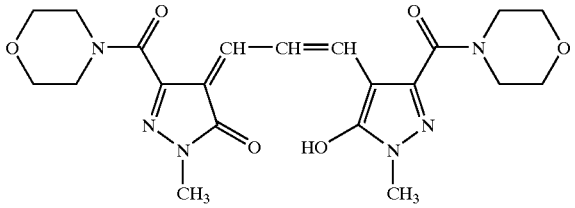

(2 mg/m$^2$)

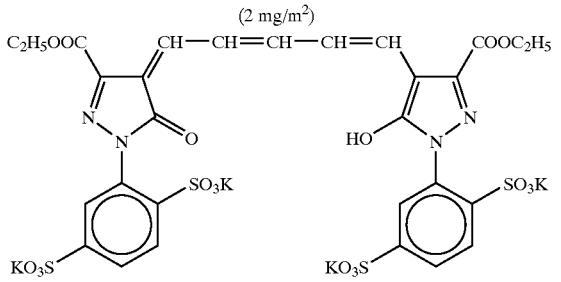

(3 mg/m$^2$)

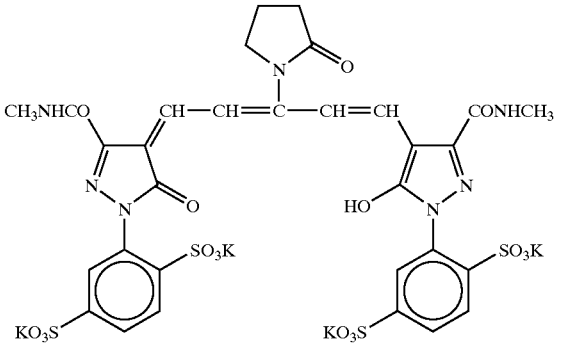

(7 mg/m$^2$)

Layer Constitution

The constitutions of the respective layers are shown below. The numerals indicate coated amounts (g/m$^2$). The coating amounts of the silver halide emulsions are in terms of silver converted coated amounts.

<Support>

The same polyethylene resin laminated paper as in Example 1 was used.

<First Layer (Blue Sensitive Emulsion Layer)>

The first layer had the same composition as the first layer (blue sensitive emulsion layer) of Example 1.

<Second Layer (Color Mixing Prevention Layer)>

The second layer had the same composition as the second layer (color mixing prevention layer) of Example 1.

<Third Layer (Green Sensitive Emulsion Layer)>

The third layer had the same composition as the third layer (green sensitive emulsion layer) of Example 1.

<Fourth Layer (Color Mixing Prevention Layer)>

The fourth layer had the same composition as the fourth layer (color mixing prevention layer) of Example 1.

<Fifth Layer (Red Sensitive Emulsion Layer)>

The fifth layer had the same composition as the fifth layer (red sensitive emulsion layer) of Example 1.

<Sixth Layer (Ultraviolet Ray Absorbing Layer)>

The sixth layer had the same composition as the sixth layer (ultraviolet ray absorbing layer) of Example 1.

<Seventh Layer (Protective Layer)>

The seventh layer had the same composition as the seventh layer (protective layer) of Example 1.

(ExC-4) Cyan coupler

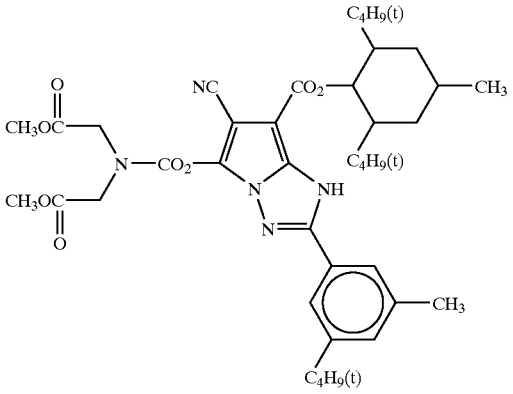

(ExC-5) Cyan coupler

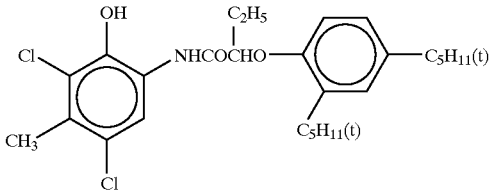

(ExC-6) Cyan coupler

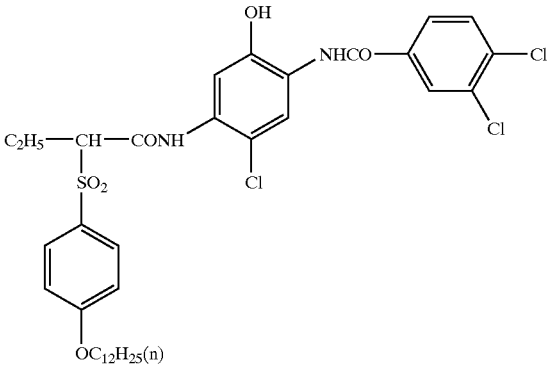

(Solv-1)

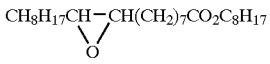

(Solv-2)

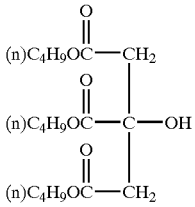

(Solv-3)

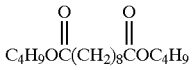

(Solv-4)

(Solv-5)

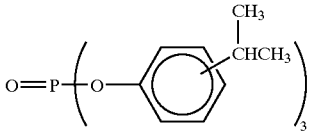

-continued (Solv-7)

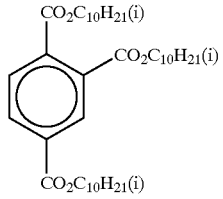

(Solv-8)

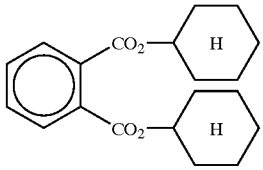

(Solv-9)

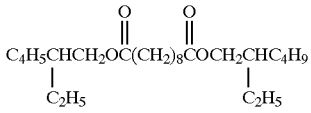

(Solv-10)

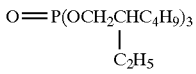

(S1–4)

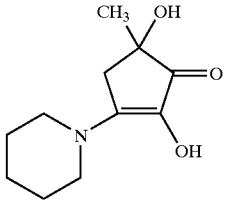

Samples were produced by making the following modifications to the sample c-101 produced in the foregoing manner.

Production of Sample c-001

A sample c-001 was produced in the same manner as in the sample c-101 except that the silver halide emulsions in the first layer, the third layer and the fifth layer of the sample c-101 were changed as follows.

<First Layer Silver Halide Emulsion>

Silver halide emulsion B (cubic particles subjected to sulfur sensitization, 3/7 (silver molar ratio) mixture of large size emulsion B-1 and small size emulsion B-2)

<Third Layer Silver Halide Emulsion>

Silver halide emulsion D (cubic particles subjected to gold-sulfur sensitization, 1/3 (silver molar ratio) mixture of large size emulsion D-1 and small size emulsion D-2)

<Fifth Layer Silver Halide Emulsion>

Silver halide emulsion F (cubic particles subjected to gold-sulfur sensitization, 5/5 (silver molar ratio) mixture of large size emulsion F-1 and small size emulsion F-2)

Production of Sample c-002

A sample c-002 was produced in the same manner as in the sample c-001 except that the composition of the fifth layer of the sample c-001 was changed as follows.

<Fifth Layer (Red Sensitive Emulsion Layer)>

| | |
|---|---|
| Silver chloride emulsion F (cubic particles subjected to sulfur sensitization, 5/5 (silver molar ratio) mixture of large size emulsion F-1 and small size emulsion F-2) | 0.10 |
| Gelatin | 1.11 |

-continued

| | |
|---|---|
| Cyan coupler (ExC-1) | 0.10 |
| Cyan coupler (ExC-3) | 0.05 |
| Cyan coupler (ExC-5) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.04 |
| Color image stabilizer (Cpd-17) | 0.07 |
| Color image stabilizer (Cpd-18) | 0.07 |
| Color image stabilizer (Cpd-20) | 0.04 |
| Ultraviolet ray absorbent (UV-7) | 0.01 |
| Solvent (Solv-5) | 0.15 |

Production of Sample c-102

A sample c-102 was produced in the same manner as in the sample c-101 except that the composition of the fifth layer of the sample c-101 was changed as follows.

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.10 |
| Gelatin | 1.11 |
| Cyan coupler (ExC-1) | 0.10 |
| Cyan coupler (ExC-3) | 0.05 |
| Cyan coupler (ExC-5) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.04 |
| Color image stabilizer (Cpd-17) | 0.07 |
| Color image stabilizer (Cpd-18) | 0.07 |
| Color image stabilizer (Cpd-20) | 0.04 |
| Ultraviolet ray absorbent (UV-7) | 0.01 |
| Solvent (Solv-5) | 0.15 |

Production of Sample c-103

A sample c-103 was produced in the same manner as in the sample c-101 except that the composition of the fifth layer of the sample c-101 was changed as follows.

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.10 |
| Gelatin | 1.11 |
| Cyan coupler (ExC-1) | 0.10 |
| Cyan coupler (ExC-3) | 0.05 |
| Cyan coupler (ExC-5) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.03 |
| Color image stabilizer (Cpd-15) | 0.30 |
| Color image stabilizer (Cpd-16) | 0.04 |
| Color image stabilizer (Cpd-17) | 0.07 |
| Color image stabilizer (Cpd-18) | 0.07 |
| Color image stabilizer (Cpd-20) | 0.04 |
| Ultraviolet ray absorbent (UV-7) | 0.01 |
| Solvent (Solv-5) | 0.15 |

Production of Sample c-104

A sample c-104 was produced in the same manner as in the sample c-101 except that the composition of the fifth layer of the sample c-101 was changed as follows.

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.10 |
| Gelatin | 1.11 |
| Cyan coupler (ExC-1) | 0.02 |
| Cyan coupler (ExC-3) | 0.01 |
| Cyan coupler (ExC-4) | 0.11 |
| Cyan coupler (ExC-5) | 0.01 |
| Color image stabilizer (Cpd-1) | 0.01 |
| Color image stabilizer (Cpd-6) | 0.06 |
| Color image stabilizer (Cpd-7) | 0.02 |
| Color image stabilizer (Cpd-9) | 0.04 |
| Color image stabilizer (Cpd-10) | 0.01 |
| Color image stabilizer (Cpd-14) | 0.01 |
| Color image stabilizer (Cpd-15) | 0.12 |
| Color image stabilizer (Cpd-16) | 0.01 |
| Color image stabilizer (Cpd-17) | 0.01 |
| Color image stabilizer (Cpd-18) | 0.07 |
| Color image stabilizer (Cpd-20) | 0.01 |
| Ultraviolet ray absorbent (UV-7) | 0.01 |
| Solvent (Solv-5) | 0.15 |

Production of Sample c-201

A sample c-201 was prepared in the same manner as in the sample c-101 except that the amount of the ultramarine blue pigment in the polyethylene resin on the emulsion layers was decreased to 70% with respect to the sample c-101.

Production of Sample c-202

A sample c-202 was prepared in the same manner as in the sample c-102 except that the amount of the ultramarine blue pigment in the polyethylene resin on the emulsion layers was decreased to 70% with respect to the sample c-102.

Production of Sample c-203

A sample c-203 was prepared in the same manner as in the sample c-103 except that the amount of the ultramarine blue pigment in the polyethylene resin on the emulsion layers was decreased to 70% with respect to the sample c-103.

Production of Sample c-204

A sample c-204 was prepared in the same manner as in the sample c-104 except that the amount of the ultramarine blue pigment in the polyethylene resin on the emulsion layers was decreased to 70% with respect to the sample c-104.

Production of Sample c-205

A sample c-205 was prepared in the same manner as in the sample c-105 except that the amount of the ultramarine blue pigment in the polyethylene resin on the emulsion layers was decreased to 70% with respect to the sample c-101, and the composition of the fifth layer was changed as follows.

<Fifth Layer (Red Sensitive Emulsion Layer)>

| | |
|---|---|
| Silver chloride emulsion E (cubic particles subjected to gold-sulfur sensitization, 5/5 (silver molar ratio) mixture of large size emulsion E-1 and small size emulsion E-2) | 0.22 |
| Gelatin | 1.11 |
| Cyan coupler (ExC-6) | 0.23 |
| Solvent (Solv-9) | 0.12 |
| Solvent (Solv-10) | 0.12 |

Production of Sample c-301

A sample c-301 was prepared in the same manner as in the sample c-101 except that the amount of the ultramarine blue pigment in the polyethylene resin on the emulsion layers was decreased to 50% with respect to the sample c-101.

Production of Sample c-302

A sample c-302 was prepared in the same manner as in the sample c-102 except that the amount of the ultramarine blue pigment in the polyethylene resin on the emulsion layers was decreased to 50% with respect to the sample c-102.

Production of Sample c-303

A sample c-303 was prepared in the same manner as in the sample c-103 except that the amount of the ultramarine blue pigment in the polyethylene resin on the emulsion layers was decreased to 50% with respect to the sample c-103.

Production of Sample c-304

A sample c-304 was prepared in the same manner as in the sample c-104 except that the amount of the ultramarine blue pigment in the polyethylene resin on the emulsion layers was decreased to 50% with respect to the sample c-104.

The respective samples after coating were stored at 25° C. and 55% RH for 10 days. The samples were then subjected to exposure of 0.1 second at 200 lux-sec through a wedge for trichromatic separation with a solarization meter MODEL FWK produced by Fuji Photo Film Co., Ltd., and processed in the same process as in the exposure process A in Examples 1 to 8.

The reflective densities of the respective samples were measured under conditions of 25° C. and 60% RH by using a spectrophotometer U-3410 produced by Hitachi, Ltd. at an integrating sphere open area ratio of 2% and a slit width of 5 nm with specular light being removed.

The reflective densities at wavelengths of 450 nm, 550 nm and 650 nm of the white background (unexposed portion) were measured and designated as A(450), A(550) and A(650). A(550)/A(450) and A(650)/A(450) were calculated from the measured values.

The reflective density on a cyan-colored portion was measured in the same manner as the white background under conditions of 25° C. and 60% RH by using a spectrophotometer U-3410 produced by Hitachi, Ltd. at an integrating sphere open area ratio of 2% and a slit width of 5 nm with specular light being removed. At this time, scanning was carried out from 400 nm to 700 nm, and such a sample was produced that exhibit a density of 1.0 at the wavelength providing the maximum density by calculating from the sample exposed through the wedge. The minimum density during the scanning from 400 nm to 700 nm was designated as C(min), the reflective density at a wavelength of 425 nm was designated as C(425), and the reflective density at a wavelength of 530 nm was designated as C(530). (C(425)−C(min))/(1−C(min)) and (C(530)−C(min))/(1−C(min)) were calculated from the values obtained by the foregoing measurements.

As an index of color reproduction band, the respective samples, which had been exposed through an wedge and subjected to a coloration developing process by the process A, were measured for the densities of the cyan-colored portion, the magenta-colored portion and the yellow-colored portion with a color analyzer C-2000 produced by Hitachi, Ltd. and a xenon common light source with an interval of a density of 0.1, and the L*a*b* color space volume V where color reproduction was possible was calculated with D65 as the white point. When the L*a*b* color space volume V is increased, the color reproducible band is increased, and thus the faithful color reproduction range is increased.

The unexposed samples, which had been stored at 25° C. and 55% RH for 10 days after coating and subjected to the coloration developing process A of 30 cm×30 cm, were subjected to functional evaluation for white background by 50 test subjects with the following standard. The scores for the respective samples were designated as average values.

| | |
|---|---|
| 5 points: | Considerably excellent in whiteness |
| 4 points: | Excellent in whiteness |
| 3 points: | Normally white |
| 2 points: | Somewhat colored |
| 1 point: | Colored |

As functional evaluation for color reproducibility, a negative film having the Macbeth Color Checker chart printed thereon was prepared by using SUPERIA 400 produced by Fuji Photo Film Co., Ltd., and the respective samples were subjected to functional evaluation of color reproducibility of yellow-green and green by 50 test subjects with the following standard. The scores for the respective samples were designated as average values.

| | |
|---|---|
| 5 points: | Faithfully color reproduction, very brilliant |
| 4 points: | Substantially faithful reproduction, brilliant |
| 3 points: | Slightly turbid but allowable, slightly lacking brilliance |
| 2 points: | Turbid, not brilliant |
| 1 point: | Considerably turbid, quite not brilliant |
| 0 point: | Different color |

In order to evaluate the stability of the color images, the respective samples after coating were stored at 25° C. and 55% RH for 10 days. The samples were then subjected to exposure of 0.1 second at 200 lux·sec through a wedge for trichromatic separation with a solarization meter MODEL FWK produced by Fuji Photo Film Co., Ltd., and subjected to coloration developing process by the process A. The samples were stored at 80° C. and 20% for 10 days, and the change in density before and after the heated storage of the point having a density of 1.0 before the heated storage. The remaining density, while the density before the heated storage was 100, was calculated in terms of percentage, which was designated as the heat toughness. The measurement of the density was carried out with SPECTRO EYE produced by Gretag Macbeth, Inc.

The results of the evaluation are shown in Table 9.

TABLE 9

| Sample | A(450) | A(550) | A(650) | A(550)/A(450) | A(650)/A(450) | (C(425)-C(min)/(1-C(min)) | (C(530)-C(min)/(1-C(min)) |
|---|---|---|---|---|---|---|---|
| c-001 | 0.075 | 0.081 | 0.067 | 1.08 | 0.89 | 0.221 | 0.163 |
| c-002 | 0.076 | 0.080 | 0.068 | 1.05 | 0.89 | 0.080 | 0.115 |
| c-101 | 0.063 | 0.078 | 0.063 | 1.24 | 1.00 | 0.220 | 0.163 |
| c-102 | 0.062 | 0.078 | 0.065 | 1.26 | 1.05 | 0.081 | 0.140 |
| c-103 | 0.062 | 0.077 | 0.064 | 1.24 | 1.03 | 0.080 | 0.115 |

TABLE 9-continued

| | | | | | | | |
|---|---|---|---|---|---|---|---|
| c-104 | 0.064 | 0.077 | 0.066 | 1.20 | 1.03 | 0.077 | 0.115 |
| c-201 | 0.058 | 0.065 | 0.050 | 1.10 | 0.85 | 0.221 | 0.163 |
| c-202 | 0.059 | 0.064 | 0.051 | 1.08 | 0.86 | 0.081 | 0.140 |
| c-203 | 0.058 | 0.065 | 0.050 | 1.12 | 0.86 | 0.080 | 0.115 |
| c-204 | 0.058 | 0.064 | 0.050 | 1.08 | 0.85 | 0.078 | 0.115 |
| c-205 | 0.058 | 0.066 | 0.049 | 1.14 | 0.84 | 0.148 | 0.100 |
| c-301 | 0.057 | 0.053 | 0.040 | 0.93 | 0.70 | 0.221 | 0.163 |
| c-302 | 0.056 | 0.055 | 0.042 | 0.98 | 0.75 | 0.081 | 0.139 |
| c-303 | 0.057 | 0.056 | 0.041 | 0.98 | 0.72 | 0.080 | 0.115 |
| c-304 | 0.057 | 0.056 | 0.040 | 0.98 | 0.70 | 0.079 | 0.114 |

| Sample | Color reproduction volume V | Functional evaluation of white background | Macbeth reproducibility | Heat toughness |
|---|---|---|---|---|
| c-001 | 1.00 | 3.0 | 2.5 | 70 |
| c-002 | 1.04 | 3.1 | 3.0 | 85 |
| c-101 | 1.04 | 4.6 | 2.6 | 70 |
| c-102 | 1.13 | 4.6 | 4.0 | 85 |
| c-103 | 1.15 | 4.7 | 4.1 | 86 |
| c-104 | 1.17 | 4.8 | 4.2 | 88 |
| c-201 | 1.05 | 4.7 | 2.7 | 71 |
| c-202 | 1.14 | 4.7 | 4.1 | 86 |
| c-203 | 1.16 | 4.8 | 4.2 | 87 |
| c-204 | 1.16 | 4.8 | 4.2 | 89 |
| c-205 | 1.15 | 4.7 | 4.2 | 98 |
| c-301 | 1.07 | 4.6 | 2.9 | 69 |
| c-302 | 1.17 | 4.7 | 4.2 | 84 |
| c-303 | 1.18 | 4.7 | 4.4 | 88 |
| c-304 | 1.19 | 4.8 | 4.4 | 89 |

Upon comparing the samples c-001 and c-002 in Table 9, it was understood that when (C(425)−C(min))/(1−C(min)) and (C(530)−C(min))/(1−C(min)) were within the scope of the invention, the color reproduction volume V was increased by 4%. In the sample c-102 where both of them were combined, the color reproduction volume V was increased by 13%, which was considered as an unexpected effect. The similar effects were observed for the Macbeth reproducibility, which was functional evaluation. It was understood from the fact that the Macbeth reproducibility was improved that the similar effects could be obtained not only from the calculation of the measurement values but also from the functional evaluation. Thus, it was understood that all the samples of the invention were largely enhanced in color reproducibility.

Example 15

Production of Sample c-401

A sample c-401 was produced in the same manner as in the sample c-101 except that the coating amount of the sixth layer was reduced to 60% with respect to the sample c-101.

Production of Sample c-402

A sample c-402 was produced in the same manner as in the sample c-102 except that the coating amount of the sixth layer was reduced to 60% with respect to the sample c-102.

Production of Sample c-403

A sample c-403 was produced in the same manner as in the sample c-103 except that the coating amount of the sixth layer was reduced to 60% with respect to the sample c-103.

Production of Sample c-404

A sample c-404 was produced in the same manner as in the sample c-104 except that the coating amount of the sixth layer was reduced to 60% with respect to the sample c-104.

Production of Sample c-501

A support was produced in the same manner as in the sample c-101 except that the ultramarine blue pigment in the polyethylene resin on the emulsion layers was removed. A composition was produced in the same manner as in the sample c-101 except that a pigment (BLUE A3R-K and VIOLET B-K, produced by Ciba Speciality Chemicals, Inc.) was mixed in the first layer coating composition along with the yellow coupler, the color image stabilizer, the solvent and the auxiliary solvent, and the dispersion B thus dispersed and emulsified was used after uniformizing. The composition was coated on the support, from which the ultramarine blue pigment had been removed, to produce a sample c-501. The coating amount of BLUE A3R-K was 0.0018 g/m$^2$, and the coating amount of VIOLET B-K was 0.0012 g/m$^2$.

Production of Sample c-502

A support was produced in the same manner as in the sample c-102 except that the ultramarine blue pigment in the polyethylene resin on the emulsion layers was removed. A composition was produced in the same manner as in the sample c-102 except that a pigment (BLUE A3R-K and VIOLET B-K, produced by Ciba Speciality Chemicals, Inc.) was mixed in the first layer coating composition along with the yellow coupler, the color image stabilizer, the solvent and the auxiliary solvent, and the dispersion B thus dispersed and emulsified was used after uniformizing. The composition was coated on the support, from which the ultramarine blue pigment had been removed, to produce a sample c-502. The coating amount of BLUE A3R-K was 0.0018 g/m$^2$, and the coating amount of VIOLET B-K was 0.0012 g/m$^2$.

The samples c-001, c-002, c-101 to c-104, c-401 to c-404, c-501 and c-502 after coating were stored at 25° C. and 55% RH for 10 days. The samples were then subjected to exposure of 0.1 second at 200 lux-sec through a wedge for trichromatic separation with a solarization meter MODEL FWK produced by Fuji Photo Film Co., Ltd., and processed in the same process as in the exposure process A in Examples 1 to 8.

The samples were measured for the L*a*b* values of the unexposed portion with a color analyzer C-2000 produced by Hitachi, Ltd. and a xenon common light source, and the measurement values in the L*a*b* color space were obtained with D65 as the white point.

The samples were measured and calculated for (C(425)−C(min))/(1−C(min)) and (C(530)−C(min))/(1−C(min)) in the same manner as in Example 14. Furthermore, the functional evaluation of whiteness degree and the Macbeth reproducibility were evaluated in the same manner as in Example 14.

The samples were stored at 25° C. and 55% RH for 10 days, and were subjected to exposure of 0.1 second at 200 lux·sec through a wedge for trichromatic separation with a solarization meter MODEL FWK produced by Fuji Photo Film Co., Ltd., followed by subjecting to the coloration developing process in the same manner as in the process A in Examples 1 to 8. The samples were irradiated with light at 100,000 lux for two weeks by using a xenon tester XW-1200 produced by Shimadzu Corp., and the change in density before and after the light irradiation of the point having a density of 1.0 before the light irradiation. The remaining density, while the density before the heated storage was 100, was calculated in terms of percentage. The measurement of the density was carried out with SPECTRO EYE produced by Gretag Macbeth, Inc.

The results of the evaluation are shown in Table 10.

TABLE 10

| Sample | L* | a* | b* | (C(425)-C(min)/(1-C(min)) | (C(530)-C(min)/(1-C(min)) | Functional evaluation of white background | Macbeth reproducibility | Light toughness |
|---|---|---|---|---|---|---|---|---|
| c-001 | 91.0 | 0.9 | −4.0 | 0.221 | 0.163 | 3.0 | 2.5 | 75 |
| c-002 | 91.0 | 0.9 | −3.9 | 0.080 | 0.115 | 3.1 | 3.0 | 77 |
| c-101 | 91.5 | 1.1 | −6.0 | 0.220 | 0.163 | 4.6 | 2.6 | 76 |
| c-102 | 91.4 | 1.1 | −5.9 | 0.081 | 0.140 | 4.6 | 4.0 | 80 |
| c-103 | 91.5 | 1.1 | −6.1 | 0.080 | 0.115 | 4.7 | 4.1 | 80 |
| c-104 | 91.6 | 1.0 | −6.0 | 0.077 | 0.115 | 4.8 | 4.2 | 85 |
| c-401 | 93.0 | 1.1 | −6.9 | 0.221 | 0.163 | 4.7 | 2.6 | 63 |
| c-402 | 93.1 | 1.1 | −6.8 | 0.081 | 0.140 | 4.7 | 4.2 | 81 |
| c-403 | 93.1 | 1.0 | −6.9 | 0.080 | 0.115 | 4.8 | 4.4 | 80 |
| c-404 | 93.2 | 1.1 | −6.9 | 0.078 | 0.115 | 4.8 | 4.4 | 86 |
| c-501 | 92.3 | 1.1 | −6.0 | 0.222 | 0.164 | 4.6 | 2.5 | 76 |
| c-502 | 92.4 | 1.1 | −6.1 | 0.079 | 0.115 | 4.7 | 4.3 | 86 |

It was understood from Table 10 that, as similar to Example 14, the samples having the white background and the density that were in the scope of the invention exhibited considerable improvement in Macbeth reproducibility.

Example 16

The same evaluations as in Examples 14 and 15 were carried out except that the exposure process A (which was the same as the process A in Examples 1 to 8) carried out in Examples 14 and 15 was changed to the exposure process B in Examples 1 to 8. As a result, the similar effect could be obtained.

Example 17

The samples produced in Examples 14 and 15 were subjected to exposure in the following manner. As a result, the effect of the invention was obtained as similar to Example 14.

Exposure Method

The color photosensitive materials produced in Examples 14 and 15 were subjected to exposure by using a scanning exposure apparatus disclosed in FIG. 6 of JP-A No. 11-88619. As the light sources, a light source of 688 nm (R light) was obtained by using a semiconductor laser, and a light source of 532 nm (G light) and a light source of 473 nm (B light) were obtained by combining a semiconductor laser with an SHG. The amounts of laser light of the respective wavelengths were modulated with an external modulator, and the light was reflected by a rotating polyhedron to effect scanning exposure of the sample moving in the direction perpendicular to the scanning direction. The scanning exposure was carried out at 400 dpi, and the average exposure time per one pixel was $8\times10^{-8}$ second. In order to suppress fluctuation of the amount of light of the semiconductor laser, the temperature was maintained at constant by using a peltier element.

According to the invention, a silver halide color photographic photosensitive material excellent in white background is provided, and such a silver halide color photographic photosensitive material is provided that provides stable white background irrespective of a viewing light source, is excellent in performance stability upon long-term storage in an unexposed state and in performance stability against fluctuation in processing conditions, and is excellent in applicability to quick process.

According to the invention, such a silver halide color photographic photosensitive material is provided that can provide a preferred whiteness degree in highlight portions immediately after a developing process and can maintain the preferred whiteness degree of highlight portions after storage under high humidity conditions.

According to the invention, such a silver halide color photographic photosensitive material is provided that can reduce coloration on white background of a high silver chloride print material containing the super quick process to obtain a color print that is satisfactory from the standpoint of image quality, and such a silver halide color photographic photosensitive material is also provided that can reproduce the faithful color in a bright region superior to the other color image formation methods.

According to the invention, a process for forming an image using the silver halide color photographic photosensitive material of the invention is provided.

What is claimed is:

1. A silver halide color photographic photosensitive material comprising, on a reflective support, at least one yellow-coloring photosensitive silver halide emulsion layer, at least one magenta-coloring photosensitive silver halide emulsion layer, at least one cyan-coloring photosensitive silver halide emulsion layer, and at least one non-photosensitive, non-coloring hydrophilic colloid layer, chromaticity at an unexposed portion of the material after a color development treatment satisfying the following condition (A):

$$91 \leqq L^* \leqq 96,\ 0^* a^* \leqq 2.0,\ -9.0 \leqq b^* \leqq -3.0 \quad \text{(A).}$$

2. The silver halide color photographic photosensitive material according to claim 1, wherein at least one of the hydrophilic colloid layer and the silver halide emulsion layers comprises at least one of high boiling point organic solvents represented by the following general formulae (A) to (F):

$$RaOOC(CH_2)_mCOORb \quad \text{General formula (A)}$$

wherein Ra and Rb each independently represents a linear or branched alkyl group having from 4 to 10 carbon atoms, and m represents an integer of from 2 to 10, $$RcOOC(C_nH_{2n-2})COORd \quad \text{General formula (B)}$$

wherein Rc and Rd each independently represents a linear or branched alkyl group having from 4 to 10 carbon atoms, and n represents an integer of from 2 to 10, $$ReCOO(CH_2)_pOCORf \quad \text{General formula (C)}$$

wherein Re and Rf each independently represents a linear or branched alkyl group having from 3 to 24 carbon atoms, and p represents an integer of from 2 to 10, $$C(Rg)(Rh)(Ri)(OH) \quad \text{General formula (D)}$$

wherein Rg represents an alkyl group or an alkenyl group, Rh and Ri each independently represents a hydrogen atom, an alkyl group or an alkenyl group, and the total carbon number of the groups represented by Rg, Rh and Ri is at least 10, $$X—((CH_2)_q—O(CO)Rj)_r \quad \text{General formula (E)}$$

wherein X represents a 5- to 7-member saturated hydrocarbon group, q represents an integer of from 0 to 2, r represents an integer of from 1 to 3, and Rj represents a linear or branched alkyl group having from 4 to 16 carbon atoms, and $$YO—C(COORk)(CH_2COOR1)(CH_2COORm) \quad \text{General formula (F)}$$

wherein Rk, Rl and Rm each independently represents an alkyl group, an alkenyl group or an aryl group, and Y represents a hydrogen atom or an acyl group.

3. The silver halide color photographic photosensitive material according to claim 2, wherein the hydrophilic colloid layer comprises a color mixing prevention layer, and the color mixing prevention layer includes at least one of the at least one of high boiling point organic solvents represented by the general formulae (A) to (F).

4. The silver halide color photographic photosensitive material according to claim 1, wherein the chromaticity of the unexposed portion after the color development treatment satisfies the following condition (B):

$$91 \leqq L^* \leqq 96,\ 0.3 \leqq a^* \leqq 1.6,\ -8.0 \leqq b^* \leqq -4.8 \quad \text{(B).}$$

5. The silver halide color photographic photosensitive material according to claim 1, wherein the chromaticity of the unexposed portion after the color development treatment satisfies the following condition (C):

$$93 \leqq L^* \leqq 96,\ 0.3 \leqq a^* \leqq 1.6,\ -8.0 \leqq b^* \leqq -4.8 \quad \text{(C).}$$

6. The silver halide color photographic photosensitive material according to claim 1, wherein at least one of layers constituting the photosensitive material includes pigment.

7. The silver halide color photographic photosensitive material according to claim 6, wherein the pigment comprises at least one pigment selected from the group consisting of indanthrone pigment, indigo pigment, triarylcarbonium pigment, azo pigment, quinacridone pigment, dioxazine pigment and diketopyrrolopyrrole pigment.

8. The silver halide color photographic photosensitive material according to claim 1, wherein at least one of layers constituting the photosensitive material comprises at least one of magenta couplers represented by the following general formulae (M-1) and (M-2):

General formula (M-1)

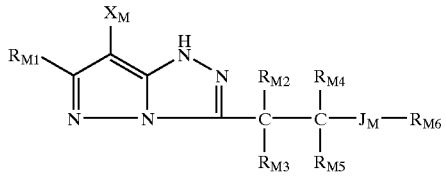

in which: $R_{M1}$ represents a hydrogen atom or a substituent; $R_{M2}$ and $R_{M3}$ each represents an alkyl group; $R_{M4}$ and $R_{M5}$ each represents a hydrogen atom or an alkyl group; $J_M$ represents —O—C(=O)—, —$NR_{M7}CO$— or —$NR_{M7}SO_2$—, and $R_{M7}$ represents a hydrogen atom or an alkyl group; $R_{M6}$ represents an alkyl group, an aryl group, an alkoxy group, an aryloxy group, an alkylamino group or an arylamino group; and $X_M$ represents a hydrogen atom, a halogen atom or a group that is releasable by a coupling reaction with an oxidized product of a color developing agent, and:

General formula (M-2)

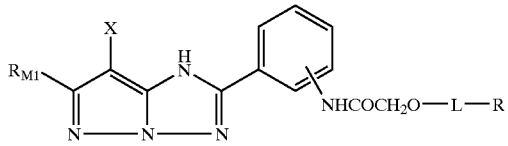

in which: R represents an alkyl group, an alkenyl group, an alkynyl group, an aryl group or a heterocyclic group; $R_{M1}$ represents a hydrogen atom or a substituent; L represents —CO— or —$SO_2$—; and X represents a hydrogen atom or a group that is releasable by a coupling reaction with an oxidized product of a developing agent.

9. The silver halide color photographic photosensitive material according to claim 4, wherein, after a red-exposing process and the color development treatment, reflective density C(λ) for wavelength λ at a cyan-colored portion satisfies the following conditions (1) and (2):

$$0.04 \leqq (C(425)-C(min))(1-C(min)) \leqq 0.10 \quad (1)$$

$$0.09 \leqq (C(530)-C(min))/(1-C(min)) \leqq 0.15 \quad (2)$$

wherein C(min) represents a minimum density in a wavelength range from 400 to 700 nm, given that cyan density for a wavelength that provides a maximum density of cyan coloration is 1.0.

10. The silver halide color photographic photosensitive material according to claim 9, wherein at least one of the at least one cyan-coloring photosensitive silver halide emulsion layer comprises at least one compound selected from compounds represented by the following general formulae (PTA-I) and (PTA-II):

General formula (PTA-I)

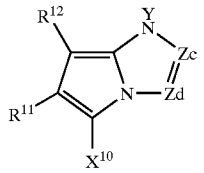

General formula (PTA-II)

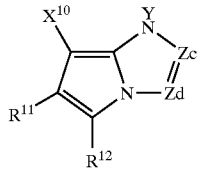

in which: one of Zc and Zd represents —N═ and the other represents —C($R_{13}$)═, and $R_{13}$ represents a hydrogen atom or a substituent; $R_{11}$, and $R_{12}$ each represents an electron attracting group having a Hammett's substituent constant σp of 0.2 or more, and the sum of the op values of $R_{11}$ and $R_{12}$ is 0.65 or more; $X_{10}$ represents a hydrogen atom or a group that is releasable by a coupling reaction with an oxidized product of an aromatic primary amine color developing agent; Y represents a hydrogen atom or a group that is releasable by the color development treatment; and $R_{11}$, $R_{12}$, $R_{13}$ and $X_{10}$ each may be a divalent group that bonds with a polymer chain or a multimer, which is at least a dimer, to form a homopolymer or a copolymer.

11. The silver halide color photographic photosensitive material according to claim 9, wherein at least one of the at least one cyan-coloring photosensitive silver halide emulsion layer comprises at least one of compounds represented by the following general formula (IA)

General formula (IA)

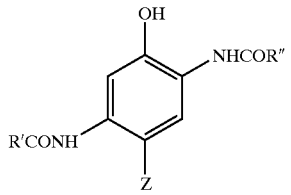

in which R' and R" each independently represents a substituent, and Z represents a hydrogen atom or a group that is releasable by a coupling reaction with an oxidized product of an aromatic primary amine color developing agent.

12. A process for forming a color image, the process comprising the steps of:

preparing the silver halide color photographic photosensitive material according to claim 1;

scan-exposing the photosensitive material with a light beam modulated based on image information; and thereafter, subjecting the photosensitive material to a color development treatment.

13. A process for forming a color image, the process comprising the steps of:

preparing the silver halide color photographic photosensitive material according to claim 1;

converting image information to halftone dot information; and scan-exposing the photosensitive material with light source units based on the halftone dot information, the light source units including at least three light source units that emit mutually different wavelengths of light, at least one of the light source units including a light source selected from laser light sources and light emitting diodes.

14. A process for forming a color image, the process comprising the steps of:

imagewise exposing the silver halide color photographic photosensitive material according to claim 1, subjecting the photosensitive material to a color development treatment;

thereafter, subjecting the photosensitive material to at least one of
desilvering,
water washing, and
stabilization; and subsequently, drying the photosensitive material to form the color image, wherein the color development treatment includes a duration of from 3 to 25 seconds, and the process for forming a color image includes a duration from commencement of the step of subjecting the photosensitive material to a color development treatment to completion of the step of drying of from 10 to 100 seconds.

* * * * *